US012495847B2

(12) United States Patent
Sechrist

(10) Patent No.: US 12,495,847 B2
(45) Date of Patent: Dec. 16, 2025

(54) MULTI-WAY RECONFIGURABLE GARMENT AND FASTENER ASSEMBLY

(71) Applicant: AFYX, LLC, North Reading, MA (US)

(72) Inventor: Diana Mohoreanu Sechrist, Lynnfield, MA (US)

(73) Assignee: AFYX, LLC, North Reading, MA (US)

( * ) Notice: Subject to any disclaimer, the term of this patent is extended or adjusted under 35 U.S.C. 154(b) by 265 days.

(21) Appl. No.: 17/656,637

(22) Filed: Mar. 25, 2022

(65) Prior Publication Data

US 2022/0312870 A1 Oct. 6, 2022

Related U.S. Application Data

(60) Provisional application No. 63/260,302, filed on Aug. 16, 2021, provisional application No. 63/200,812, filed on Mar. 30, 2021.

(51) Int. Cl.
*A41D 15/04* (2006.01)
*A44B 17/00* (2006.01)

(52) U.S. Cl.
CPC ..... *A41D 15/04* (2013.01); *A44B 17/0082* (2013.01)

(58) Field of Classification Search
CPC .... A41D 15/04; A41D 15/00; A44B 17/0082; A41H 37/001; A41H 37/005; A41H 37/00; A41H 37/04
See application file for complete search history.

(56) References Cited

U.S. PATENT DOCUMENTS 1,251,236 A * 12/1917 Karberg ..... A41F 1/00 112/408
2,020,568 A * 11/1935 Oathout ..... A44B 1/20 112/475.15
2,237,368 A 4/1941 Seitzman et al.
3,344,435 A * 10/1967 Artzt ..... A41B 13/08 2/111
3,463,162 A * 8/1969 Heggie ..... A41B 11/12 450/95
5,379,888 A * 1/1995 Rentos ..... B65D 73/02 24/304
5,704,933 A * 1/1998 Fell ..... A61F 13/64 2/265
6,393,622 B1 * 5/2002 Rice ..... A41F 11/00 2/409

(Continued)

FOREIGN PATENT DOCUMENTS

CA 3215738 9/2023
EP 4312642 2/2024
WO WO 2022 212216 A1 10/2022

OTHER PUBLICATIONS

International Search Report and Written Opinion received in PCT Application No. PCT/US2022/022057 mailed on Jun. 17, 2022.

*Primary Examiner* — Uyen T Nguyen
(74) *Attorney, Agent, or Firm* — VIA LLP

(57) ABSTRACT

A reconfigurable garment is configurable in at least 2 different styles. The garment has a body that includes a fabric panel. At least three first fastening elements and at least three second fastening elements are positioned within an outer boundary of the fabric panel. Each of the at least three first fastening elements is configured to mate with any of the at least three second fastening elements such that the fabric panel can be transformed into the at least 2 different styles.

12 Claims, 108 Drawing Sheets

(56) References Cited

U.S. PATENT DOCUMENTS

| | | | | |
|---|---|---|---|---|
| 2007/0128980 | A1* | 6/2007 | Fildan | A41H 37/001 450/39 |
| 2012/0210497 | A1* | 8/2012 | Rodarmel | A41D 27/08 2/244 |
| 2014/0310858 | A1 | 10/2014 | Kupiec | |
| 2020/0178625 | A1 | 6/2020 | Turand | |

* cited by examiner

MULTI-WAY RECONFIGURABLE GARMENT AND FASTENER ASSEMBLY

BACKGROUND OF THE INVENTION

Field of the Invention

The present invention generally relates to reconfigurable apparel. More particularly, the present invention relates to reconfigurable apparel that employ a fabric panel with a plurality of interconnectable and interchangeable fastening elements.

Description of the Related Art

Today's convertible clothing offers cost-effective solutions to a bulging closet; however, convertible dresses available on the market today seem to lack in functional design for a woman's constantly changing body and style demands based on life stages. Nowhere is this more apparent than complete change to wardrobes required during maternity. Many of today's dresses use "fabric manipulation" by the user to create multiple looks. Adjusting one piece of fabric into multiple styles does not enable a garment to fit a woman "just right" without sewing the fabric in strategic spots to allow the garment to feel and appear more tailored. Once sewn, the garment must have the threads removed and be resewn to change the fit or appearance of the garment. There is a need for a garment that provides a collection of multi-way "fastening" women's apparel, which allows for user-driven designs for all stages of life with looks that are effortless.

SUMMARY OF THE INVENTION

Using strategically placed fastening elements, the dresses disclosed herein offer the user one garment with a dramatic series of styles for all occasions: relaxed or tailored, casual or formal, pre- or post-partum. The styles are created by interconnecting selected fastening elements. The fastening elements are positioned to adjust the garments for women's needs, not only when it comes to function but also style. The resulting combination of sizes and styles provides a balance of comfort, function, and aesthetics.

In some embodiments, extenders and/or belts are provided with decorative buckle accessories that also include fastening elements. The fastening elements enable the extenders and/or belts to be used with the reconfigurable garment to further enhance the available style options. The belts also can be used separate of the garment.

As a result of carefully structured fabric panels and fastening element locations, the styling options are endless for women of all ages and stages. Women can create the right look for all occasions without compromising on cost, comfort, or convenience. A single dress can do it all (a casual look, a dressed-up look, loose fit or a tight fit).

The disclosed line of reconfigurable garments employs strategically positioned fastening elements that provide the user more style flexibility. Corresponding extenders and/or belts with fastener adornments (e.g., buckles) also incorporate fastening elements that enable the extenders and/or belts to be used separately or with the line of reconfigurable garments to further enhance the reconfigurable garments.

In some embodiments, a reconfigurable garment is configurable in at least 2 different styles. The reconfigurable garment comprises a body. The body comprises a fabric panel. The fabric panel comprises an outer boundary. At least three first fastening elements and at least three second fastening elements are positioned within the outer boundary. Each of the at least three first fastening elements is configured to mate with any of the at least three second fastening elements such that the fabric panel can be transformed into the at least 2 different styles. A centerline of the fabric panel extends vertically through the fabric panel and at least a region of the fabric panel on each side of the centerline of the fabric panel defines a fastener-free region of the fabric panel.

In some such embodiments, the fabric panel is formed of a stretch fabric. In some such embodiments, the fabric panel is symmetrical about the centerline. In some such embodiments, when the fabric panel is laid flat, the at least three first fastening elements are arranged in a first line that extends outward relative to the centerline of the fabric panel and the at least three second fastening elements are arranged in a second line that extends outward relative to the centerline of the fabric panel. In some embodiments, the centerline of the fabric panel is positioned between the first line and the second line. In some such embodiments, the first line and the second line are arranged symmetrically relative to the centerline of the fabric panel. In some such embodiments, the first line extends downward and outward relative to the centerline of the fabric panel and the second line extends downward and outward relative to the centerline of the fabric panel. In some such embodiments, at least two arm holes are defined in the fabric panel with the at least two arm holes being positioned in an upper half of the fabric panel. In some such embodiments, the at least two arm holes are positioned between at least one of the at least three first fastening elements and at least one of the at least three second fastening elements.

In some such embodiments, the outer boundary comprises a first top edge with the first top edge extending laterally outward in a straight line that is normal to the centerline of the fabric panel. In some such embodiments, a second top edge also extends laterally outward in a straight line that is normal to the centerline of the fabric panel and a notch connects the first top edge to the second top edge, the notch defining a neck region of the reconfigurable garment with the at least three first fastening elements extending along the first top edge and the at least three second fastening elements extending along the second top edge.

In some such embodiments, a first side edge extends downward from the first top edge and a second side edge extends downward from the second side edge with a bottom edge connecting the first side edge and the second side edge. At least one first bottom connector is positioned adjacent a first corner defined by the first side edge and the bottom edge and at least one second bottom connector is positioned adjacent a second corner defined by the first side edge and the bottom edge. In some such embodiments, the at least three first fastening elements and the at least three second fastening elements extend along the first top edge and the centerline is positioned between the at least three first fastening elements and the at least three second fastening elements with at least three third fastening elements and at least three fourth fastening elements also positioned on the fabric panel such that each of the at least three third fastening elements is configured to mate with any of the at least three fourth fastening elements. In some such embodiments, the at least three third fastening elements are arranged in a third line that extends downward and outward relative to the centerline of the fabric panel and the at least three fourth fastening elements are arranged in a fourth line that extends downward and outward relative to the centerline of the fabric panel and the centerline of the fabric panel is positioned between the third line and the fourth line.

In some such embodiments, the outer boundary comprises at least one non-linear edge that is arranged symmetrically relative to the centerline of the fabric panel. In some such embodiments, the outer boundary comprises an inwardly extending notch that is configured to define a neck region of the reconfigurable garment. In some such embodiments, the at least one non-linear edge defines a generally circular shape of the outer boundary, the first line extends downward and outward relative to the centerline of the fabric panel and the second line extends downward and outward relative to the centerline of the fabric panel. In some such embodiments, the inwardly extending notch is positioned laterally between at least two of the at least three first fastening elements and at least two of the at least three second fastening elements.

In some such embodiments, the fabric panel is connected to an additional fabric panel such that the reconfigurable garment has a two-part shape when flattened.

In some such embodiments, the reconfigurable garment is combined with a tube dress such that the tube dress is configured to overlap with the fastener-free region of the fabric panel. In some such embodiments, the tube dress comprises at least two fastening elements along a top bustline of the tube dress and the tube dress is secured to the fabric panel.

In some such embodiments, the reconfigurable garment is combined with one or more of an extender and a belt, with the extender having a length of between 4 inches and 36 inches and comprising at least two fastening elements positioned between ends of the extender, and the belt comprising at least two fastening elements configured to interlock with fastening elements of a fastener adornment, the at least two fastening elements of the extender and the at least two fastening elements of the belt being configured to be interlockable with the at least three first fastening elements and the at least three second fastening elements of the fabric panel and the at least two fastening elements of the tube dress.

In some such embodiments, the reconfigurable garment is combined with one or more of an extender and a belt, the extender having a length of between 4 inches and 36 inches and comprising at least two fastening elements positioned between ends of the extender, and the belt comprising at least two fastening elements configured to interlock with fastening elements of a fastener adornment. The at least two fastening elements of the extender and the at least two fastening elements of the belt being configured to be interlockable with the at least one first fastening elements and the at least one second fastening elements of the fabric panel.

In some embodiments, a method of styling a reconfigurable garment can be provided. The method comprises positioning a fabric panel comprising a plurality of interconnectable fastening elements, connecting a first set of at least three pairs of fastening elements to provide a first style to the reconfigurable garment and connecting a second set of at least three pairs of fastening elements to provide a second style to the reconfigurable garment, the first set of at least three pairs of fastening elements not being the same as the second set of at least three pairs of fastening elements.

In some such embodiments, the method of styling a reconfigurable garment uses an extender to connect the first set of three pairs of fastening elements. In some such embodiments, a fastener adornment is used to connect at least one pair of the first set of three pairs of fastening elements.

In some embodiments, a method of selling a reconfigurable garment can be provided. The method comprises displaying a plurality of fabric panels without fastening elements, obtaining from a customer a set of measurements, using the set of measurements to apply at least three pairs of fastening elements while the customer waits, and providing styling information to the customer based upon different combinations of the at least three pairs of fastening elements.

In some such embodiments, the method further comprises providing a photo session with the customers to memorialize at least two styles possible with the reconfigurable garment.

In some embodiments, a method of reinforcing a fastening element comprises preparing a first reinforcement piece, the first reinforcement piece having a first outer perimeter large enough to extend beyond the fastening element, preparing a second reinforcement piece, the second reinforcement piece having a second outer perimeter large enough to extend beyond the fastening element, securing the first and second reinforcement pieces to a fabric panel at a location of the fastening element, and joining the fastening element to the first reinforcement piece, the fabric panel and the second reinforcement piece.

In some such embodiments, only one fastening element is secured to the first and second reinforcement pieces. In some such embodiments, at least one of the first and second reinforcement pieces is formed of the same fabric as the fabric panel. In some such embodiments, a third reinforcement piece is prepared and positioned relative to the fastening element such that the third reinforcement piece camouflages the fastening element.

In some embodiments, a method of reinforcing a fastening element for use in a reconfigurable garment comprises preparing a reinforcement on a fabric panel at a location of a fastening element, the reinforcement accommodating the fastening element, and joining the fastening element to the fabric panel at the location of the reinforcement.

In some embodiments, the reinforcement comprises a first reinforcement piece and a second reinforcement piece, the first reinforcement piece being secured to a first side of the fabric panel and the second reinforcement piece being secured to a second side of the fabric panel and the first reinforcement piece and the second reinforcement piece at least partially overlapping such that the fasting element is joined the all three of the first reinforcement piece, the second reinforcement piece and the fabric panel. In some such embodiments, at least one of the first reinforcement piece and the second reinforcement piece has an outer perimeter that extends beyond the fastening element. In some such embodiments, both of the first reinforcement piece and the second reinforcement piece has outer perimeters that extend beyond the fastening element. In some such embodiments, at least one of the first and second reinforcement pieces is formed of the same fabric as the fabric panel. In some such embodiments, the method further comprises preparing a third reinforcement piece and positioning the third reinforcement piece relative to the fastening element such that the third reinforcement piece camouflages the fastening element. In some such embodiments, the fastening element is a single fastening element.

In some embodiments, the reinforcement comprises an embroidered region. In some such embodiments, the reinforcement defines a locally reinforced region with the locally reinforced region comprising an outline and a fill region positioned inside of the outline. In some such embodiments, the locally reinforced region is obscured beneath the fastening element. In some such embodiments, the locally reinforced region has at least a portion that is exposed beyond the fastening element. In some such embodiments, the fastening element is a single fastening element.

BRIEF DESCRIPTION OF THE DRAWINGS

These and other features, aspects, and advantages of certain illustrative but non-limiting embodiments of the present invention will be described with reference to the following drawings.

FIGS. 80-85 are front, left, back, right, back-right, and front right views of a reconfigurable garment styled into a first look.

FIGS. 86-91 are front, left, back, right, back-right, and front right views of a reconfigurable garment styled into a second look.

FIGS. 92-97 are front, left, back, right, back-right, and front right views of another reconfigurable garment styled into a first look.

FIGS. 98-103 are front, left, back, right, back-right, and front right views of the reconfigurable garment of FIGS. 98-103 styled into a second look.

FIGS. 104-109 are front, left, back, right, back-right, and front right views of the reconfigurable garment of FIGS. 98-103 styled into a third look.

FIGS. 110-115 are front, left, back, right, back-right, and front right views of the reconfigurable garment of FIGS. 98-103 styled into a fourth look.

FIGS. 116-121 are front, left, back, right, back-right, and front right views of the reconfigurable garment of FIGS. 98-103 styled into a fifth look.

DETAILED DESCRIPTION OF THE PREFERRED EMBODIMENTS

Figure 1:
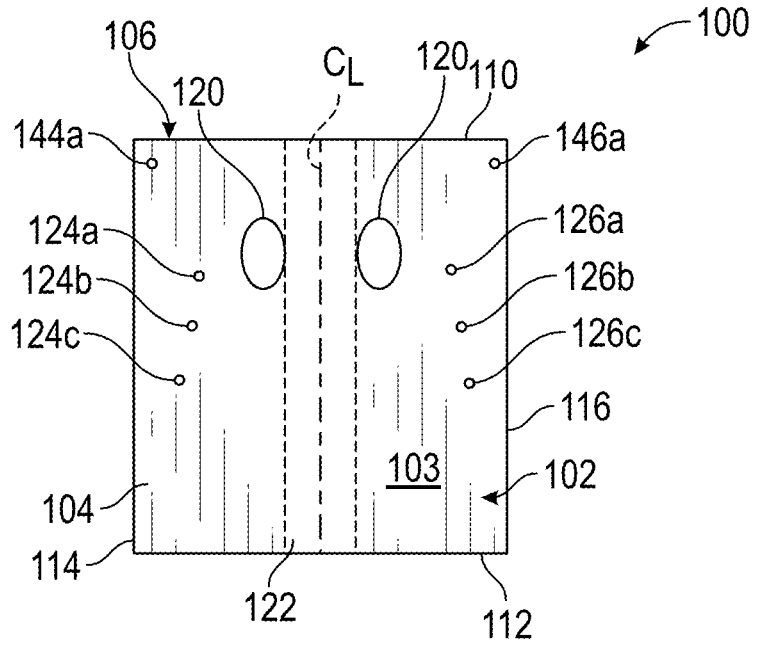
FIG. 1 is a plan view of a reconfigurable garment that is arranged and configured in accordance with certain features, aspects, and advantages of the present invention.

With reference now to FIGS. 1-14, several embodiments of reconfigurable garments are illustrated. One or more of the illustrated reconfigurable garments can be arranged and configured in accordance with certain features, aspects, and advantages of the present invention. The illustrated reconfigurable garments are dresses, skirts, and beachwear, but other clothing articles can benefit from at least some of the teachings of the present disclosure. For example, in some configurations, the reconfigurable garment can be top or a nightgown.

At least some of the reconfigurable garments can comprise a garment body formed of one or more fabric panels. While the illustrated fabric panels can be formed of a single piece of fabric, in some configurations, the fabric panels can be formed of more than one piece of fabric that are sewn or otherwise secured together.

The fabric panels can be formed of any suitable fabric. In some configurations, the fabric panels are formed of a stretch material. In some such configurations, the stretch material can be a two way stretch material or a four way stretch material. In some configurations, the stretch material can have up to 600 percent stretch in both directions of the fabric grain. Most preferred is at least 100 percent stretch in both directions. In some configurations, the fabric has no stretch. In some configurations, the fabric is a non-stretch pleated fabric or a stretch pleated fabric. In some configurations, the fabric material is a two-sided fabric material. In some such configurations, the two-sided fabric material has the same color or pattern on both sides. In some such configurations, the two-sided fabric has the same finish on both sides. In some such configurations, the two-sided fabric has different colors or patterns on each side. In some such configurations, the two-sided fabric has different finishes on each side. Some examples of suitable materials and blends include: modal, spandex, Tencel, nylon, elastane, lycra, acetate, rayon, polyester, cotton, mesh (including power mesh), knits (including jersey knit and slinky knit), viscose, velvet, toile, taffeta, satin, sateen, jacquard, silk, charmeuse, satin, crepe, suede, lining, cashmere, chiffon, silk burnout, damask, georgette, gingham, jersey, lace, leather, linen, organza, wool, denim, stretch velvet (or velour) and fabrics that are pleated (plisse or pleated fabric). Preferred blends can include polyester-spandex, rayon-spandex blends, polyester-lycra, polyester-modal, polyester-tencel, polyester-nylon, lycra-acetate, polyester-chiffon, polyester-georgette, polyester-cotton, polyester-nylon, nylon-spandex, poly-acetate, poly-viscose, pleated knits, pleated polyester, poly-mesh and polyester-plisse. These materials are preferred for their hand and for their drapability. Other fabrics also can be used.

In addition to the fabric panel or panels, each embodiment of the reconfigurable garments employs fastening elements. Different combinations of the fastening elements can be used to secure the reconfigurable garments in any of several different configurations or looks. The present disclosure will provide a sampling of the different configurations that can be achieved with a limited combination of fastening elements. By providing additional strategically positioned fastening elements, differing sizes or configurations of the reconfigurable garment can be created.

The fastening elements can be male and female elements, such as found with snaps (e.g., socket and post), magnets (and magnetizable materials), buttons and loops, toggles and loops, frog fasteners, metal hooks and eyes, or the like. In some configurations, the fastening elements can be mating components that have a universal configuration (e.g., Fidlock SNAP stackable elements) or can be ties (e.g., short strips of fabric). In some configurations, magnetizable elements can be positioned strategically and an intervening magnet can be used to connect the two magnetizable elements together. Similarly, two male or two female elements can be connected using an intervening member. Other suitable fastening elements can be used. Configurations using intervening members or magnets, while admitting to increased reconfigurations, suffer from the increased possibility of lost components when not in use. In addition, universal fastening elements, while desirable for their versatility, can lead to confusion for the ultimate customer. Thus, a preferred configuration involves fastening elements with male and female components.

Preferably, the fastening elements can be secured in a number strategic positions to enable a wearer to readily configure the garment in any of a series of different configurations. While many configurations are possible, in at least some of the illustrated configurations, male fastening elements are positioned on a first half of the fabric panel while female fastening elements are positioned on a second half of the fabric panel. Such a configuration maximizes the combinations possible and facilitates more reconfiguration of the garment; however other configurations are possible.

With reference initially to FIG. 1, a reconfigurable garment 100 is shown in a plan view. The reconfigurable garment 100 comprises a body 102. The body 102 can be formed of one or more fabric panel 104. In the illustrated configuration, the body 102 is formed of a single two-sided fabric panel 104. In some configurations, the body 102 can be formed of multiple layers of single-faced fabric and/or multiple two-sided fabric panels secured together. The body 102 comprises an inner surface 103 and an outer surface. In some configurations, the body 102 is reversible and, thus, the inner surface 103 may define an outer surface and vice versa.

The body 102 comprises an outer perimeter 106. The outer perimeter 106 can have any desired shape or configuration. As will be explained, the outer perimeter 106 defines the shape of the body 102, which impacts the drape and appearance of the various garments defined by any particular reconfigurable garment, including the illustrated reconfigurable garment 100. The outer perimeter 106 that is illustrated in FIG. 1 is a parallelogram. In particular, the illustrated outer perimeter 106 is a rectangle. In some other configurations, the outer perimeter 106 can comprise a square or any other shape of a parallelogram.

In some configurations, the outer perimeter 106 comprises four edges. In some configurations, the outer perimeter 106 comprises a top edge 110, a bottom edge 112, a left edge 114, and a right edge 116. At least one of the edges 110, 112, 114, 116 is linear. In the illustrated configuration, all of the edges 110, 112, 114, 116 are linear. As will be described, in other embodiments, not all of the edges may be linear and, in some embodiments, the panel can be circular or oval in shape, or at least one of the edges is circular or arc-like. In some configurations, two or more linear edges can be connected by curved edges or the like.

The top edge 110 and the bottom edge 112 in the configuration of FIG. 1 have the same lengths. The top edge 110 is connected to the bottom edge 112 by the left edge 114 and the right edge 116. The left edge 114 and the right edge 116 in the illustrated configuration have the same lengths as each other. Desirably, the top edge 110 and the bottom edge 112 are shorter than the left edge 114 and the right edge 116. Other configurations are possible. In some configurations, the top edge 110 has a length of between 20 inches and 65 inches. In some configurations, the left edge 114 has a length of between 20 inches and 70 inches. In some configurations, the left edge 114 can be as long as 150 inches.

The illustrated body 102 also defines at least one opening 120. In some configurations, the at least one opening 120 can define an opening that defines a collar (i.e., the wearer can insert their head and neck through the opening). In the illustrated configuration, the body 102 comprises two openings 120. The two openings 120 define armholes for the illustrated configuration (i.e., the wearer can insert their hands and arms through the openings). The illustrated openings 120 are oval or elliptical in shape. Other shapes also can be used for the openings 120. While the two openings 120 are identical in the illustrated configuration, the two openings 120 can be mirror images of each other or can be different from each other. Moreover, in some configurations, there can be three openings with one opening receiving the head/neck of the wearer while the other two openings 120 can define the armholes. Other configurations are possible.

The openings 120 in the illustrated configuration are positioned in the upper half of the body 102. In some configurations, the openings 120 can be positioned in the upper ⅓ of the body 102. In the illustrated configuration, the openings 120 are positioned on the center half of the body 102. In other words, if the body 102 was subdivided along vertical lines into quarters, one opening 120 would be positioned in the second quarter and the other opening 120 would be positioned in the third quarter. In the illustrated configuration, the centers of the openings 120 are positioned between one half and one third of the distance between each of the side edges 114, 116. In addition, the illustrated openings 120 are symmetrically disposed relative to a centerline CL. Other configurations are possible.

Fastening elements can be positioned in strategic locations anywhere on the fabric panel. In some configurations, however, there is a fastener-free region 122. In some such configurations, the fastener-free region 122 can be centrally located on the panel and, in other such configurations, the fastener-free region 122 can be positioned adjacent to the edges of the fabric panel. In the illustrated configurations, the fastener-free region 122 is positioned between the openings 120. The fastener-free region 122 can be positioned just between the openings 120, but in the illustrated configuration the fastener-free region 122 extends the full height of the body 102. In particular, the illustrated fastener-free region 122 is defined laterally by the innermost portions of the openings 120 and extends vertically between boundaries that are parallel to the centerline CL. In the illustrated configuration, the fastener-free region 122 is a center region of the body 102. The fastener-free region 122 can occupy between about 8% and 12% of the body in the central region (i.e., the region to either side of the centerline CL), preferably between about 9% and 11%, and more preferably about 10%.

Laterally outward of the fastener-free region 122 are positioned a plurality of fastening elements. To better explain at least some of the garment styles made possible by interconnecting different fastening elements, each of the fastening elements will be individually labeled. In the illustrated configuration, male fastening elements may be positioned on a first side of the centerline CL while female fastening elements may be positioned on a second side of the centerline CL. It is possible to intermix the male and female fastening elements on each side of the centerline CL. In some configurations, there are more female elements on one side of the garment than male and in other configurations there are more male elements on one side of the garment than female. In some configurations, there are an even number of female and male elements on one side of the CL. In other configurations, the fastening elements are universal and can result in significantly more configurations from the single reconfigurable garment 100. But, for purposes of this description, the fastening elements will be described in the context of male and female elements.

With reference still to FIG. 1, the illustrated reconfigurable garment 100 comprises at least two first fastening elements 124*a*, 124*b* (which can be male-male, female-male, male-female, female-female, or universal) on the first side of the centerline CL and the illustrated reconfigurable garment 100 also comprises at least two second fastening elements 126*a*, 126*b* (which can be male-male, female-male, male-female, female-female, or universal) on the second side of the centerline CL. While the illustrated reconfigurable garment 100 includes three first fastening elements 124*a*, 124*b*, 124*c* and three second fastening elements 126*a*, 126*b*, 126*c*, some configurations may have as few as two first fastening elements and many more than three first elements and some configurations may have as few as two second fastening elements and many more than three second fastening elements. In some configurations, there are more first fastening elements than there are second fastening elements or there are more second fastening elements than there are first fastening elements. In the illustrated configuration, there are equal numbers of first fastening elements and second fastening elements.

In the illustrated configuration, the top-most first fastening element 124*a* and the top-most second fastening element 126*a* are positioned laterally outward of the openings 120 and lower than an uppermost portion of the openings 120. More preferably, the top-most first fastening element 124*a* and the top-most second fastening element 126*a* are positioned laterally outward from the openings 120 and vertically between the uppermost portion of the openings 120 and a lowermost portion of the openings 120. Other configurations are possible.

The first fastening elements 124*a*, 124*b*, 124*c* and the second fastening elements 126*a*, 126*b*, 126*c* in the illustrated configuration can be vertically positioned in the central half of the body 102 and laterally positioned in the outer quarters of the body 102. While the first fastening elements 124*a*, 124*b*, 124*c* define a first line and the second fastening elements 126*a*, 126*b*, 126*c* define a second line, one or more of each of the series of first fastening elements and the series of second fastening element can define a straight line, a zig-zag, an arc, an angle or any other desired configuration. In the illustrated configuration, the first line and the second line extend vertically downward and laterally outward away from the openings 120. One or both of the first line and the second line can be otherwise configured keeping in the mind a desire to have multiple styles or looks of garments resulting from a single body. In some configurations, the first line and the second line can extend vertically downward and laterally inward. In some configurations, the first line can form one side of a V-shape, an inverted V-shape, a lambda-shape, an inverted lambda-shape, an A-shape, or an inverted A-shape. Any configuration described elsewhere in this application can be used depending upon the desired looks to be obtained In the illustrated configuration, each of the first fastening elements 124*a*, 124*b*, 124*c* can interconnect with each of the second fastening elements 126*a*, 126*b*, 126*c* and vice versa. As described above, however, other configurations are possible. Some examples of the specific interconnections that result in specific styles or looks of garments from the reconfigurable garment 100 of FIG. 1 will be described below. Other configurations are possible that are not pictured.

Figure 2:
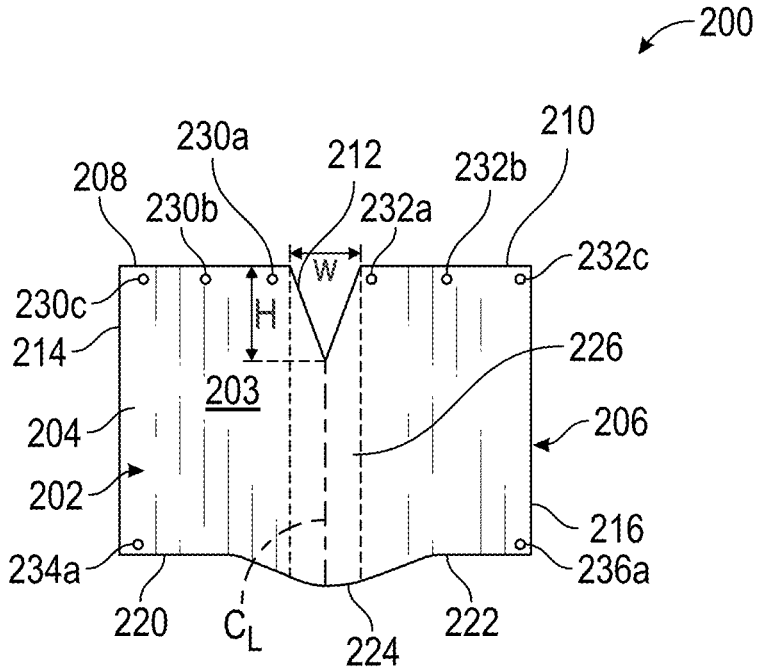
FIG. 2 is a plan view of a reconfigurable garment that is arranged and configured in accordance with certain features, aspects, and advantages of the present invention.

With reference now to FIG. 2, a second reconfigurable garment 200 is shown in plan view. The second reconfigurable garment 200 is similar in many respects to the first reconfigurable garment 100 shown in FIG. 1.

The reconfigurable garment 200 comprises a body 202. The body 202 can be formed of one or more fabric panels 204. In the illustrated configuration, the body 202 is formed of a single two-sided fabric panel. In some configurations, the body 202 can be formed of multiple layers of single-faced fabric and/or multiple two-sided fabric panels secured together. The body 202 comprises an inner surface 203 and an outer surface. In some configurations, the body 202 is reversible and, thus, the inner surface 203 may define an outer surface and vice versa.

As shown in FIG. 2, the body 202 comprises an outer perimeter 206. The outer perimeter 206 differs from the outer perimeter 106 illustrated in FIG. 1. As shown in FIG. 2, the outer perimeter 306 defines a quasi-chevron shape. The illustrated quasi-chevron shape comprises a recess on the top and a protrusion on the bottom with generally parallel sides.

The illustrated outer perimeter 206 comprises a first top edge 208. The first top edge 208 extends laterally in a straight line that is normal to a centerline CL of the body 202. The outer perimeter 206 also comprises a second top edge 210. The second top edge 210 also extends laterally in a straight line that is normal to the centerline of the body 202. The first top edge 208 and the second top edge 210 are generally vertically aligned in the illustrated configuration.

The first top edge 208 and the second top edge 210 are connected by a recessed region. In the illustrated embodiment, the recessed region is defined by a notch 212. In one configuration, the notch 212 can be a V-shape comprising two straight lines that connect as well as connect to the first top edge 208 and the second top edge 210. Other configurations of notches, including part-oval, horseshoe, or U-shaped configurations also can be used. As will be explained below, the recessed region defined by the notch 212 can be used to define a neck opening or neck region of the body 202 of the reconfigurable garment 200.

A gap is in the top edge defined between the first top edge 208 and the second top edge 210. In the illustrated configuration, a junction between the first top edge 208 and the notch 212 and a junction between the second top edge 210 and the notch 212 are spaced apart by a distance W. In some configurations, the distance W is between 1 inch and 25 inches. In addition, the recessed region or notch 212 has a second distance H, which is normal to the distance W. The second distance H can be between 5 inches and 23 inches.

In the illustrated configuration the outer perimeter 206 comprises a first side edge 214 and a second side edge 216. At least one of the side edges 214, 216 is linear. In the illustrated configuration both of the first side edge 214 and the second side edge 216 are linear. At the top, the first side edge 214 and the second side edge 216 are joined together by the top edges 208, 210 and the notch 212. At the bottom, the first side edge 214 is connected to a first bottom edge 220 while the second side edge 216 is connected to a second bottom edge 222.

The first bottom edge 220 and the second bottom edge 222 extend laterally inward from the side edges 214, 216 in a straight line that is normal to the centerline of the illustrated body 202. A center bottom edge 224 is positioned between the first bottom edge 220 and the second bottom edge 222. The center bottom edge 224 is not linear. The first bottom edge 220 and the second bottom edge 222 are connected by the center bottom edge 224. In the illustrated configuration, the center bottom edge 224 is arcuate. Preferably, the center bottom edge 224 bows outwardly from the top of the body 202. In some configurations, however, the center bottom edge 224 bows inwardly toward the top of the body 202. In some configurations, the first bottom edge 220, the second bottom edge 222, and the center bottom edge 224 are combined together to define a fully arcuate bottom edge that extends from the first side edge 214 to the second side edge 216. Other configurations also are possible.

The first side edge 214 and the second side edge 216 in the illustrated configuration are parallel with each other. In some configurations, the first side edge 214 and the second side edge 216 can taper upwardly, taper downwardly, or be hour-glass-shaped. The first side edge 214 and the second side edge 216 can be spaced apart by a distance of between 20 inches and 150 inches, and, in one preferred configuration, 70 inches.

While other configurations are possible, the first side edge 214 and the second side edge 216 have the same length as each other. In some configurations, the first side edge 214 is longer than the second side edge 216. In the illustrated configuration, the first side edge 214 and the second side edge 216 each has a length that is less than the distance between them. The first side edge 214 and the second side edge 216 each can have a length between 20 inches and 150 inches, and more preferably about 70 inches.

While the illustrated body 202 does not include the openings described with respect to the body 102 of FIG. 1, it is possible for the body 202 to include at least one opening. In some configurations, the body 202 can include two or more openings. In some such configurations, at least two arm openings can be provided. In some such configurations, the at least two arm openings can be positioned within the outer perimeter 206. Other configurations are possible.

A fastener-free region 226 can be positioned between the first side edge 214 and the second side edge 216. The fastener-free region in the illustrated arrangement extends downward from the junction between the first top edge 208 and the notch 212 and the junction between the second top edge 210 and the notch 212. The fastener-free region 226 can extend the full height of the body 202. The illustrated fastener-free region 226 has boundaries that extend vertically. The boundaries are generally parallel with the centerline CL. In the illustrated configuration, the fastener-free region 226 is a center region of the body 102. The fastener-free region 226 can occupy between about 8% and 12% of the body in the central region (i.e., the region to either side of the centerline CL), preferably between about 9% and 11%, and more preferably about 10%.

Laterally outward of the fastener-free region 122 are positioned a plurality of fastening elements. The fastening elements can be as described above with reference to FIG. 1. In the illustrated configuration, at least two first fastening elements 230*a*, 230*b* are positioned along the first top edge 208 and at least two second fastening elements 232*a*, 232*b* are positioned along the second top edge 210. In some configurations, the first and second fastening elements 230*a*, 230*b*, 232*a*, 232*b* are positioned within the second distance H of the top edges 208, 210.

In some configurations, three or more first fastening elements 230*a*, 230*b*, 230*c* are positioned along the first top edge 208 and three or more second fastening elements 232*a*, 232*b*, 232*c* are positioned along the second top edge 210. The first fastening elements 230*a*, 230*b*, 230*c* can define a first straight line. The second fastening elements 232*a*, 232*b*, 232*c* can define a second straight line. In some configurations, the first fastening elements 230*a*, 230*b*, 230*c* and the second fastening elements 232*a*, 232*b*, 232*c* can form a single straight line. As described above, other configurations are possible and any configuration described elsewhere in this application can be used depending upon the desired looks to be obtained.

As discussed above, the first fastening elements 230*a*, 230*b*, 230*c* are complementary to the second fastening elements 232*a*, 232*b*, 232*c*; however, any of the fastening element types described elsewhere in this application can be used. As discussed above, in some configurations, there may be more or less first fastening elements than second fastening elements, but the illustrated configuration has equal numbers of first fastening elements and second fastening elements.

With continued reference to FIG. 2, the illustrated body 202 also comprises lower first fastening elements 234*a* and lower second fastening elements 236*a*. The lower first fastening element 234*a* can be positioned adjacent to a corner defined by the first side edge 214 and the first bottom edge 220 while the lower second fastening element 236*a* can be positioned adjacent a corner defined by the second side edge 216 and the second bottom edge 222. While a single lower first fastening element 234*a* is shown, more than one lower first fastening element 234*a* can be provided. Similarly, while a single lower second fastening element 236*a* is shown, more than one lower second fastening element 236*a* can be provided. The same number of lower first fastening elements 234*a* and lower second fastening elements 236*a* can be the same as each other or different from each other. Moreover, the lower first fastening element 234*a* can be configured to connect with one or more of the first fastening elements 230*a*, 230*b*, 230*c* and/or one or more of the lower second fastening elements 232*a*, 232*b*, 232*c*. Similarly, the lower second fastening element fastening element 236*a* can be configured to connect with one or more of the first fastening elements 230, 230*b*, 230*c* and/or one or more of the lower second fastening elements 232*a*, 232*b*, 232*c*.

Figure 3:
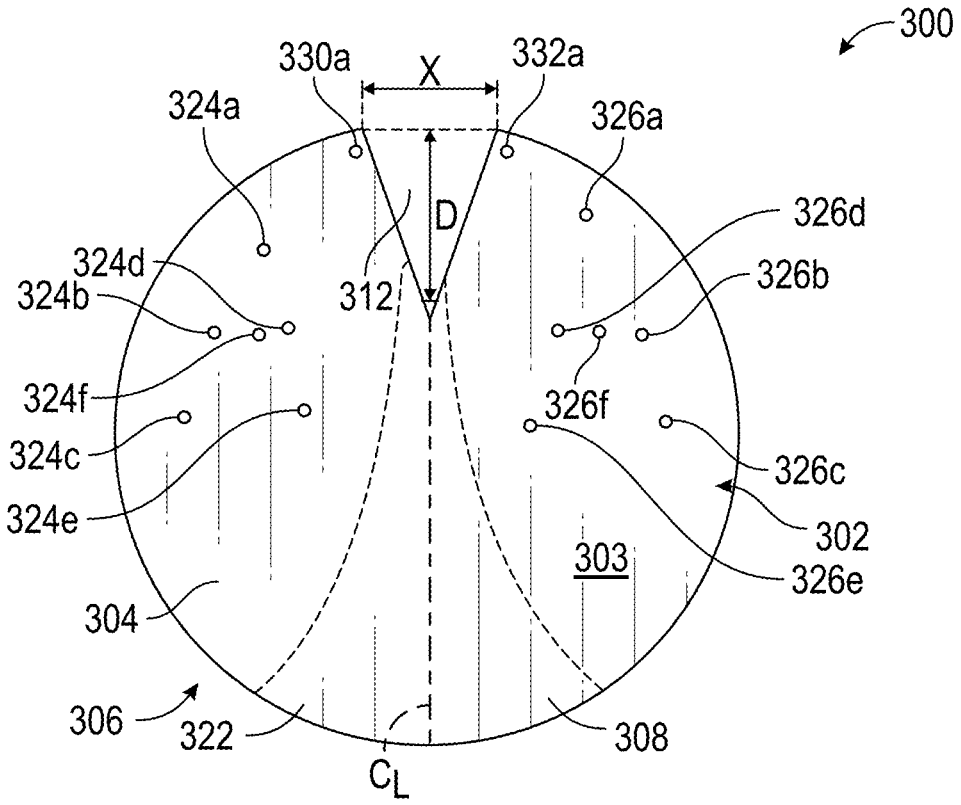
FIG. 3 is a plan view of a reconfigurable garment that is arranged and configured in accordance with certain features, aspects, and advantages of the present invention.

With reference now to FIG. 3, a third reconfigurable garment 300 is shown in plan view. The third reconfigurable garment 300 is similar in many respects to the second reconfigurable garment 200 that is shown in FIG. 2.

The reconfigurable garment 300 comprises a body 302. The body 302 can be formed of one or more fabric panels 304. In the illustrated configuration, the body 302 is formed of a single two-sided fabric panel. In some configurations, the body 302 can be formed of multiple layers of single-faced fabric and/or multiple two-sided fabric panels 304 secured together. The body 302 comprises an inner surface 303 and an outer surface. In some configurations, the body 302 is reversible and, thus, the inner surface 303 may define an outer surface and vice versa.

As shown in FIG. 3, the body 302 comprises an outer perimeter 306. The outer perimeter 306 differs from the outer perimeters 106, 206 illustrated in FIGS. 1 and 2. The outer perimeter 306 is defined by at least one edge 308. As shown in FIG. 3, the at least one edge 308 defines a generally circular shape. The outer perimeter 306 of the body 302 of FIG. 3 can be circular, oval, elliptical, any similar shape, or any irregular shape. In the illustrated configuration, the outer perimeter 306 is an elongated circular shape. More specifically, the illustrated outer perimeter 306 is an elongated circular shape with the vertical length being slightly longer than the horizontal length.

With reference to FIG. 3, the illustrated body 302 can be symmetrical about a vertical centerline CL. In the illustrated configuration, the vertical dimension of the outer perimeter 306 is between 20 inches and 85 inches, and more preferably 60 inches. The horizontal dimension of the outer perimeter 306 is between 20 inches and 85 inches, and more preferably 60 inches. Other configurations are possible.

In the illustrated configuration the at least one edge 308 is interrupted by a recessed region 312. Preferably, the recessed region 312 is in an upper portion of the body 302. In the illustrated embodiment, the recessed region 312 is defined by a notch. In one configuration, the notch can be a V-shape comprising two straight lines that connect as well as connect to the at least one edge 308. The recessed region 312 can be defined by other configurations of notches, including part-oval, horseshoe, or U-shaped configurations. As will be explained below, the recessed region 312 can be used to define a neck opening or neck region of the body 302 of the reconfigurable garment 300.

A gap in the at least one edge 308 is defined by the recessed region 312. In the illustrated configuration, a first end of the recessed region 312 and a second end of the recessed region 312 are spaced apart by a distance X. In some configurations, the distance X is between 1 inch and 22 inches, preferably between 4 inches and 10 inches, and more preferably 6 inches. In addition, the recessed region 312 has a second distance D, which is normal to the distance X. The second distance D can be between 6 inches and 25 inches, and preferably between and more preferably 18 inches.

While the illustrated body 302 does not include the openings described with respect to the body 102 of FIG. 1, it is possible for the body 302 to include at least one opening. In some configurations, the body 302 can include two or more openings. In some such configurations, at least two arm openings can be provided. In some such configurations, the at least two arm openings can be positioned within the outer perimeter 306. Other configurations are possible.

A fastener-free region 322 can be positioned in a central region of the body 302 in the illustrated arrangement, the fastener-free region 322 extends downward from a portion of the recessed region 312. In some configurations, the fastener-free region 322 is defined by arcuate or curved boundary lines that extend from the recessed region 312 to a portion of the at least one edge 308 that is disposed in the lower half of the body 302. In the illustrated configuration, the intersection between the fastener-free region 322 and the at least one edge 308 is in the lower quarter of the body 302. The illustrated fastener-free region 322 can be in the laterally central portion of the body 302. In some configurations, the lower region of the fastener-free region 322 is wider than the upper region of the fastener-free region. The fastener-free regions can be conical or volcano-shaped. Other configurations may be suitable.

Laterally outward of the fastener-free region 322 are positioned a plurality of fastening elements. The plurality of fastening elements can be structured in any manner referred to elsewhere in this disclosure and the plurality of fastening elements in other garments can employ the arrangement shown in FIG. 3.

The illustrated reconfigurable garment 300 comprises at least two first fastening elements 324*a*, 324*b* on the first side of the centerline CL and the illustrated reconfigurable garment 300 also comprises at least two second fastening elements 326*a*, 326*b* on the second side of the centerline CL. The fastener-free region 322 separates the grouping of first fastener elements 324*a*, 324*b* from the grouping of second fastener elements 326*a*, 326*b*. While the illustrated reconfigurable garment 300 includes six first fastening elements 324*a*, 324*b*, 324*c*, 324*d*, 324*e*, 324*f* and six second fastening elements 326*a*, 326*b*, 326*c*, 326*d*, 326*e*, 326*f*, some configurations may have as few as two pairs of first and second fastening elements and many more than six pairs of first elements and some configurations may have as few as two second fastening elements and many more than six second fastening elements. In some configurations, there are more first fastening elements than there are second fastening elements or there are more second fastening elements than there are first fastening elements. In the illustrated configuration, there are equal numbers of first fastening elements and second fastening elements.

In the illustrated configuration, the top-most first fastening element 324*a* and the top-most second fastening element 326*a* are positioned laterally outward of the recessed region 312 and vertically between the lowermost portion of the recessed region 312 and the uppermost portion of the recessed region 312. More preferably, the middle first fastening element 324*b* and the middle second fastening element 326*b* are positioned laterally outward from the recess region 312 and vertically lower than the lowermost portion of the recessed region 312. Other configurations are possible.

The first fastening elements 324*a*, 324*b*, 324*c* and the second fastening elements 326*a*, 326*b*, 326*c* in the illustrated configuration can be vertically positioned in the upper half of the body 302 and laterally positioned in the outer quarters of the body 302. While the first fastening elements 324*a*, 324*b*, 324*c* define a first line and the second fastening elements 326*a*, 326*b*, 326*c* define a second line, one or more of each of the series of first fastening elements and the series of second fastening elements can define a straight line, a zig-zag, an arc, an angle or any other desired configuration. In the illustrated configuration, the first line and the second line extend vertically downward and laterally outward away from the recessed region 312. One or both of the first line and the second line can be otherwise configured keeping in the mind a desire to have multiple styles or looks of garments resulting from the single body 302.

The first fastening elements 324*d*, 324*e* and the second fastening elements 326*d*, 326*e* in the illustrated configuration can be vertically positioned in the upper half of the body 302 and laterally positioned inward of the first fastening element 324*a* and laterally positioned inward of the second fastening element 326*a*. In the illustrated configuration, the first fastening elements 324*a*, 324*d*, 324*e* define a third line and the second fastening elements 326*a*, 326*d*, 326*e* define a fourth line. One or more of each of the series of first fastening elements and the series of second fastening elements can define a straight line, a zig-zag, an arc, an angle or any other desired configuration. In the illustrated configuration, the third line and the fourth line extend vertically downward and laterally inward toward the centerline CL. One or both of the third line and the fourth line can be otherwise configured keeping in the mind a desire to have multiple styles of garments resulting from a single body.

With continued reference to FIG. 3, the sixth first fastening element 324*f* can be positioned in the V-shape created by the first fastening elements 324*a*, 324*b*, 324*c*, 324*d*, 324*e* and the sixth second fastening element 326*f* can be positioned in the V-shape created by the second fastening elements 326*a*, 326*b*, 326*c*, 326*d*, 326*e*. In the illustrated configuration, the first fastening elements form an A-shape and the second fastening elements form an A-shape. Other configurations can be used. The illustrated A-shape, however, increases the number of available styles and sizes.

In the third reconfigurable garment 300 of FIG. 3, a further first fastening element 330*a* and a further second fastening element 332*a* are provided. In the illustrated configuration, the further first fastening element 330*a* and the further second fastening element 332*a* are provided adjacent the juncture between each lateral side of the recessed region 312 and the at least one edge 308. The further first fastening element 330*a* and the further second fastening element 332*a* can be secured together. In some configurations, the further first fastening element 330*a* can be secured to at least one of the first fastening elements 324*a*, 324*b*, 324*c* and/or second fastening elements 326*a*, 326*b*, 326*c*. Similarly, the further second fastening element 332*a* can be secured to at least one of the first fastening elements 324*a*, 324*b*, 324*c* and/or second fastening elements 326*a*, 326*b*, 326*c*.

In the illustrated configuration, each of the first fastening elements 324*a*, 324*b*, 324*c*, 324*d*, 324*e*, 330*a* can interconnect with each of the second fastening elements 326*a*, 326*b*, 326*c*, 324*d*, 324*e*, 332*a* and vice versa. As described above, however, other configurations are possible. The specific interconnections that result in specific styles or looks of dresses from the reconfigurable garment 300 of FIG. 3 will be described below.

Figure 4:
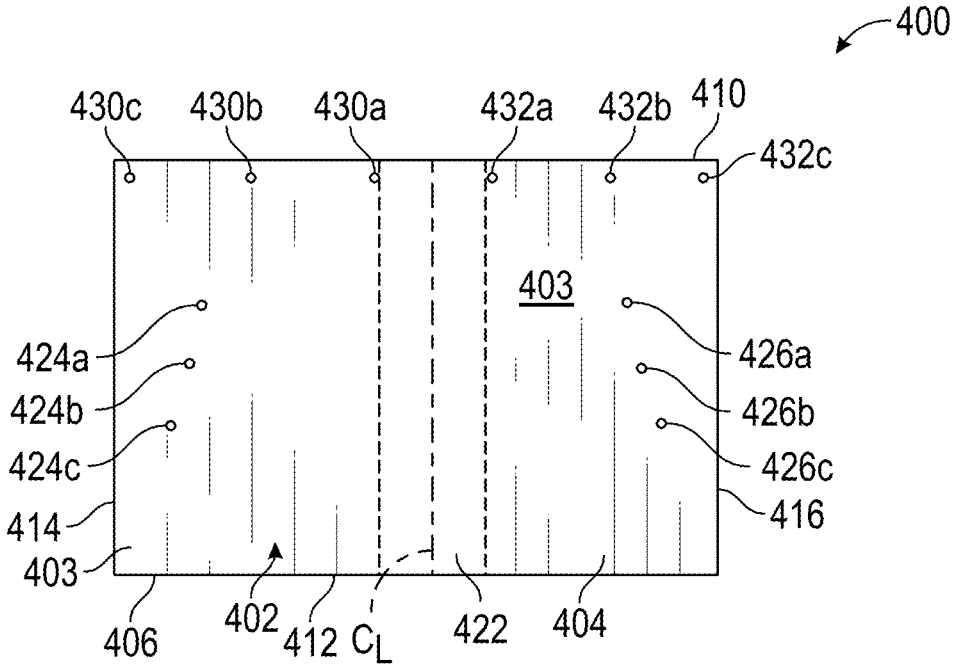
FIG. 4 is a plan view of a reconfigurable garment that is arranged and configured in accordance with certain features, aspects, and advantages of the present invention.

With reference now to FIG. 4, a further reconfigurable garment 400 is shown in plan view. The reconfigurable garment 400 comprises a body 402. The body 402 can be formed of one or more fabric panel 404. In the illustrated configuration, the body 402 is formed of a single two-sided fabric panel 404. In some configurations, the body 402 can be formed of multiple layers of single-faced fabric and/or multiple two-sided fabric panels 404 secured together. The body 402 comprises an inner surface 403 and an outer surface. In some configurations, the body 402 is reversible and, thus, the inner surface 403 may define an outer surface and vice versa.

The body 402 comprises an outer perimeter 406. The outer perimeter 406 can have any desired shape or configuration. As will be explained, the outer perimeter 406 defines the shape of the body 402, which impacts the drape and appearance of the various garments defined by any particular reconfigurable garment, including the illustrated reconfigurable garment 400. The outer perimeter 406 that is illustrated in FIG. 4 is a parallelogram. In particular, the illustrated outer perimeter 406 is a rectangle. In some other configurations, the outer perimeter 406 can comprise a square or any other shape of a parallelogram.

In some configurations, the outer perimeter 406 comprises four edges. In some configurations, the outer perimeter 406 comprises a top edge 410, a bottom edge 412, a first side edge 414, and a second side edge 416. At least one of the edges 410, 412, 414, 416 is linear. In the illustrated configuration, all of the edges 410, 412, 414, 416 are linear. As will be described, in other embodiments, not all of the edges may be linear and, in some embodiments, are least one of the edges is circular or arc-like.

The top edge 410 and the bottom edge 412 in the illustrated configuration have the same lengths. The top edge 410 is connected to the bottom edge 412 by the first side edge 414 and the second side edge 416. The first side edge 414 and the second side edge 416 in the illustrated configuration have the same lengths. Desirably, the top edge 410 and the bottom edge 412 are longer than the first side edge 414 and the second side edge 416. Other configurations are possible.

In some configurations, the top edge 410 has a length of between 20 inches and 150 inches. In some configurations, the first side edge 414 has a length of between 20 inches and 150 inches.

While the illustrated body 402 does not include the openings described with respect to the body 102 of FIG. 1, it is possible for the body 402 to include at least one opening. In some configurations, the body 402 can include two or more openings. In some such configurations, at least two arm openings can be provided. In some such configurations, the at least two arm openings can be positioned within the outer perimeter 406. Other configurations are possible.

A fastener-free region 422 can extend vertically on the body 402. The fastener-free region 422 can extend the full height of the body 402. In particular, the illustrated fastener-free region 422 extends vertically between boundaries that are parallel to the centerline CL. In the illustrated configuration, the fastener-free region 422 is a center region of the body 402. The fastener-free region 422 can occupy between about 8% and 12% of the body in the central region (i.e., the region to either side of the centerline CL), preferably between about 9% and 11%, and more preferably about 10%.

Laterally outward of the fastener-free region 422 are positioned a plurality of fastening elements. The plurality of fastening elements can be configured as described above. The illustrated fourth reconfigurable garment 400 comprises at least two first fastening elements 424*a*, 424*b* on the first side of the centerline CL and the illustrated fourth reconfigurable garment 400 also comprises at least two second fastening elements 426*a*, 426*b* on the second side of the centerline CL. While the illustrated fourth reconfigurable garment 400 includes three first fastening elements 424*a*, 424*b*, 424*c* and three second fastening elements 426*a*, 426*b*, 426*c*, some configurations may have as few as two first fastening elements and many more than three first fastening elements and some configurations may have as few as two second fastening elements and many more than three second fastening elements. In some configurations, there are more first fastening elements than there are second fastening elements or there are more second fastening elements than there are first fastening elements. In the illustrated configuration, there are equal numbers of first fastening elements and second fastening elements.

In the illustrated configuration, the top-most first fastening element 424*a* and the top-most second fastening element 426*a* are positioned below the top edge 410 by a distance of at least ⅓ of a full vertical dimension of the body 402. In some configurations, at least two fastening elements of the first fastening elements and at least two of the second fastening elements are positioned vertically in a center ⅓ of the body. Preferably, three of the first fastening elements and three of the second fastening elements are positioned vertically in a center ⅓ of the body. Other configurations are possible.

The first fastening elements 424*a*, 424*b*, 424*c* and the second fastening elements 426*a*, 426*b*, 426*c* in the illustrated configuration can be laterally positioned in the outer quarters of the body 402. While the first fastening elements 424*a*, 424*b*, 424*c* define a first line and the second fastening elements 426*a*, 426*b*, 426*c* define a second line, one or more of each of the series of first fastening elements and the series of second fastening element can define a straight line, a zig-zag, an arc, an angle or any other desired configuration. One or both of the first line and the second line can be otherwise configured keeping in the mind a desire to have multiple styles or looks of garments resulting from a single body.

In some configurations, laterally outward of the fastener-free region 422 are positioned an additional plurality of fastening elements. In the illustrated configuration, at least two third fastening elements 430*a*, 430*b* are positioned along the top edge 410 and at least two fourth fastening elements 432*a*, 432*b* are positioned along the top edge 410. In some configurations, the third and fourth fastening elements 430*a*, 430*b*, 432*a*, 432*b* are positioned within one-third of the full vertical dimension of the body 402 from the top edge 410.

In some configurations, three or more third fastening elements 430*a*, 430*b*, 430*c* are positioned along the top edge 410 and three or more fourth fastening elements 432*a*, 432*b*, 432*c* are positioned along the top edge 410. The third fastening elements 430*a*, 430*b*, 430*c* can define a first straight line. The fourth fastening elements 432*a*, 432*b*, 432*c* can define a second straight line. In some configurations, the third and fourth fastening elements 430*a*, 430*b*, 430*c*, 432*a*, 432*b*, 432*c* can define a single line. As described above, other configurations are possible.

In the illustrated configuration, each of the first fastening elements 424*a*, 424*b*, 424*c* can interconnect with each of the second fastening elements 426*a*, 426*b*, 426*c* and vice versa. As described above, however, other configurations are possible and any configuration described elsewhere in this application can be used depending upon the desired looks to be obtained. As also discussed above, the third fastening elements 430*a*, 430*b*, 430*c* are complementary to the fourth fastening elements 432*a*, 432*b*, 432*c*. In some configurations, there may be more or fewer third fastening elements than fourth fastening elements, but the illustrated configuration has equal numbers of third fastening elements and fourth fastening elements. Where the fourth reconfigurable garment 400 includes first, second, third and fourth fastening elements, there may be more or fewer of one set (e.g., first fastening elements and second fastening elements) than the other set (e.g., third fastening elements and fourth fastening elements). Moreover, the third fastening elements can be complementary to one or both of the first fastening elements or the second fastening elements. Similarly, the fourth fastening elements can be complementary to one or both of the first fastening elements or the second fastening elements. However, any of the fastening element types described elsewhere in this application can be used. The specific interconnections that result in specific styles of dresses from the reconfigurable garment 400 of FIG. 4 will be described below.

Figure 5:
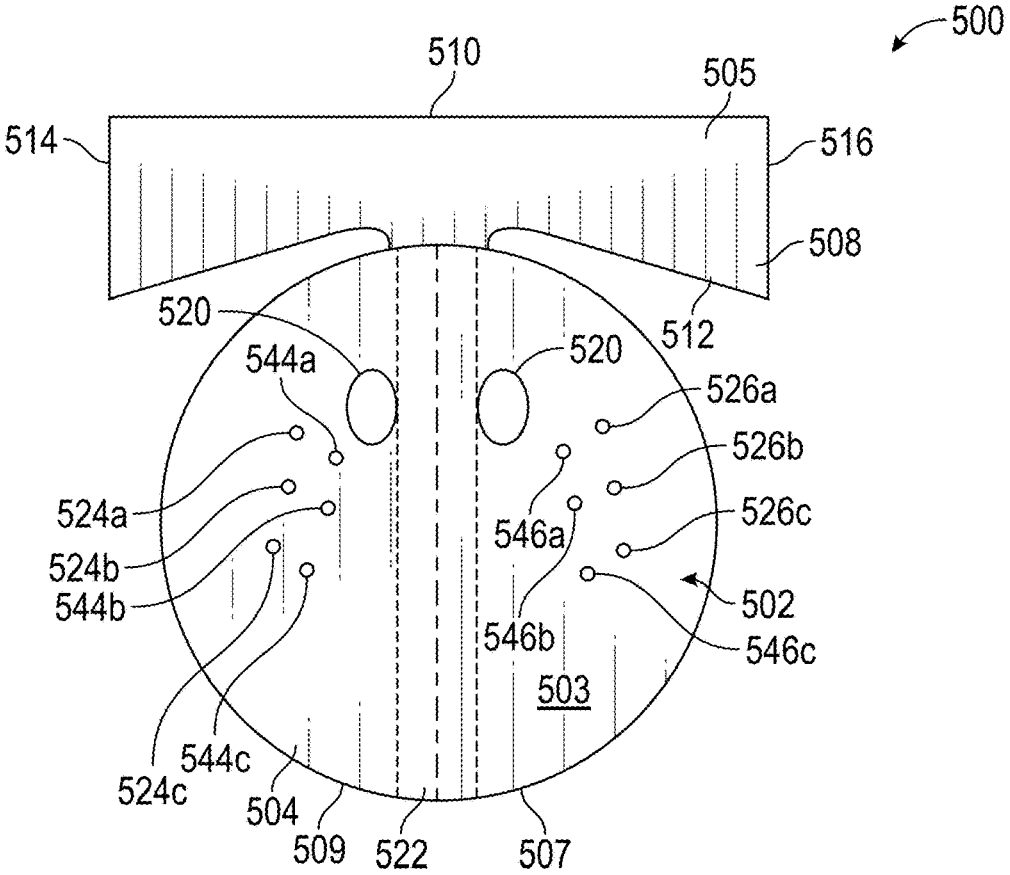
FIG. 5 is a plan view of a reconfigurable garment that is arranged and configured in accordance with certain features, aspects, and advantages of the present invention.

With reference now to FIG. 5, a fifth reconfigurable garment 500 is shown in plan view. The fifth reconfigurable garment 500 is similar in many respects to the other reconfigurable garments shown in FIG. 1-4.

The reconfigurable garment 500 comprises a body 502. The body 502 can be formed of one or more fabric panels 504, 505. In the illustrated configuration, the body 502 is formed of a plurality of two-sided fabric panels. More particularly, the body 502 comprises a first fabric panel 504 and a second fabric panel 505. In some configurations, however, the body 502 can be formed of a single fabric panel. In some configurations, one or more of the fabric panels 504, 505 of the body 502 can be formed of multiple layers of single-faced fabric and/or multiple two-sided fabric panels secured together. The body 502 comprises an inner surface 503 and an outer surface. In some configurations, the body 502 is reversible and, thus, the inner surface 303 may define an outer surface and vice versa.

As discussed above, the illustrated body 502 can comprise two fabric panels 504, 505. In the illustrated configuration, the first fabric panel 504 is a lower fabric panel and the second fabric panel 505 is an upper fabric panel. The two fabric panels define a two-part shape (e.g., T-shape, angels wing shape, etc.). For example, rather than a smooth transition between the two panels, an abrupt transition can be provided, such as by a neck or the like. The two fabric panels 504, 505 can be connected in any suitable manner. In some configurations, fastening elements can be used to join the two fabric panels 504, 505. The fastening elements can be similar or the same as those discussed elsewhere in this disclosure. In some configurations, the two fabric panels 504, 505 can be sewn together, welded together, adhered together or otherwise secured together such that the two fabric panels 504, 505 cannot be separated without damaging one panel or the other panel. In some configurations, an enlarged single panel having the same overall shape or configuration also can be used.

As shown in FIG. 5, the first panel 504 of the body 502 comprises an outer perimeter 507 and the second fabric panel 505 of the body comprises an outer perimeter 508. The illustrated outer perimeter 507 of the first panel is defined by at least one edge 509. As shown in FIG. 5, the at least one edge 509 defines a generally circular shape. The outer perimeter 507 of the first panel 504 of the body 502 of FIG. 5 can be circular, oval, elliptical, any similar shape, or an irregular shape. Moreover, the outer perimeter 507 can take any desired shape, including those discussed above. In the illustrated configuration, the outer perimeter 507 is an elongated circular shape. More specifically, the illustrated outer perimeter 507 is an elongated circular shape with the vertical length that is longer than the horizontal length.

The outer perimeter 508 of the upper fabric panel 505 can be the same shape and/or size as, or differently shaped and/or sized relative to, the lower outer perimeter 507 of the lower fabric panel 504. In the illustrated configuration, the outer perimeter 508 of the upper fabric panel 505 is shaped differently relative to the outer perimeter 507 of the lower fabric panel 504. The outer perimeter 508 that is illustrated in FIG. 5 is a parallelogram or angel-wing shaped. In particular, the illustrated outer perimeter 508 has an upper portion that is a rectangle and a lower portion formed by two triangles that curve to join the lower fabric panel 504. In some other configurations, the outer perimeter 508 can comprise a square, any other shape of a parallelogram, or any other shape.

In some configurations, the outer perimeter 508 comprises four edges. In some configurations, the outer perimeter 508 comprises a top edge 510, a pair of bottom edges 512, a first side edge 514, and a second side edge 516. At least one of the edges 510, 512, 514, 516 is linear. In the illustrated configuration, three of the edges 510, 512, 514, 516 are linear. Other configurations are possible.

The top edge 510 is connected to the bottom edge 512 by the first side edge 514 and the second side edge 516. The first side edge 514 and the second side edge 516 in the illustrated configuration have the same lengths. Desirably, the top edge 510 and the bottom edge 512 are longer than the first side edge 514 and the second side edge 516. Other configurations are possible.

The illustrated second fabric panel 505 does not include any fastening elements. In some configurations, however, the second fabric panel 505 can have fastening elements. In such configurations, the fastening elements can be complementary with only fastening elements on the second fabric panel 505 or can be complementary only with fastening elements on the first fabric panel 504, or can be complementary with fastening elements on both fabric panels 504, 505. The extra fabric provided by the second fabric panel 505 provides additional styling options through draping, joining, and tying, as will be explained below.

With reference to FIG. 5, the body 502 can be symmetrical about a vertical centerline CL. In the illustrated configuration, the vertical dimension of the body 502 is between 20 inches and 85 inches and more preferably 60 inches. The horizontal dimension of the body 502 is between 20 inches and 85 inches, and more preferably 60 inches. Other configurations are possible.

The illustrated body 502 also defines at least one opening 520. In the illustrated configuration, the first panel 504 of the body 502 comprises two openings 520. The two openings 520 define armholes for the illustrated configuration. The illustrated openings 520 are oval or elliptical in shape. Other shapes also can be used for the openings 520. While the two openings 520 are identical in the illustrated configuration, the two openings 520 can be mirror images of each other or can be different from each other. Other configurations are possible.

The openings 520 in the illustrated configuration are positioned in the upper half of the first panel 504 of the body 502. In some configurations, the openings 520 can be positioned in the upper ⅓ of the first panel 504 of the body 502. In the illustrated configuration, the openings 520 are positioned on the center half of the first panel 504 of the body 502. In other words, if the first panel 504 of the body 502 was subdivided into quarters, one opening 520 would be positioned in the second quarter and the other opening 520 would be positioned in the third quarter. The illustrated openings 520 are symmetrically disposed relative to the centerline CL. Other configurations are possible.

Positioned between the openings 520 can be a fastener-free region 522. The fastener-free region 522 can be positioned just between the openings 520, but in the illustrated configuration the fastener-free region 522 extends the full height of at least the first panel 504 of the body 502. In particular, the illustrated fastener-free region 522 is defined laterally by the innermost portions of the openings 520 and extends vertically between boundaries that are parallel to the centerline CL. In the illustrated configuration, the fastener-free region 522 is a center region of the first panel 504 of the body 502. The fastener-free region 122 can occupy between about 8% and 12% of the body in the central region, preferably between about 9% and 11%, and more preferably about 10%.

Laterally outward of the fastener-free region 522 are positioned a plurality of fastening elements. In the illustrated configuration, male fastening elements may be positioned on a first side of the centerline CL while female fastening elements may be positioned on a second side of the centerline CL. It is possible to intermix the male and female fastening elements; however, it is preferred to segregate those elements on opposing sides of the centerline CL. In some configurations, the fastening elements are universal and can result in significantly more configurations from the single reconfigurable garment 500. But, for purposes of this description, the fastening elements will be described in the context of male and female elements.

In the arrangement shown in FIG. 5, a plurality of series of fastening elements is presented one each side of the centerline CL. In particular, two or more rows of fastening elements can be provided to allow for different sizes or different combinations of sizes. In other words, with multiple rows or sets of fastening elements, the fitment of the reconfigurable garment 500 can be better customized to the wearer. For example, for someone with a smaller bustline and larger waistline, a first combination of fastening elements can be used while another different combination of fastening elements can be used for someone with a larger bustline and a smaller waistline.

The illustrated fifth reconfigurable garment 500 comprises at least two first fastening elements 524*a*, 524*b* on the first side of the centerline CL and the illustrated fifth reconfigurable garment 500 also comprises at least two second fastening elements 526*a*, 526*b* on the second side of the centerline CL. While the illustrated fifth reconfigurable garment 500 includes three first fastening elements 524*a*, 524*b*, 524*c* and three second fastening elements 526*a*, 526*b*, 526*c*, some configurations may have as few as two first fastening elements and many more than three first elements and some configurations may have as few as two second fastening elements and many more than three second fastening elements. In some configurations, there are more first fastening elements than there are second fastening elements or there are more second fastening elements than there are first fastening elements. In the illustrated configuration, there are equal numbers of first fastening elements and second fastening elements.

In the illustrated configuration, the top-most first fastening element 524*a* and the top-most second fastening element 526*a* are positioned laterally outward of the openings 520 and lower than an uppermost portion of the openings 520. More preferably, the top-most first fastening element 524*a* and the top-most second fastening element 526*a* are positioned laterally outward from the openings 520 and vertically between the uppermost portion of the openings 520 and a lowermost portion of the openings 520. Other configurations are possible.

The first fastening elements 524*a*, 524*b*, 524*c* and the second fastening elements 526*a*, 526*b*, 526*c* in the illustrated configuration can be vertically positioned in the central half of the body 502 and laterally positioned in the outer quarters of the body 502. While the first fastening elements 524*a*, 524*b*, 524*c* define a first line and the second fastening elements 526*a*, 526*b*, 526*c* define a second line, one or more of each of the series of first fastening elements and the series of second fastening element can define a straight line, a zig-zag, an arc, an angle or any other desired configuration. In the illustrated configuration, the first line and the second line extend vertically downward and laterally outward away from the openings 520. One or both of the first line and the second line can be otherwise configured keeping in the mind a desire to have multiple styles or looks of garments resulting from a single body.

As discussed above, the reconfigurable garment 500 can include at least a set of third fastening elements 544*a*, 544*b*, 544*c* and a set of fourth fastening elements 546*a*, 546*b*, 546*c*. The third fastening elements 544*a*, 544*b*, 544*c* and the fourth fastening elements 546*a*, 546*b*, 546*c* can be positioned between the first set of fastening elements 524*a*, 524*b*, 524*c* and second set of fastening elements 526*a*, 526*b*, 526*c*. The illustrated third and fourth sets of fastening elements also can be positioned vertically lower than a corresponding member of the first and second sets of fastening elements. While two sets of fastening elements are positioned on each side of the center line CL, more sets also can be provided. In addition, it is possible for different numbers of sets of fastening elements to be provided on each side of the fastener-free region 522. Moreover, differing numbers of fastening elements can be provided in each set such that the first and second sets each have 3 fastening elements while the third and fourth sets each have 4 fastening elements, for example but without limitation.

In the illustrated configuration, each of the first fastening elements 524*a*, 524*b*, 524*c* and third fastening elements 544*a*, 544*b*, 544*c* can interconnect with each of the second fastening elements 526*a*, 526*b*, 526*c* and fourth fastening elements 546*a*, 546*b*, 546*c* and vice versa. As described above, however, other configurations are possible to provide differing sizes and styles. The specific interconnections that result in specific sizes styles of dresses from the reconfigurable garment 500 of FIG. 5 will be described below.

Figure 6:
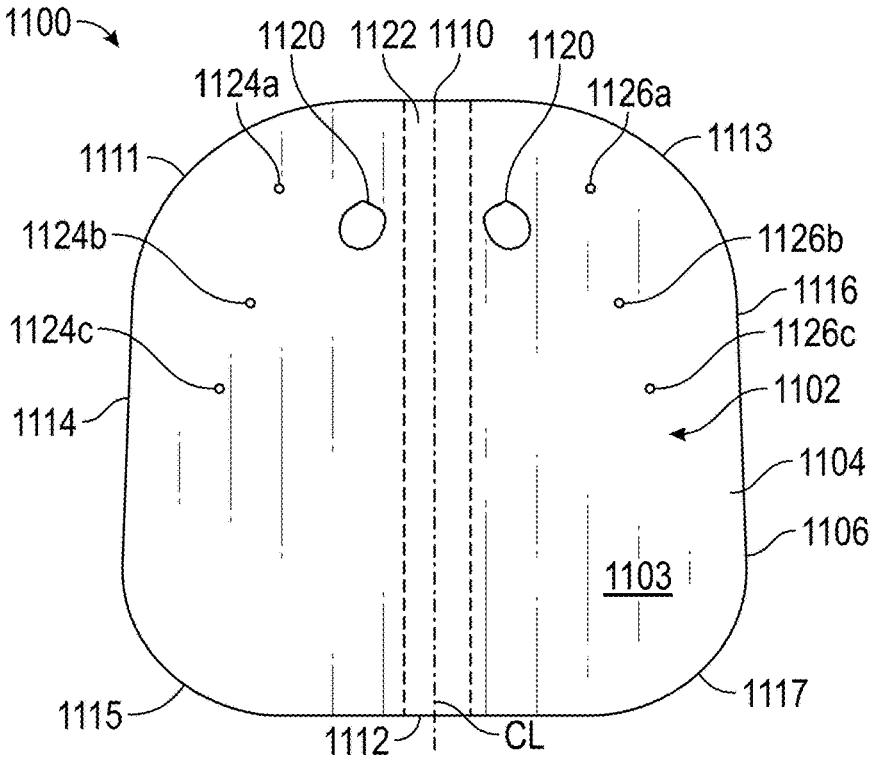
FIG. 6 is a plan view of a reconfigurable garment that is arranged and configured in accordance with certain features, aspects, and advantages of the present invention.

With reference now to FIG. 6, a reconfigurable garment 1100 is shown in a plan view. The reconfigurable garment 1100 comprises a body 1102. The body 1102 can be formed of one or more fabric panel 1104. In the illustrated configuration, the body 1102 is formed of a single two-sided fabric panel 1104. In some configurations, the body 1102 can be formed of multiple layers of single-faced fabric and/or multiple two-sided fabric panels secured together. The body 1102 comprises an inner surface 1103 and an outer surface. In some configurations, the body 1102 is reversible and, thus, the inner surface 1103 may define an outer surface and vice versa.

The body 1102 comprises an outer perimeter 1106. The outer perimeter 1106 can have any desired shape or configuration. As will be explained, the outer perimeter 1106 defines the shape of the body 1102, which impacts the drape and appearance of the various garments defined by any particular reconfigurable garment, including the illustrated reconfigurable garment 1100. The outer perimeter 1106 that is illustrated in FIG. 6 is a quadrilateral with rounded corners. In particular, the illustrated outer perimeter 1106 comprises four linear sides with four rounded corners. In some other configurations, the outer perimeter 1106 can comprise any other shape of a parallelogram with rounded corners.

As mentioned directly above, the illustrated outer perimeter 1106 comprises four linear edges. In some configurations, the outer perimeter 1106 comprises a top edge 1110, a bottom edge 1112, a left edge 1114, and a right edge 1116. Each of these edges is a linear portion. In other embodiments, not all of the edges may be linear and, in some embodiments, the panel can be circular or oval in shape, or at least one of the edges is circular or arc-like.

In the illustrated configuration, the top edge 1110 and the left edge 1114 are connected by a first curved edge 1111, the top edge 1110 and the right edge 1114 are connected by a second curved edge 1113, the bottom edge 1112 and the left edge 1114 are connected by a third curved edge 1115, and the bottom edge 1112 and the right edge 1114 are connected by a fourth curved edge 1117. In some configurations, one or more of the these corners is not a curved edge but, instead is an angle, such as a right angle, an acute angle, or an obtuse angle.

The top edge 1110 and the bottom edge 1112 in the configuration of FIG. 6 have differing lengths. As illustrated, the top edge 1110 is shorter than the bottom edge 1112. The top edge 1110 is connected to the bottom edge 1112 by the left edge 1114 and the right edge 1116. The left edge 1114 and the right edge 1116 in the illustrated configuration have the same lengths as each other. Desirably, the top edge 1110 is shorter than the left edge 1114 and the right edge 1116. Other configurations are possible. In some configurations, the top edge 1110 has a length of between 10 inches and 45 inches. In some configurations, the top edge 1110 can be as long as 70 inches. In some configurations, the bottom edge 1112 has a length of between 12 inches and 60 inches. In some configurations, the bottom edge 1112 can be as long as 75 inches. In some configurations, the left edge 1114 has a length of between 15 inches and 55 inches. In some configurations, the left edge 1114 can be as long as 70 inches.

The illustrated body 1102 also defines at least one opening 1120. In some configurations, the at least one opening 1120 can define an opening that defines a collar (i.e., the wearer can insert their head and neck through the opening). In the illustrated configuration, the body 1102 comprises two openings 1120. The two openings 1120 define armholes for the illustrated configuration (i.e., the wearer can insert their hands and arms through the openings). The illustrated openings 1120 are oval or elliptical in shape. Other shapes also can be used for the openings 1120. While the two openings 1120 are identical in the illustrated configuration, the two openings 1120 can be mirror images of each other or can be different from each other. Moreover, in some configurations, there can be three openings with one opening receiving the head/neck of the wearer while the other two openings 1120 can define the armholes. Other configurations are possible.

The openings 1120 in the illustrated configuration are positioned in the upper half of the body 1102. In some configurations, the openings 1120 can be positioned in the upper ⅓ of the body 1102. In the illustrated configuration, the openings 1120 are positioned on the center half of the body 1102. In other words, if the body 1102 was subdivided along vertical lines into quarters, one opening 1120 would be positioned in the second quarter and the other opening 1120 would be positioned in the third quarter. In the illustrated configuration, the centers of the openings 1120 are positioned between one half and one third of the distance between each of the side edges 1114, 1116. In addition, the illustrated openings 1120 are symmetrically disposed relative to a centerline CL. Other configurations are possible.

Fastening elements can be positioned in strategic locations anywhere on the fabric panel. In some configurations, however, there is a fastener-free region 1122. In some such configurations, the fastener-free region 1122 can be centrally located on the panel and, in other such configurations, the fastener-free region 1122 can be positioned adjacent to the edges of the fabric panel. In the illustrated configurations, the fastener-free region 1122 is positioned between the openings 1120. The fastener-free region 1122 can be positioned just between the openings 1120, but in the illustrated configuration the fastener-free region 1122 extends the full height of the body 1102. In particular, the illustrated fastener-free region 1122 is defined laterally by the innermost portions of the openings 1120 and extends vertically between boundaries that are parallel to the centerline CL. In the illustrated configuration, the fastener-free region 1122 is a center region of the body 1102. The fastener-free region 1122 can occupy between about 8% and 12% of the body in the central region (i.e., the region to either side of the centerline CL), preferably between about 9% and 11%, and more preferably about 10%.

Laterally outward of the fastener-free region 1122 are positioned a plurality of fastening elements. In the illustrated configuration, male fastening elements may be positioned on a first side of the centerline CL while female fastening elements may be positioned on a second side of the centerline CL. It is possible to intermix the male and female fastening elements on each side of the centerline CL. In some configurations, there are more female elements on one side of the garment than male and in other configurations there are more male elements on one side of the garment than female. In some configurations, there are an even number of female and male elements on one side of the CL. In other configurations, the fastening elements are universal and can result in significantly more configurations from the single garment 1100. But, for purposes of this description, the fastening elements will be described in the context of male and female elements.

With reference still to FIG. 1, the illustrated garment 1100 comprises at least two first fastening elements 1124*a*, 1124*b* (which can be male-male, female-male, male-female, female-female, or universal) on the first side of the centerline CL and the illustrated garment 1100 also comprises at least two second fastening elements 1126*a*, 1126*b* (which can be male-male, female-male, male-female, female-female, or universal) on the second side of the centerline CL. While the illustrated garment 1100 includes three first fastening elements 1124*a*, 1124*b*, 1124*c* and three second fastening elements 1126*a*, 1126*b*, 1126*c*, some configurations may have as few as two first fastening elements and many more than three first elements and some configurations may have as few as two second fastening elements and many more than three second fastening elements. In some configurations, there are more first fastening elements than there are second fastening elements or there are more second fastening elements than there are first fastening elements. In the illustrated configuration, there are equal numbers of first fastening elements and second fastening elements.

In the illustrated configuration, the top-most first fastening element 1124*a* and the top-most second fastening element 1126*a* are positioned laterally outward of the openings 1120 and higher than a lowermost portion of the openings 1120. More preferably, the top-most first fastening element 1124*a* and the top-most second fastening element 1126*a* are positioned laterally outward from the openings 1120 and vertically higher that the uppermost portion of the openings 1120. Other configurations are possible.

In the illustrated configuration, the second down of the first fastening element 1124*b* and the second down of the second fastening element 1126*b* are lower that an uppermost portion of the openings 1120. More preferably, these fastening elements 1124*b*, 1126*b* are lower than the lowermost portion of the openings 1120.

The first fastening elements 1124*a*, 1124*b*, 1124*c* and the second fastening elements 1126*a*, 1126*b*, 1126*c* in the illustrated configuration can be vertically positioned in the upper half of the body 1102 and laterally positioned in the outer quarters of the body 1102. While the first fastening elements 1124*a*, 1124*b*, 1124*c* define a first line and the second fastening elements 1126*a*, 1126*b*, 1126*c* define a second line, one or more of each of the series of first fastening elements and the series of second fastening element can define a straight line, a zig-zag, an arc, an angle or any other desired configuration. In the illustrated configuration, the first line and the second line extend vertically downward and laterally outward away from the openings 1120. One or both of the first line and the second line can be otherwise configured keeping in the mind a desire to have multiple styles or looks of garments resulting from a single body. In some configurations, the first line and the second line can extend vertically downward and laterally inward. In some configurations, the first line can form one side of a V-shape, an inverted V-shape, a lambda-shape, an inverted lambda-shape, an A-shape, or an inverted A-shape. Any configuration described elsewhere in this application can be used depending upon the desired looks to be obtained In the illustrated configuration, each of the first fastening elements 1124*a*, 1124*b*, 1124*c* can interconnect with each of the second fastening elements 1126*a*, 1126*b*, 1126*c* and vice versa. As described above, however, other configurations are possible. Some examples of the specific interconnections that result in specific styles or looks of garments from the reconfigurable garment 1100 of FIG. 6 will be described below. Other configurations are possible that are not pictured.

Figure 7:
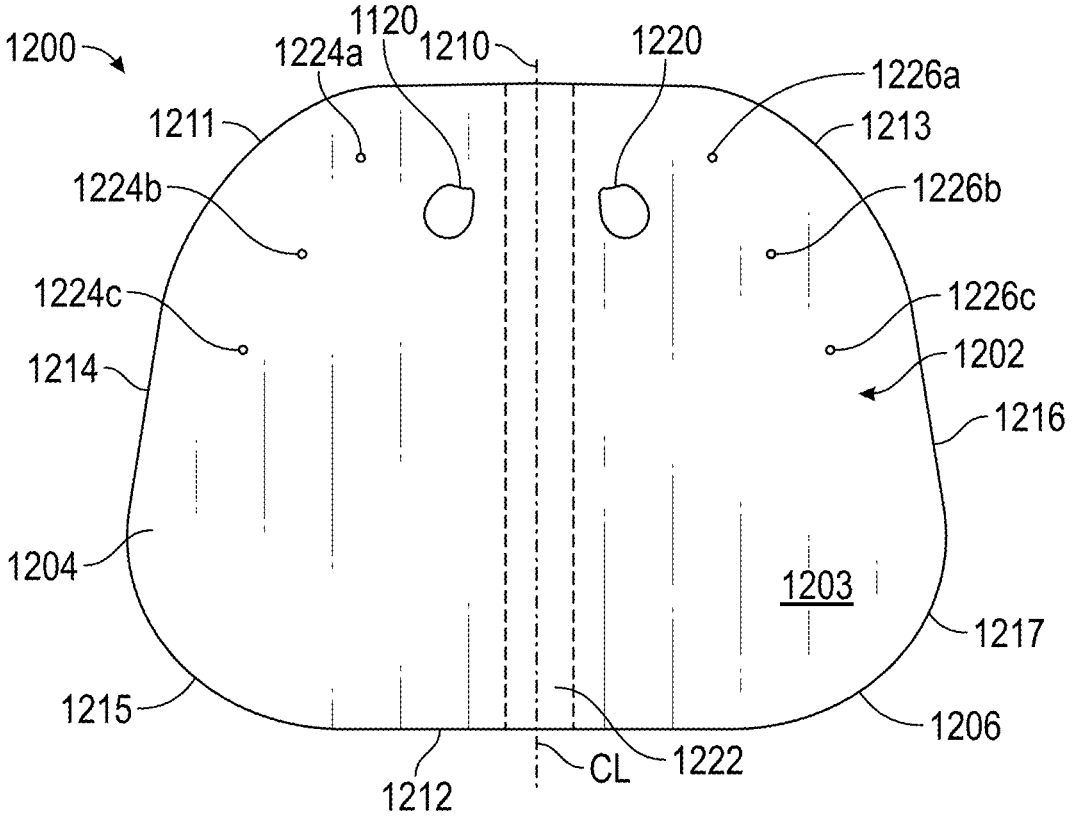
FIG. 7 is a plan view of a reconfigurable garment that is arranged and configured in accordance with certain features, aspects, and advantages of the present invention.

With reference now to FIG. 7, a reconfigurable garment 1200 is shown in a plan view. The reconfigurable garment 1200 is a medium-large version of the reconfigurable garment 1100 of FIG. 6, which is a small-medium version. As such, the reconfigurable garment 1200 is configured similarly to the reconfigurable garment 1100 of FIG. 6. Given the structure of the garments, the lower end of the reconfigurable garment 1100 of FIG. 6 has a small lateral dimension relative to the lower end of the reconfigurable garment 1200 of FIG. 7.

The reconfigurable garment 1200 comprises a body 1202. The body 1202 can be formed of one or more fabric panel 1204. In the illustrated configuration, the body 1202 is formed of a single two-sided fabric panel 1204. In some configurations, the body 1202 can be formed of multiple layers of single-faced fabric and/or multiple two-sided fabric panels secured together. The body 1202 comprises an inner surface 1203 and an outer surface. In some configurations, the body 1202 is reversible and, thus, the inner surface 1203 may define an outer surface and vice versa.

The body 1202 comprises an outer perimeter 1206. The outer perimeter 1206 can have any desired shape or configuration. As will be explained, the outer perimeter 1206 defines the shape of the body 1202, which impacts the drape and appearance of the various garments defined by any particular reconfigurable garment, including the illustrated reconfigurable garment 1200. The outer perimeter 1206 that is illustrated in FIG. 7 is a quadrilateral with rounded corners. In particular, the illustrated outer perimeter 1206 comprises four linear sides with four rounded corners. In some other configurations, the outer perimeter 1206 can comprise any other shape of a parallelogram with rounded corners.

As mentioned directly above, the illustrated outer perimeter 1206 comprises four linear edges. In some configurations, the outer perimeter 1206 comprises a top edge 1210, a bottom edge 1212, a left edge 1214, and a right edge 1216. The left edge 1214 and the right edge 1216 diverge from each other from top to bottom. Each of these edges is a linear portion. In other embodiments, not all of the edges may be linear and, in some embodiments, the panel can be circular or oval in shape, or at least one of the edges is circular or arc-like.

In the illustrated configuration, the top edge 1210 and the left edge 1214 are connected by a first curved edge 1211, the top edge 1210 and the right edge 1214 are connected by a second curved edge 1213, the bottom edge 1212 and the left edge 1214 are connected by a third curved edge 1215, and the bottom edge 1212 and the right edge 1214 are connected by a fourth curved edge 1217. In some configurations, one or more of the these corners is not a curved edge but, instead is an angle, such as a right angle, an acute angle, or an obtuse angle.

The top edge 1210 and the bottom edge 1212 in the configuration of FIG. 6 have differing lengths. As illustrated, the top edge 1210 is shorter than the bottom edge 1212. The top edge 1210 is connected to the bottom edge 1212 by the left edge 1214 and the right edge 1216. The left edge 1214 and the right edge 1216 in the illustrated configuration have the same lengths as each other. Desirably, the top edge 1210 is shorter than the left edge 1214 and the right edge 1216. The largest width of the body 1202 is in the lower half of the body 1202 and the smallest width of the body 1202 is in the upper half of the body. Other configurations are possible.

In some configurations, if the edges were projected such that the linear portions intersected, the top edge 1210 has a length of between 10 inches and 65 inches. In some configurations, if the edges were projected such that the linear portions intersected, the top edge 1210 can be as long as 75 inches. In some configurations, if the edges were projected such that the linear portions intersected, the bottom edge 1212 has a length of between 15 inches and 80 inches. In some configurations, if the edges were projected such that the linear portions intersected, the bottom edge 1212 can be as long as 100 inches. In some configurations, if the edges were projected such that the linear portions intersected, the left edge 1214 has a length of between 15 inches and 60 inches. In some configurations, if the edges were projection such that the linear portions intersected, the left edge 1214 can be as long as 80 inches.

The illustrated body 1202 also defines at least one opening 1220. In some configurations, the at least one opening 1220 can define an opening that defines a collar (i.e., the wearer can insert their head and neck through the opening). In the illustrated configuration, the body 1202 comprises two openings 1220. The two openings 1220 define armholes for the illustrated configuration (i.e., the wearer can insert their hands and arms through the openings). The illustrated openings 1220 are oval or elliptical in shape. Other shapes also can be used for the openings 1220. While the two openings 1220 are identical in the illustrated configuration, the two openings 1220 can be mirror images of each other or can be different from each other. Moreover, in some configurations, there can be three openings with one opening receiving the head/neck of the wearer while the other two openings 1220 can define the armholes. Other configurations are possible.

The openings 1220 in the illustrated configuration are positioned in the upper half of the body 1202. In some configurations, the openings 1220 can be positioned in the upper ⅓ of the body 1202. In the illustrated configuration, the openings 1220 are positioned on the center half of the body 1202. In other words, if the body 1202 was subdivided along vertical lines into quarters, one opening 1220 would be positioned in the second quarter and the other opening 1220 would be positioned in the third quarter. In the illustrated configuration, the centers of the openings 1220 are positioned between one half and one third of the distance between each of the side edges 1214, 1216. In addition, the illustrated openings 1220 are symmetrically disposed relative to a centerline CL. Other configurations are possible.

Fastening elements can be positioned in strategic locations anywhere on the fabric panel. In some configurations, however, there is a fastener-free region 1222. In some such configurations, the fastener-free region 1222 can be centrally located on the panel and, in other such configurations, the fastener-free region 1222 can be positioned adjacent to the edges of the fabric panel. In the illustrated configurations, the fastener-free region 1222 is positioned between the openings 1220. The fastener-free region 1222 can be positioned just between the openings 1220, but in the illustrated configuration the fastener-free region 1222 extends the full height of the body 1202. In particular, the illustrated fastener-free region 1222 is defined laterally by the innermost portions of the openings 1220 and extends vertically between boundaries that are parallel to the centerline CL. In the illustrated configuration, the fastener-free region 1222 is a center region of the body 1202. The fastener-free region 1222 can occupy between about 8% and 12% of the body in the central region (i.e., the region to either side of the centerline CL), preferably between about 9% and 11%, and more preferably about 10%.

Laterally outward of the fastener-free region 1222 are positioned a plurality of fastening elements. In the illustrated configuration, male fastening elements may be positioned on a first side of the centerline CL while female fastening elements may be positioned on a second side of the centerline CL. It is possible to intermix the male and female fastening elements on each side of the centerline CL. In some configurations, there are more female elements on one side of the garment than male and in other configurations there are more male elements on one side of the garment than female. In some configurations, there are an even number of female and male elements on one side of the CL. In other configurations, the fastening elements are universal and can result in significantly more configurations from the single garment 1200. But, for purposes of this description, the fastening elements will be described in the context of male and female elements.

With reference still to FIG. 7, the illustrated garment 1200 comprises at least two first fastening elements 1224*a*, 1224*b* (which can be male-male, female-male, male-female, female-female, or universal) on the first side of the centerline CL and the illustrated garment 1200 also comprises at least two second fastening elements 1226*a*, 1226*b* (which can be male-male, female-male, male-female, female-female, or universal) on the second side of the centerline CL. While the illustrated garment 1200 includes three first fastening elements 1224*a*, 1224*b*, 1224*c* and three second fastening elements 1226*a*, 1226*b*, 1226*c*, some configurations may have as few as two first fastening elements and many more than three first elements and some configurations may have as few as two second fastening elements and many more than three second fastening elements. In some configurations, there are more first fastening elements than there are second fastening elements or there are more second fastening elements than there are first fastening elements. In the illustrated configuration, there are equal numbers of first fastening elements and second fastening elements.

In the illustrated configuration, the top-most first fastening element 1224*a* and the top-most second fastening element 1226*a* are positioned laterally outward of the openings 1220 and higher than a lowermost portion of the openings 1220. More preferably, the top-most first fastening element 1224*a* and the top-most second fastening element 1226*a* are positioned laterally outward from the openings 1220 and vertically higher that the uppermost portion of the openings 1220. Other configurations are possible.

In the illustrated configuration, the second down of the first fastening element 1224*b* and the second down of the second fastening element 1226*b* are lower that an uppermost portion of the openings 1220. More preferably, these fastening elements 1224*b*, 1226*b* are lower than the lowermost portion of the openings 1220.

The first fastening elements 1224*a*, 1224*b*, 1224*c* and the second fastening elements 1226*a*, 1226*b*, 1226*c* in the illustrated configuration can be vertically positioned in the upper half of the body 1202 and laterally positioned in the outer quarters of the body 1202. While the first fastening elements 1224*a*, 1224*b*, 1224*c* define a first line and the second fastening elements 1226*a*, 1226*b*, 1226*c* define a second line, one or more of each of the series of first fastening elements and the series of second fastening element can define a straight line, a zig-zag, an arc, an angle or any other desired configuration. In the illustrated configuration, the first line and the second line extend vertically downward and laterally outward away from the openings 1220. One or both of the first line and the second line can be otherwise configured keeping in the mind a desire to have multiple styles or looks of garments resulting from a single body. In some configurations, the first line and the second line can extend vertically downward and laterally inward. In some configurations, the first line can form one side of a V-shape, an inverted V-shape, a lambda-shape, an inverted lambda-shape, an A-shape, or an inverted A-shape. Any configuration described elsewhere in this application can be used depending upon the desired looks to be obtained In the illustrated configuration, each of the first fastening elements 1224*a*, 1224*b*, 1224*c* can interconnect with each of the second fastening elements 1226*a*, 1226*b*, 1226*c* and vice versa. As described above, however, other configurations are possible. Some examples of the specific interconnections that result in specific styles or looks of garments from the reconfigurable garment 1200 of FIG. 7 will be described below. Other configurations are possible that are not pictured.

Figure 8:
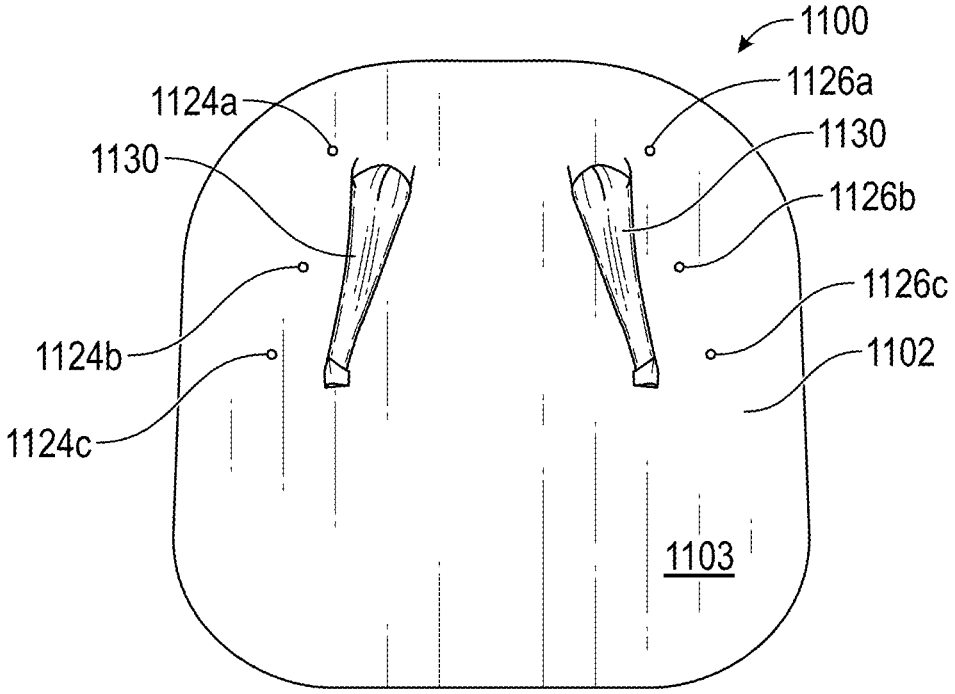
FIG. 8 is a plan view of a reconfigurable garment that is arranged and configured in accordance with certain features, aspects, and advantages of the present invention.
Figure 9:
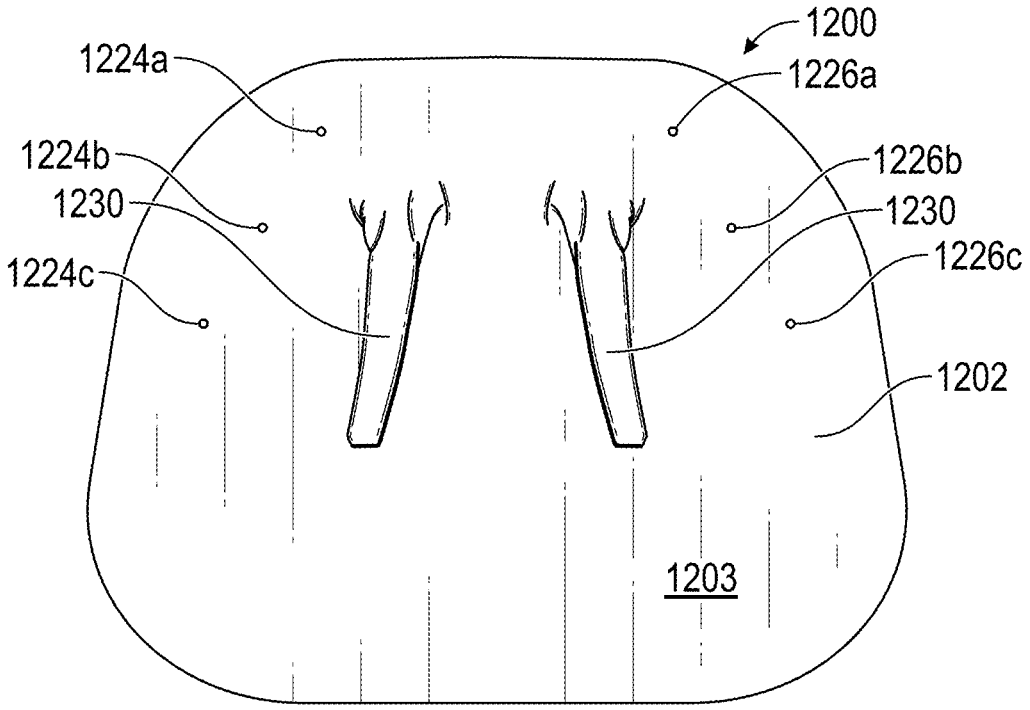
FIG. 9 is a plan view of a reconfigurable garment that is arranged and configured in accordance with certain features, aspects, and advantages of the present invention.
Figure 10:
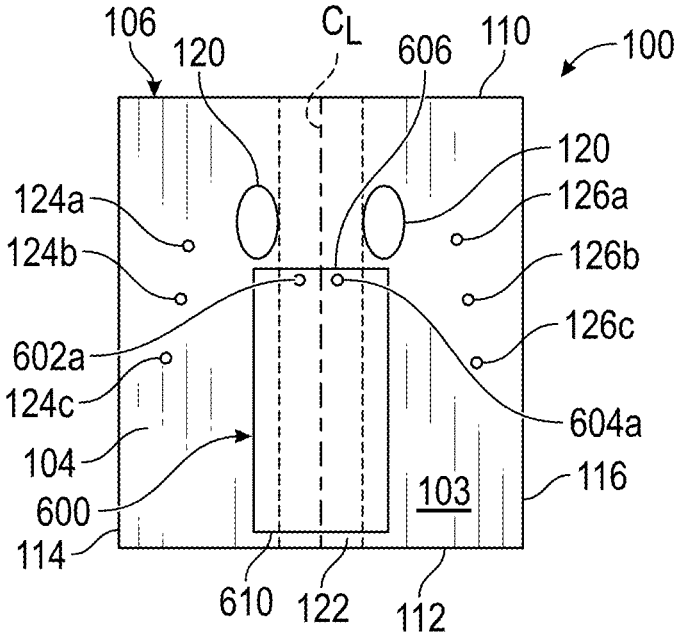
FIG. 10 is a plan view of the reconfigurable garment of FIG. 1 in combination with a tube dress, which combination that is arranged and configured in accordance with certain features, aspects, and advantages of the present invention.
Figure 11:
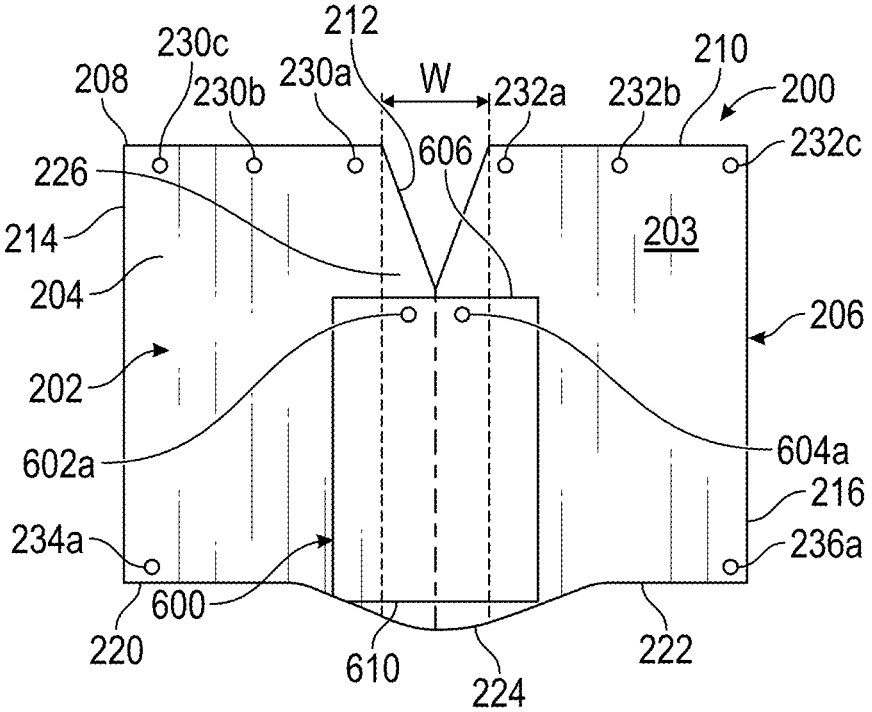
FIG. 11 is a plan view of the reconfigurable garment of FIG. 2 in combination with a tube dress, which combination that is arranged and configured in accordance with certain features, aspects, and advantages of the present invention.
Figure 12:
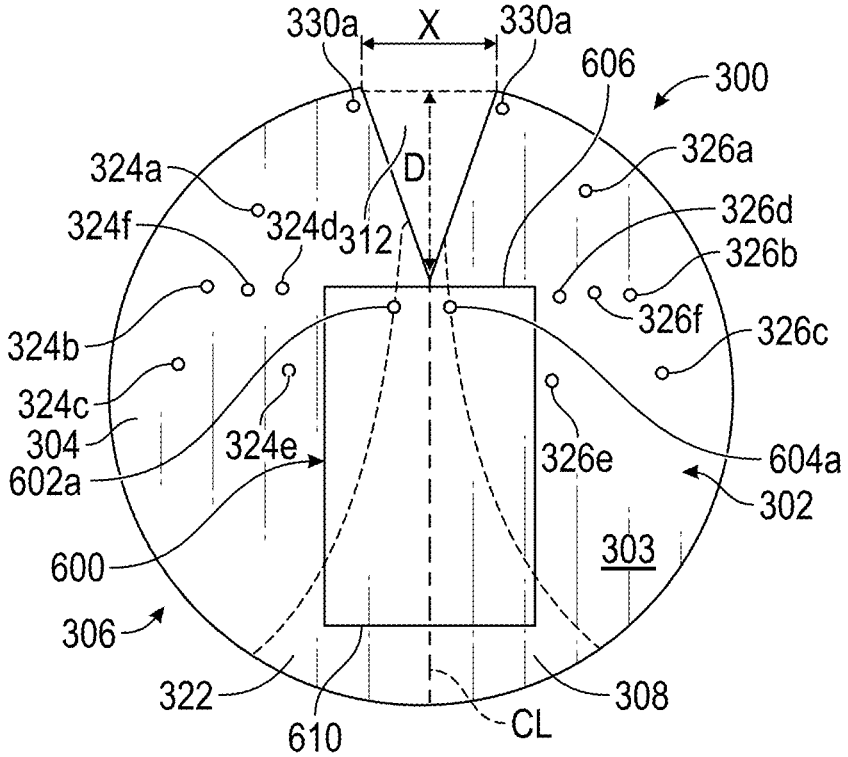
FIG. 12 is a plan view of the reconfigurable garment of FIG. 3 in combination with a tube dress, which combination that is arranged and configured in accordance with certain features, aspects, and advantages of the present invention.
Figure 13:
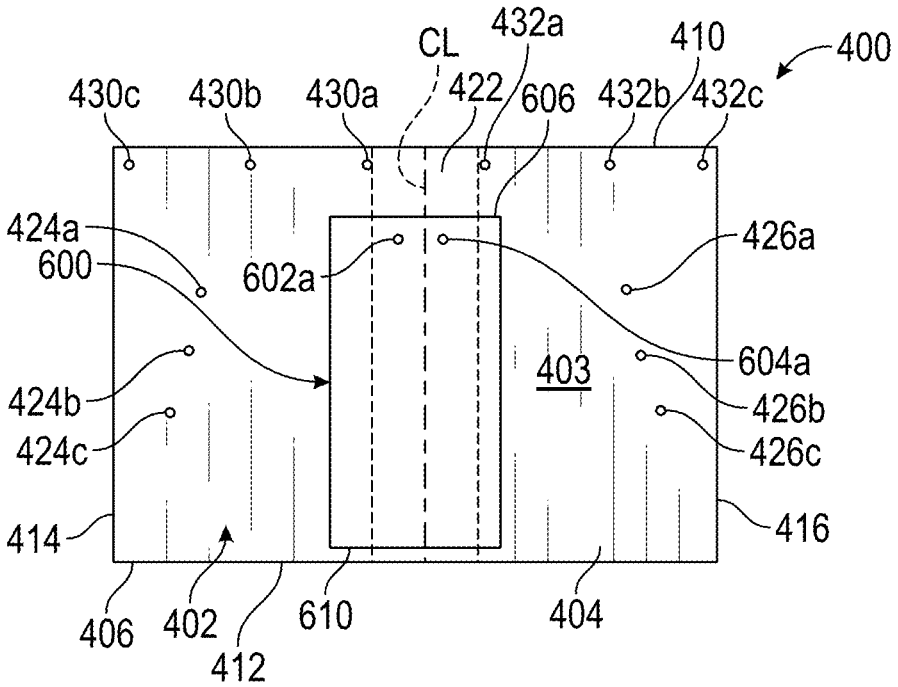
FIG. 13 is a plan view of the reconfigurable garment of FIG. 4 in combination with a tube dress, which combination that is arranged and configured in accordance with certain features, aspects, and advantages of the present invention.
Figure 14:
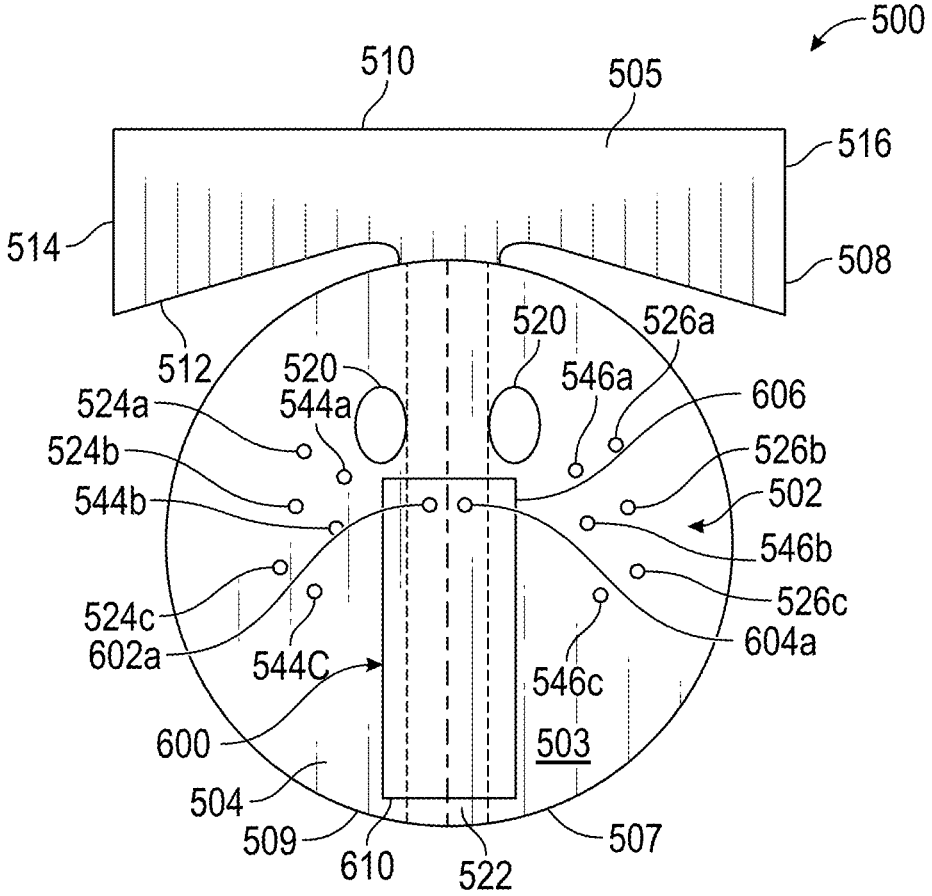
FIG. 14 is a plan view of the reconfigurable garment of FIG. 5 in combination with a tube dress, which combination that is arranged and configured in accordance with certain features, aspects, and advantages of the present invention.

FIGS. 8 and 9 are the garments of FIGS. 6 and 7 with the addition of sleeves 1130, 1230 respectively. The sleeves 1130, 1230 are secured to the openings 1120, 1220. In some configurations, the sleeves 1130, 1230 may be removable. In the illustrated configuration, the sleeves 1130, 1230 are sewn to the bodies 1102, 1202. The sleeves 1130, 1230 can be formed of the same fabric as the bodies 1102, 1202 or can be formed of a different material. Preferably, however, the fabric of the sleeves 1130, 1230 possesses the same or similar stretch relative to the fabric of the bodies 1102, 1202.

FIGS. 10-14 illustrate the dresses of FIGS. 1-5 in combination with a tube dress 600. As used herein, the term tube dress has its ordinary and customary meaning and also means a typically sleeveless dress that is stretchy and tight-fitting. In some configurations, the tube dress can include shoulder straps similar to a camisole or tank top and the term "tube dress" should be understood to include such configurations unless specified that the tube dress does not include such straps.

The illustrated tube dress 600 can include two or more fastening elements 602*a*, 604*a*. The fastening elements 602*a*, 604*a* can be positioned at the first end of the tube dress 606. Preferably, the fastening elements 602*a*, 604*a* are positioned inside of the hem of the tube dress 600. While only four are being discussed herein, there can be as many or as few of these hem fastening elements as desired. Each of the fastening elements 602*a*, 604*a* is arranged and configured to interconnect with one or more of the fastening elements of the garments described above or any of the adornments, belts, or extenders discussed below. In some configurations, the tube dress 600 is temporarily connected with the fabric panel of the garment with which it is paired. In some configurations, the tube dress 600 is sewn to the fabric panel of the garment with which it is paired. In other configurations, the tube dress does not come with any fastening elements at all. As mentioned above, the tube dress can be used in combination with the extenders and the decorative buckles for the user to decorate and/or secure additional fabric panels and embellishments to create the desired style or look.

In the illustrated configurations, the tube dress 600 is positioned such that a lower end 610 of the tube dress 600 is adjacent or slightly inside of the perimeter of the garment with which it is combined. In some configurations where the panel has openings in the form of arm holes or a neck recesses, the tube dress 600 is vertically positioned between the openings or neck recesses and the lowermost portion of the outer perimeter of the panel. Preferably, the tube dress 600 overlaps at least a portion of the fastener-free region of the panel. More preferably, the width of the tube dress 600 when flattened extends beyond the fastener-free region of the panel on both lateral sides of the fastener-free region. Most preferably, when the panel of the garment is laid flat and the tube dress 600 is laid flat on top of the panel, the tube dress 600 will not cover any of the fastening elements (other than any of the fastening elements used to secure the tube dress 600 to the panel). Other configurations are possible. In some configurations, a full row of fastening elements can encircle the upper seam of the tube dress 600. Any other suitable arrangements of fastening elements can be provided.

Figure 15A:
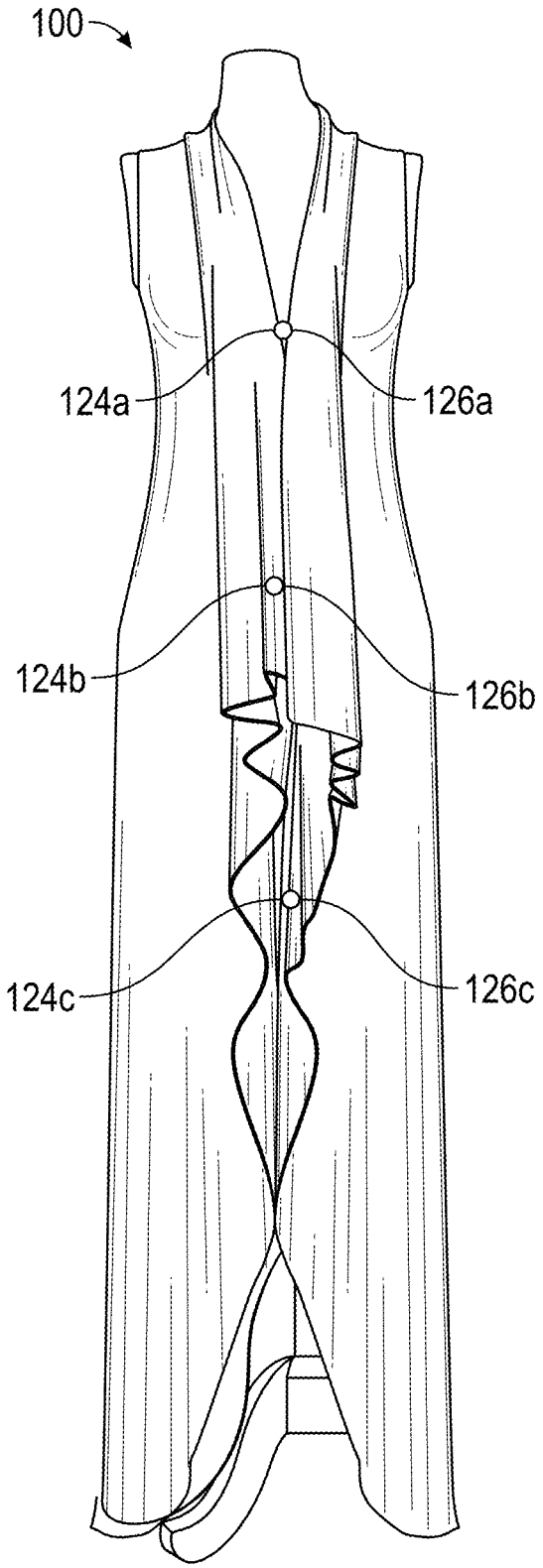
FIGS. 15A and 15B are front and rear views of the reconfigurable garment of FIG. 1 styled into a first look.
Figure 15B:
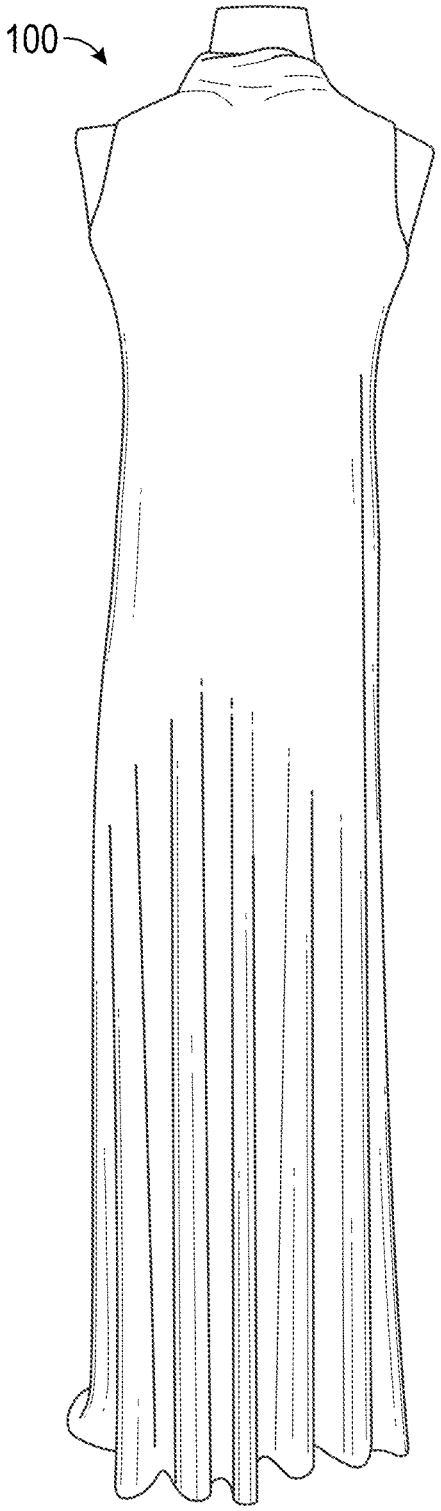
Figure 15C:
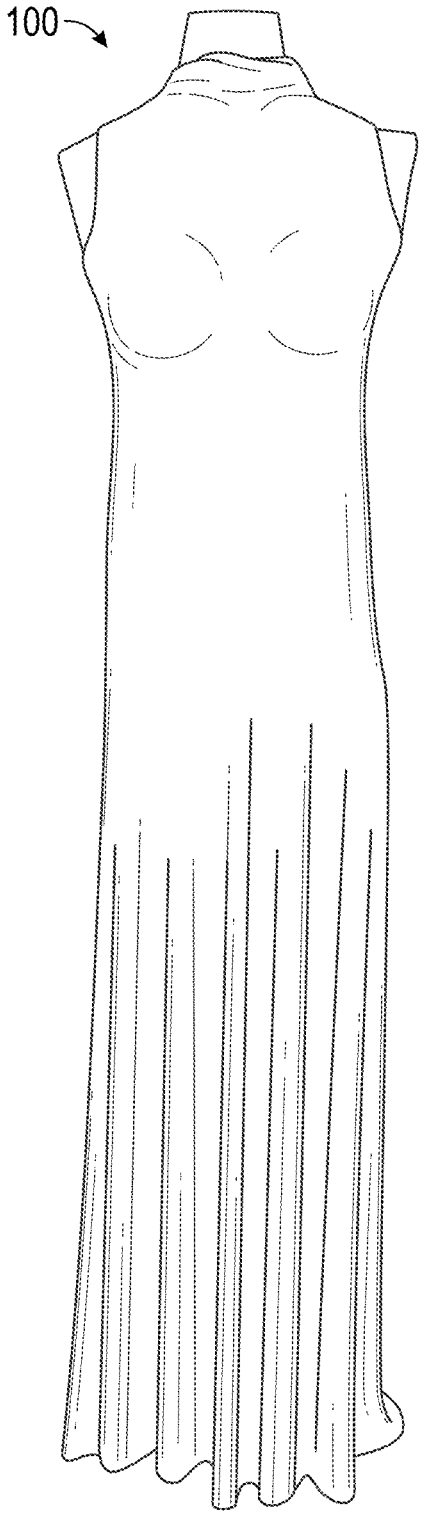
FIGS. 15C and 15D are front and rear views of the reconfigurable garment of FIG. 1 styled into a second look.
Figure 15D:
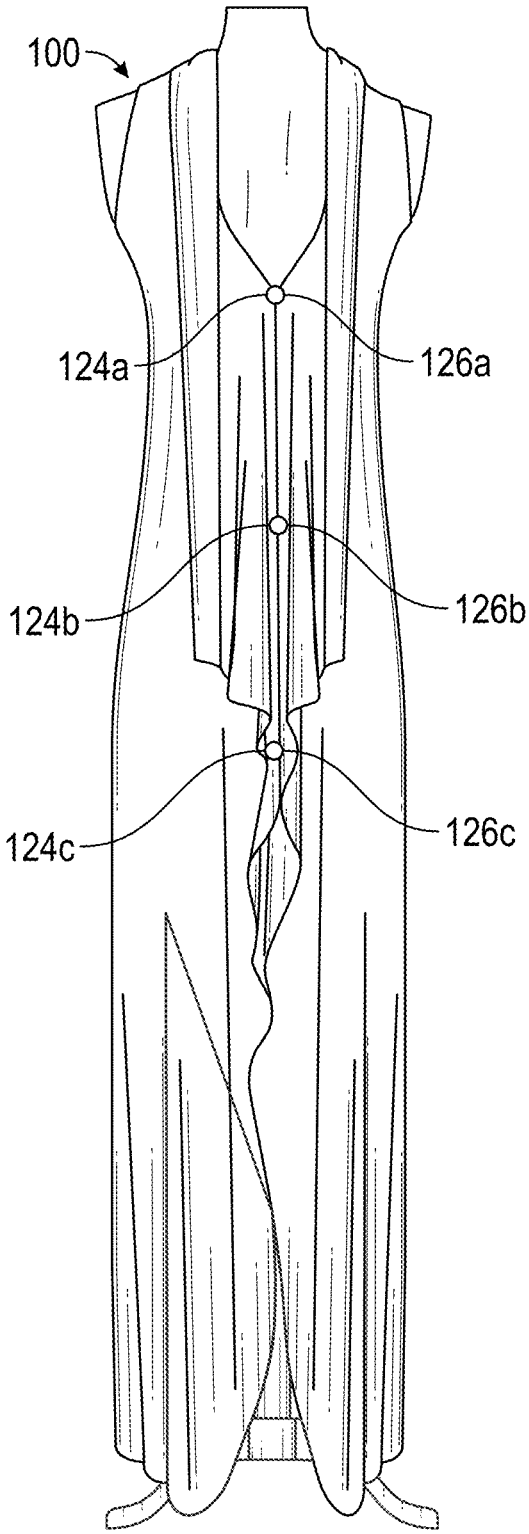
Figure 15E:
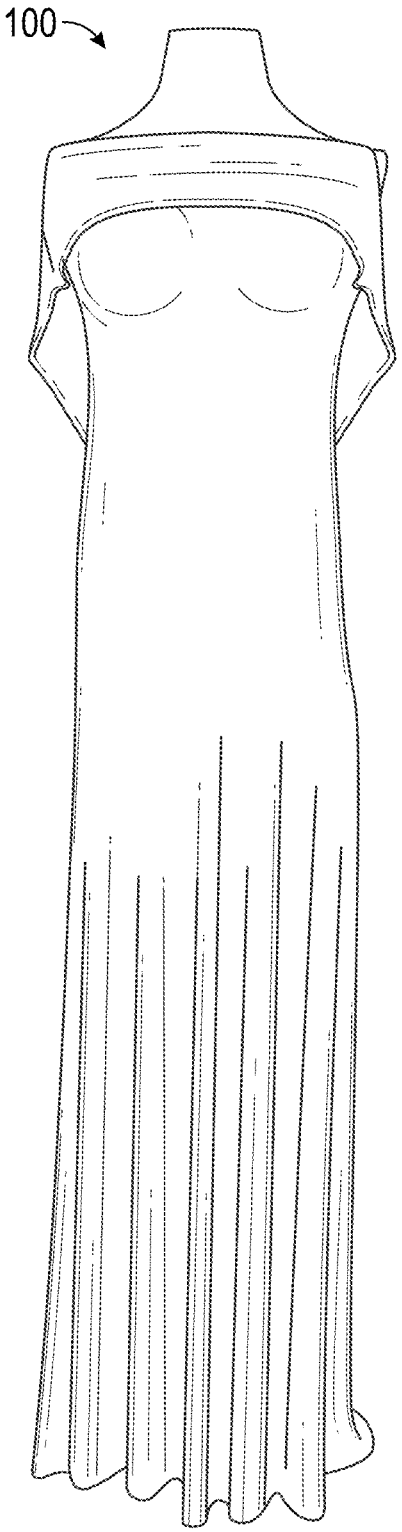
FIGS. 15E and 15F are front and rear views of the reconfigurable garment of FIG. 1 styled into a third look.
Figure 15F:
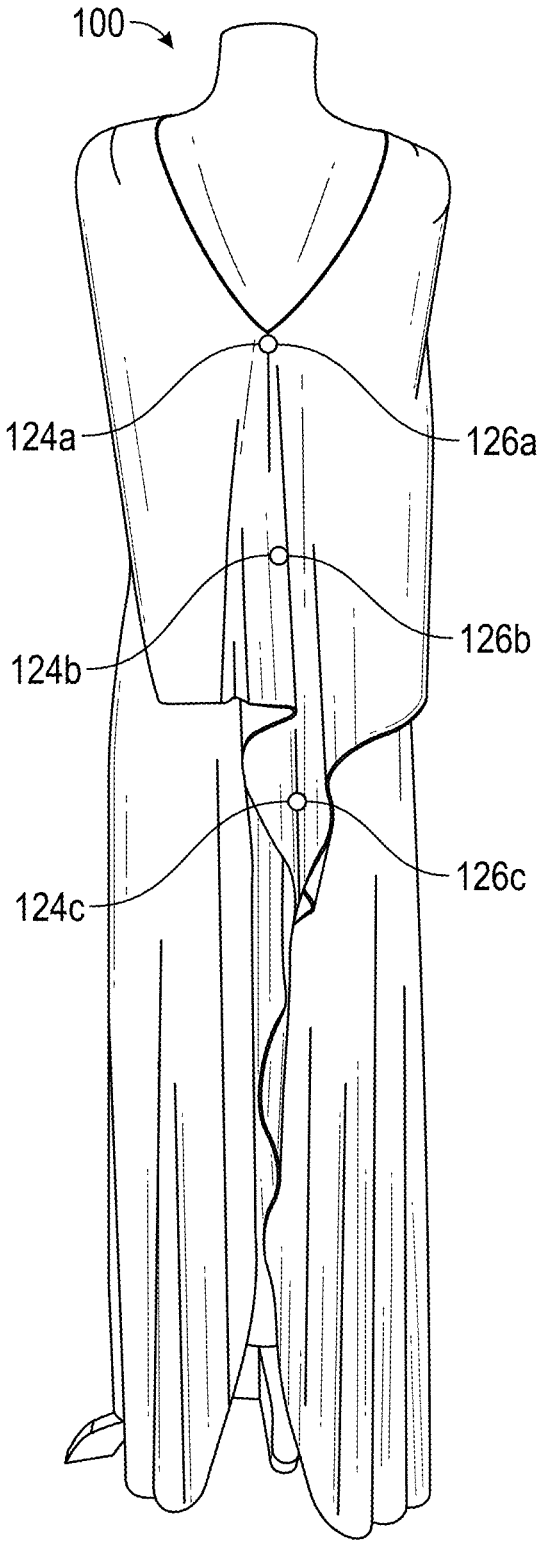
Figure 15G:
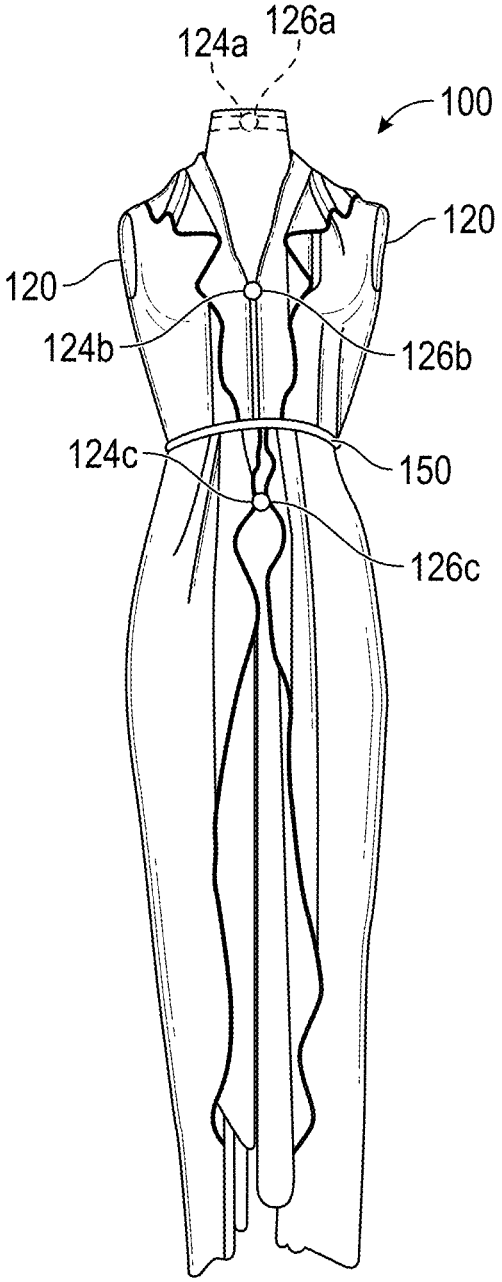
FIGS. 15G and 15H are front and rear views of the reconfigurable garment of FIG. 1 styled into a fourth look.
Figure 15H:
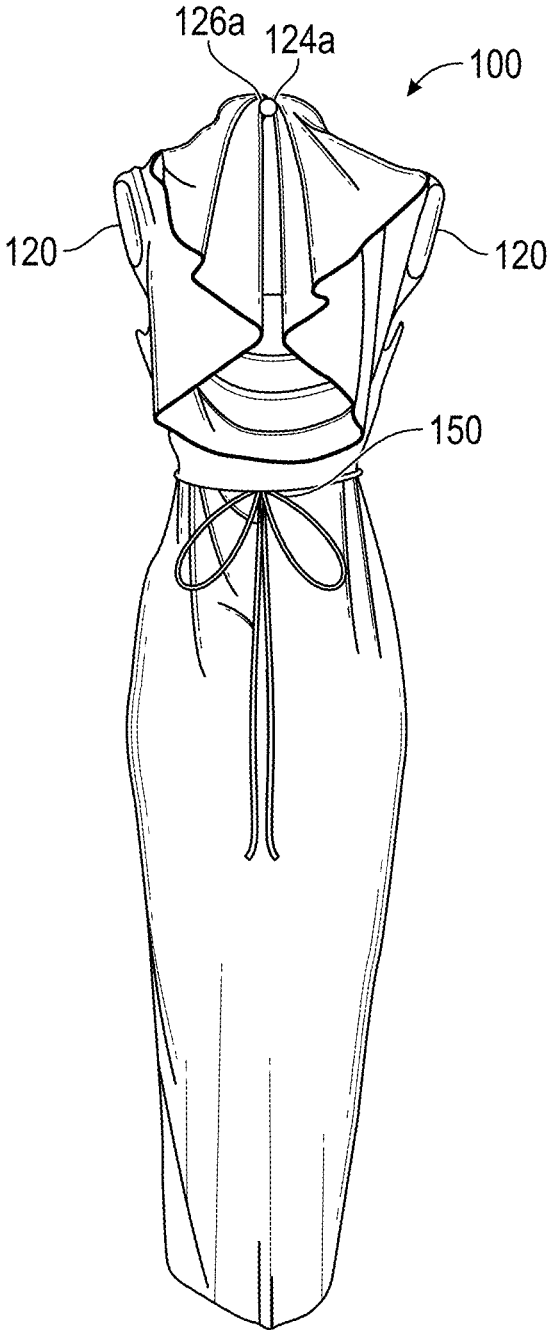
Figure 15I:
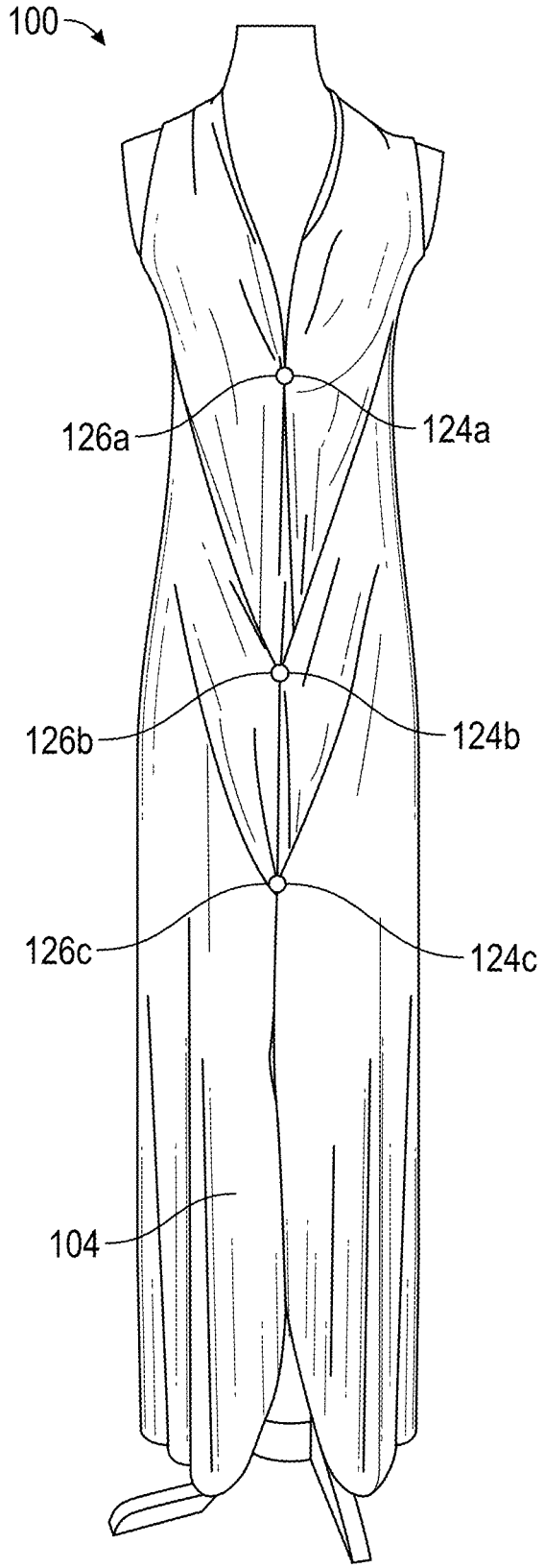
FIG. 15I is a front view of the reconfigurable garment of FIG. 1 styled into a fifth look.
Figure 15J:
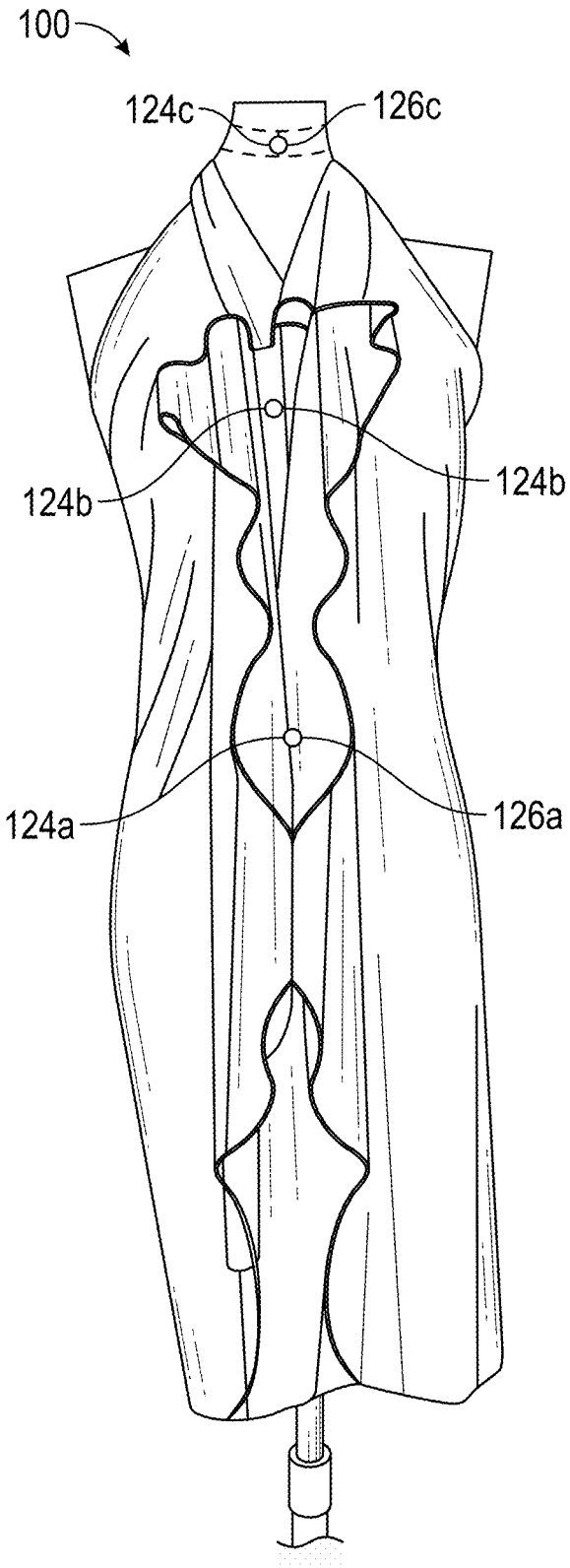
FIGS. 15J and 15K are front and rear views of the reconfigurable garment of FIG. 1 styled into a sixth look but having a circular fabric panel.
Figure 15K:
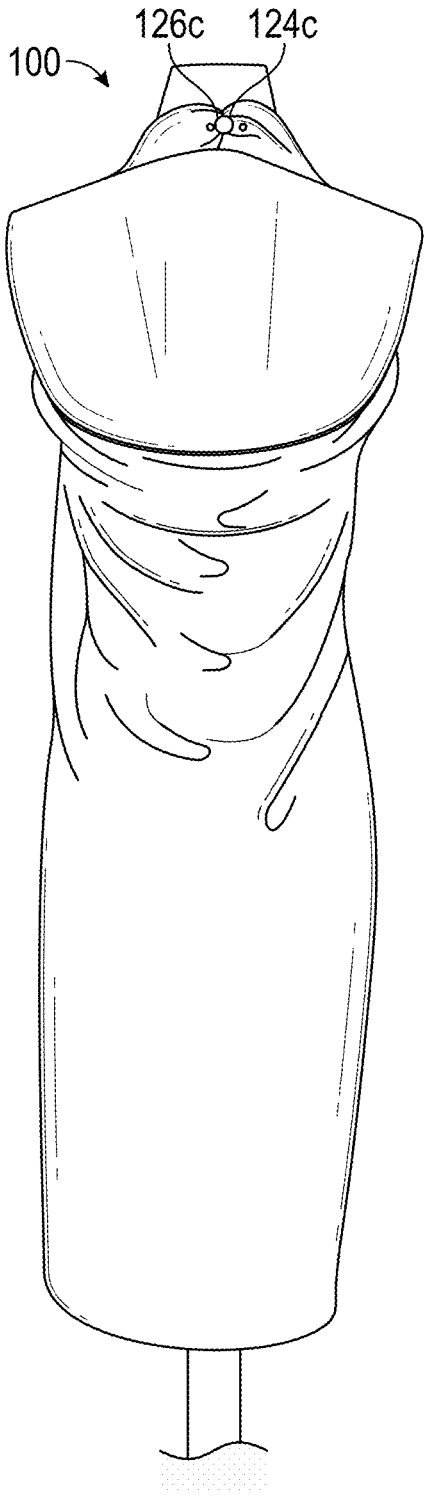
Figure 15L:
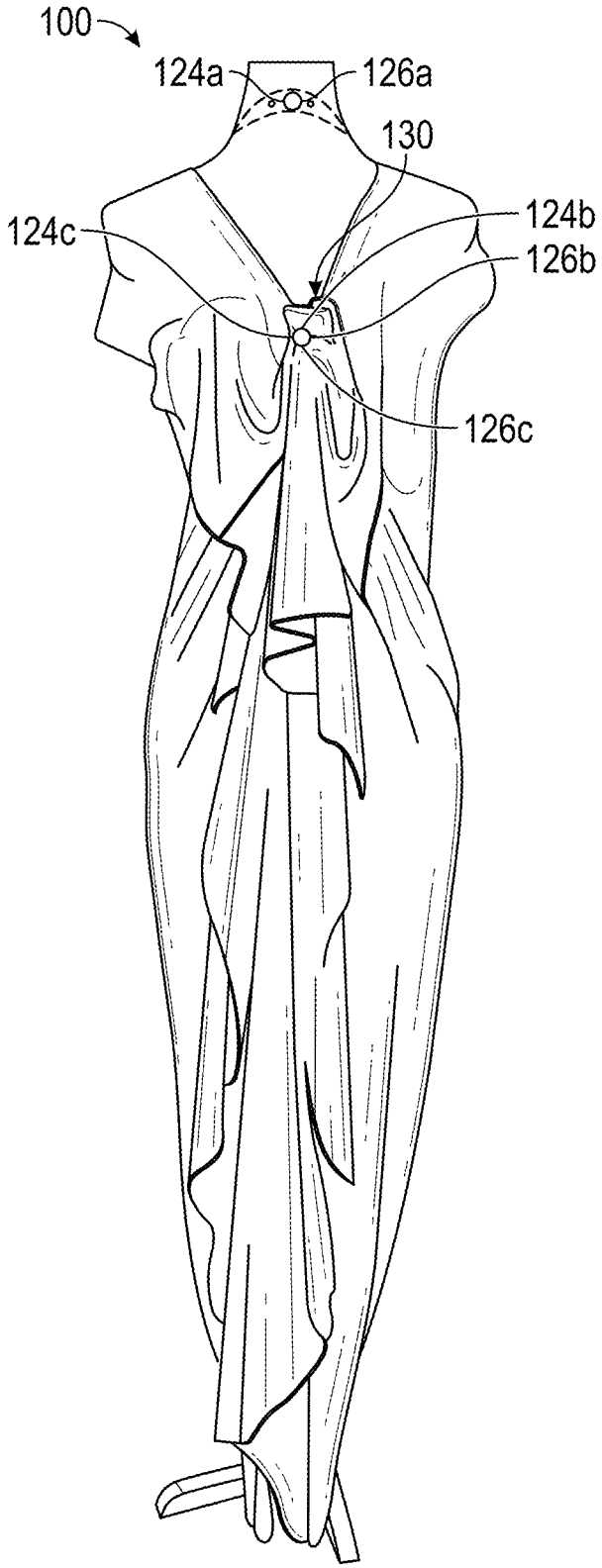
FIG. 15L is a front view of the reconfigurable garment of FIG. 1 styled into a seventh look.
Figure 15M:
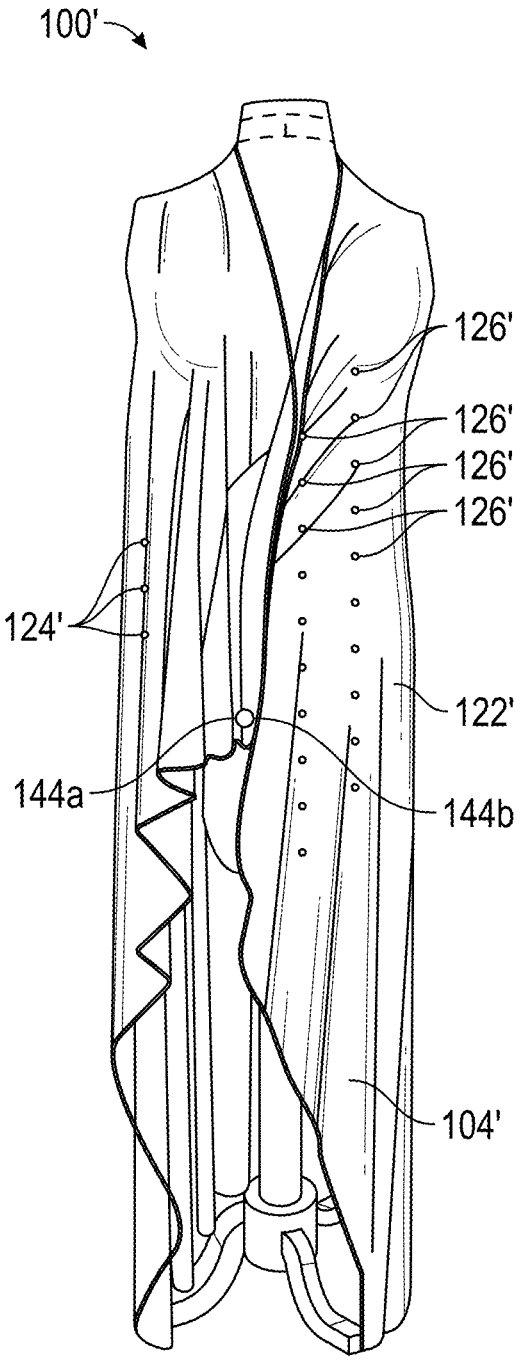
FIGS. 15M, 15N, and 15O are front views of a variation of the reconfigurable garment FIG. 1 in which up to 40 fastening elements have been included.
Figure 15N:
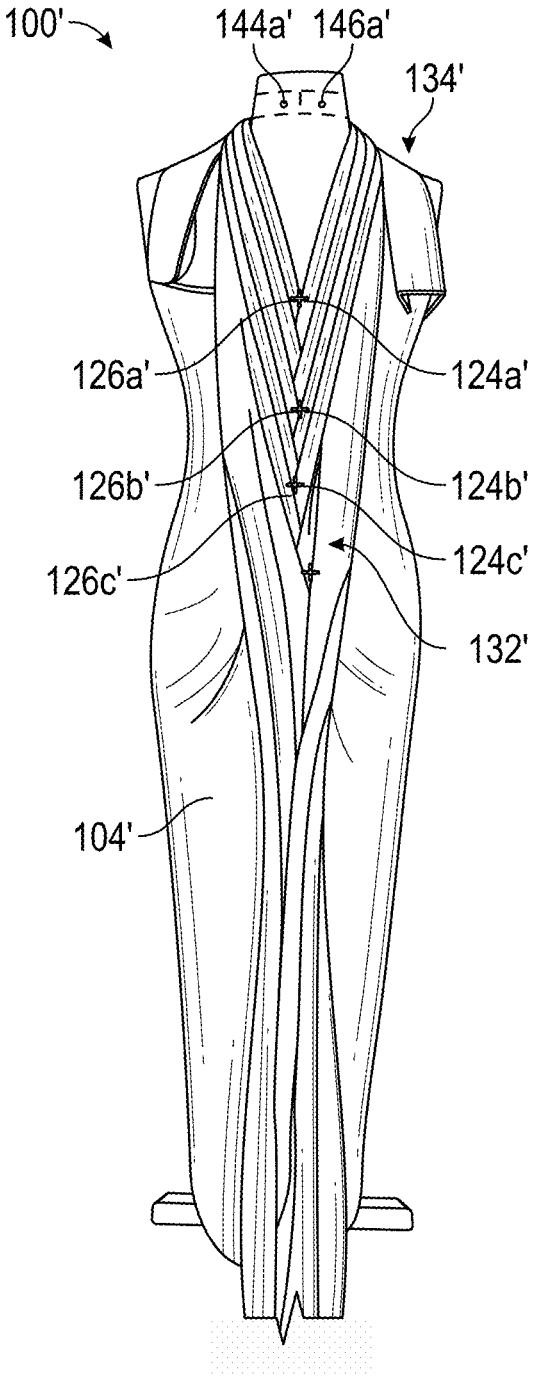
Figure 15O:
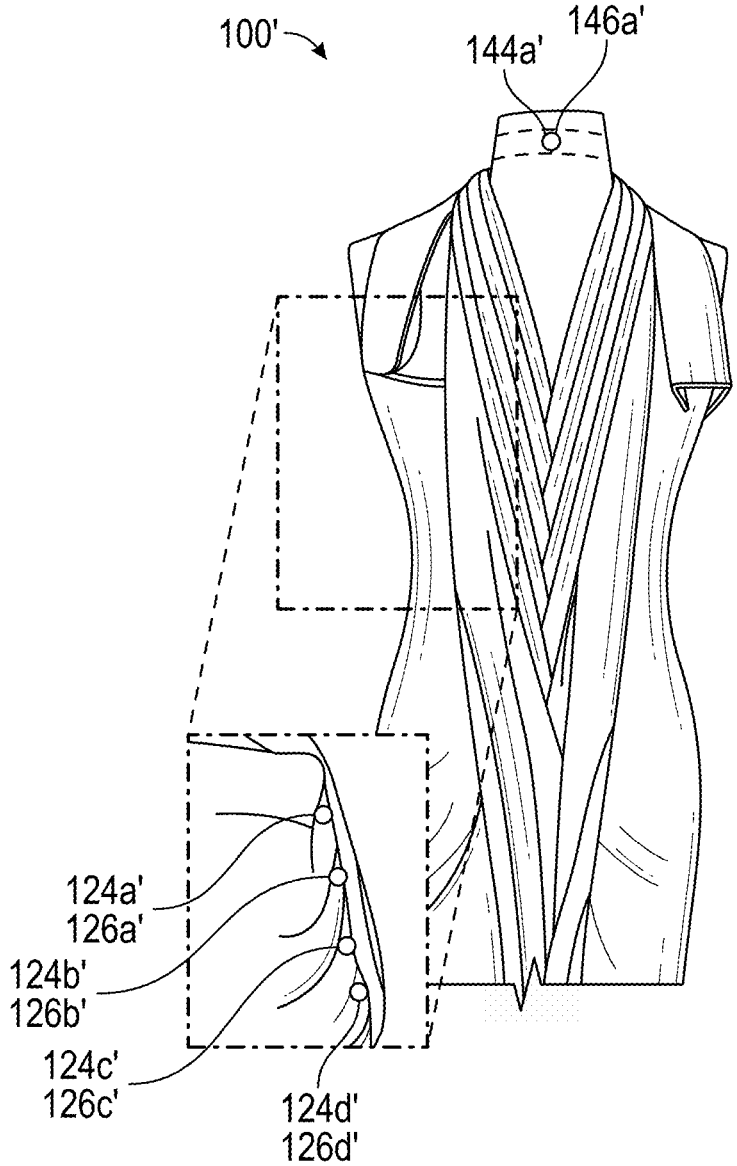
Figure 15P:
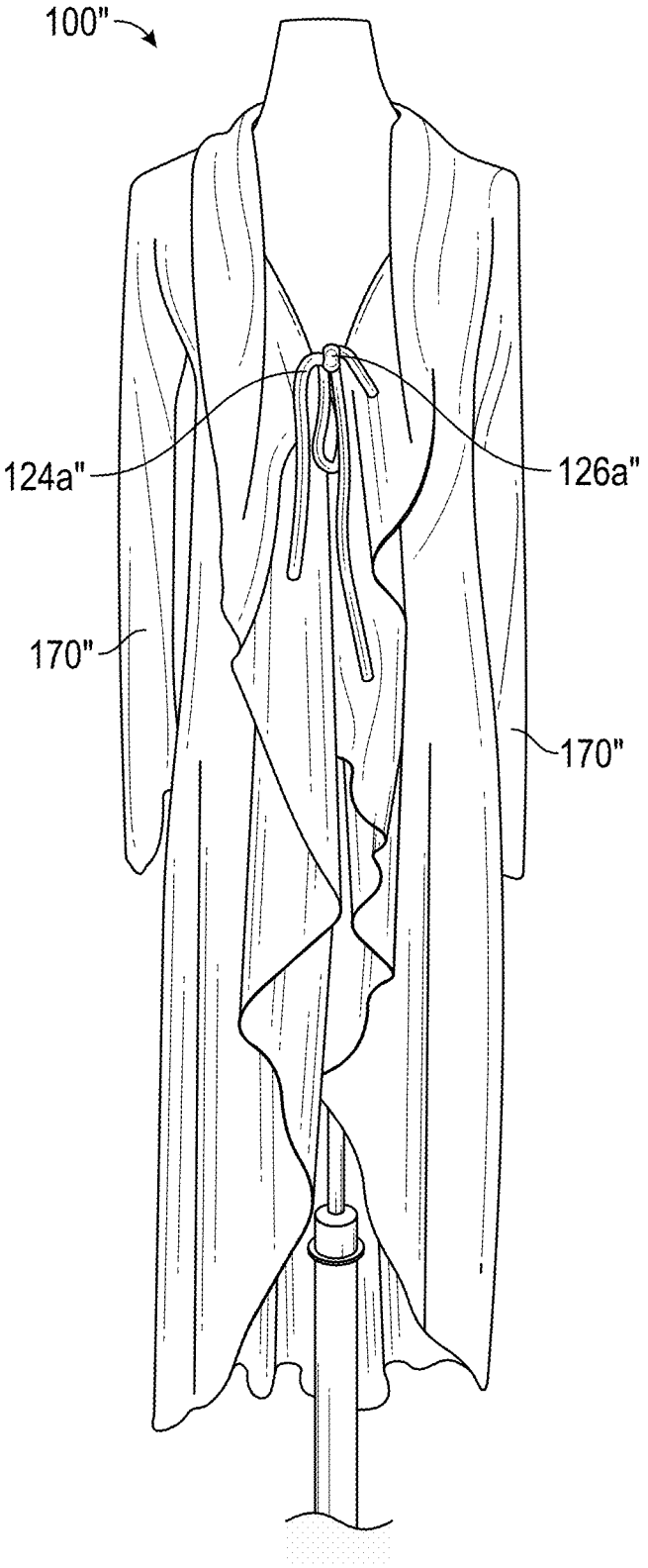
FIG. 15P and FIG. 15Q are views of the reconfigurable garment of FIG. 1 styled into an additional look using ties and extenders.
Figure 15Q:
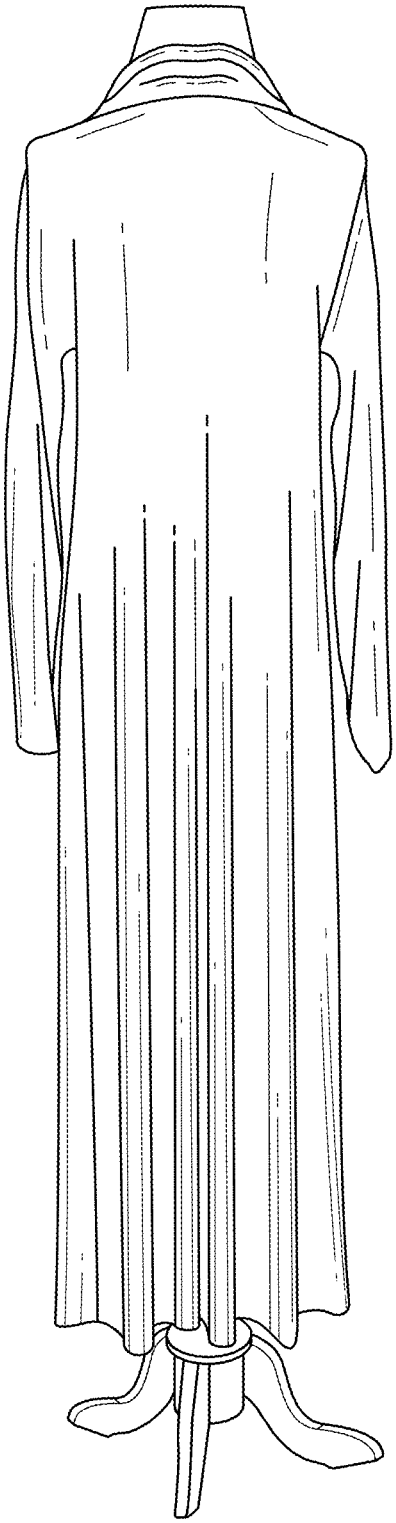
Figure 15R:
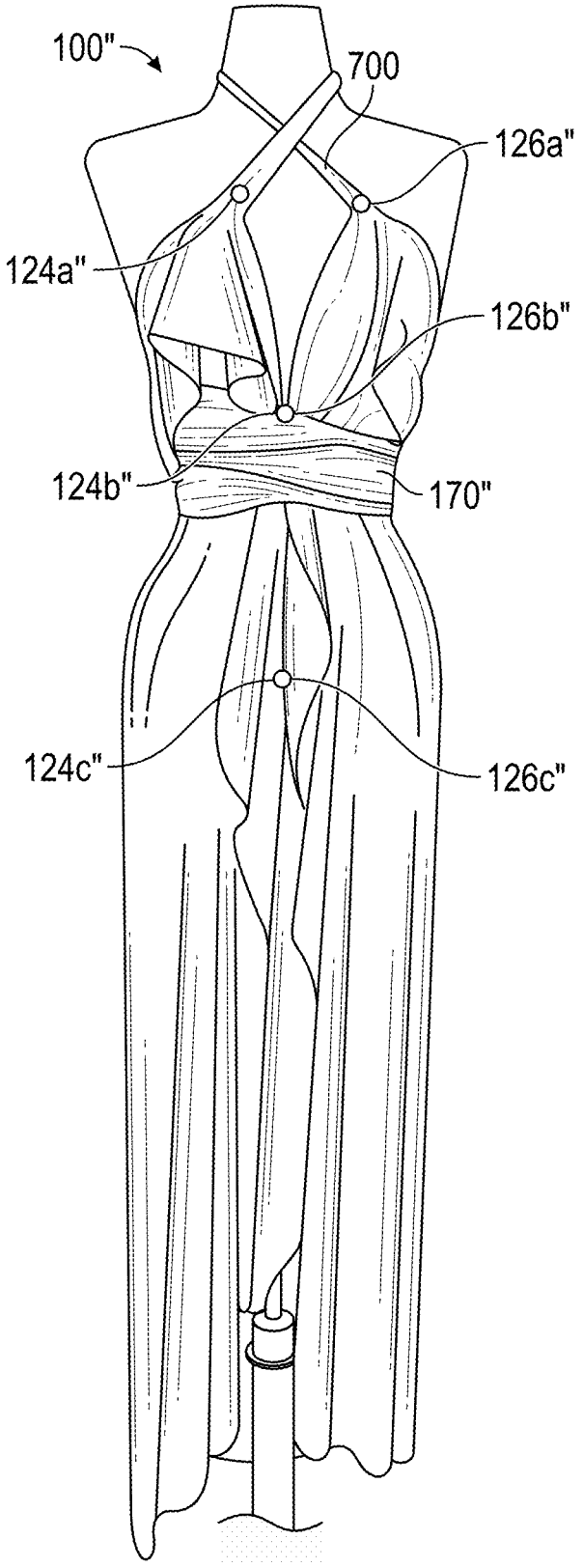
FIG. 15R is a front view of the reconfigurable garment of FIG. 1 styled into a further look using ties and extenders.
Figure 15S:
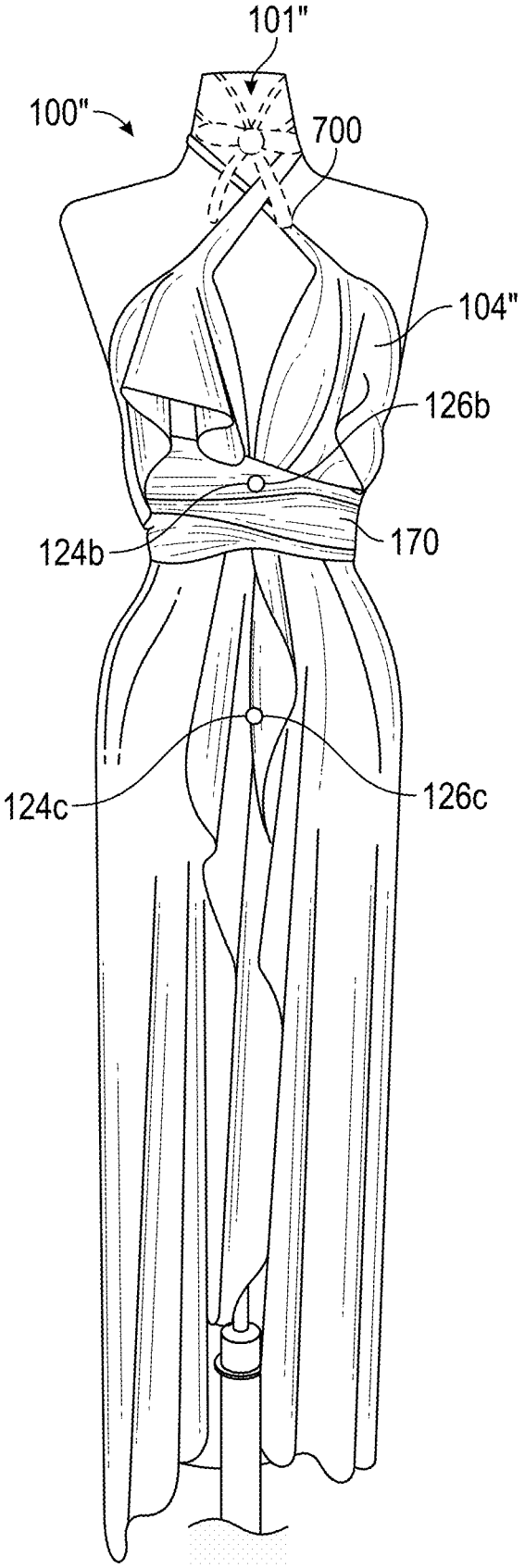
FIG. 15S is a front view of a variation of the reconfigurable garment of FIG. 1 where some of the fastening elements have been replaced by a sewn connection or integrally formed extenders.

With reference now to FIGS. 15A-15S, certain styles of the reconfigurable garment 100 of FIG. 1 will be described in more detail. While a number of different styles will be discussed, there are many more styles possible using the reconfigurable garment 100 of FIG. 1.

As shown in FIGS. 15A-15B, the reconfigurable garment 100 can comprise a V-neck with a ruffle extending down the middle of the front of the reconfigurable garment 100. To create the style of FIGS. 15A-15B, the wearer would put their arms through the openings 120, similar to putting on a vest. With the reconfigurable garment 100 draped onto the shoulders of the wearer, the wearer fastens the relevant fastening elements 124, 126 together. In the illustrated configuration, the upper fastening elements 124*a*, 126*a* are connected, the middle fastening elements 124*b*, 126*b* are connected, and lower fastening elements 124*c*, 126*c* are connected. These fastening elements combinations close the front of the reconfigurable garment 100. FIG. 15A is a front view and FIG. 15B is a rear view.

In FIGS. 15C-15D, the reconfigurable garment 100 of FIG. 1 has been styled to have a high-neck in the front with draping extending down the rear of the reconfigurable garment 100. To create the style of FIGS. 15C-15D, the wearer would put their arms through the openings 120, similar to putting on a smock. Similar to the arrangement of FIGS. 15A-15B, with the reconfigurable garment 100 draped on the shoulders of the wearer, the wearer fastens together the top fastening elements 124*a*, 126*a*, the middle fastening elements 124*b*, 126*b*, and the lower fastening elements 124*c*, 126*c*. FIG. 15C is a front view and FIG. 15D is a rear view.

The reconfigurable garment 100 of FIG. 1 is shown in FIGS. 15E-15F configured to have a short back cape appearance together with a more elongated neckline. To achieve this look, the wearer would don the reconfigurable garment 100 like a smock with the arms extending through the openings 120 and with the fabric panel extending across the front of the wearer's body. The upper fastening elements 124*a*, 126*a* are connected, the middle fastening elements 124*b*, 126*b* are connected, and the lower fastening elements 124*c*, 126*c* are connected. With the fastening elements 124, 126 connected, the excess fabric in the neck region of the wearer is turned over to cover an upper torso of the wearer. FIG. 15E is a front view and FIG. 15F is a rear view.

FIGS. 15G-15H illustrate the reconfigurable garment 100 of FIG. 1 styled with as little as one pair of fastening elements 124, 126 connected. In the arrangement of FIGS. 15G-15H, the wearer places the fabric against their back. The fastening element 124*a* is connected to the fastening element 126*a*. After the fastening elements 124*a*, 126*a* are connected, the loop formed by the fabric is placed around the neck, the arms of the wearer are inserted into the openings 120 like a vest, and the excess fabric is pulled over the shoulders. This style of the garment provides a draped V-neck in the upper portion of the front of the torso of the wearer. However, the other fastening elements 124*b*, 126*b*, 124*c*, 126*c*, can be fastened down the front if desired. The illustrated style also incorporates a waist-tie 150 to finish the look. FIG. 15G is a front view and FIG. 15H is a rear view.

With reference to FIG. 15I, a strikingly different style or look can be obtained using the fabric panel 104 of FIG. 1 by inverting the fabric panel 104 relative to the wearer. In some such configurations, the fabric panel 104 of FIG. 1 may be reversed by the user to create a number of different styles that conceal the draping by placing the draping between the reconfigurable garment 100 and the wearer. In the style of FIG. 15I, the draping is positioned between the fastening elements 124, 126 and the wearer. The upper first fastening element 124*a* is connected to the upper second fastening element 126*a*. The middle first fastening element 126*a* is connected to the middle second fastening element 126*b*. The lower first fastening element 124*c* is connected to the lower second fastening element 126*c*. The illustrated style still features a V-neck dress, similar to the style shown in FIGS. 15A-15B.

FIGS. 15J-15K illustrate a variation of the reconfigurable garment 100 of FIG. 1 in yet an additional style. The reconfigurable garment 100 of FIG. 1 has been modified to have a panel shape that is circular instead of a parallelogram but with the remaining elements remaining the same. As illustrated, the fastening elements 124, 126 can be used by the wearer to provide a shorter garment as well. For example, the lower first and second fastening elements 124*c*, 126*c* can be connected and the lower loop created by the fastening elements 124*c*, 126*c* and the fabric panel 104 can be passed over the head and around the back of the neck of the wearer. The other first and second fastening elements 124*a*, 124*b*, 126*a*, 126*b* can be optionally fastened down the front and the material draped downward from the neckline as desired.

FIG. 15L illustrates the reconfigurable garment 100 of FIG. 1 in a further style. Rather than a connection of two sets of fastening elements 124*b*, 126*b* and 124*c*, 126*c*, the fastening elements 124*b*, 126*c* can be connected over top of fastening elements 124*c*, 126*b* such that a knotted effect 130 can be created. In other words, the fastening elements 124*b*, 126*c* can be connected and then the fabric panel 104 can be wrapped around the location of the fastening elements 124*b*, 126*c* before connecting the fastening elements 124*c*, 126*b*. Other combinations of fastening elements also can be used.

A modified version of the reconfigurable garment 100 is shown in FIGS. 15M, 15N, and 15O. The modified reconfigurable garment 100' can include significantly more fastening elements than the reconfigurable garment 100 shown in FIG. 1. For example, as shown in FIG. 15M, in some configurations, the modified reconfigurable garment 100' can include up to 40 fastening elements 124', 126'. In the configuration illustrated in FIG. 15M, the modified reconfigurable garment 100' includes two rows of each of the fastening elements 124', 126' on each side of the fastener-free region 122', which spans a rear portion of the reconfigurable garment 100'. In the illustrated configuration, each of the illustrated rows of fastening elements 124', 126' includes 10 fastening elements, but the number can be higher or lower and each row can have the same number as the other rows or the rows can have differing numbers from each other. The rows of fastening elements 124' 126' on each side of the fastener-free region 122' can be parallel, as shown, or can be otherwise configured (e.g., angled relative to each other, hour-glass shaped, etc.). As shown, the fastening elements 124' 126' can be secured together to provide a forward-facing drape 132' and a small shoulder drape 134'. For example, the inner rows (i.e., the two rows furthest from the fastener-free region 122' of the fastening elements 124', 126' can be snapped together, and the outer rows (i.e., the rows closest to the fastener-free region 122') of the fastening elements 124', 126' can be secured together. The enlarged side partial view in the inlay of FIG. 15O illustrates the connections of the fastening elements 124*a*', 126*a*', and the connection of the fastening elements 124*b*', 126*b*', and the connection of the fastening elements 124*c*', 126*c*', and the connection of the fastening elements 124*d*', 126*d*' to create the unique forward-facing drape 132'. In the illustrated configuration, fastening elements 144*a*', 146*a*' (similar to, e.g., the fastening elements 144*a*, 146*a* in FIG. 1) in the corners of the fabric panel 104' can be joined and positioned behind the neck of the wearer.

With reference to FIGS. 15P and 15Q, a reconfigurable garment 100" is another modification of the reconfigurable garment 100, which includes different fastening elements. For example, the reconfigurable garment 100" is shown using fastening elements 124*a*", 126*a*" in the form of fabric ties instead of, or in addition to, the snap elements described above in reference to FIG. 1. While only one set of fastening elements 124*a*", 126*a*" in the form of fabric ties is shown, additional sets of fabric ties can be used. In the illustrated configuration of FIG. 15P, at least three sets of fabric ties are provided. FIG. 15P also illustrates the use of sleeves 170".

FIG. 15R includes, in addition to the fastening elements 124", 126" described above with respect to FIG. 15P, an extender 700 (which will be discussed below in greater detail) that joins with one or more of the fastening elements 124", 126" described above. The extender 700 facilitates additional looks when joining with the fastening elements 124", 126". In the illustrated configuration of FIG. 15R, the style can be completed by using the sleeves 170" to define a waist tie or the like. In some configurations, the sleeves 170" can be omitted and the waistline can be defined by a waist tie, belt, or the like. As has been described, as few as two sets of two fastening elements 124", 126" or, in the illustrated configuration, two sets of three or more fastening elements 124", 126", can be used to configure more than three different styles. Moreover, in the reconfigurable garment 100" of FIG. 15R, different fastening elements combinations can be used to reconfigure the reconfigurable garment 100" into different styles.

FIG. 15S illustrates the reconfigurable garment 100" of FIG. 15R with the extenders 700 integrally formed with, or sewn to, the fabric panel 104". Additionally, rather than having a single extender 700, the reconfigurable garment 100" of FIG. 15S has two extenders 700 or straps that can be tied in the back at a connection location 101". To some extent, the two extenders 700 could alternatively be considered fastening elements in the form of ties.

Figure 16A:
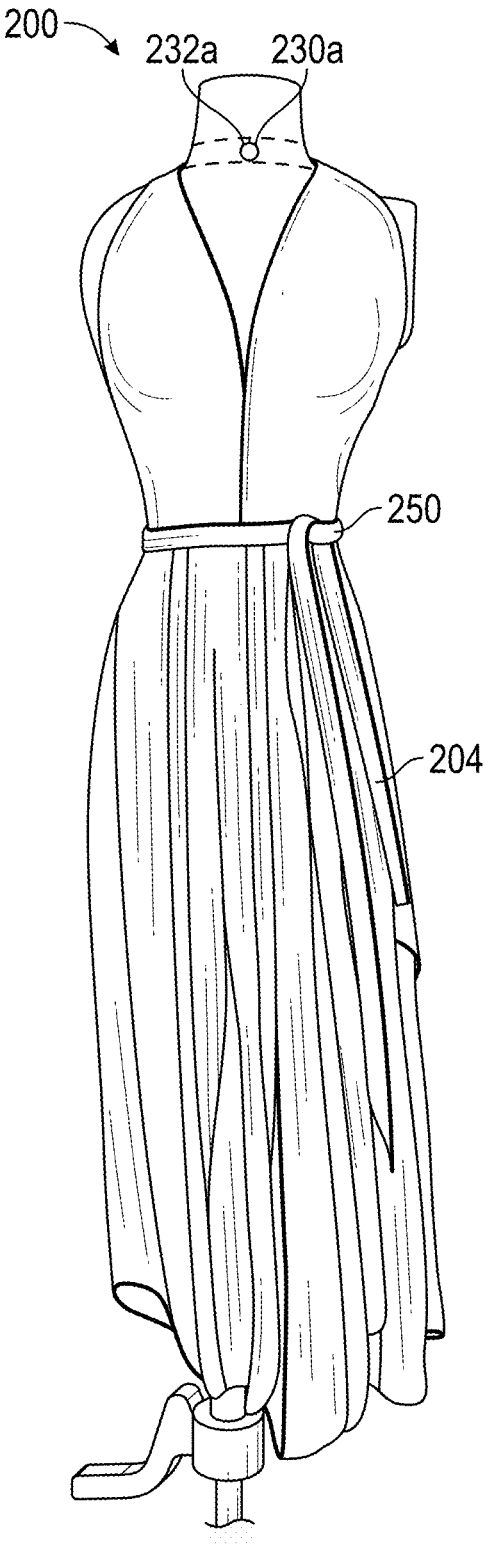
FIGS. 16A and 16B are front and rear views of the reconfigurable garment of FIG. 2 styled into a first look.
Figure 16B:
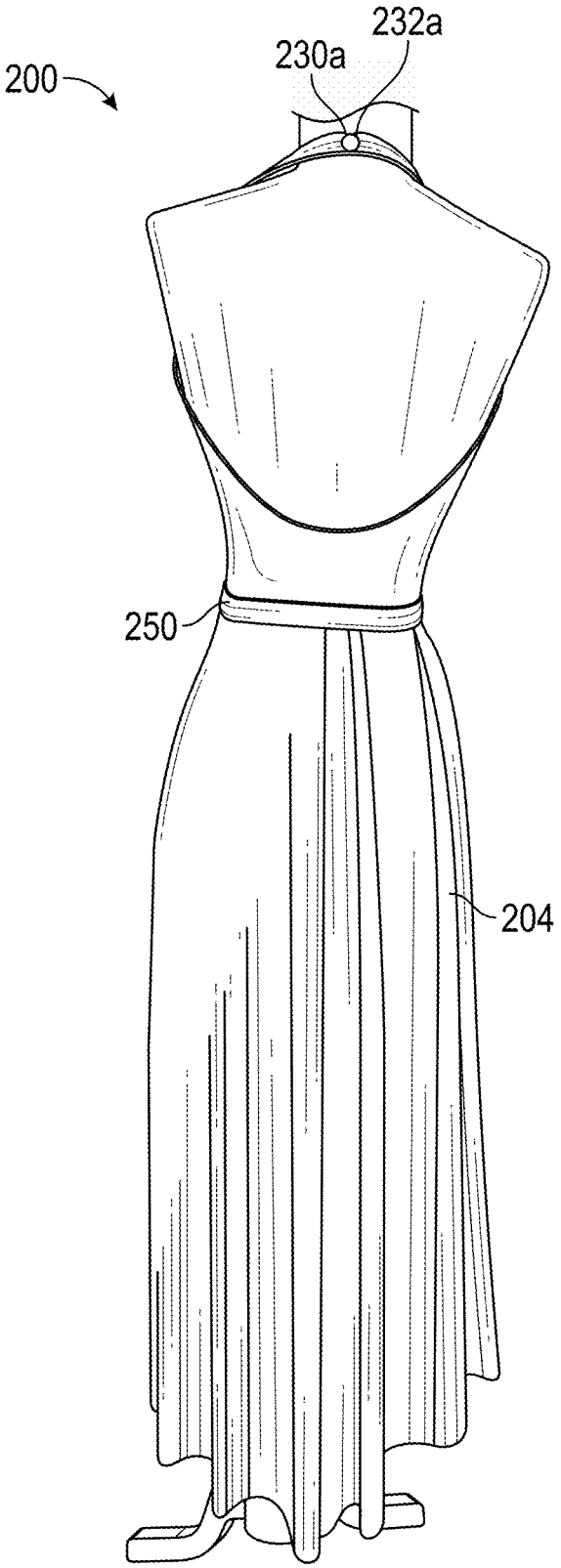

With reference now to FIGS. 16A-16B, the reconfigurable garment 200 of FIG. 2 is illustrated. The reconfigurable garment 200 has been configured into a first style. In this style, the fabric panel 204 is placed against the back of the wearer while fastening elements 230*a*, 232*a* are held in the hands of the wearer. The fastening elements 230*a*, 232*a* are brought underneath the armpits and secured behind a neck of the wearer to create a halter style look. The style can be finished with a waist tie 250. In this style, only one set of the fastening elements is used to secure the fabric panel in place and the waistline is defined by the waist tie 250. The style features a clean V-neck appearance and an upper back region that is not covered by the fabric panel 204.

Figure 16C:
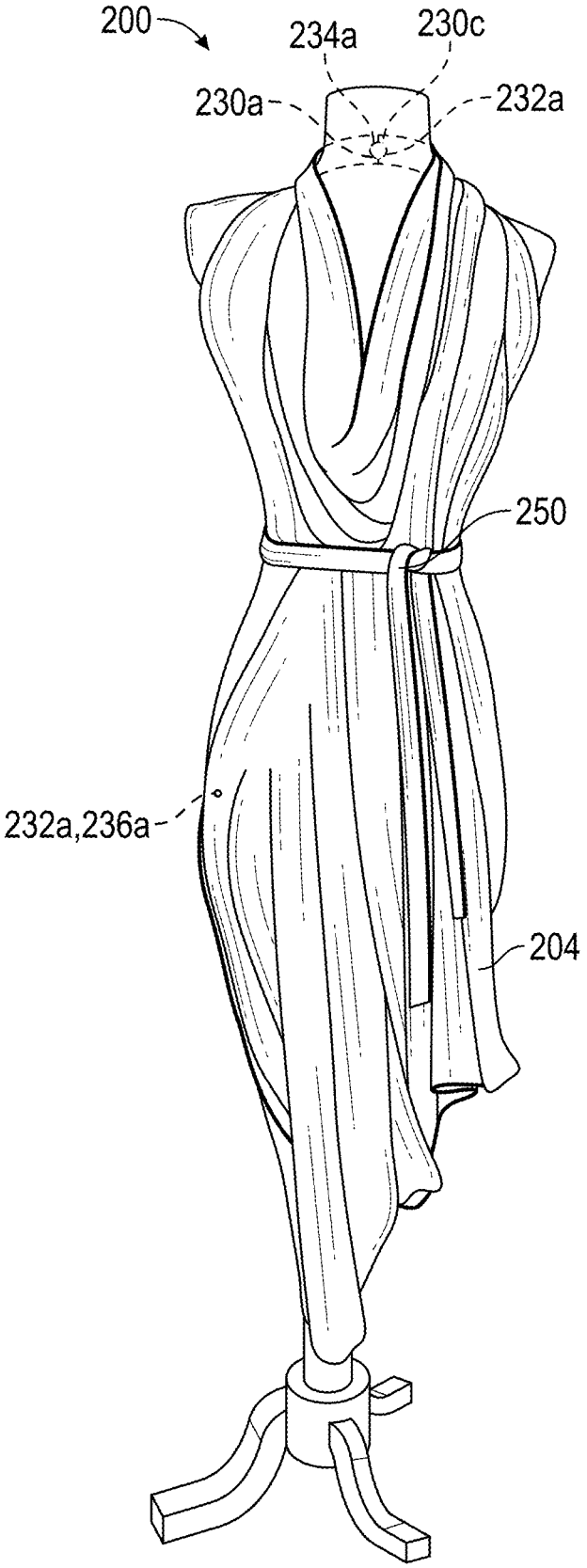
FIG. 16C is a front view of the reconfigurable garment of FIG. 2 styled into a second look.

The reconfigurable garment 200 of FIG. 2 is shown in FIG. 16C in another style. In this style, the fabric panel 204 is placed against the back of the wearer. As with the style shown in FIG. 16A-16B, the fastening elements 230*a*, 232*a* are brought underneath the armpits and secured behind the neck of the wearer to create a halter style look. The fastening elements along one side, e.g., fastening elements 230*c*, 234*a*, are joined together to create a loop. The loop, when created by connecting the fastening elements 230*c*, 234*a*, can be formed towards the body of the wearer. The wearer steps into the loop with both feet. The wearer can create a second loop on the opposite side of the wearer's body by connecting the fastening elements along the other side, e.g., fastening elements 232*c*, 236*a*. Again, the loop formed should be inwards towards the body of the wearer and the wearer can place this second loop over the neck. As with the style shown in FIG. 16A-16B, the style that is shown in FIG. 16C can be finished with a waist tie 250.

Figure 16D:
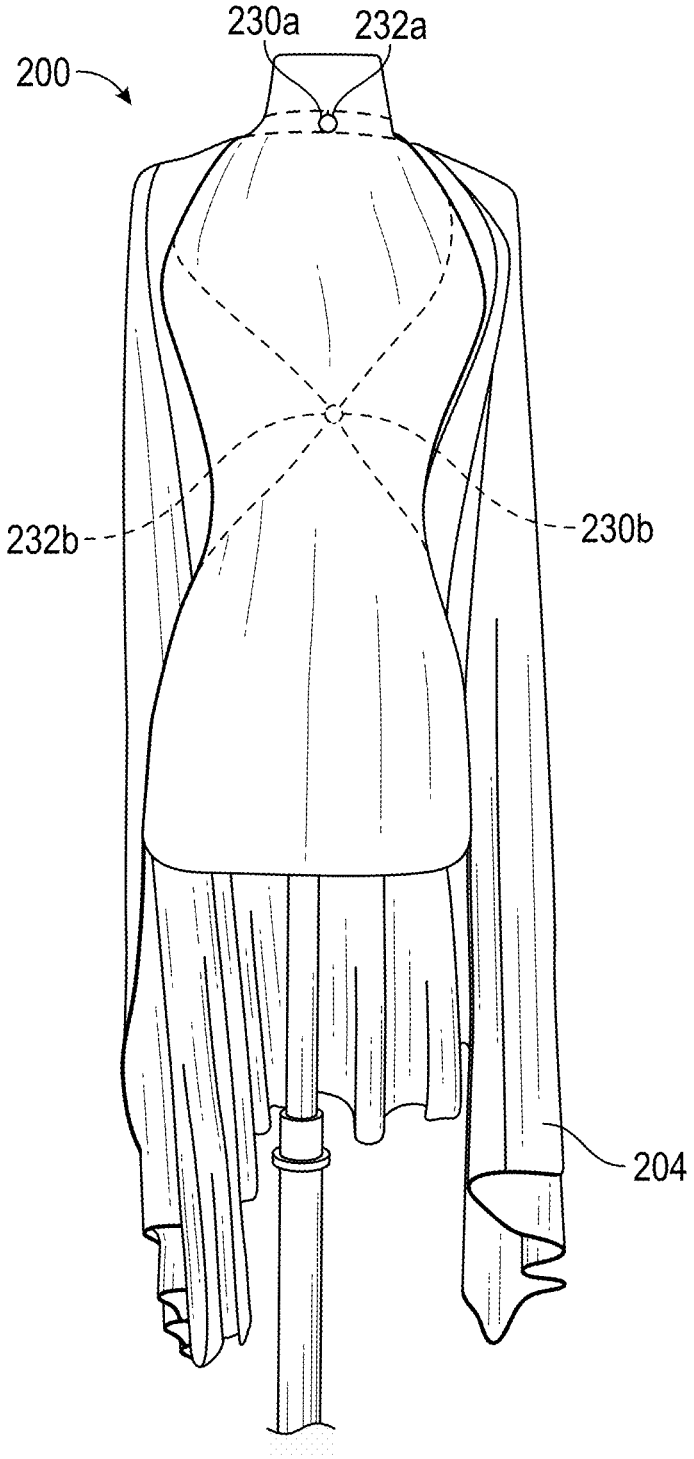
FIG. 16D is a front view of the reconfigurable garment of FIG. 2 styled into a third look.

In FIG. 16D, the reconfigurable garment 200 is shown being styled as a cape. In this style, the fabric panel 204 is held by the wearer near the fastening elements 230*a*, 232*a* behind the back of the wearer and over the shoulders of the wearer. The fastening elements 230*a*, 232*a* can be secured together behind the back of the wearer and with the fabric panel 204 extending under the armpits of the wearer. In this style, a cape appearance is provided without requiring the reconfigurable garment 200 to be connected in the front of the body of the wearer.

Figure 16E:
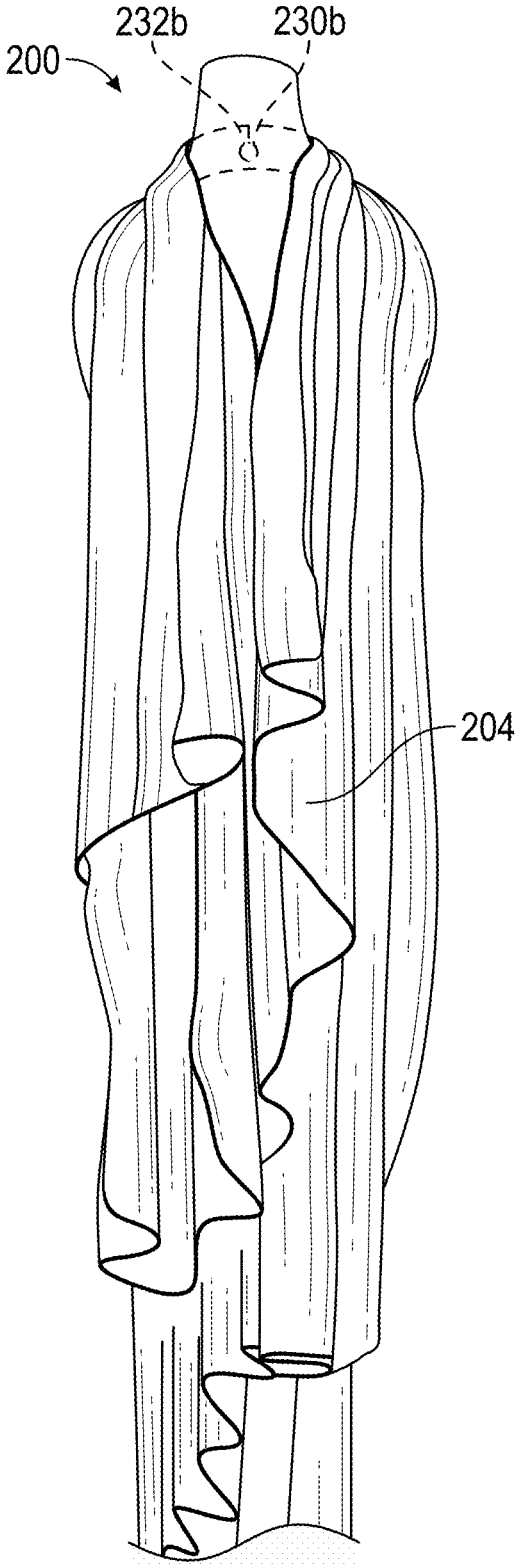
FIGS. 16E-16J are views of additional looks possible with the reconfigurable garment of FIG. 2.
Figure 16F:
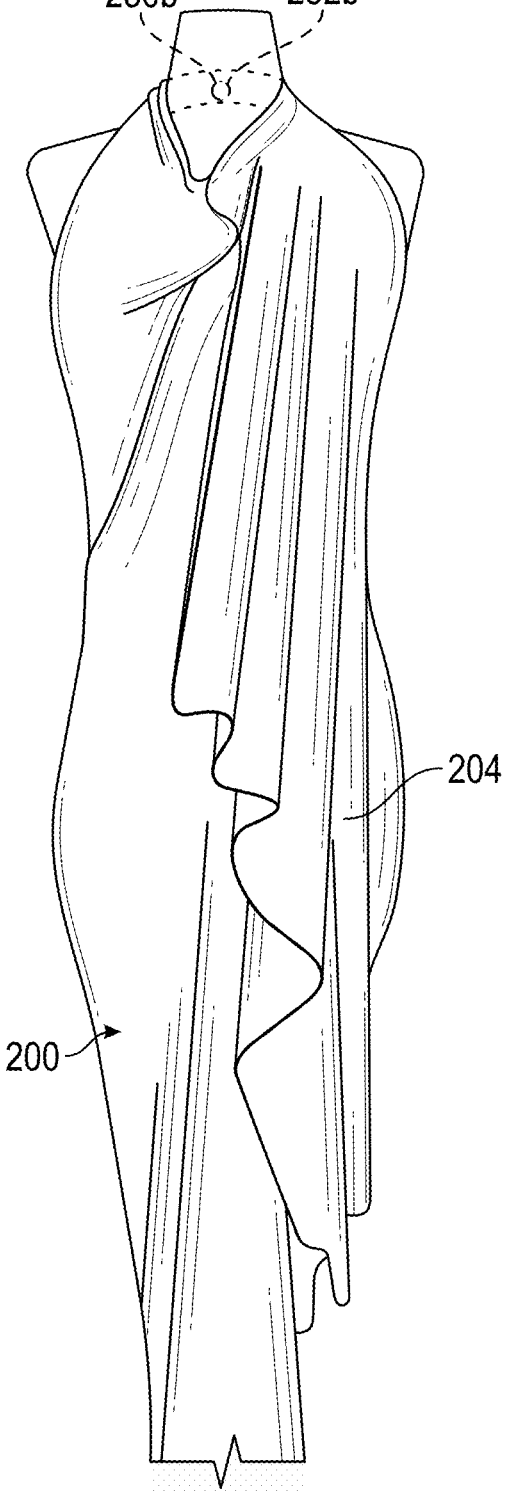
Figure 16G:
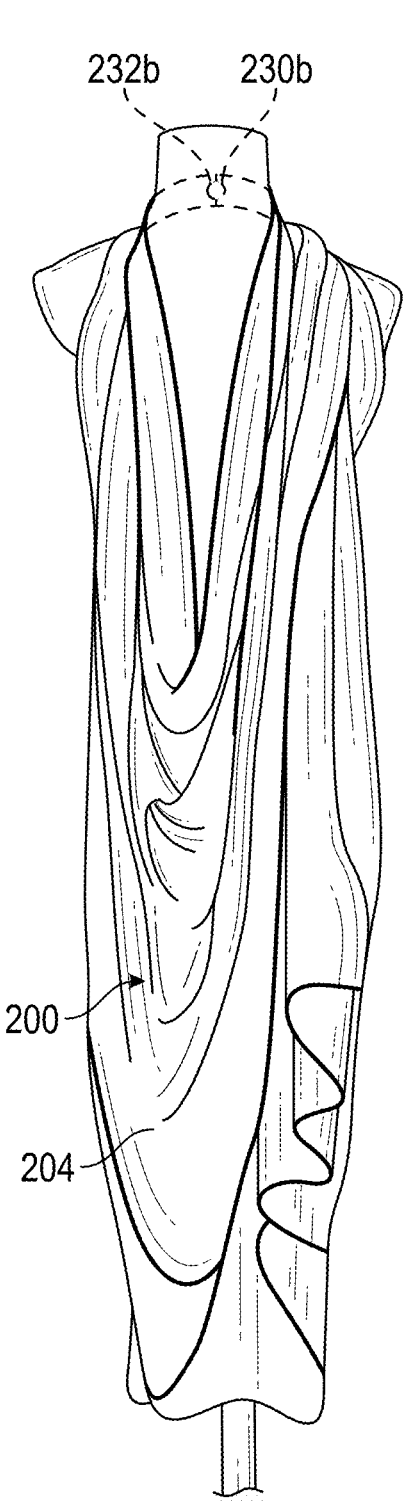

Turning now to FIG. 16E, the wearer can change the look of the reconfigurable garment 200 by securing the fastening element 230*b* and the fastening element 232*b* around their neck. Alternatively, the wearer can connect the fastening element 230*b* and the fastening element 232*b* in a crisscross shape around their neck to create the look seen in FIG. 16F. A looser halter fit can be achieved, as shown in FIG. 16G, by connecting the fastening element 230*b* and the fastening element 232*b*. A tighter halter fit can be provided by securing the fastening element 230*a* to the fastening element 232*a*.

Figure 16H:
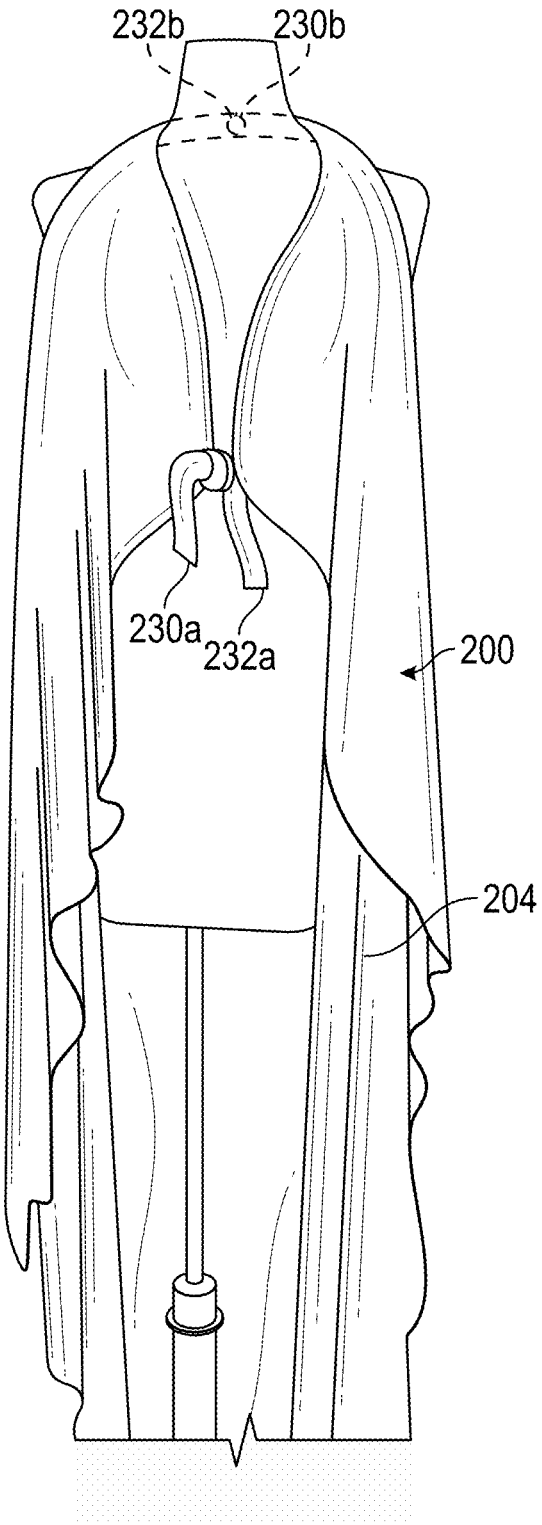
Figure 16I:
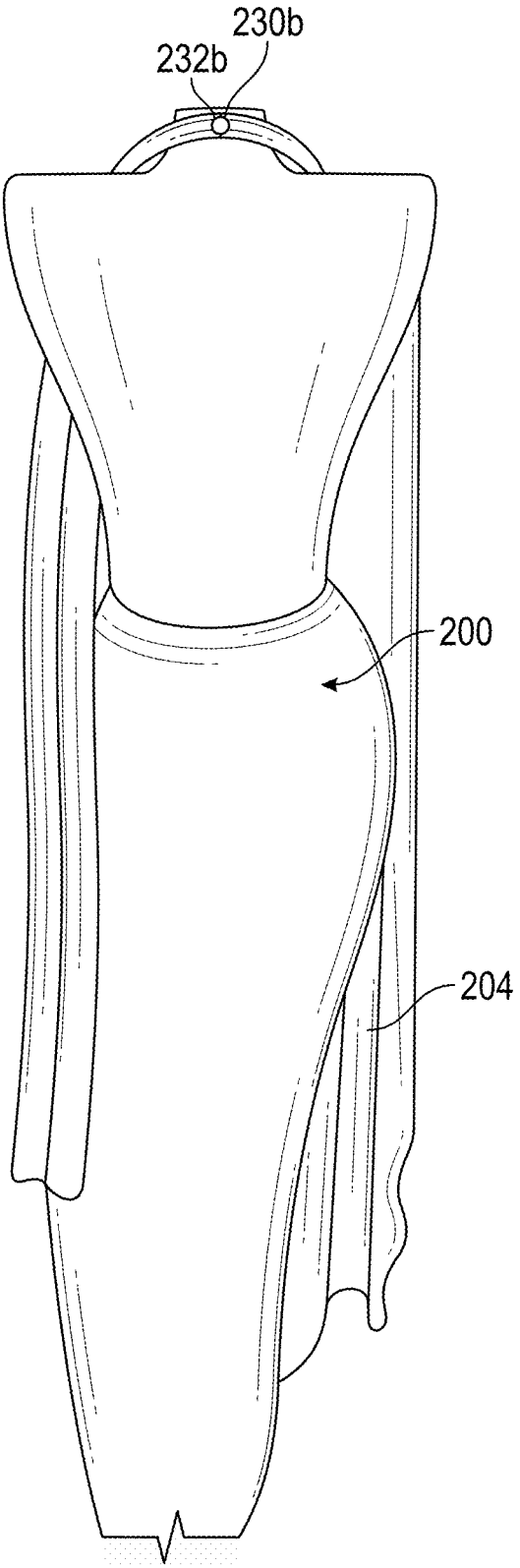
Figure 16J:
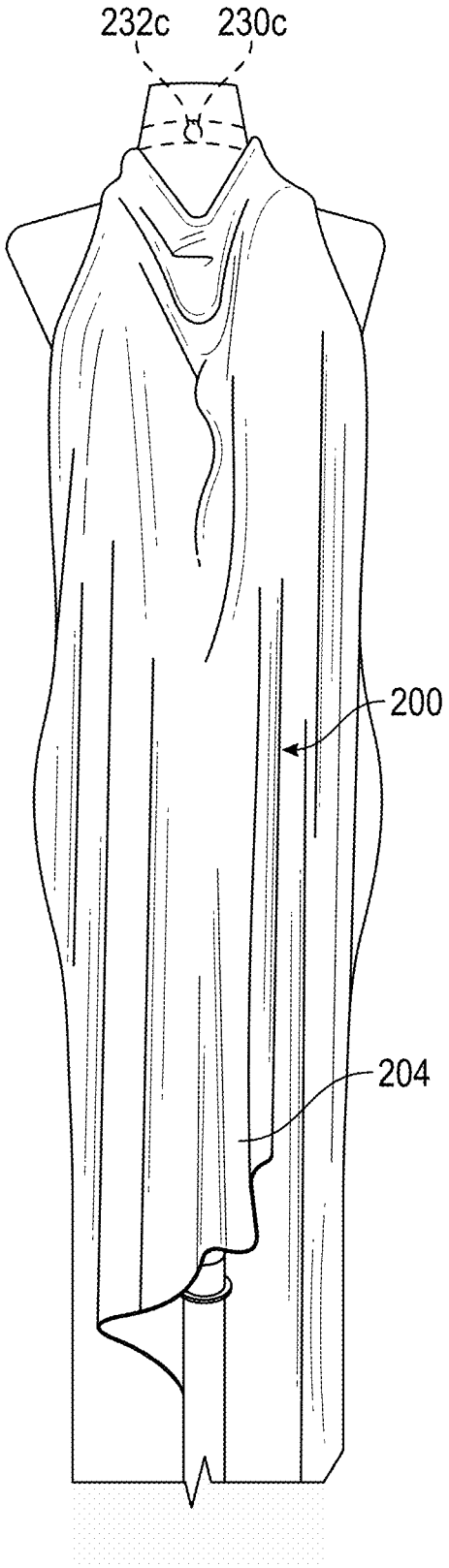

Many other configurations are possible with the user connecting the fastening element 230*b* and the fastening element 232*b*. For example, as seen in FIG. 16H, the fastening element 230*b* and the fastening element 232*b* are connected and then the fastening element 230*a* and the fastening element 232*a* are connected around a bustline to create a bikini top-like effect, which is suitable as beachwear. This design can be taken one step further by continuing to fasten more fastening elements to hide the bust from view by crisscross fastening the fastening element 230*c* with the fastening element 232*c* around the neck to create the style shown in FIG. 16J.

Figure 16K:
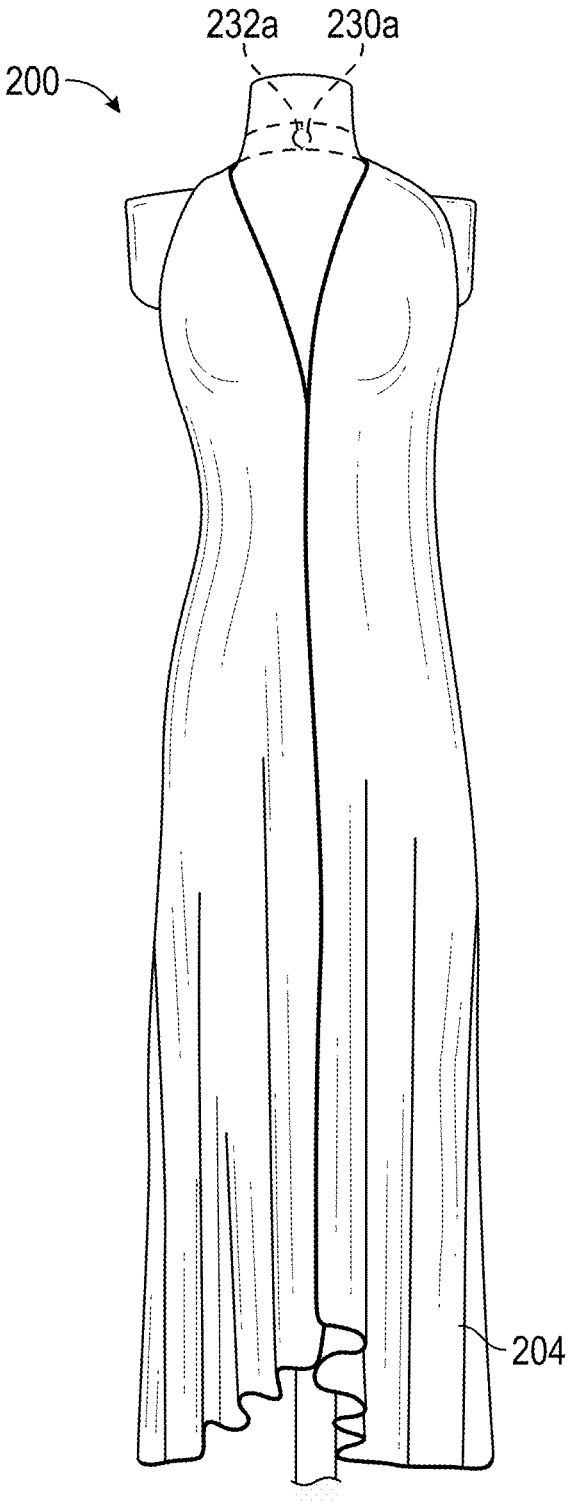
FIG. 16K and FIG. 16L are views of yet additional looks possible with the reconfigurable garment of FIG. 2.
Figure 16L:
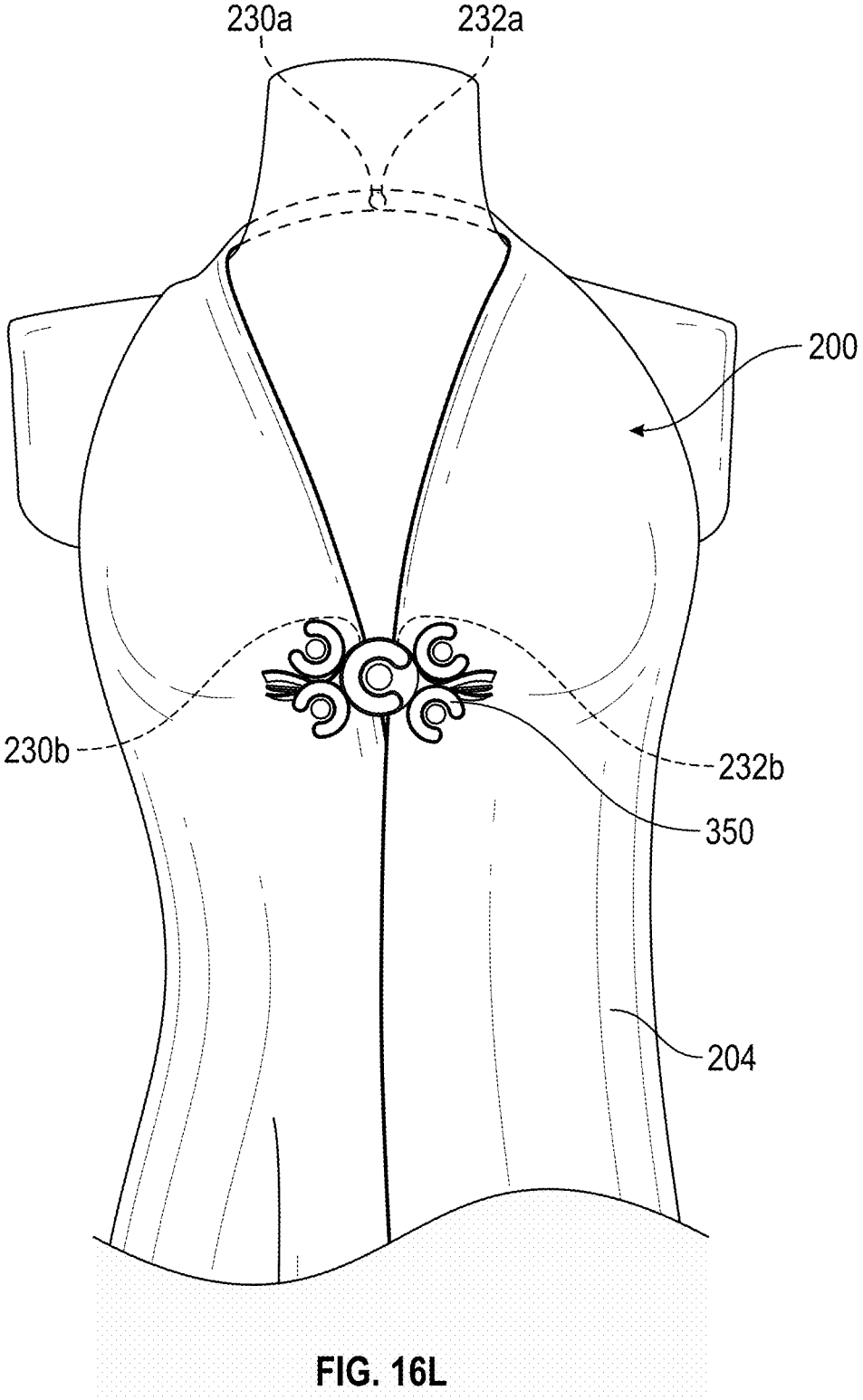
Figure 16M:
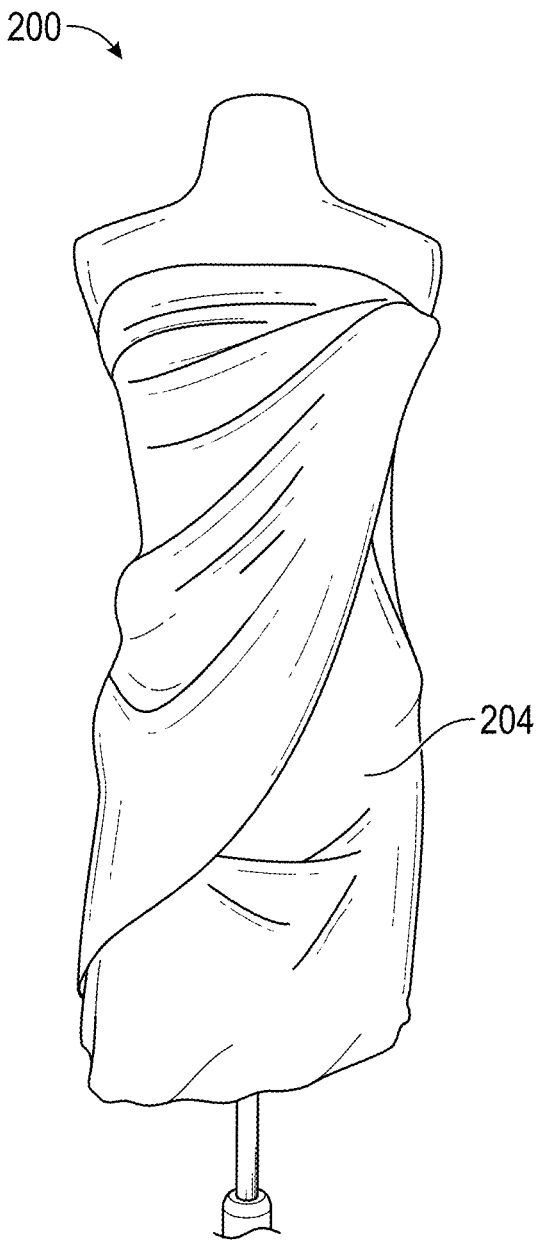
FIG. 16M and FIG. 16N are front and rear views of the reconfigurable garment of FIG. 2 styled into a shortened look.
Figure 16N:
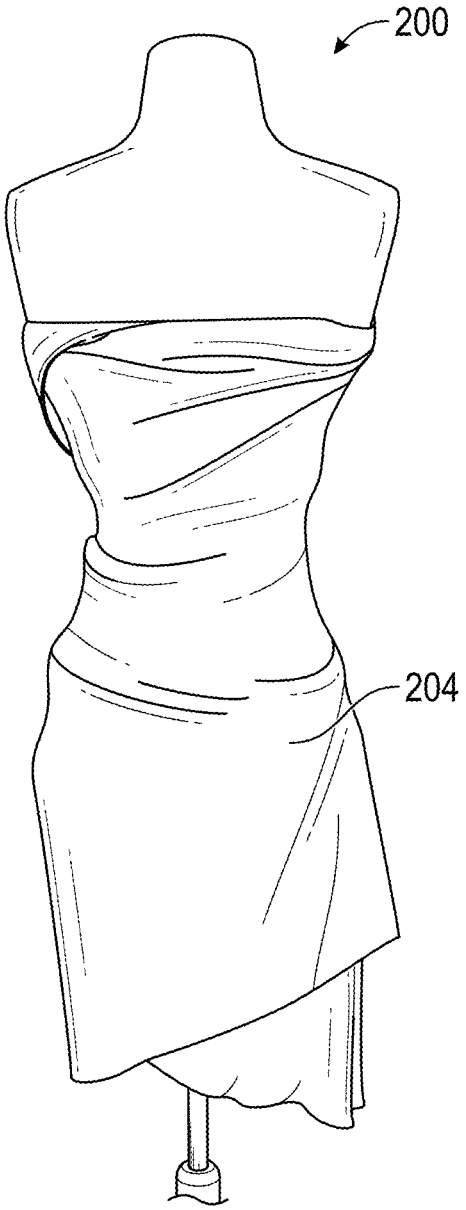
Figure 16O:
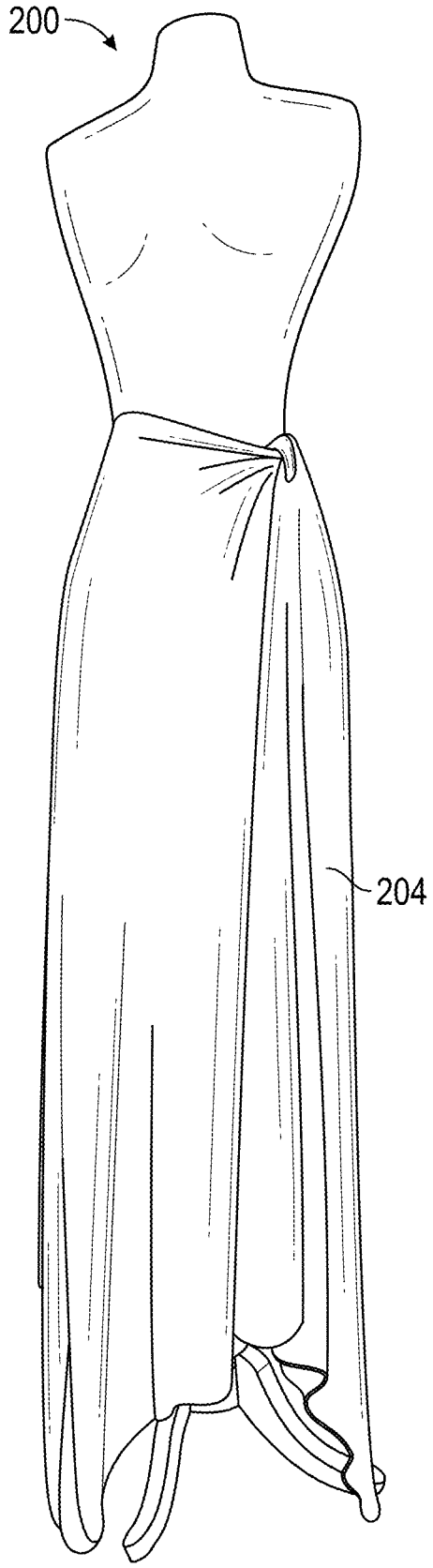
FIG. 16O is a front view of the reconfigurable garment of FIG. 2 styled into another look.

The second reconfigurable garment 200 provides with wearer with two or more looks that can be created by joining different sets of fastening elements. As described above, all or less than all of the fastening elements can be used in arriving at any desired style. While a number of distinct styles of the second reconfigurable garment 200 have been shown and described, more styles also are possible. In some configurations, the fabric panel 204 can be reversed by the wearer to create a number of different styles. In some such configurations, the draping can be concealed, as shown in FIG. 16K and as discussed above, or can be connected with one or more adornment, as shown in FIG. 16L. In the configuration of FIG. 16L, the fastening element 230*b* and the fastening element 232*b* are connected using the fastener adornment 350. In some configurations, the fabric panel 204 can be manipulated by the wearer using the various fastening elements 230, 232, 234, 236 to create the appearance of a shorter garment as shown in FIG. 16M and discussed above. A further style possible with any of the garments disclosed herein is a skirt configuration (e.g., see FIG. 16N). FIG. 16O illustrates the second reconfigurable garment 200 with the fabric panel 204 secured around the waist using the fastening elements. In some configurations, an extender can be used to secure the fabric panel 204 in place around the waist of the wearer.

Figure 17A:
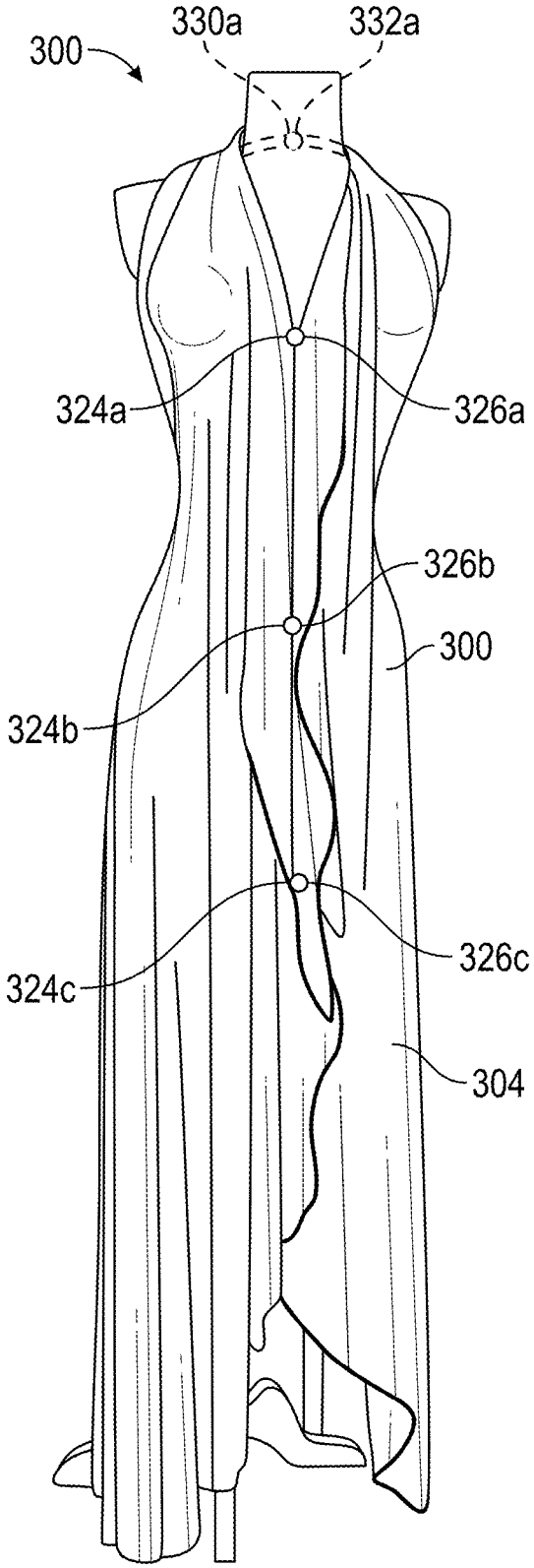
FIGS. 17A and 17B are front and rear views of the reconfigurable garment of FIG. 3 styled into a first look.
Figure 17B:
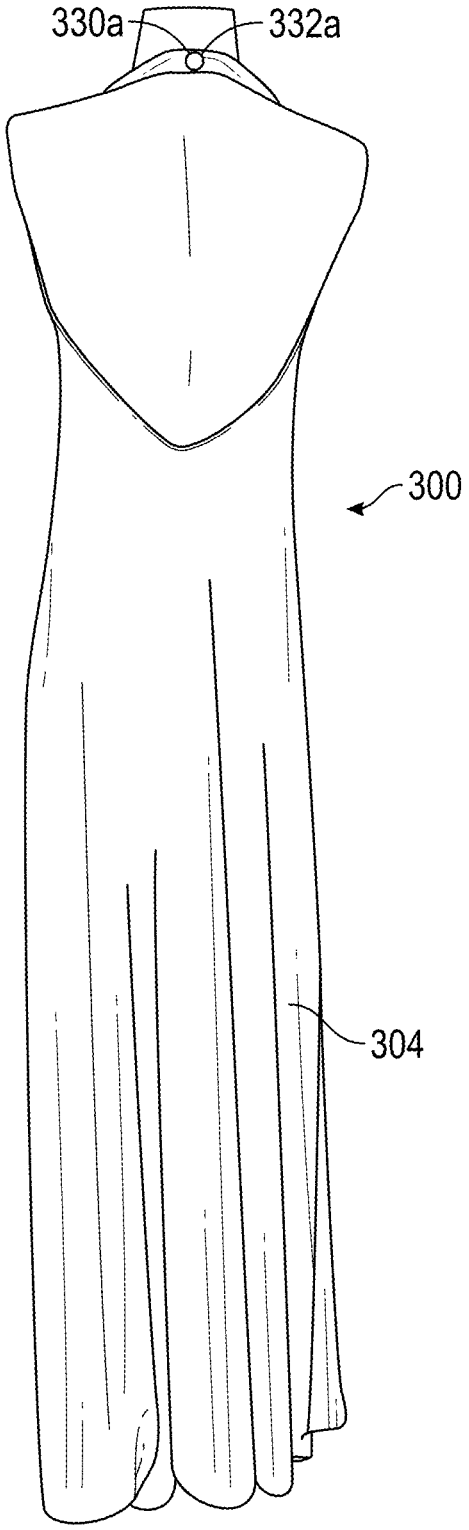

With reference now to FIGS. 17A-17B, the third reconfigurable garment 300 is shown in a first style configuration. As illustrated, the third reconfigurable garment 300 can be styled to be backless with a draped V-neck front. In this style, the fabric panel 304 is held by the wearer near the fastening elements 330*a*, 332*a* behind the back of the wearer. The fastening elements 330*a*, 332*a* are brought underneath the armpits and secured behind the neck of the wearer. The three sets of two fastening elements 324*a*, 326*a*, 324*b*, 326*b*, 324*c*, 326*c* can be joined together with each couple (e.g., 324*a*, 326*a*) being joined together. In this manner, the fastening elements are positioned medially along the front torso. With reference to FIG. 17F, as discussed in greater detail below, the user optionally can reverse the fabric panel 304 and use the same fastening configuration (joining fastening element 324*a* with fastening element 326*a*, joining fastening element 324*b* with fastening element 326*b* and joining fastening element 324*c* with fastening element 326*c*) to create a new look that conceals the draped effect from the front of the garment.

Figure 17C:
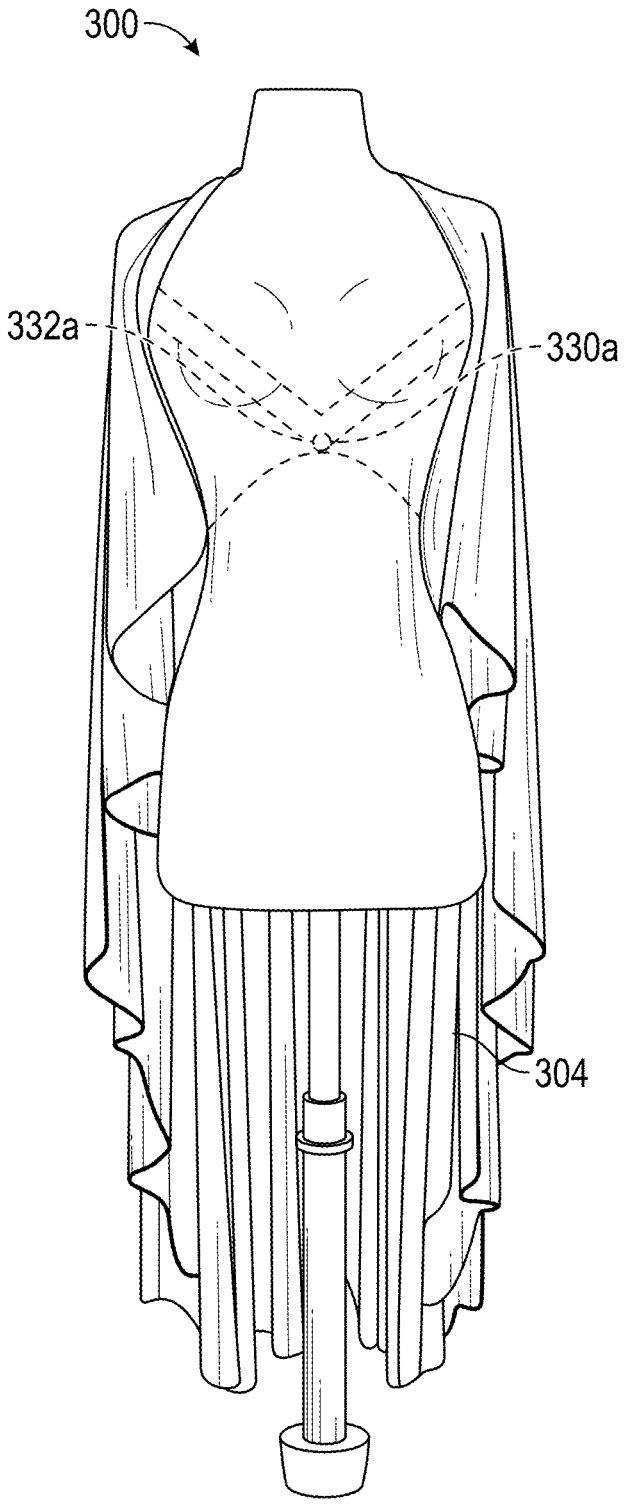
FIG. 17C is a front view of the reconfigurable garment of FIG. 3 styled into a second look.

The third reconfigurable garment 300 is shown in a second style in FIG. 17C. To arrive at this style, the wearer would hold the fabric panel 304 in the region of the further first and second fastening elements 330*a*, 332*a*. More specifically, the further first and second fastening elements 330*a*, 332*a* are held just behind the shoulders like a cape. The further first and second fastening elements 330*a*, 332*a* are fastened together behind the back after draping the fabric over the shoulders and under the armpits of the wearer.

While the style of FIG. 17C may be satisfactory for some wearers, others may desire to create a cape with sleeves. To do so, the wearer would create the second style and then continue to connect the second and third fastening elements 324*b*, 324*c* and pass their arms through the loop and also connect second and third fastening elements 326*b*, 326*c* and pass their arms through the loop.

Figure 17D:
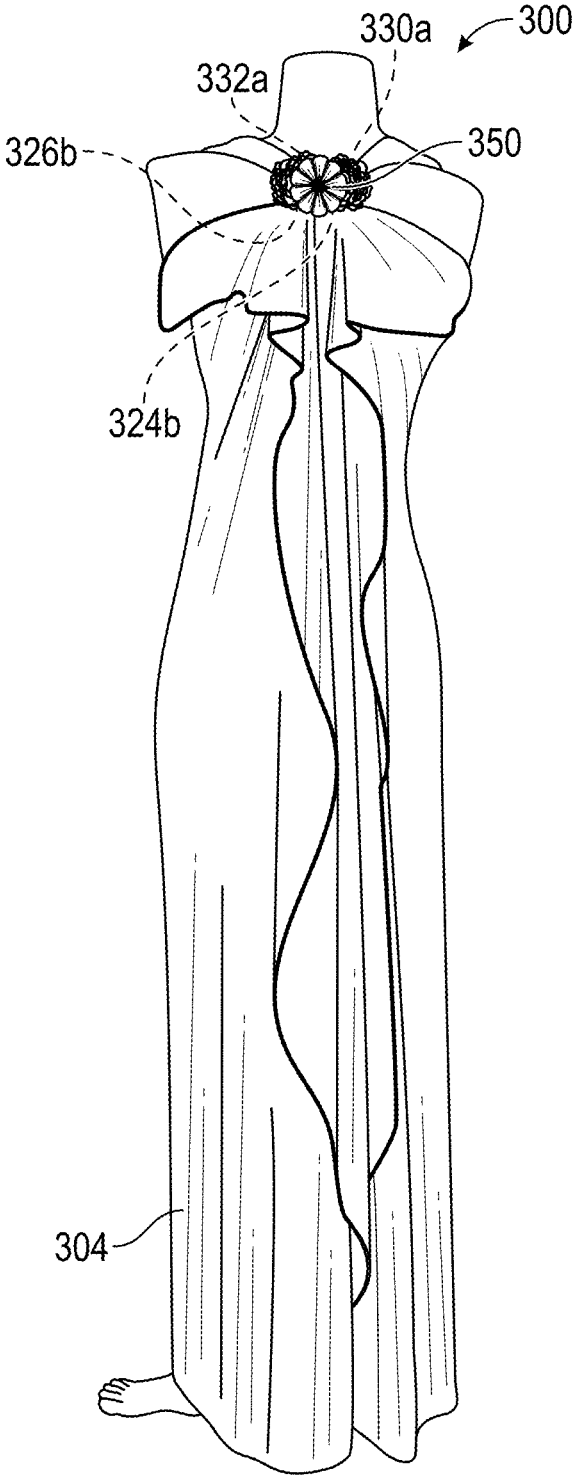
FIGS. 17D and 17E are front and rear views of the reconfigurable garment of FIG. 3 styled into a third look.
Figure 17E:
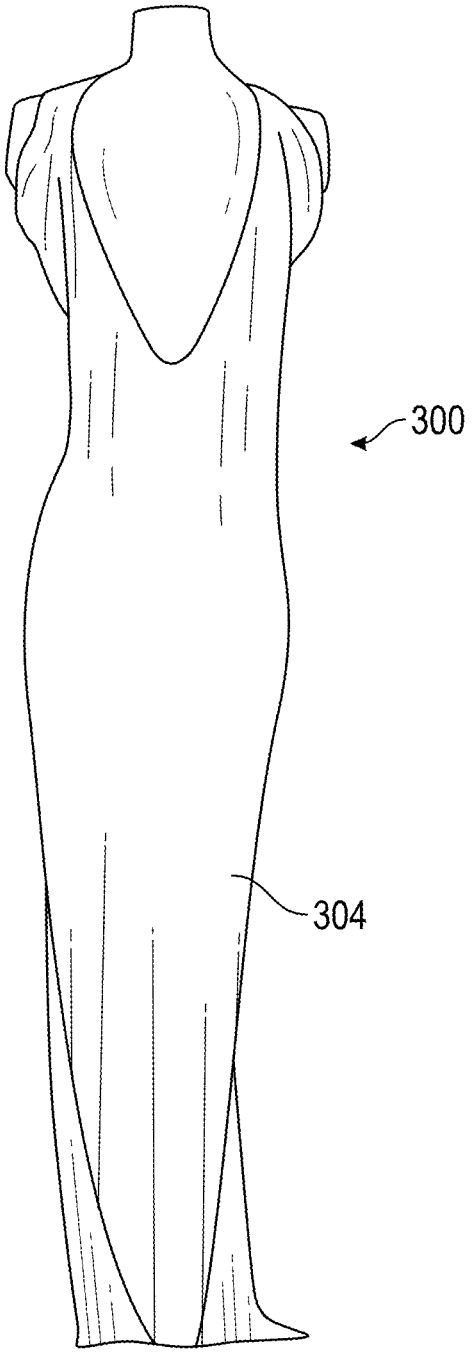
Figure 17F:
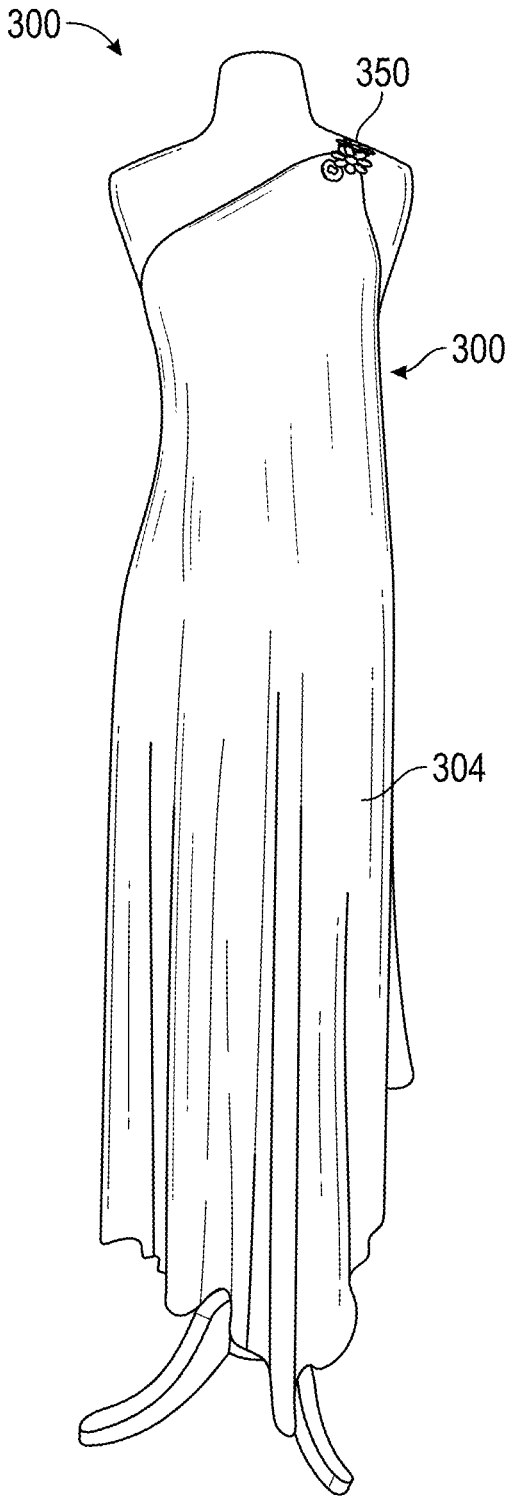
FIGS. 17F and 17G are front views of two additional looks with the reconfigurable garment of FIG. 3.

With reference to FIGS. 17D and 17E, the third reconfigurable garment 300 can be configured to provide straps with openings through which the wearer would pass their arms. In this style, the fabric panel 304 can be held in the region of the further first and second fastening elements 330*a*, 332*a* with the fabric panel 304 being held against the wearer's back so the fabric panel is across the shoulders. The fastening element 324*b* and the fastening element 326*b* can be interconnected around the region of the fastening elements 330*a*, 332*a*. To better obscure the location of the interconnection, an adornment 350 or the like can be positioned over the intersection of the fastening elements 330*a*, 332*a*, 324*b*, 326*b*. In some configurations, other fastening elements, such as fastening elements 334*c*, 326*c*, can be interconnected rather than fastening elements 324*b*, 326*b*, to better accommodate differently sized wearers.

Figure 17G:
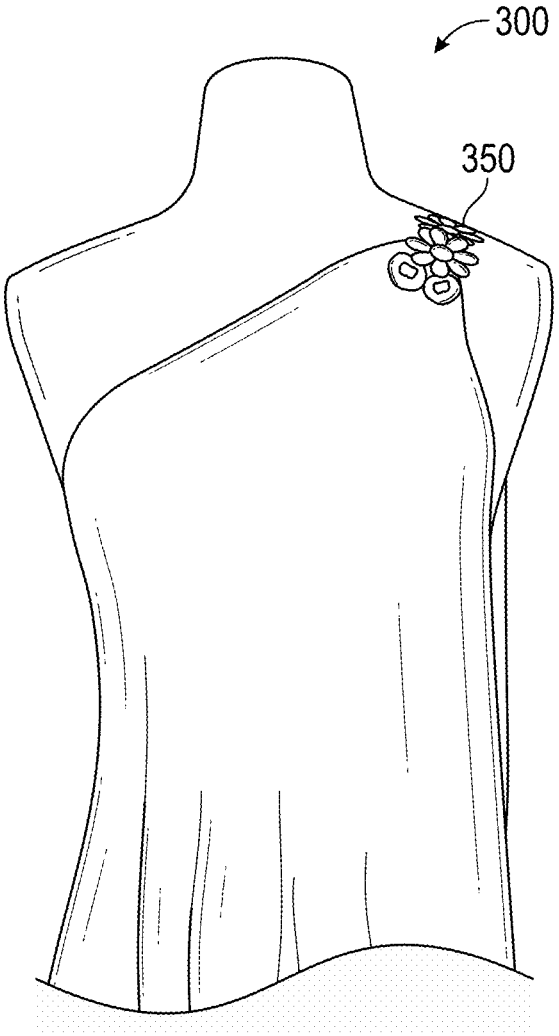
Figure 17H:
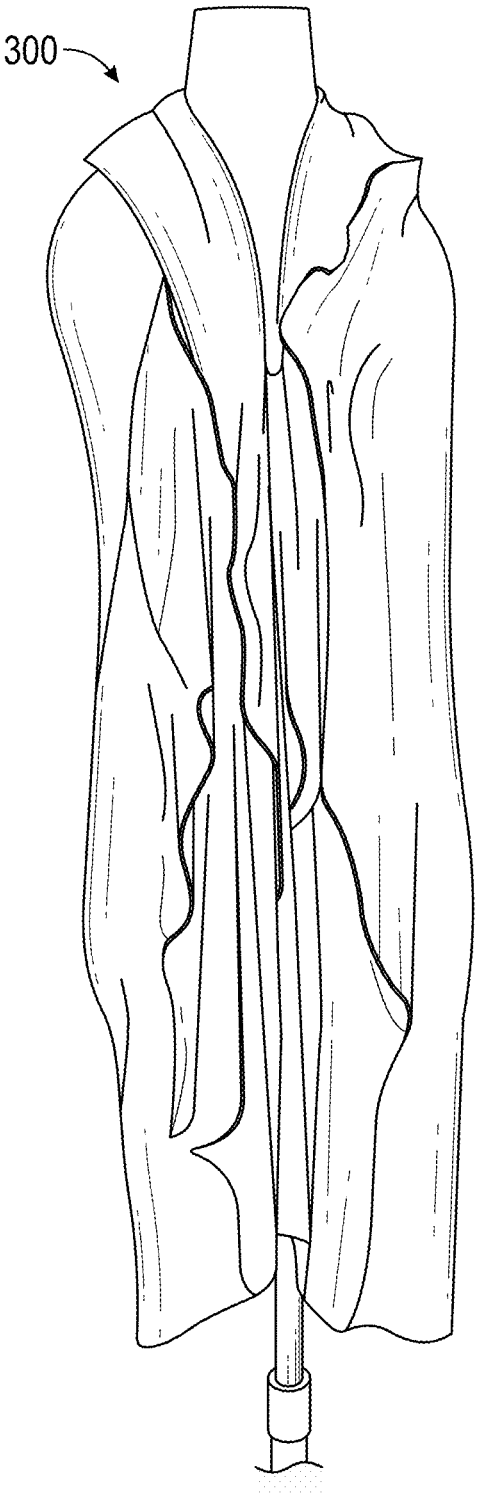
FIGS. 17H and 17I are front and rear views of the reconfigurable garment of FIG. 3 styled into a shortened look.
Figure 17I:
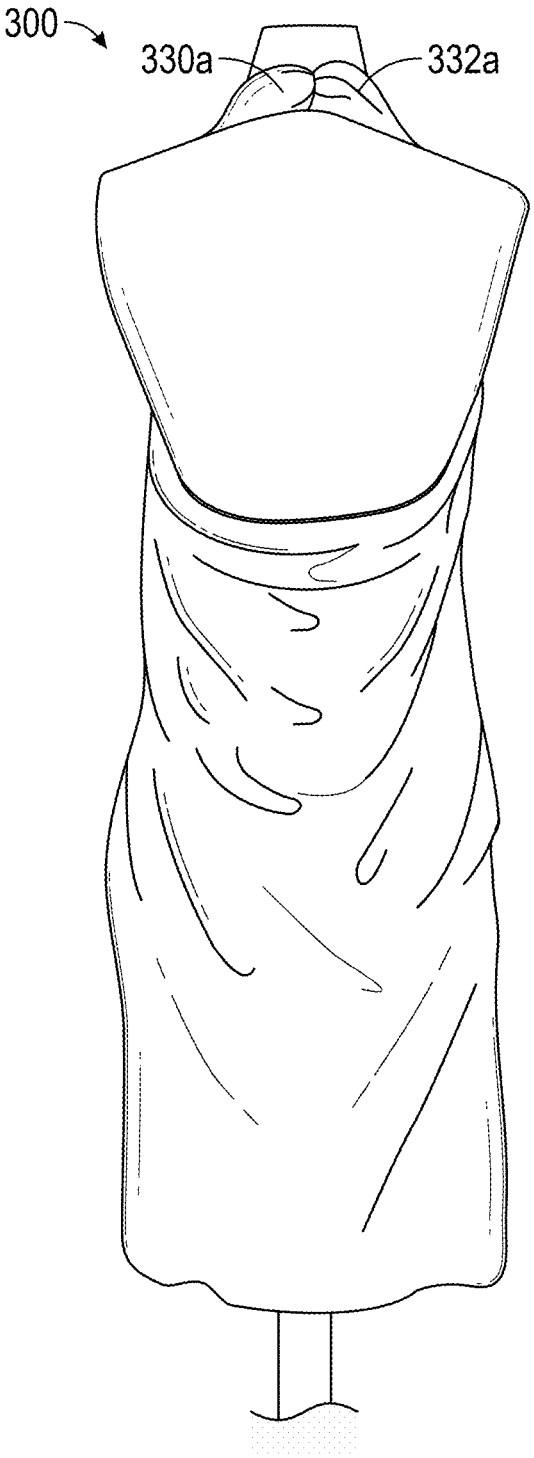

As shown and described above, the third reconfigurable garment 300 can provide at least three different styles from a single garment. By connecting different pairs of fastening elements, the wearer can arrive at multiple different styles. Moreover, the fabric panel 304 can be reversed by the wearer to create a number of different styles that conceal the draping, as shown in FIGS. 17F and 17G, or can be manipulated by the wearing using the various fastening elements to create the appearance of a shorter garment, as shown in FIGS. 17H and 17I. In the style of FIG. 17G, the adornment 350 can be used to connect two fastening elements at the shoulder of the wearer; however, in some configurations, the two fastening elements can be directly connected at the shoulder to provide an elegant yet simple style.

Figure 18A:
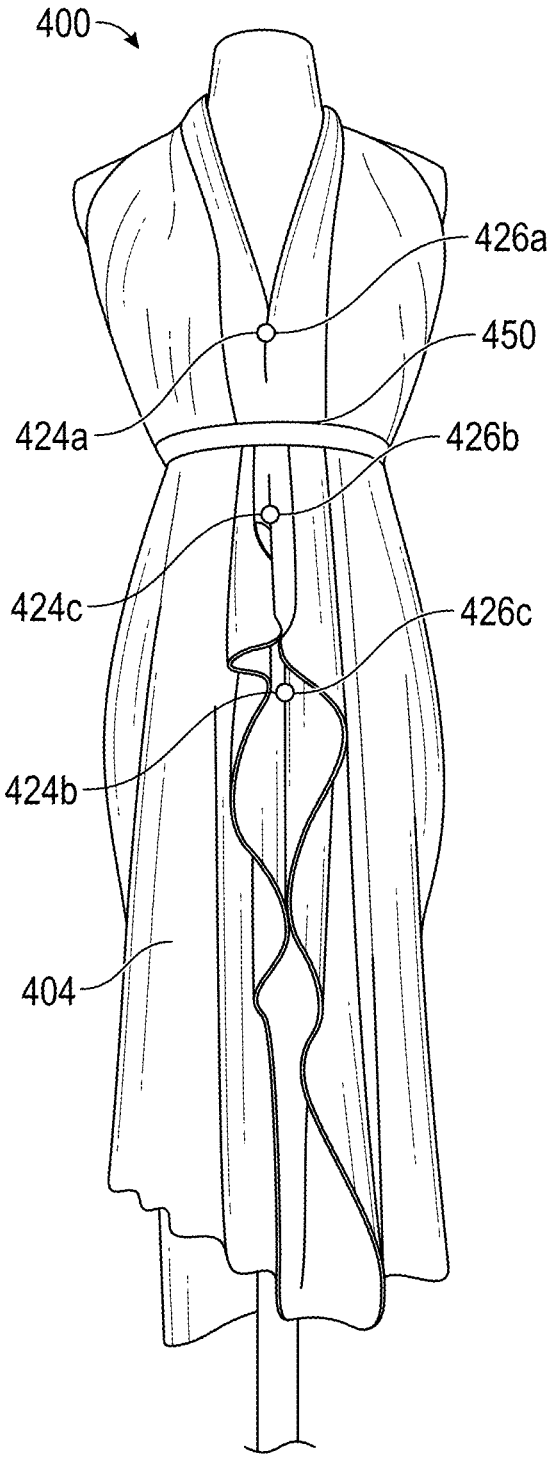
FIGS. 18A and 18B are front and rear views of the reconfigurable garment of FIG. 4 styled into a first look.
Figure 18B:
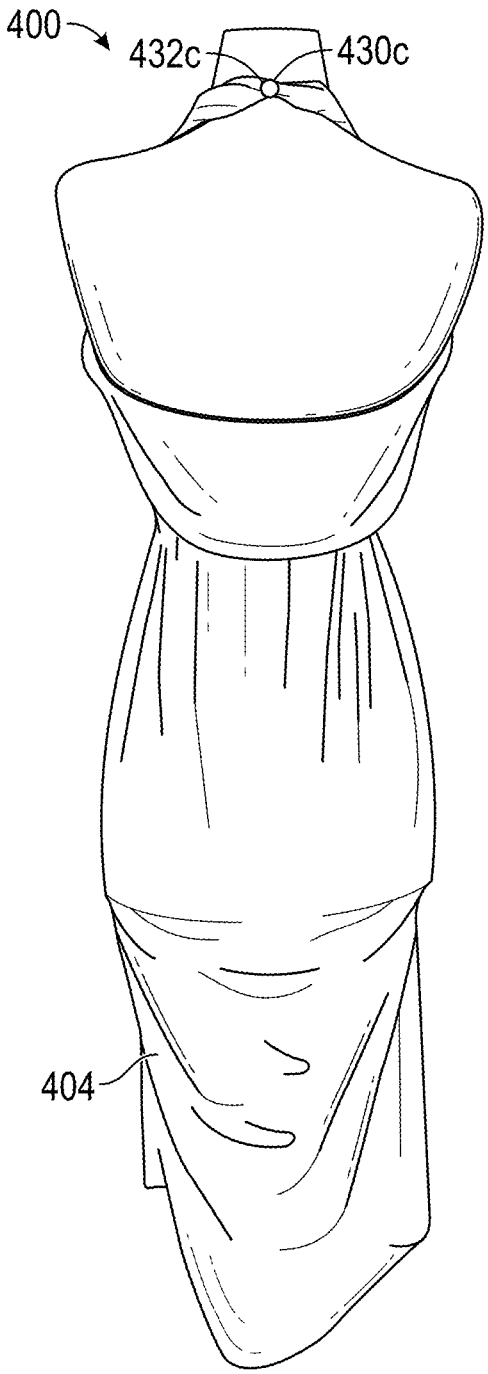

The fourth reconfigurable garment 400 that is shown in FIG. 4 can be styled in a first configuration. With reference to FIGS. 18A and 18B, the fabric panel 404 of the fourth reconfigurable garment 400 can be wrapped around the user under the armpits. The first fastening elements 424*a*, 424*b*, 424*c* and the second fastening elements 426*a*, 426*b*, 426*c* can be connected together to provide the first style. More particularly, the first fastening element 424*a* and the second fastening element 426*a*, the first fastening element 424*b* and the second fastening element 426*b*, and the first fastening element 424*c* and the second fastening element 426*c* can be connected. The neckline of the illustrated style results from fastening any set of third and fourth fastening elements

430*a*, 430*b*, 430*c*, 432*a*, 432*b*, 432*c*. In particular, the third and fourth fastening elements (e.g., third fastening element 432*c* and fourth fastening element 430*c*) can be selected to provide a comfortable fit around the neck of the wearer. Once the fastening elements have been connected, the fabric can be draped and shaped around the chest for the desired look. In some configurations, a belt, extender, or waist tie 450 can be added to accentuate the waistline of the wearer.

Figure 18C:
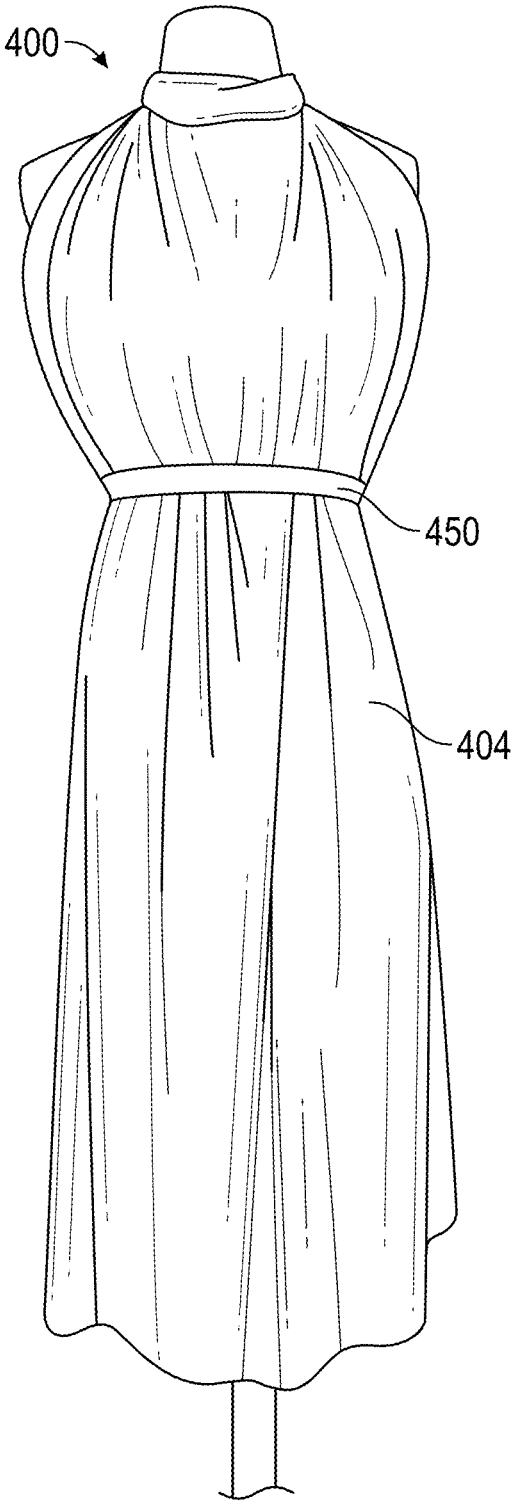
FIGS. 18C and 18D are front and rear views of the reconfigurable garment of FIG. 4 styled into a second look.
Figure 18D:
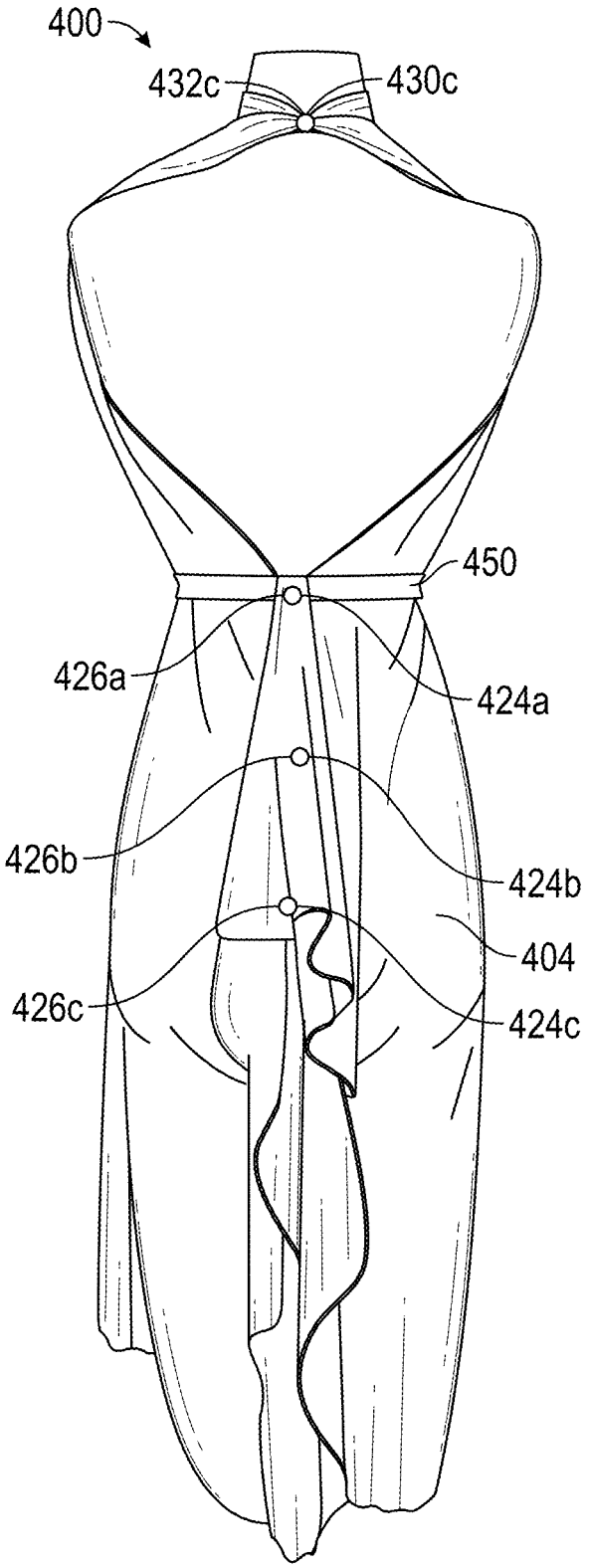

With reference to FIGS. 18C and 18D, the fourth reconfigurable garment 400 is styled in a second look. In this configuration, the fourth reconfigurable garment 400 can be wrapped around the wearer under the armpits. The first fastening element 424*a* and the second fastening element 426*a*, the first fastening element 424*b* and the second fastening element 426*b*, and the first fastening element 424*c* and the second fastening element 426*c* can be connected. Once the fastening elements have been connected, the fourth reconfigurable garment 400 can be rotated so that the joined first fastening element 424*a* and second fastening element 426*a* are positioned in the tailbone region of the wearer. Finally, a halter can be created by choosing any desired third and fourth fastening elements 430*a*, 430*b*, 430*c*, 432*a*, 432*b*, 432*c*. In some configurations, a belt, extender, or waist tie 450 can be added to accentuate the waistline of the wearer.

Figure 18E:
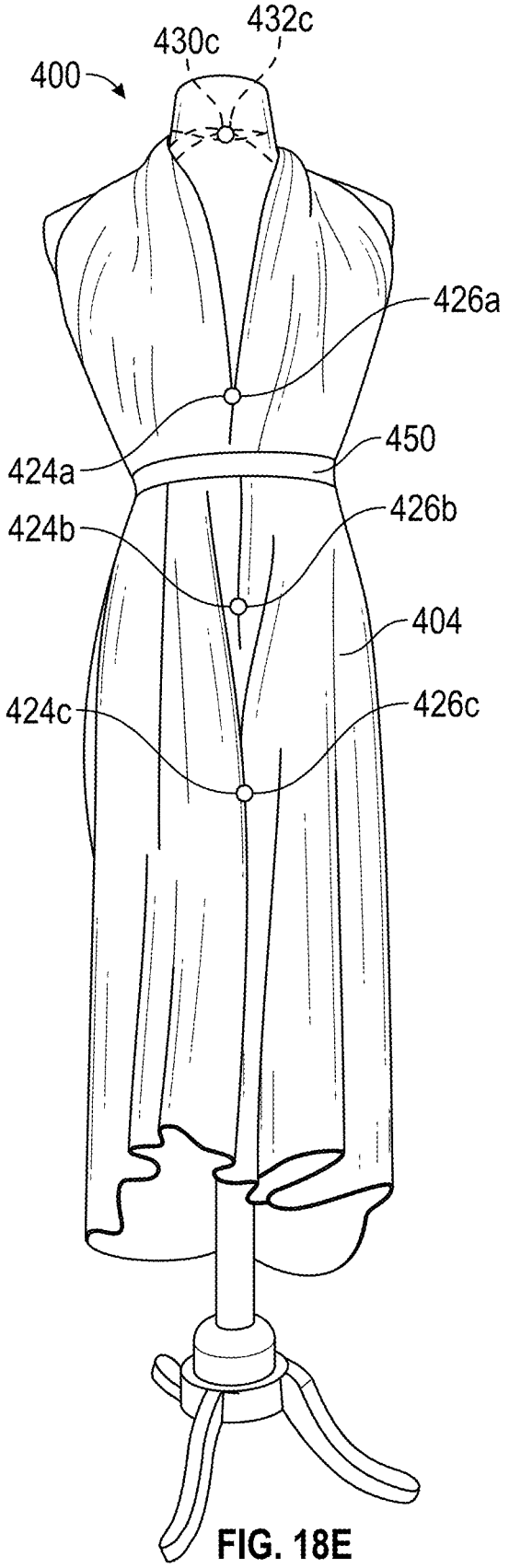
FIGS. 18E and 18F are front and rear views of the reconfigurable garment of FIG. 4 styled into a third look.
Figure 18F:
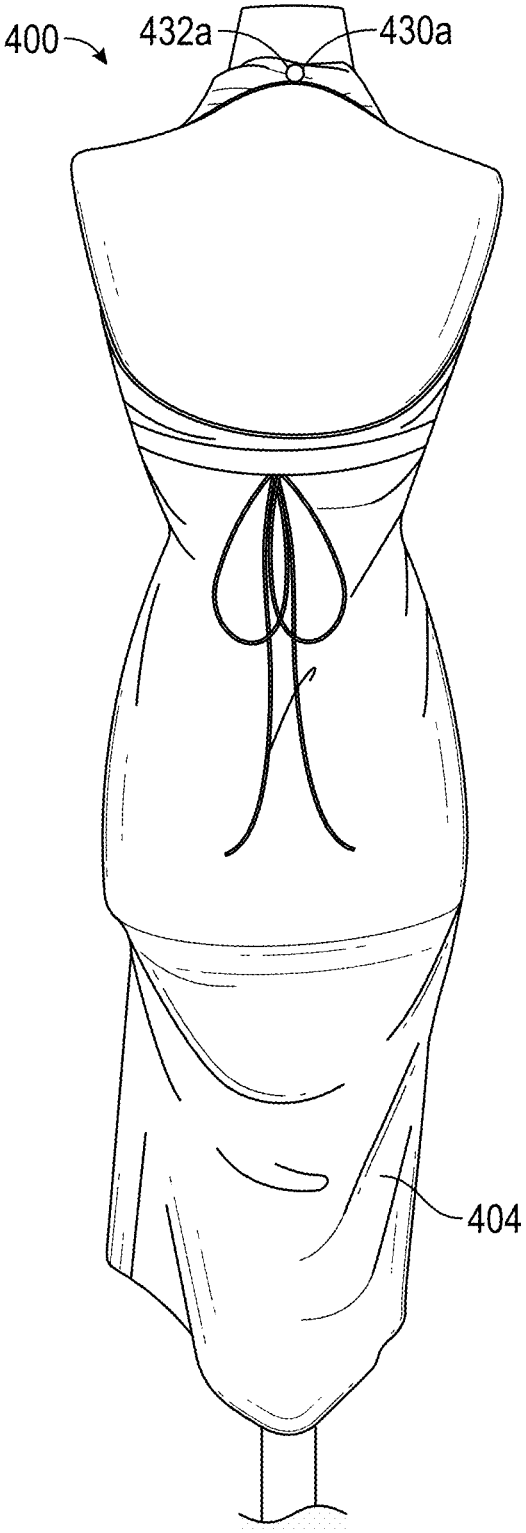

The fourth reconfigurable garment 400 is styled in a third look in FIGS. 18E and 18F. Once again, the fabric panel 404 of the fourth reconfigurable garment 400 is wrapped around the wearer under the armpits. With the fabric panel 404 wrapped around the wearer, the third fastening element 430*c* and the fourth fastening element 432*c* are connected so that the fabric panel 404 is connected around the wearer's neck. The first fastening element 424*a* and the second fastening element 426*a*, the first fastening element 424*b* and the second fastening element 426*b*, and the first fastening element 424*c* and the second fastening element 426*c* can be connected. Finally, any remaining third and fourth fastening elements can be connected to adjust the neckline for comfort. As with some of the embodiments discussed above, a waist tie 450, extender or belt can be added to the look to help gather in the waist or neck region of the style.

The fourth reconfigurable garment 400 provides the wearer with two or more looks that can be created by joining different sets of fastening elements. All or less than all of the fastening elements can be used in arriving at any desired style. While three distinct styles of the fourth reconfigurable garment 400 have been shown and described, more styles also are possible. Moreover, the fabric panel 404 of the reconfigurable garment 400 of FIG. 4, can be manipulated using its various fastening configurations to create the appearance of a shorter garment, similar to that shown in FIGS. 18E and 18F).

Figure 19A:
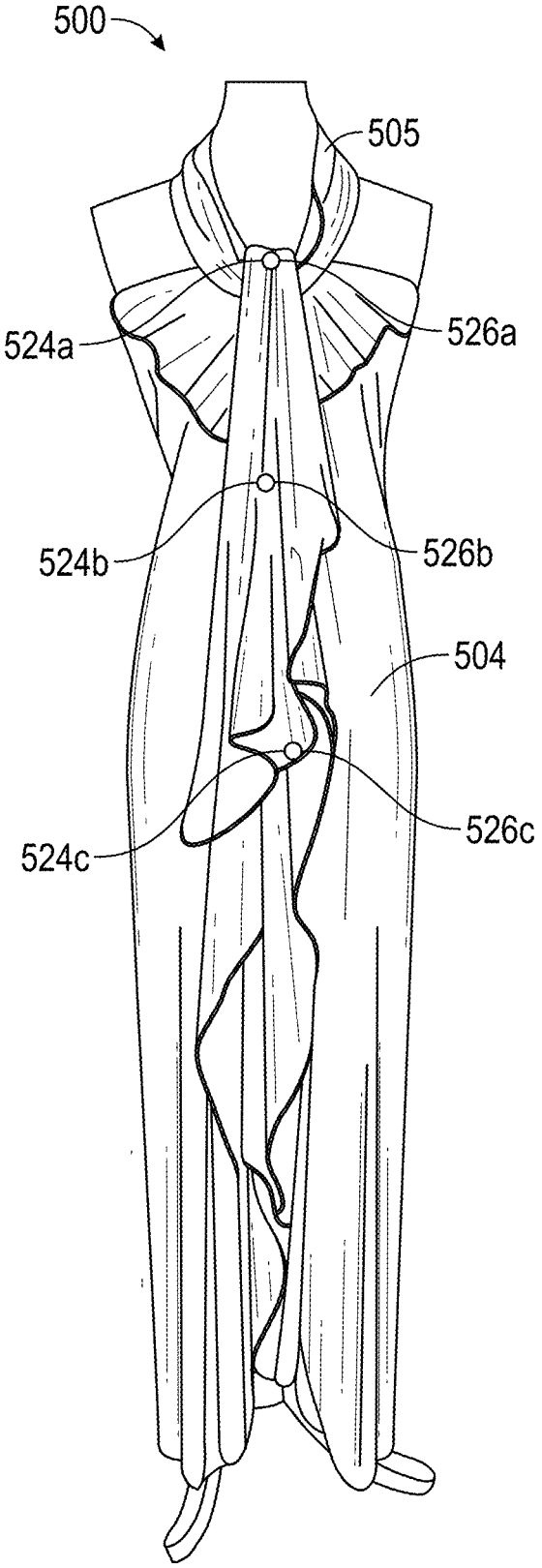
FIGS. 19A-19X are views of the reconfigurable garment of FIG. 5 styled into various different looks.
Figure 19B:
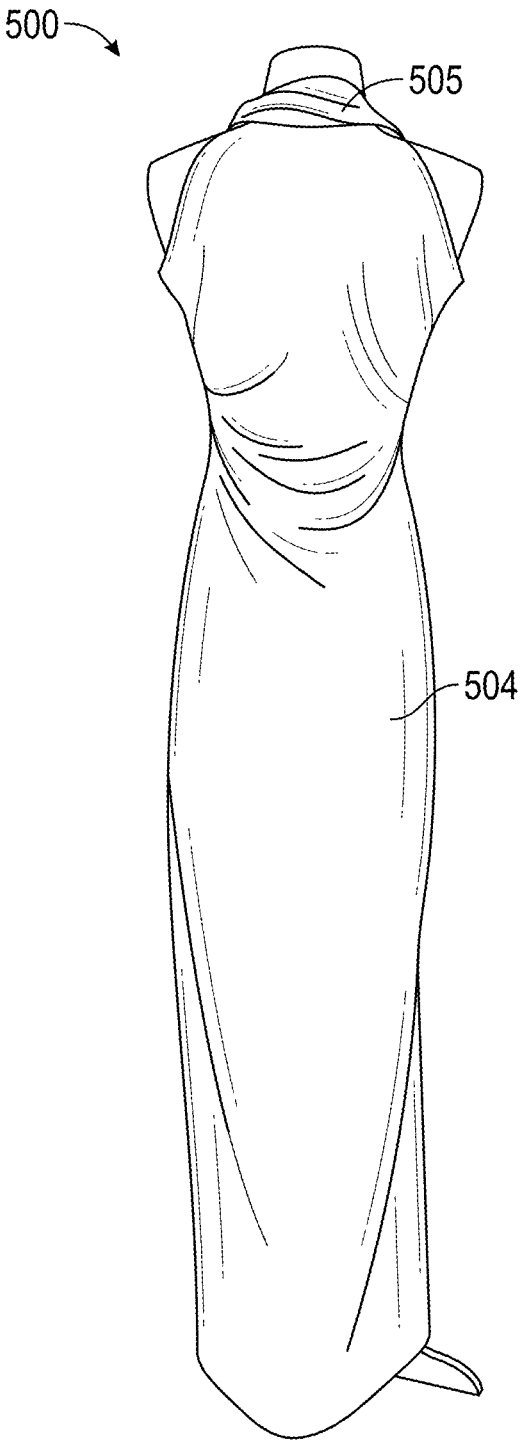

The fifth reconfigurable garment 500 shown in FIG. 5 can include the additional fabric panel 505, which further increases the styling flexibility. FIGS. 19A and 19B illustrate a first style for the fifth reconfigurable garment 500. The first fabric panel 504 of the fifth reconfigurable garment 500 is held against the back and the wearer fastens the relevant fastening elements together. In the illustrated configuration, the fastening elements 544*a*, 546*a* are connected, the fastening elements 544*b*, 546*b* are connected, and the fastening elements 544*c*, 546*c* are connected to create the look seen in FIG. 19E and then the user simply loops the additional fabric panel 505 under and over the secured fastening elements 524*a* and 526*a* to create the draped effect shown on the front of the dress in FIG. 19A. As shown, the neck region takes on a scarf-lie appearance with a nice draping of fabric down the medial portion of the front of the garment.

Figure 19C:
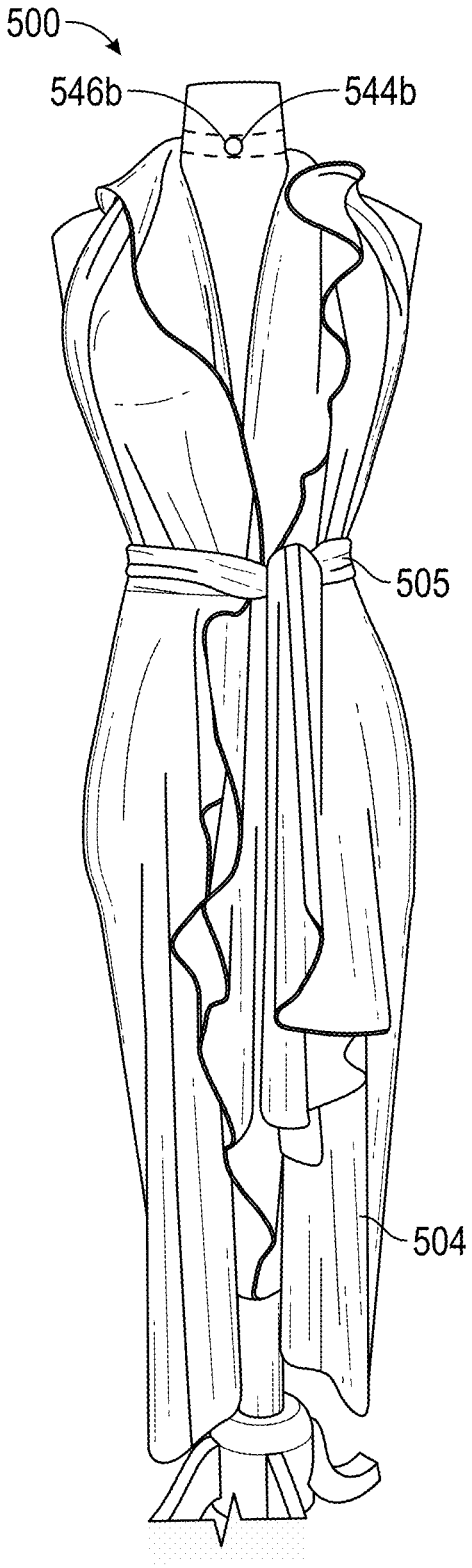
Figure 19D:
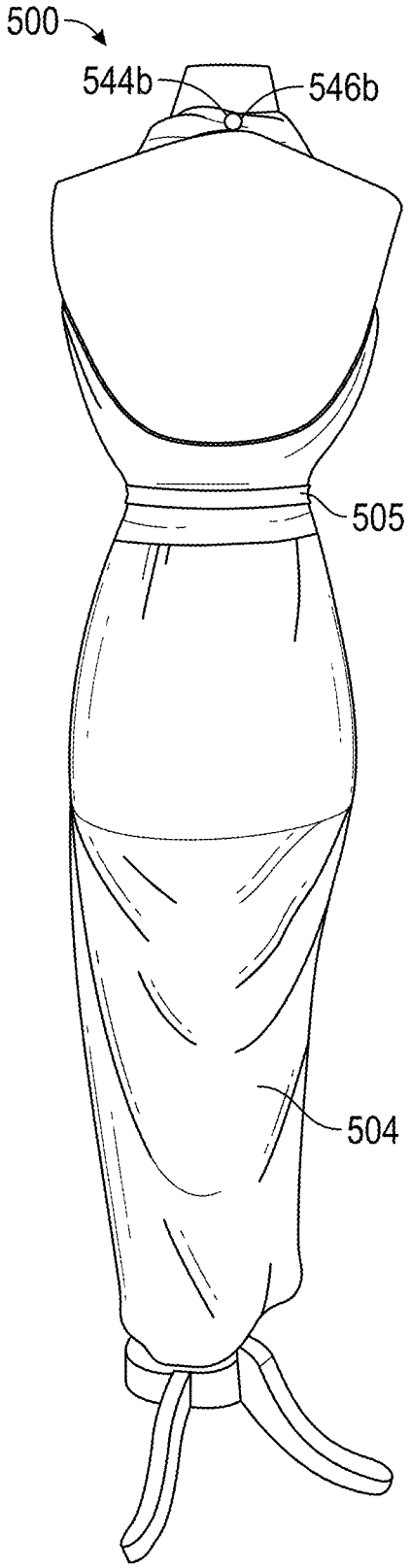
Figure 19E:
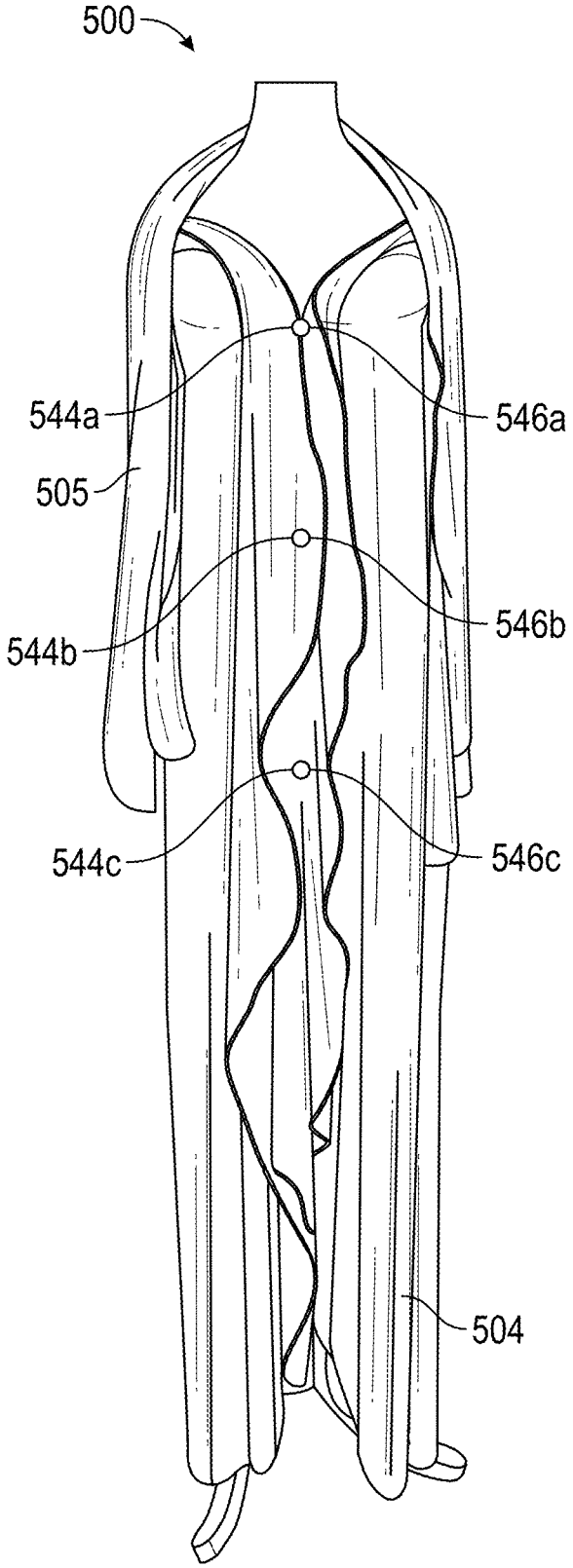
Figure 19F:
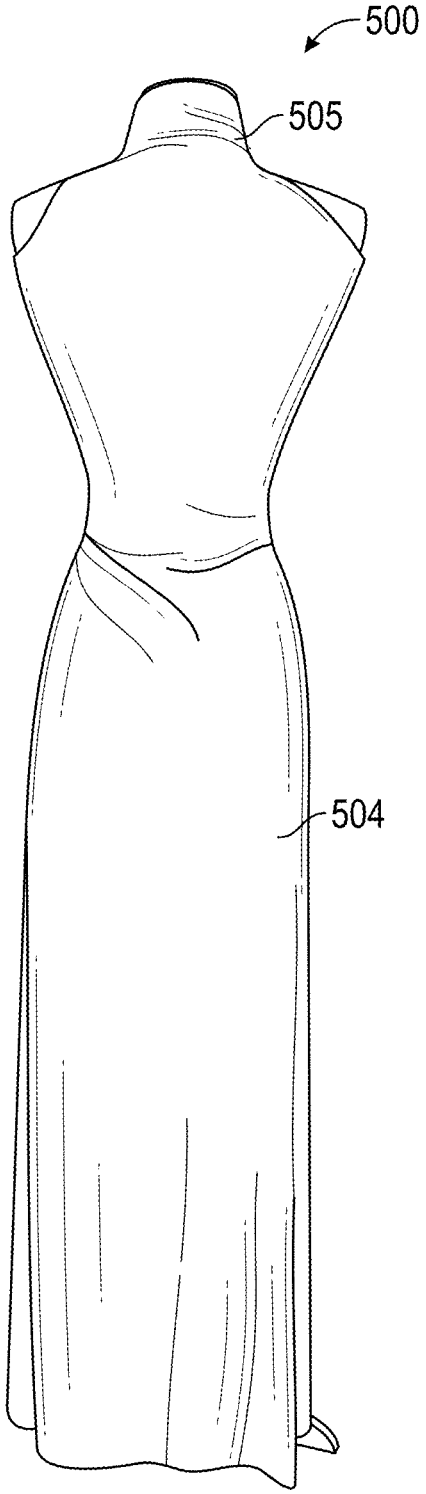
Figure 19G:
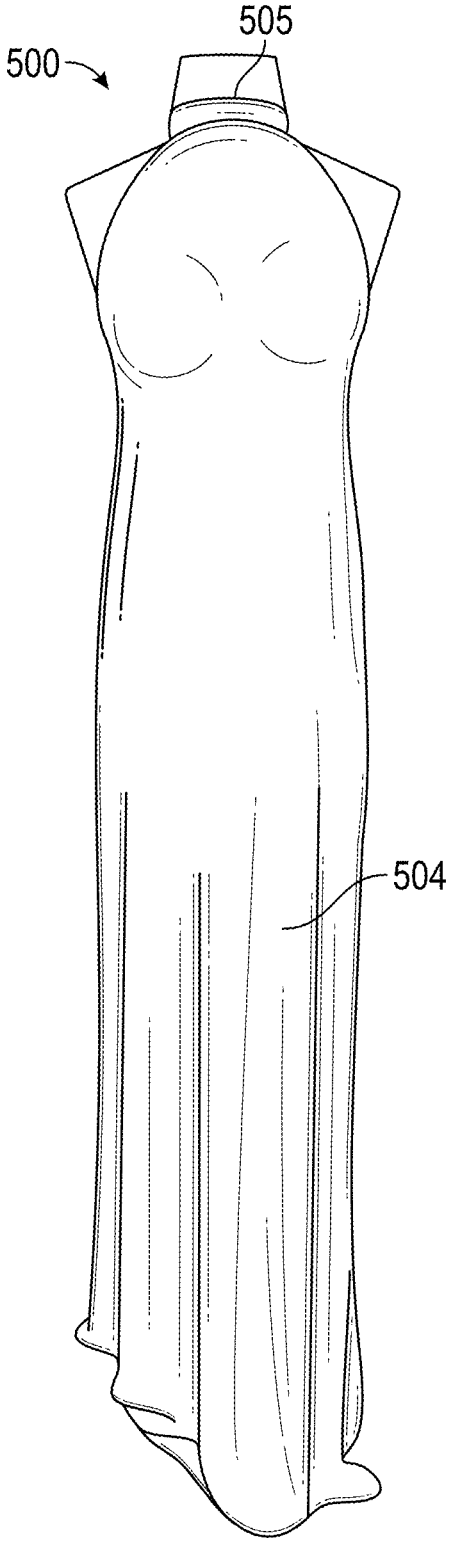
Figure 19H:
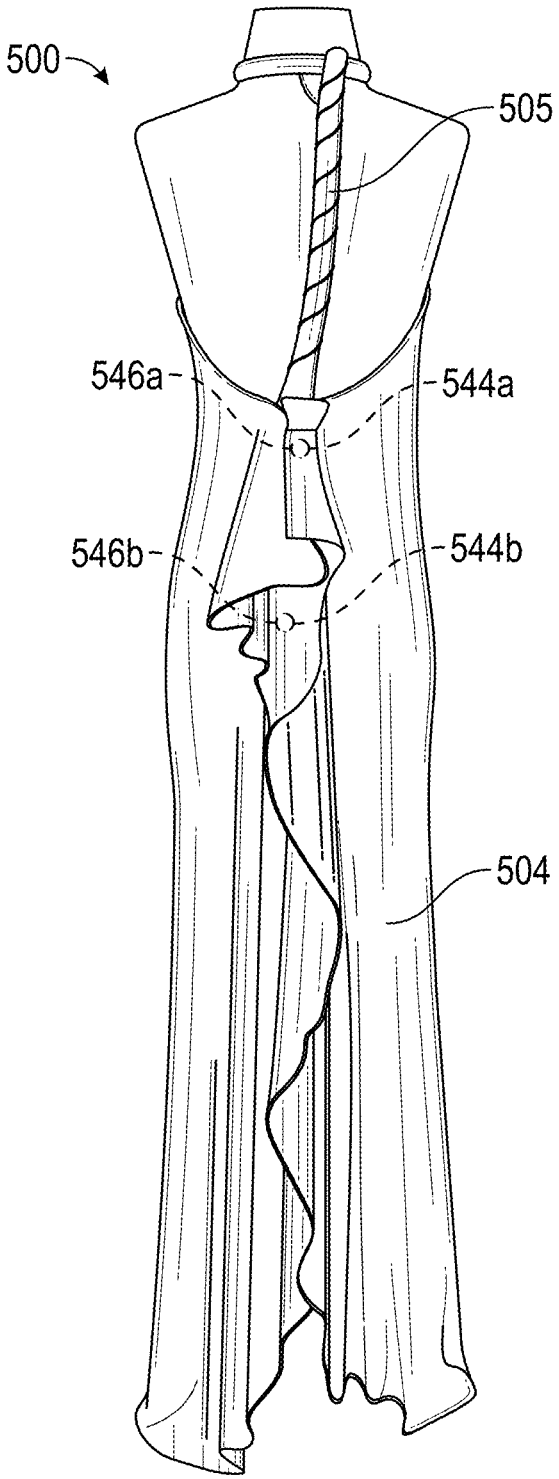
Figure 19I:
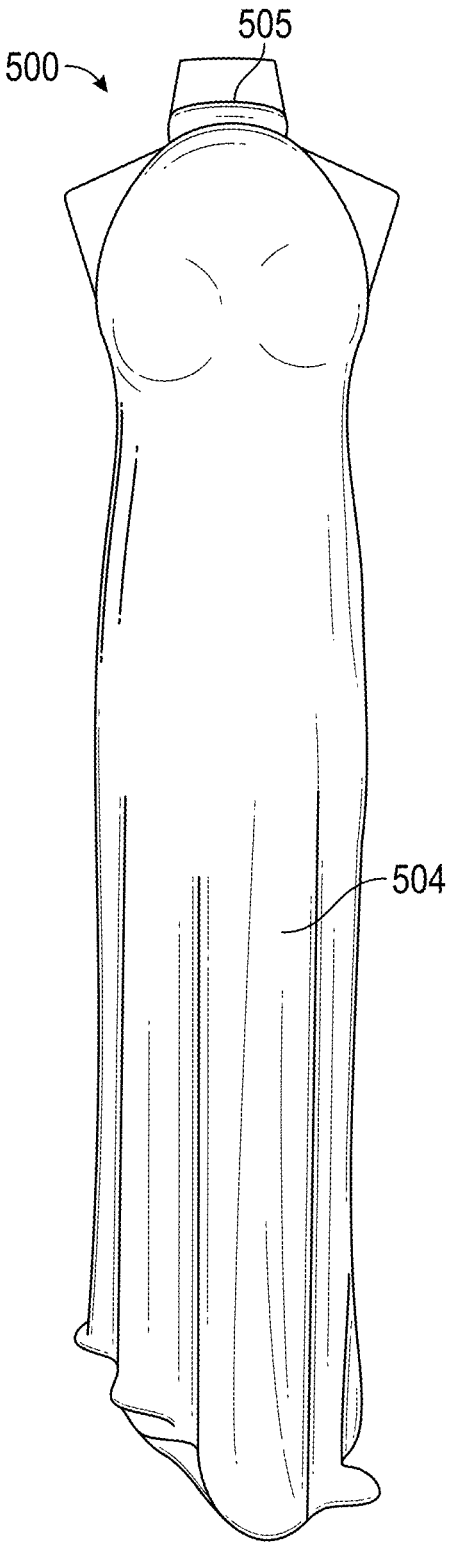
Figure 19J:
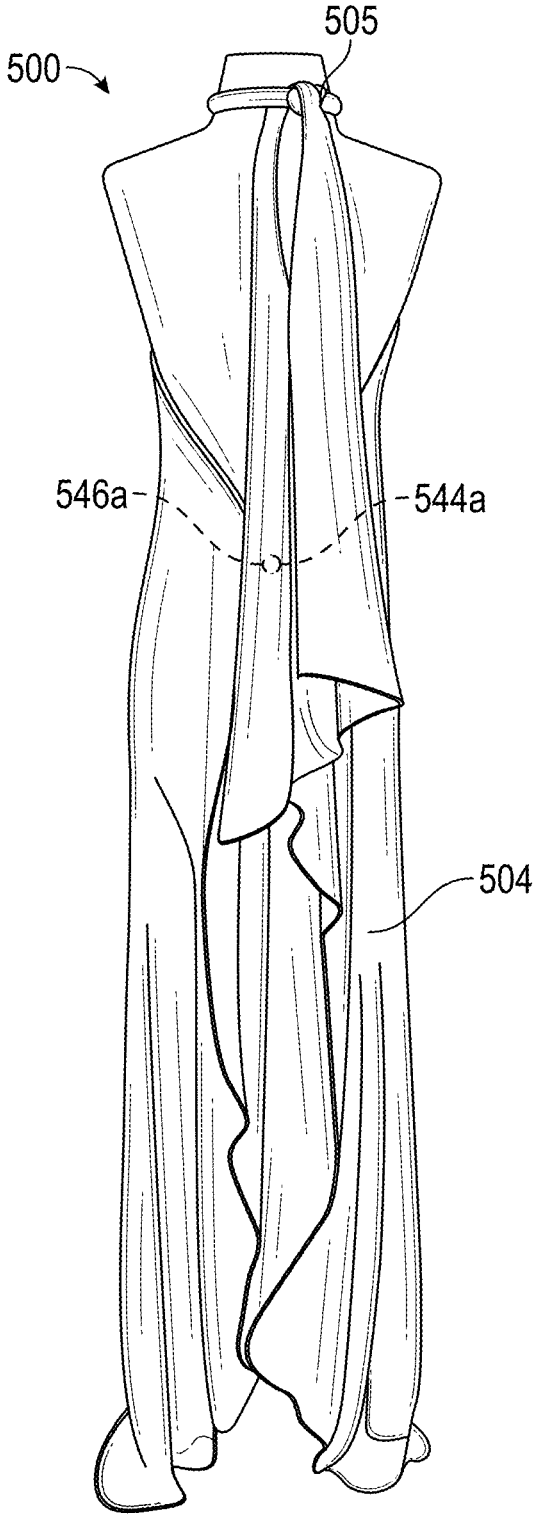
Figure 19K:
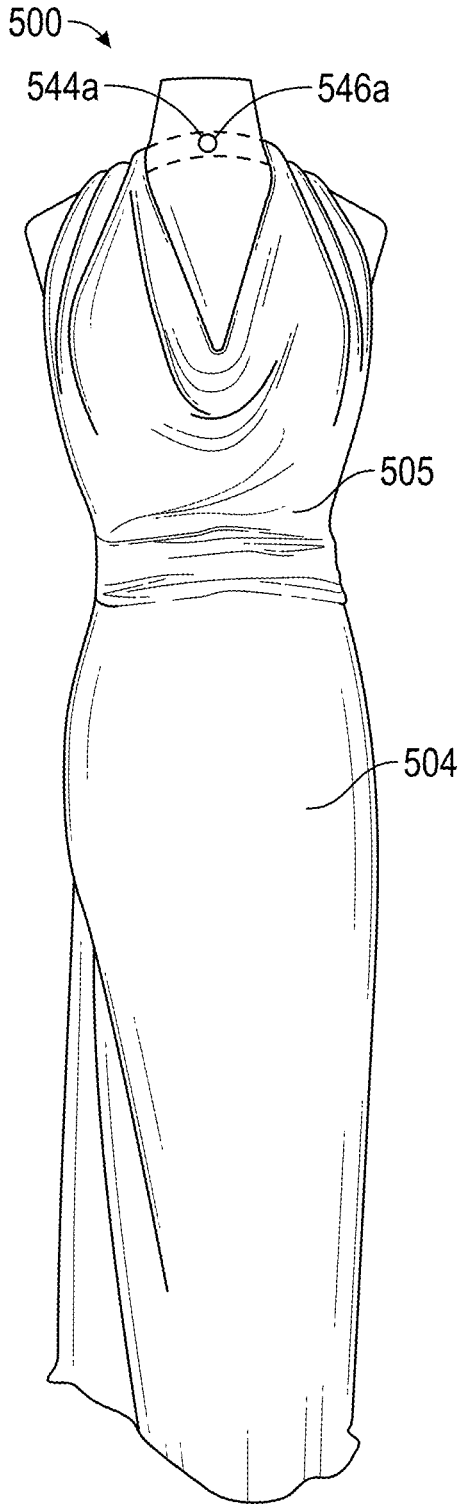
Figure 19L:
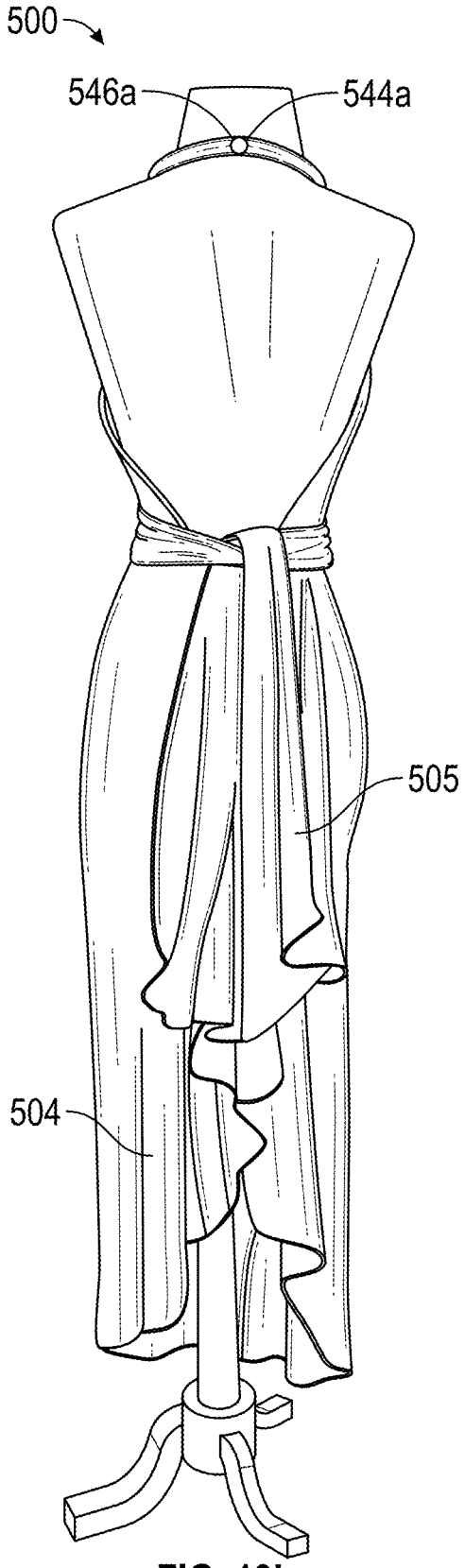
Figure 19M:
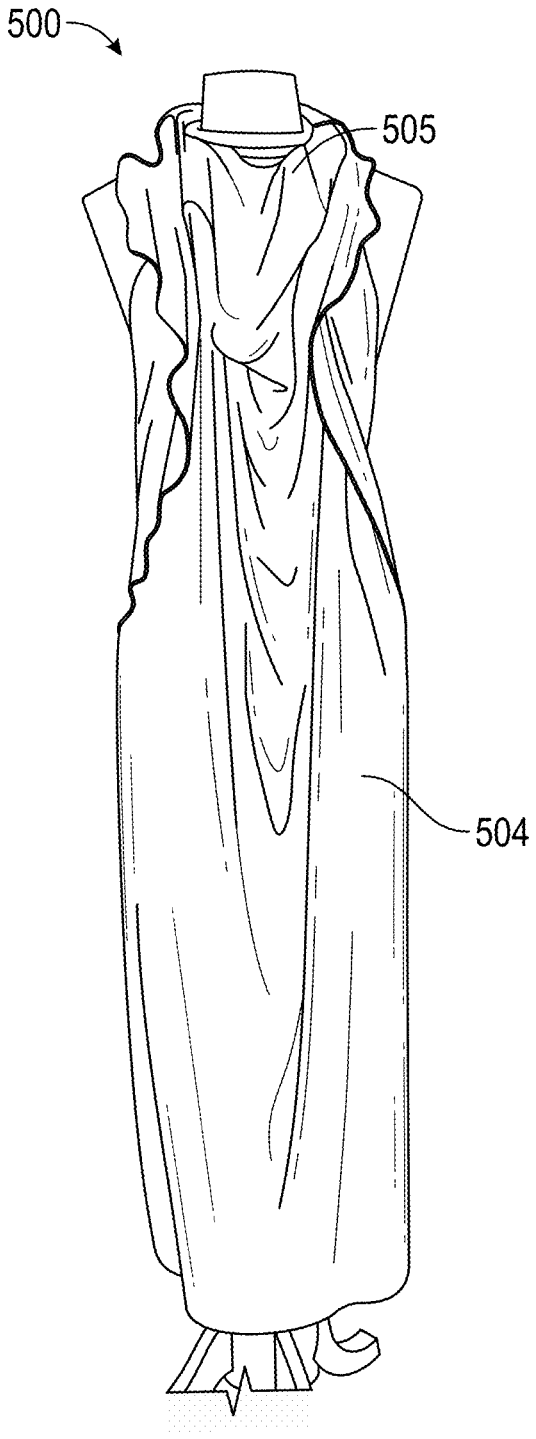
Figure 19N:
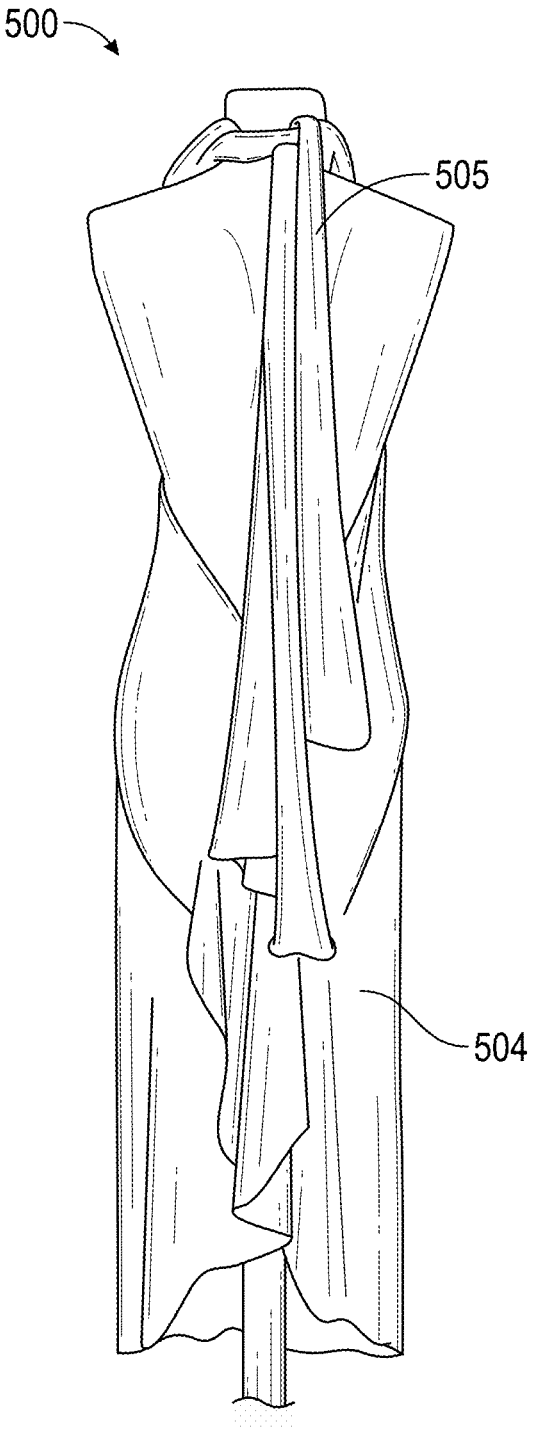
Figure 19O:
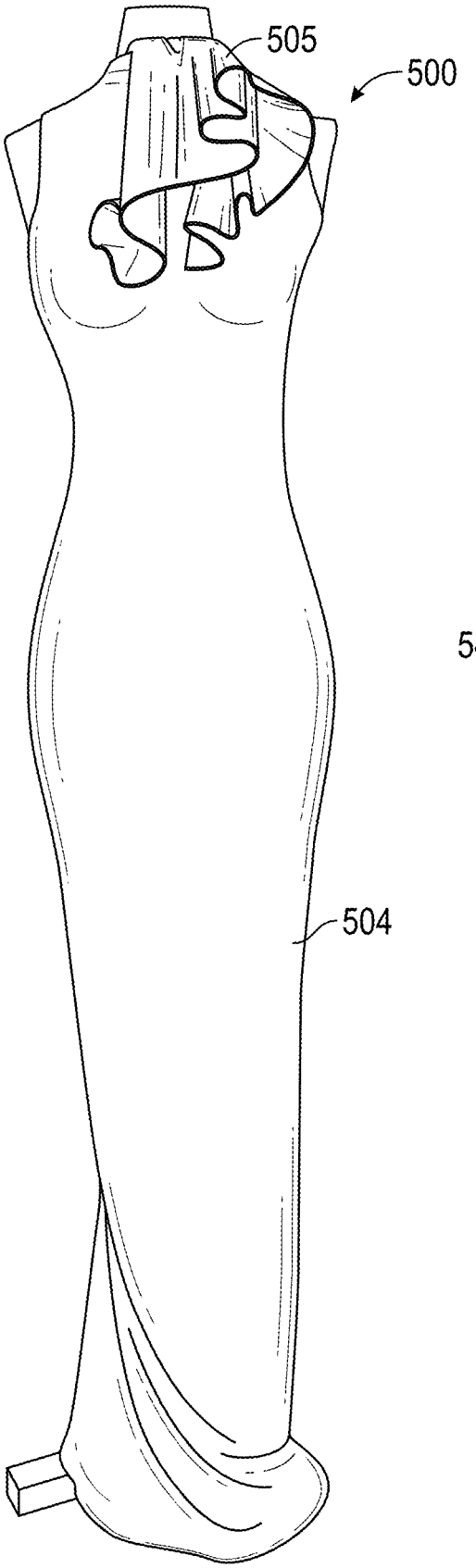
Figure 19P:
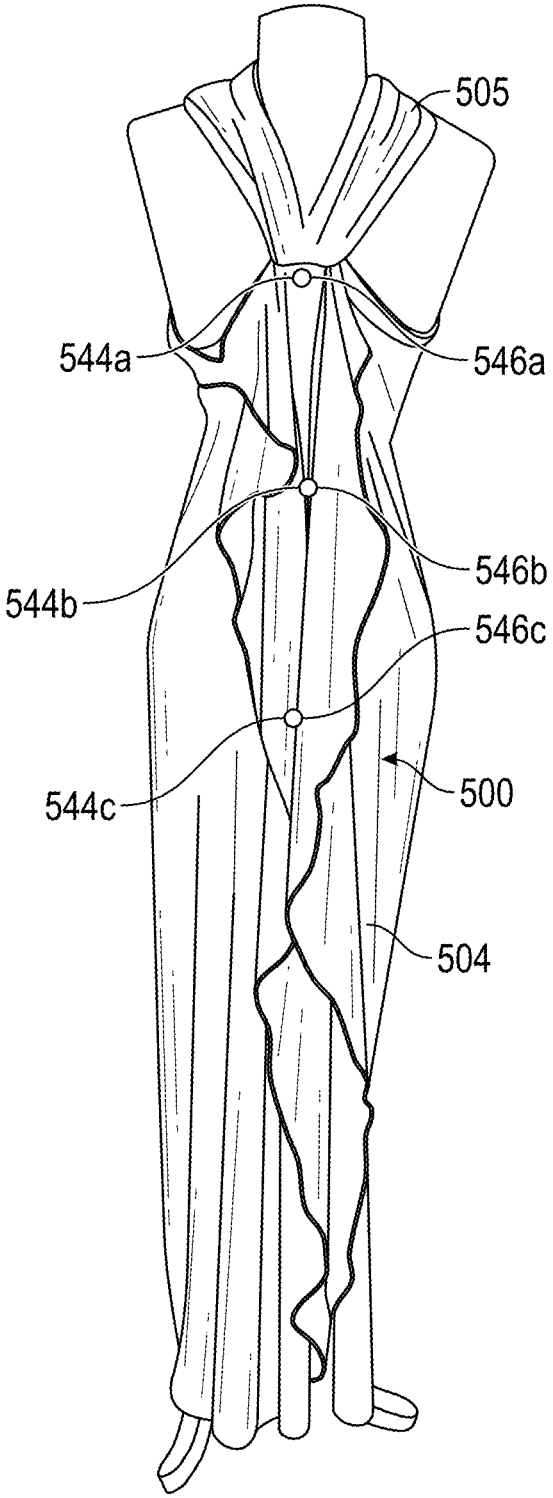
Figure 19Q:
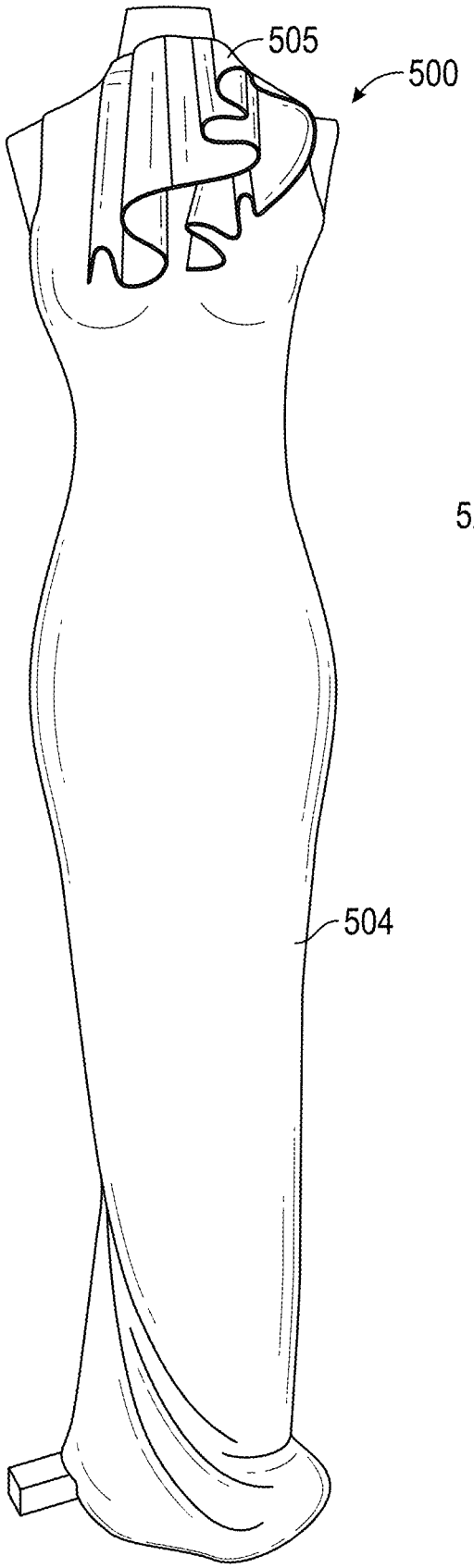
Figure 19R:
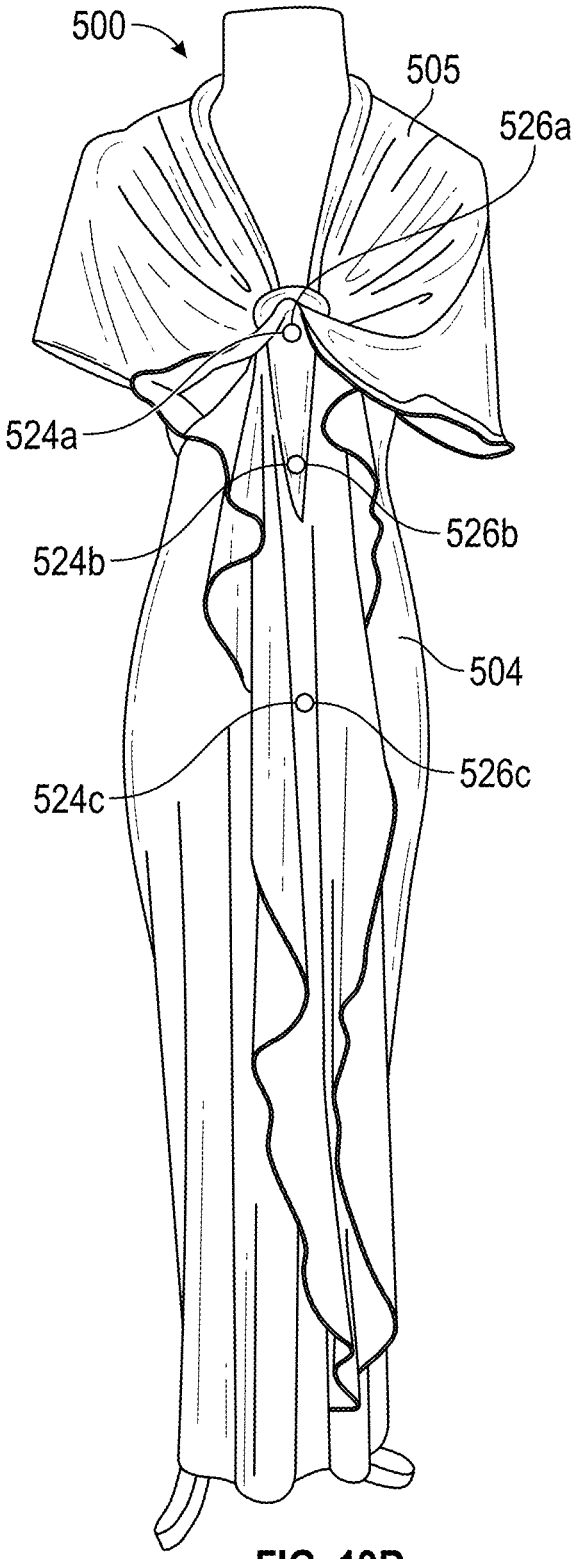
Figure 19S:
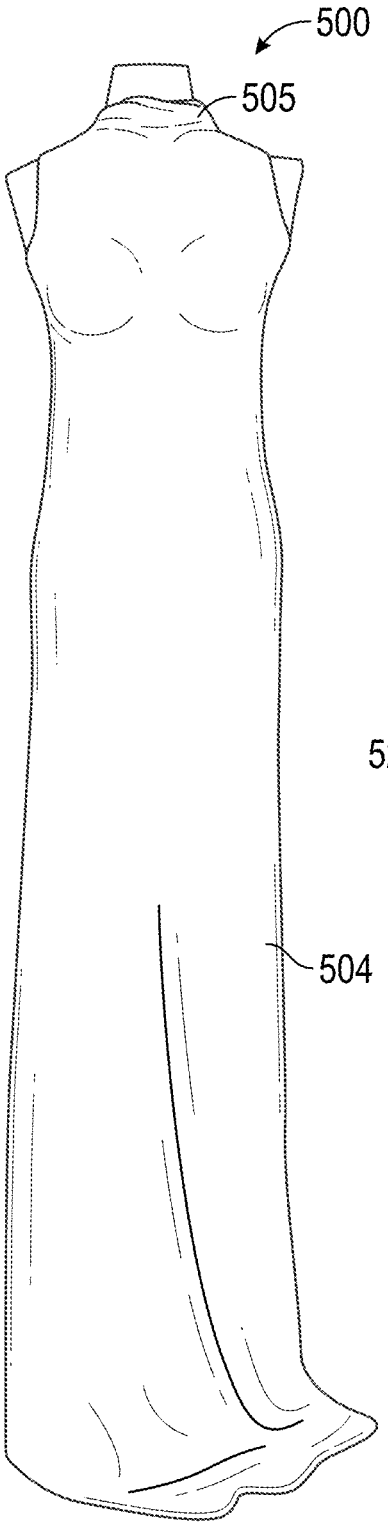
Figure 19T:
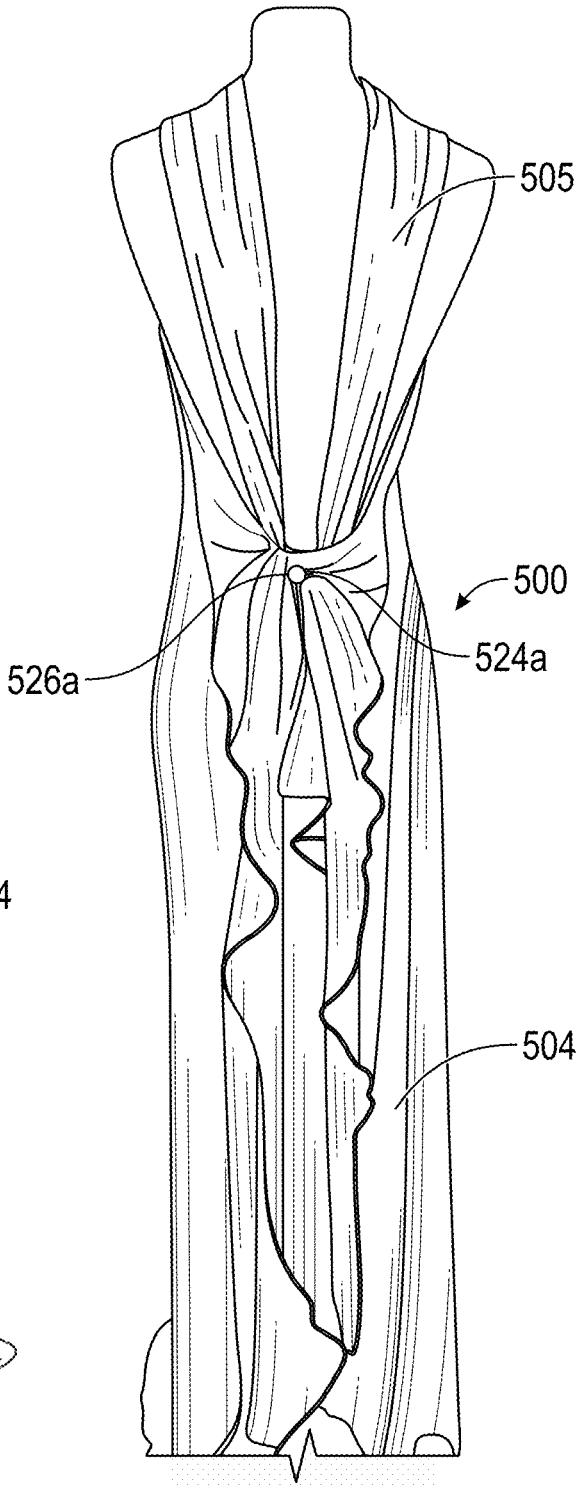
Figure 19U:
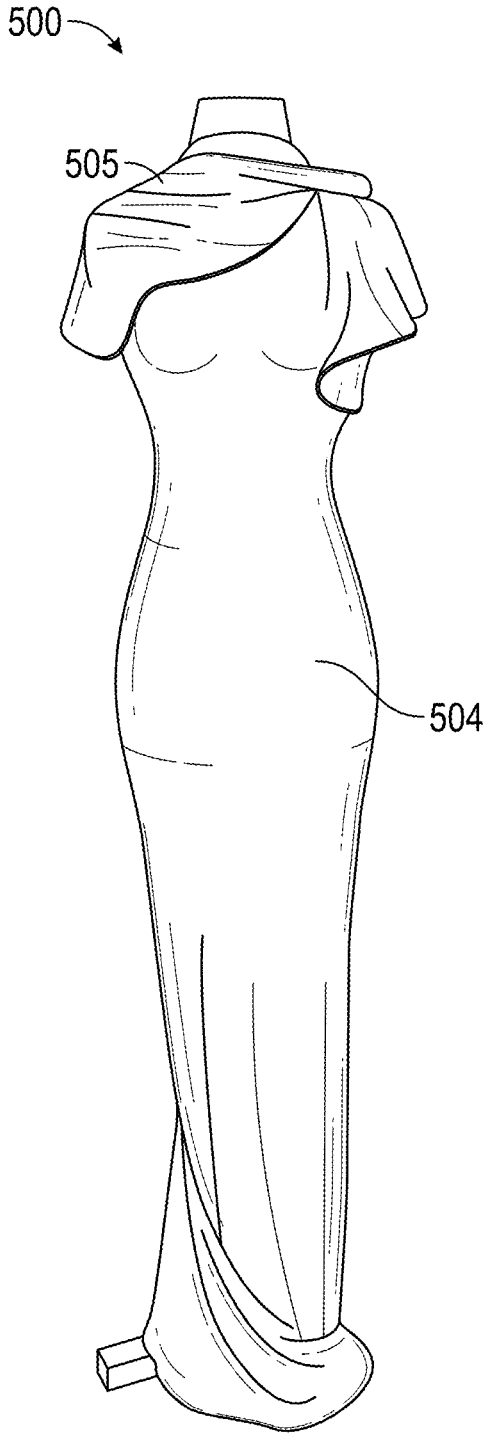
Figure 19V:
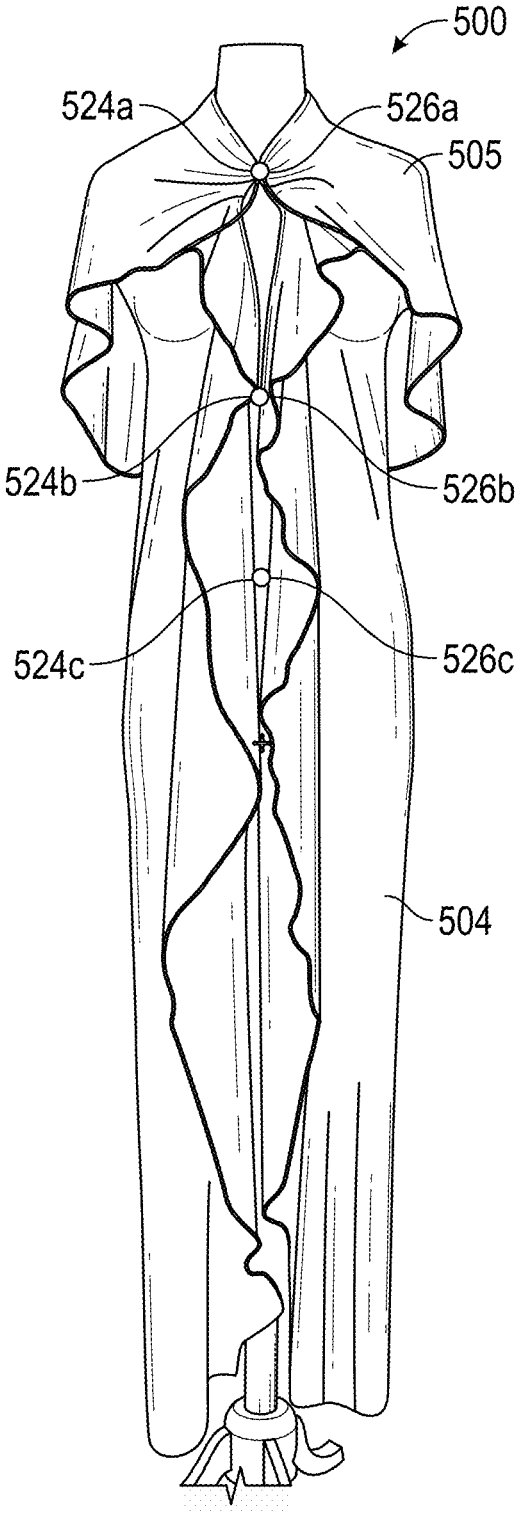
Figure 19W:
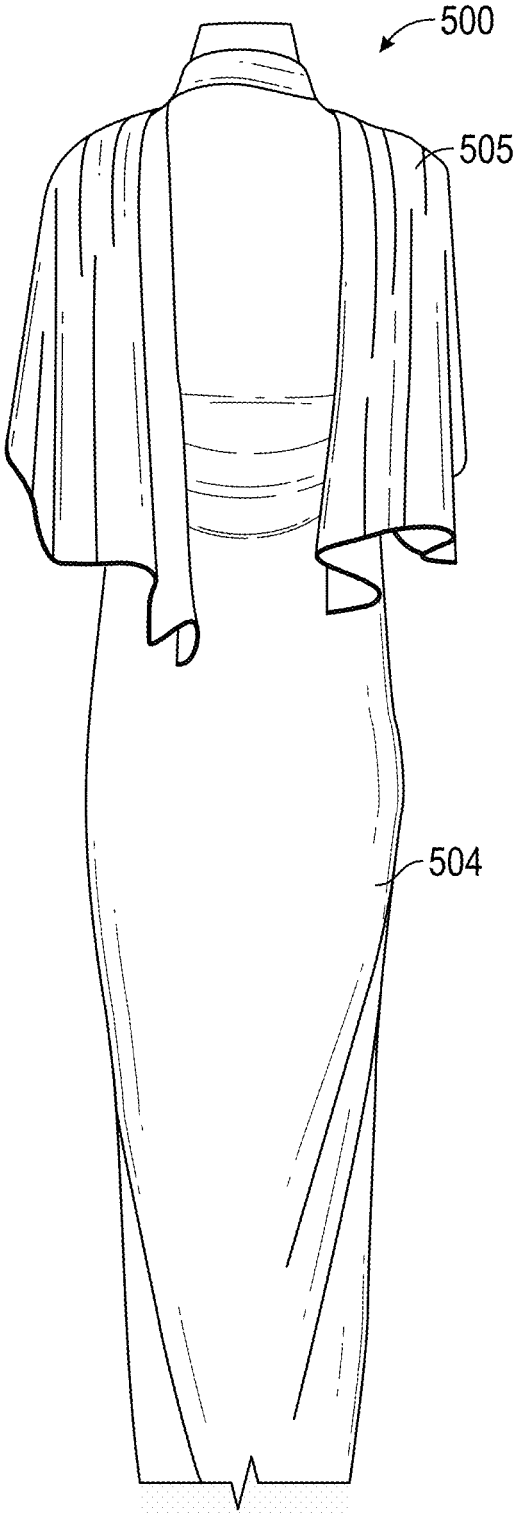
Figure 19X:
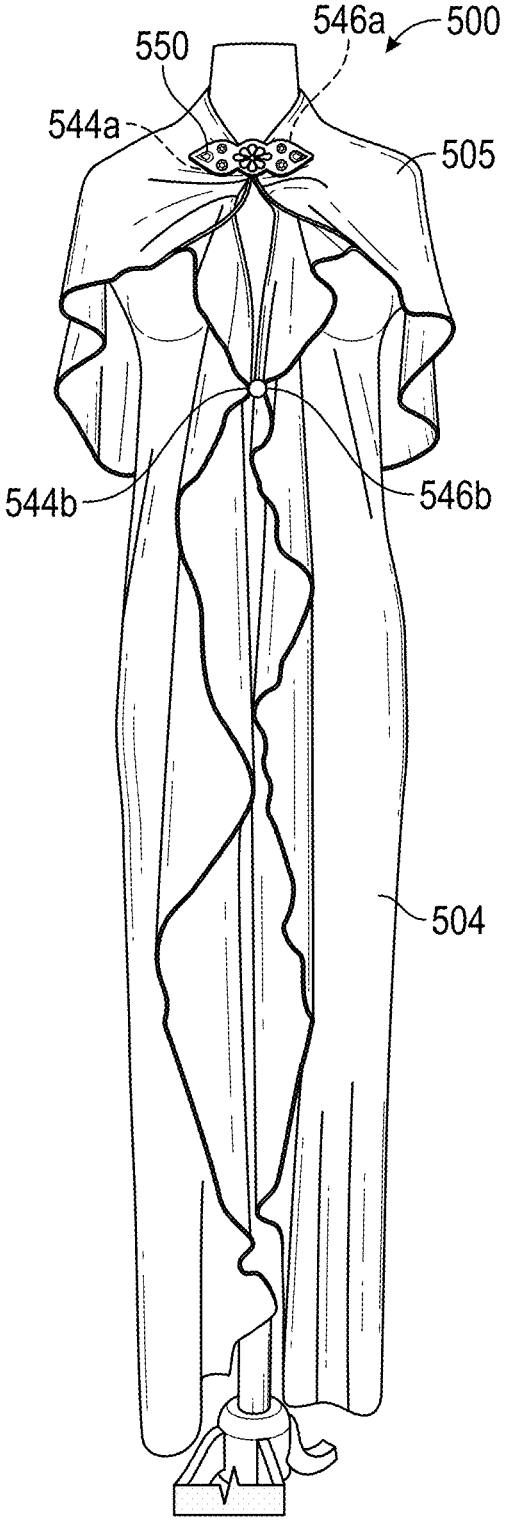

While the style of FIG. 19A may be satisfactory for some wearers, others may desire to take this style further by reconfiguring the garment to hide their arms by moving the draped material of the additional fabric panel 505 over their arms and onto their shoulders to create the style seen in FIGS. 19V and 19W. Similar to previous garments discussed, the wearer can alter the style by inter-connecting any set of fastening elements with an adornment 550, as shown in FIG. 19X. In this particular configuration, a decorative buckle 550 is used to interconnect and secure the fastening element 544*a* and the fastening element 546*a* together.

FIGS. 19C and 19D illustrate an additional style for the fifth reconfigurable garment 500. The first fabric panel 504 of the fifth reconfigurable garment 500 can be wrapped around the wearer under the armpits to create a V front style look. In this style, the fabric panel 504 is held by the wearer near fastening elements 544*b* and 546*b* behind the back of the wearer. The fastening elements 544*b* and 546*b* are brought underneath the armpits and secured behind the neck of the wearer. The wearer then takes the leftover material that is hanging along their backside (the top bit of fabric panel 504 and all of fabric panel 505) and ties it around their waist to create the effect of a draped belt shown in FIG. 19C. The neckline of the illustrated style results from draping the fabric panel 504 to provide an attractive ruffled front with a clean backless rear, as shown in FIG. 19D.

Additional styles for the fifth reconfigurable garment 500 are shown in FIGS. 19E-19T. For example, FIGS. 19G and 19H and FIGS. 191 and 19J show the fifth reconfigurable garment 500 styled as a turtleneck dress by placing the fabric panel 504 along the front of the wearer's body and securing the fastening element 544*a* to the fastening element 546*a* (which in this configuration are now located on the backside of the reconfigurable garment 500). To create the turtleneck effect, the user carefully twists the additional fabric panel 505 and simply ties the remaining fabric of the additional fabric panel 505 behind the neck while allowing for a loose drape to flow along their backside as shown in FIG. 19J. Alternatively, as shown in FIG. 19H, the wearer can twist the additional fabric panel 505 and secure the twisted additional fabric panel 505 to the fastening element 544*a* or the fastening element 546*b*, which can be located on the backside of the garment in the illustrated configuration.

FIG. 19K showcases the reconfigurable garment 500 as a loose drape halter front dress. In this style, the fabric panel 504 is held by the wearer near the fastening element 544*a* and the fastening element 546*a* in front of the wearers body. The two fastening elements 544*a*, 546*a* then are secured behind the neck of the wearer. The user takes the leftover material that is hanging along their frontside (e.g., the top bit of the fabric panel 504 and all of the additional fabric panel 505) and the leftover fabric material can be tied around the waist to create the effect of a belt, as shown in FIG. 19L.

FIGS. 19M-19S illustrate the reconfigurable garment 500 with the fabric panel 504 reversed on the wearer's body and with the fabric panel 504 positioned so that the back of the reconfigurable garment 500 illustrated in FIG. 19A becomes the front of the reconfigurable garment 500 illustrated in FIGS. 19M-19T. When positioned in this manner, the front of the reconfigurable garment 500 in the earlier figures becomes the back of the reconfigurable garment 500 in the later figures to create another extended series of unique styles. The reconfigurable garment 500 is shown with the fastening elements down the back of the wearer with the additional fabric panel 505 being positioned as a shawl by wrapping the additional fabric panel 505 around the neck of the wearer. FIGS. 19V and 19W illustrate the reconfigurable garment 500 with the additional fabric panel 505 as a shawl, cap or scarf. As illustrated, the additional fabric panel 505 can be adjusted pro cover more of the arms of the wearer or less of the arms of the wearer. Finally, FIG. 19X illustrates the reconfigurable garment 500 using the adornment 550 to join a plurality of fastening elements to create yet additional styles.

As can be seen, there are a wide variety of styles possible with the single reconfigurable garment 500. At least eleven different styles are presented for the single garment shown in FIG. 5. While eleven distinct styles of the fifth reconfigurable garment 500 have been shown and described, more styles also are possible. It is also worth noting that the user can also optionally reverse the additional fabric panel 505 and use other fastening configurations to create additional styles similar to outer garments discussed herein.

FIGS. 20A-20I illustrate the garment 1100 of FIG. 7 configured in three different looks. While a number of different styles will be discussed, there are many more styles possible using the reconfigurable garment 1100 of FIG. 7.

Figure 20A:
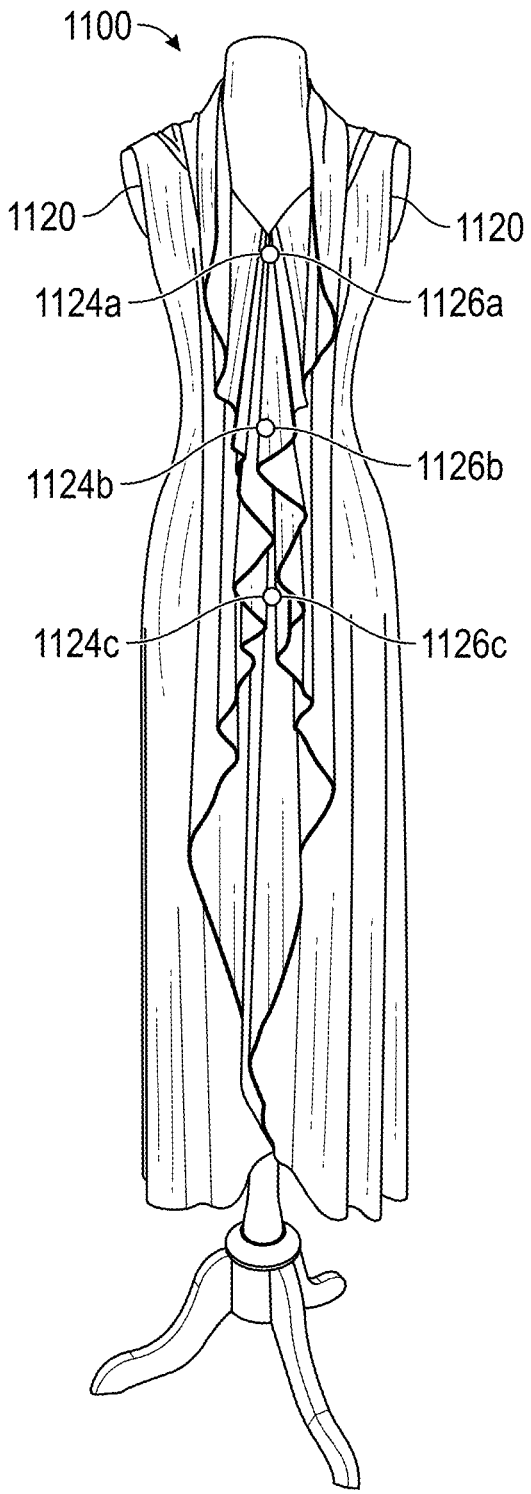
FIGS. 20A-20I are views of the reconfigurable garment of FIG. 6 and FIG. 7 styled into various looks.
Figure 20B:
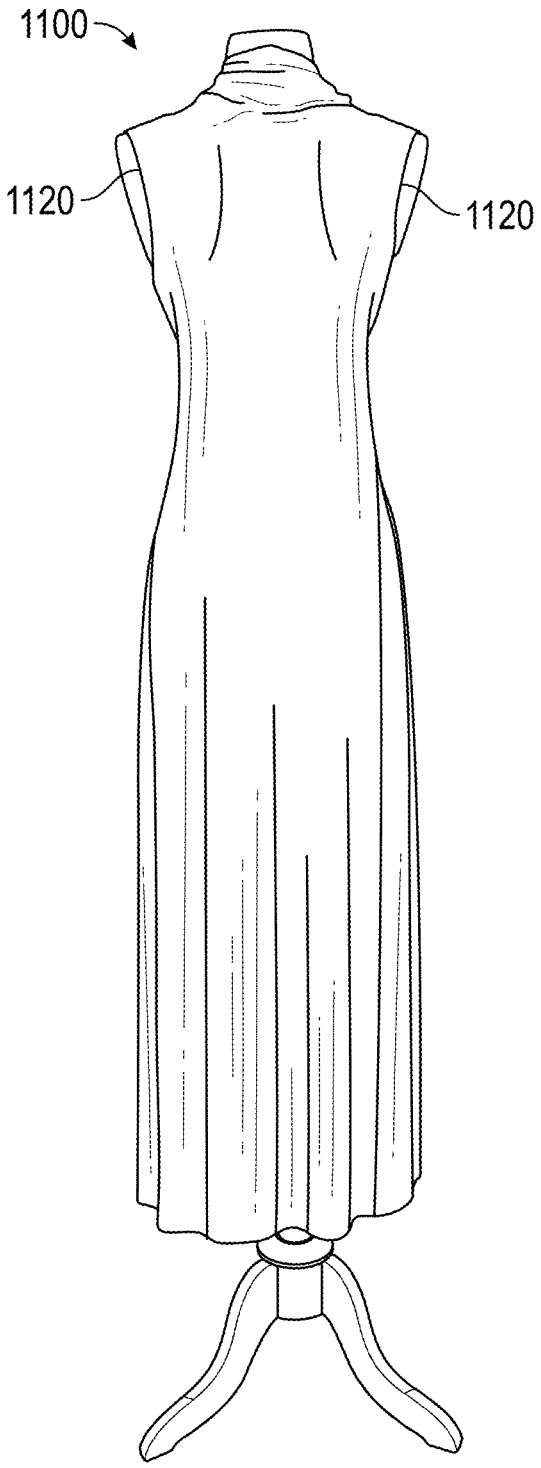

As shown in FIGS. 20A and 20B, the reconfigurable garment 1100 can comprise a V-neck with a ruffle extending down the middle of the front of the garment 1100. To create the style of FIGS. 20A-20B, the wearer would put their arms through the openings 1120, similar to putting on a vest. With the reconfigurable garment 1100 draped onto the shoulders of the wearer, the wearer fastens the relevant fastening elements 1124, 1126 together. In the illustrated configuration, the upper fastening elements 1124*a*, 1126*a* are connected, the middle fastening elements 1124*b*, 1126*b* are connected, and lower fastening elements 1124*c*, 1126*c* are connected. These fastening elements combinations close the front of the garment 1100. FIG. 20A is a front view and FIG. 20B is a rear view.

Figure 20C:
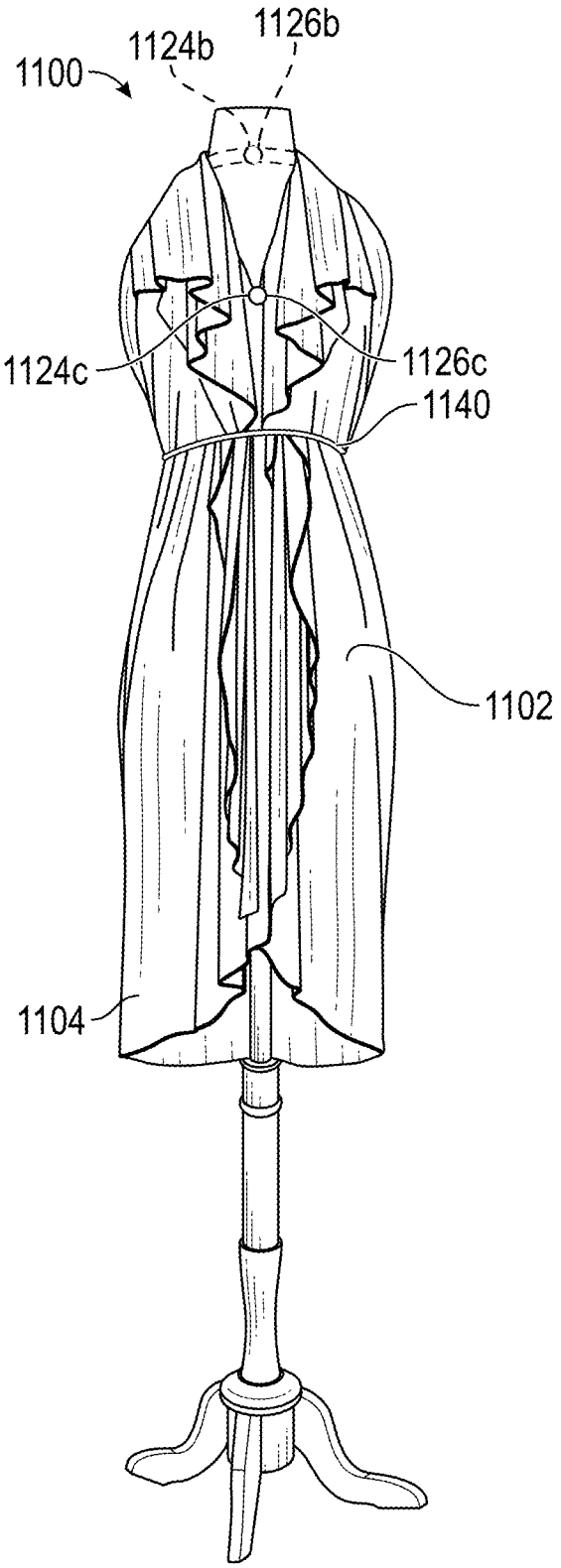
Figure 20D:
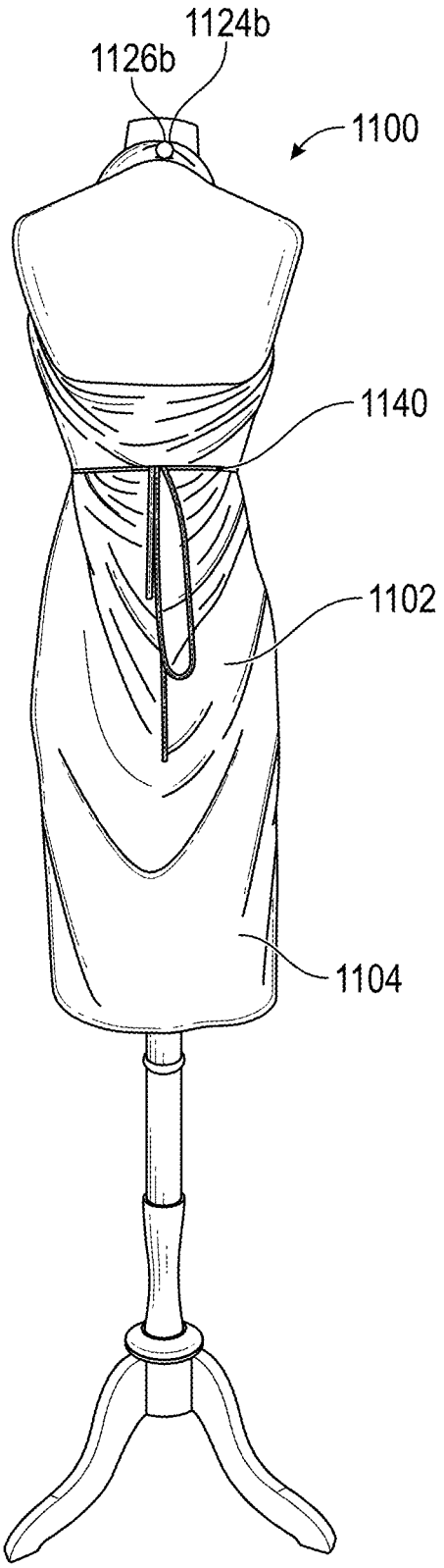

FIGS. 20C and 20D illustrate the reconfigurable garment 1100 of FIG. 7 styled in a halter look with an optional belt. In the illustrated configuration, the fabric panel 1104 of the garment 1100 is folded in half along a horizontal line. In other words, the upper portion that includes the openings 1120 is tucked inside of the lower portion. The fastening element 1124*b* and the fastening element 1124*b* are secured together to form a halter strap around the back of the neck of the wearer. To form the front of the garment shown in FIGS. 20C and 20D, the fastening element 1124*c* is connected to the fastening element 1126*c*. As described above, a belt 1140 or other suitable element can be secured around the wearer. In the illustrated configuration, the belt 1140 can be wrapped around the waist of the wearer and tied into position.

Figure 20E:
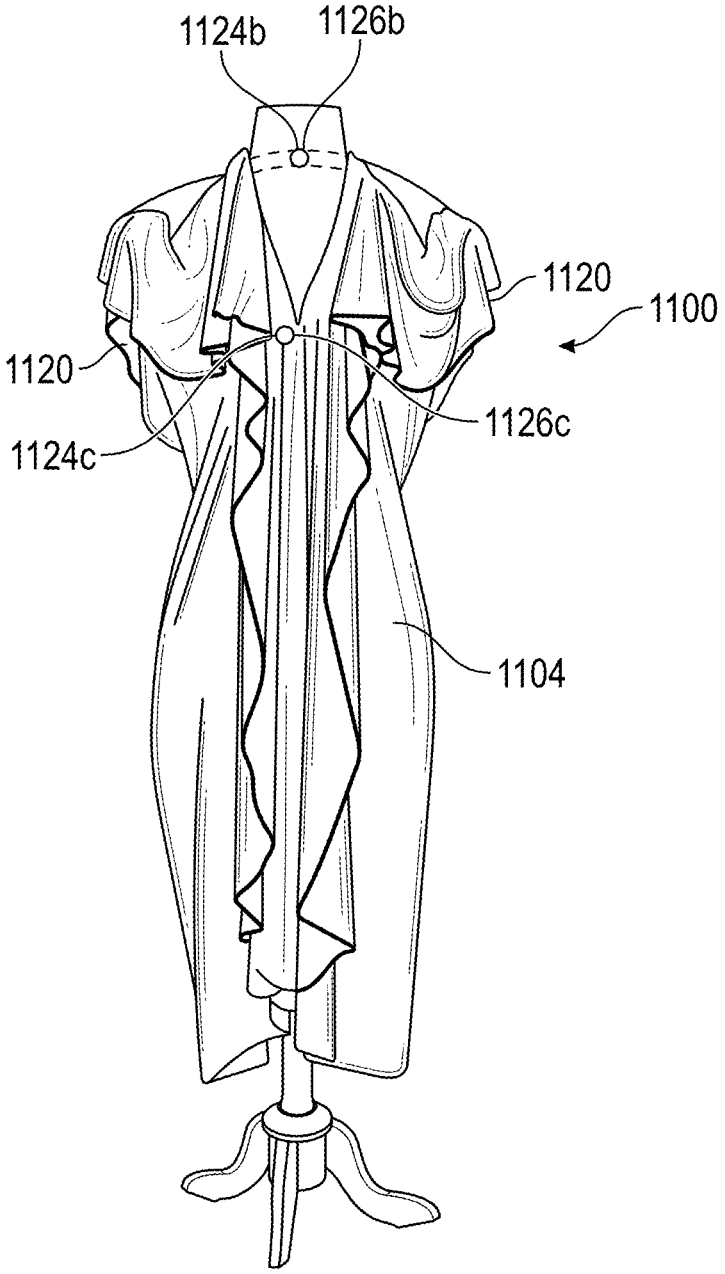
Figure 20F:
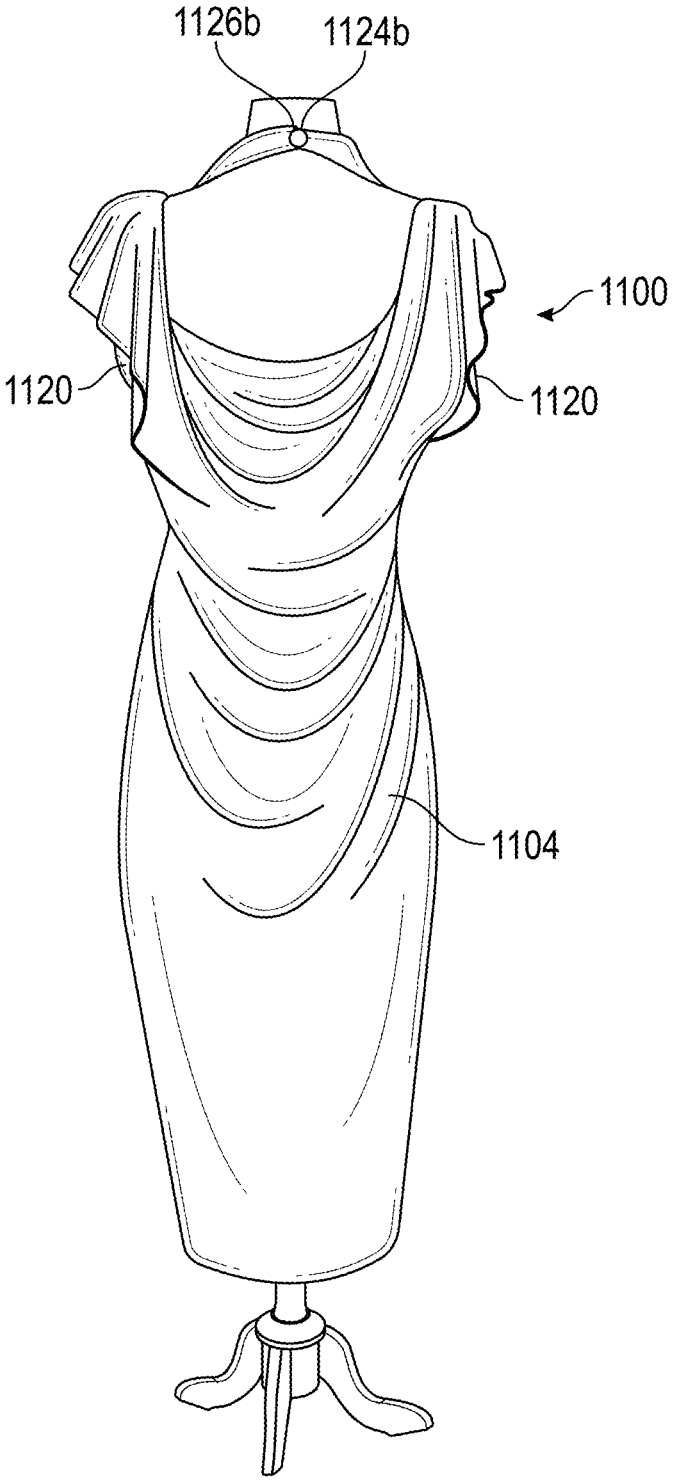
Figure 20G:
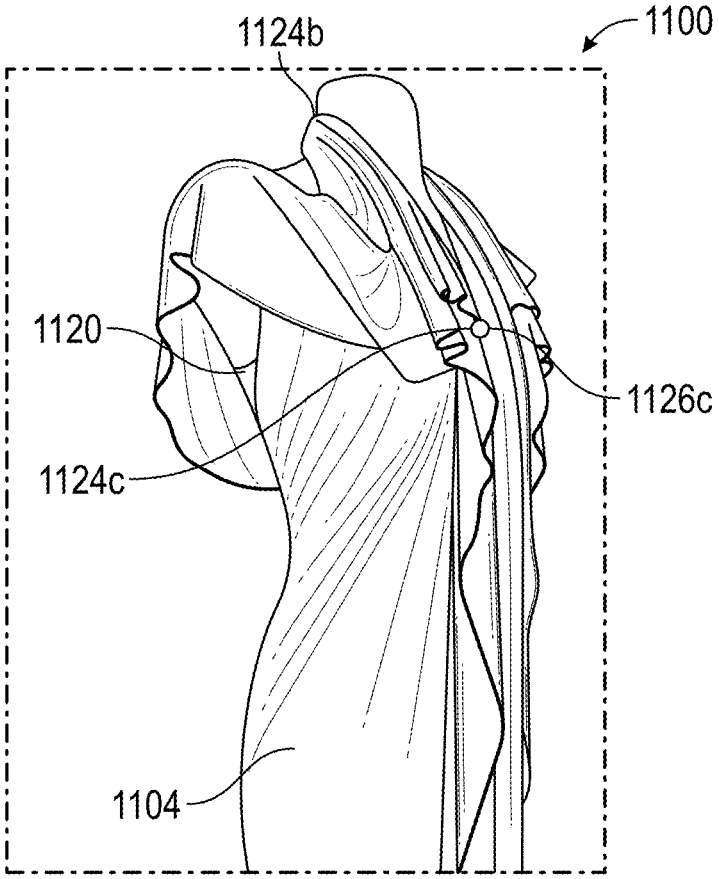

FIGS. 20E-20G illustrate the reconfigurable garment 1100 of FIG. 7 styled to provide a cold-shoulder look. The garment 1100 is configured by putting on the reconfigurable garment 1100 like a duster vest using the armholes 1120 and then securing the fastening elements 1124*b*, 1126*b* together behind the neck of the wearer. With the fastening elements 1124*b*, 1126*b* connected, the excess fabric drops along the backside of the wearer to create an exposed shoulder style. In some configurations, the fastening elements 1124*c*, 1126*c* can be connected together to close the front of the reconfigurable garment 1100. Other configurations also are possible.

Figure 20H:
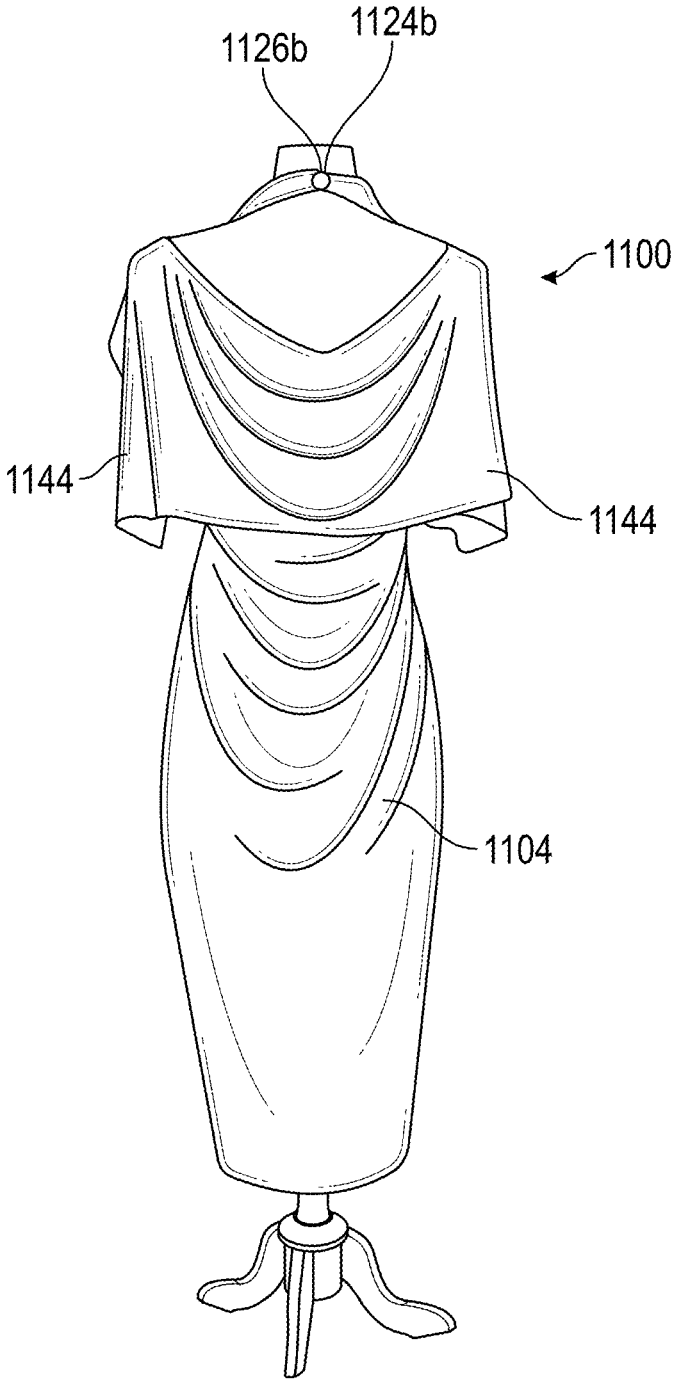
Figure 20I:
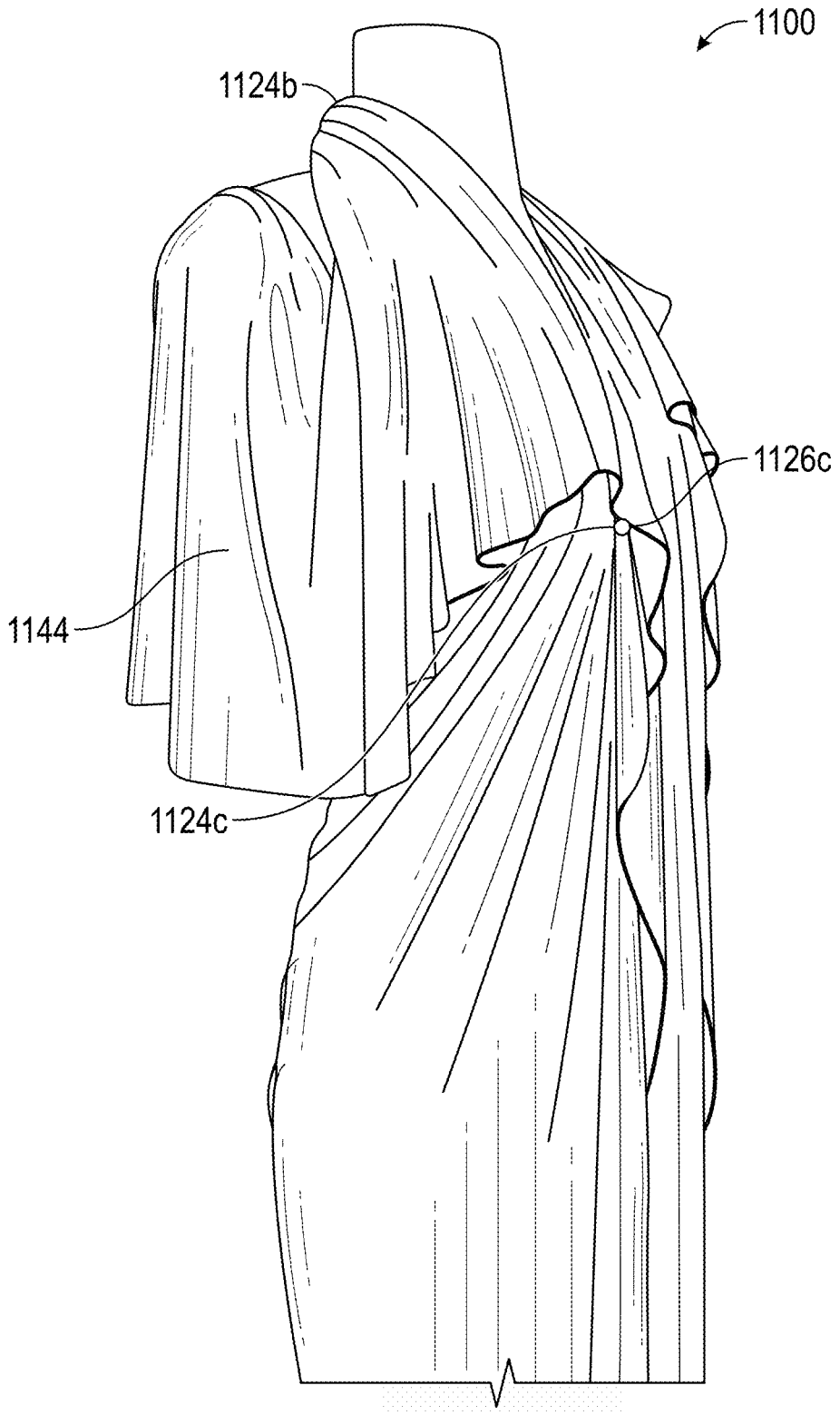

FIGS. 20H-20I illustrate a similar look to the configuration shown in FIG. 20E-20G. In FIGS. 20H-20I, the reconfigurable garment 1100 of FIG. 7 is styled similarly to the style of FIG. 20E-20G. The main difference between the two styles is the addition of drape 1144 to the arms of the wearer.

FIGS. 21A-21M illustrate the garment of FIGS. 8 and 9 in various styles. As discussed above, the garments 1100, 1200 include sleeves 1130, 1230. The sleeves 1130, 1230 can be used to provide further styles to the garments 1100, 1200 of FIGS. 6 and 7.

Figure 21A:
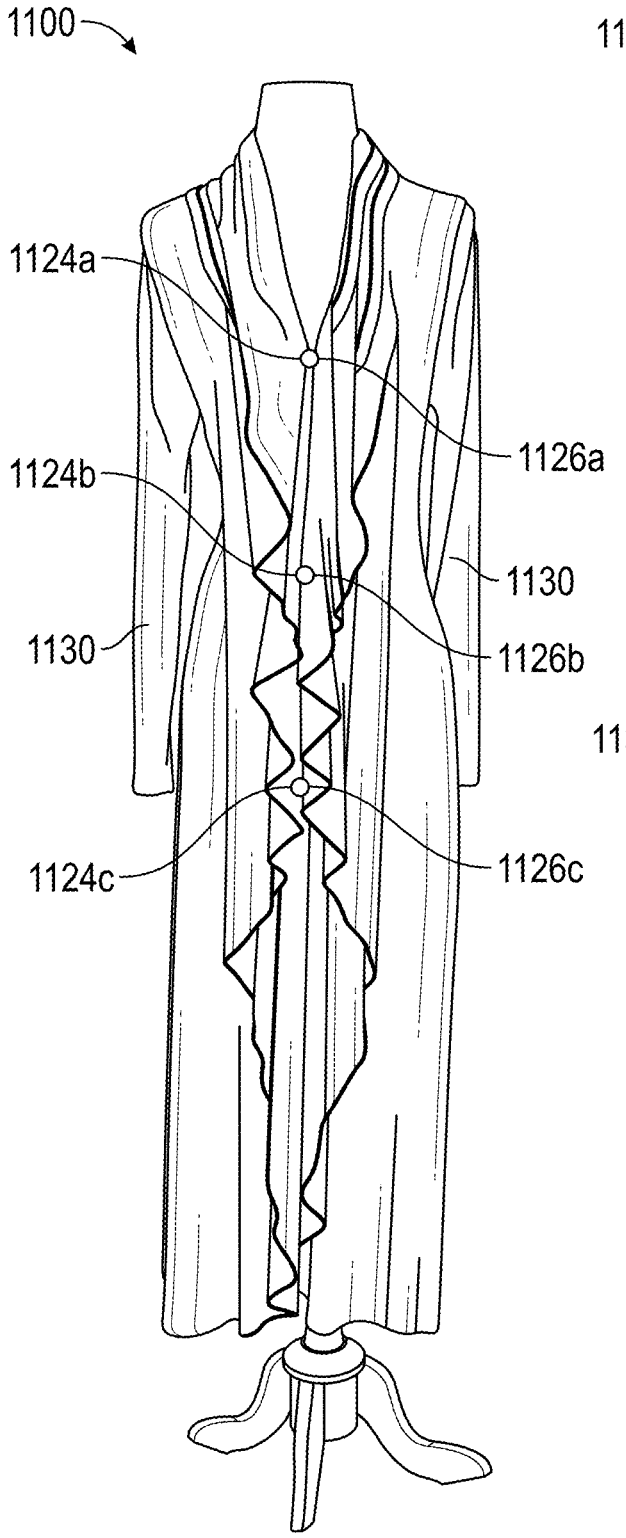
FIGS. 21A-21N are views of the reconfigurable garment of FIG. 8 and FIG. 9 styled into various looks.
Figure 21B:
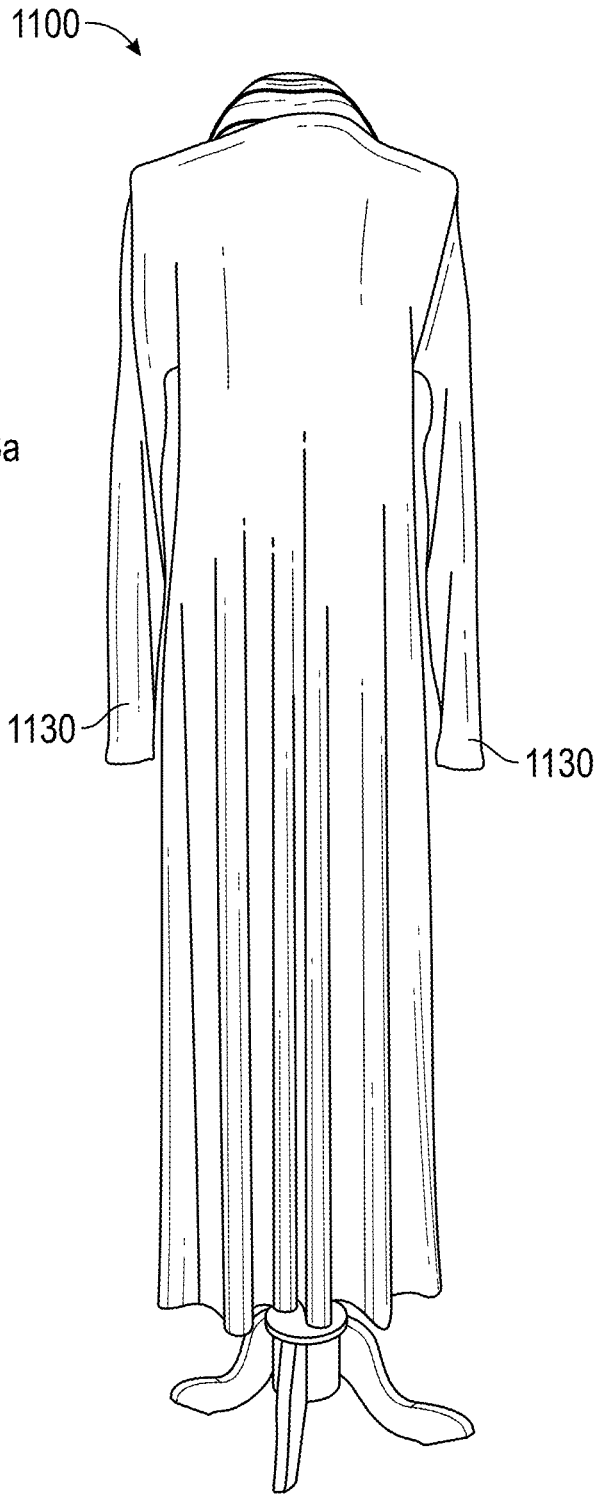

As shown in FIGS. 21A-21B, the reconfigurable garment 1100 can comprise a V-neck with a ruffle extending down the middle of the front of the garment 1100. To create the style of FIGS. 21A-21B, the wearer would put their arms through the openings 1120, similar to putting on a vest, and through the sleeves 1130. With the reconfigurable garment 1100 draped onto the shoulders of the wearer, the wearer fastens the relevant fastening elements 1124, 1126 together. In the illustrated configuration, the upper fastening elements 1124*a*, 1126*a* are connected, the middle fastening elements 1124*b*, 1126*b* are connected, and lower fastening elements 1124*c*, 1126*c* are connected. These fastening elements combinations close the front of the garment 1100. FIG. 21A is a front view and FIG. 21B is a rear view. FIG. 21N illustrates the look of FIGS. 21A and 21B in combination with a belt 1140 that can be arranged and configured in accordance with any of the descriptions elsewhere in this disclosure.

Figure 21C:
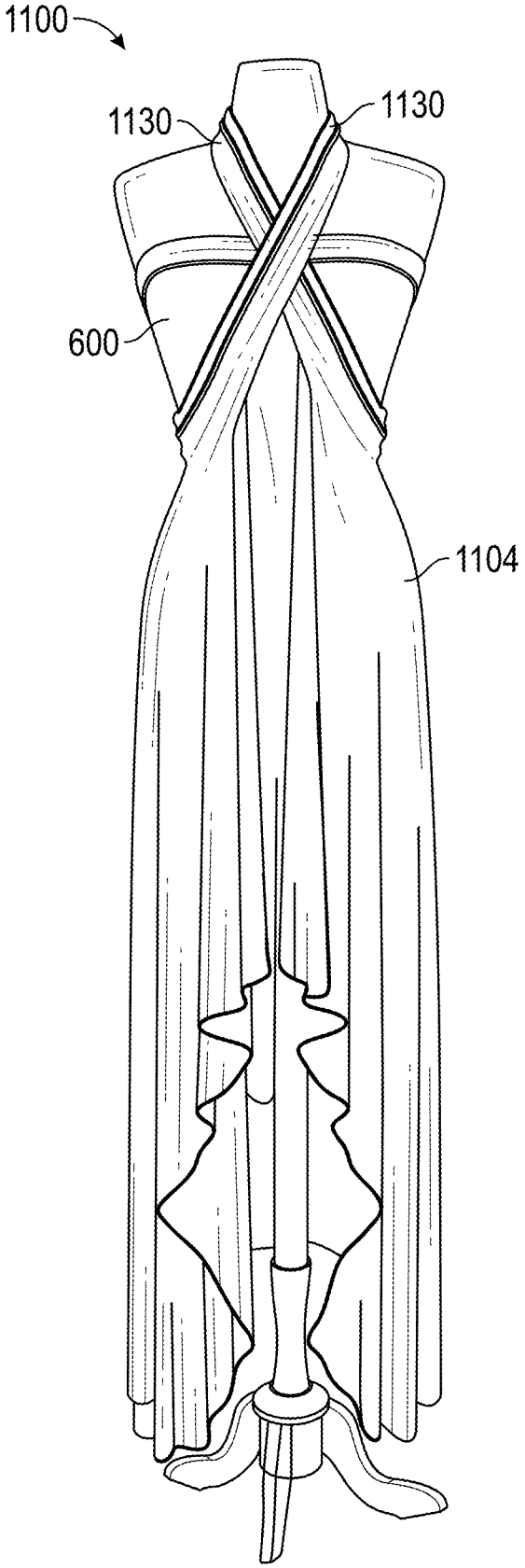
Figure 21D:
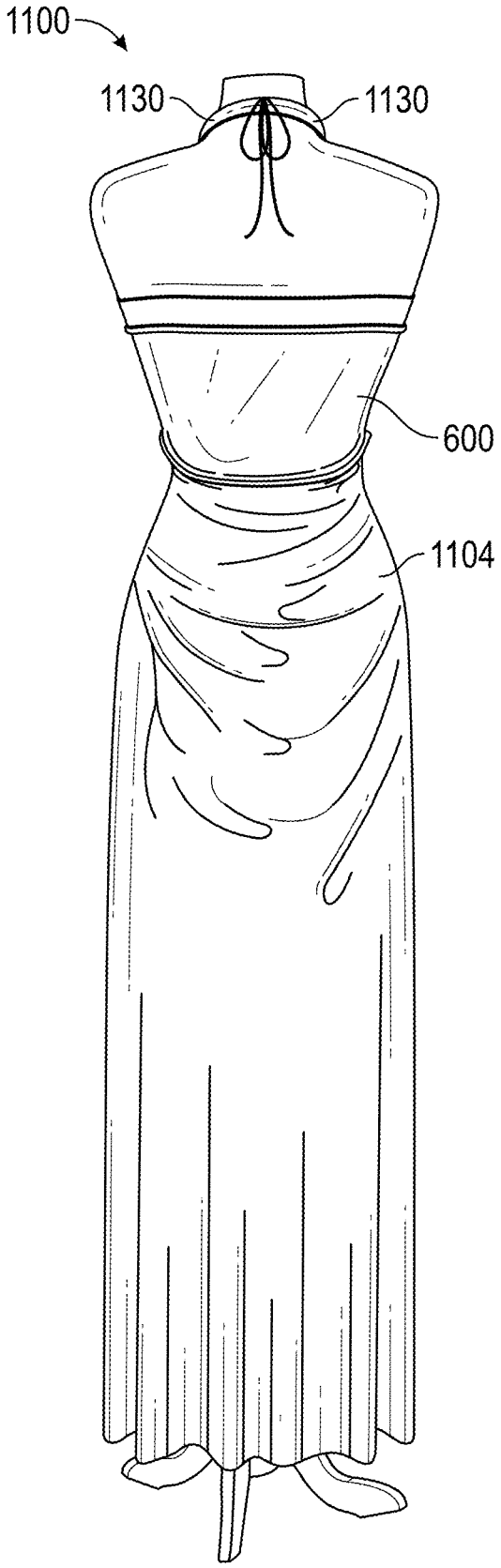

FIGS. 21C and 21D illustrate the reconfigurable garment 1100 of FIG. 7 styled in a long evening wear look. To achieve this look, the wearer holds the fabric panel 1104 against the back of the wearer and the sleeves 1130 are crossed around the front chest of the wearer before being tied around the neck of the wearer. In some configurations, the front of the garment can be closed using the fastening elements. In the illustrated configuration, however, the fastening elements are not secured together.

Figure 21E:
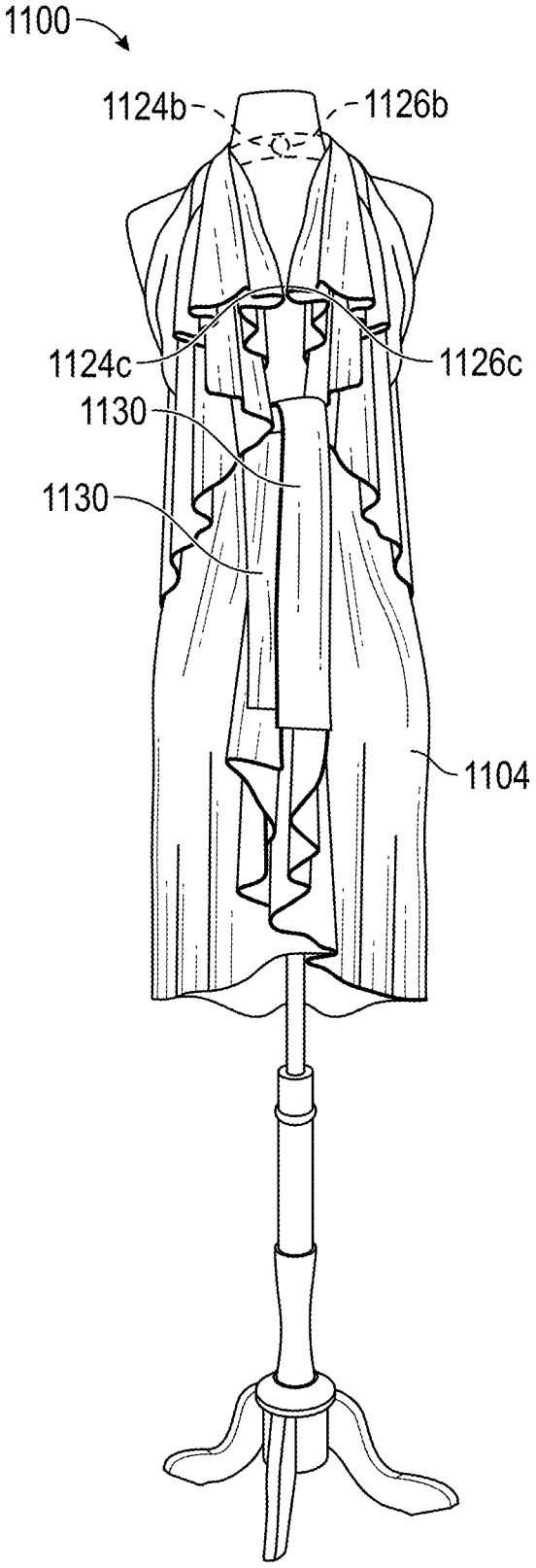
Figure 21F:
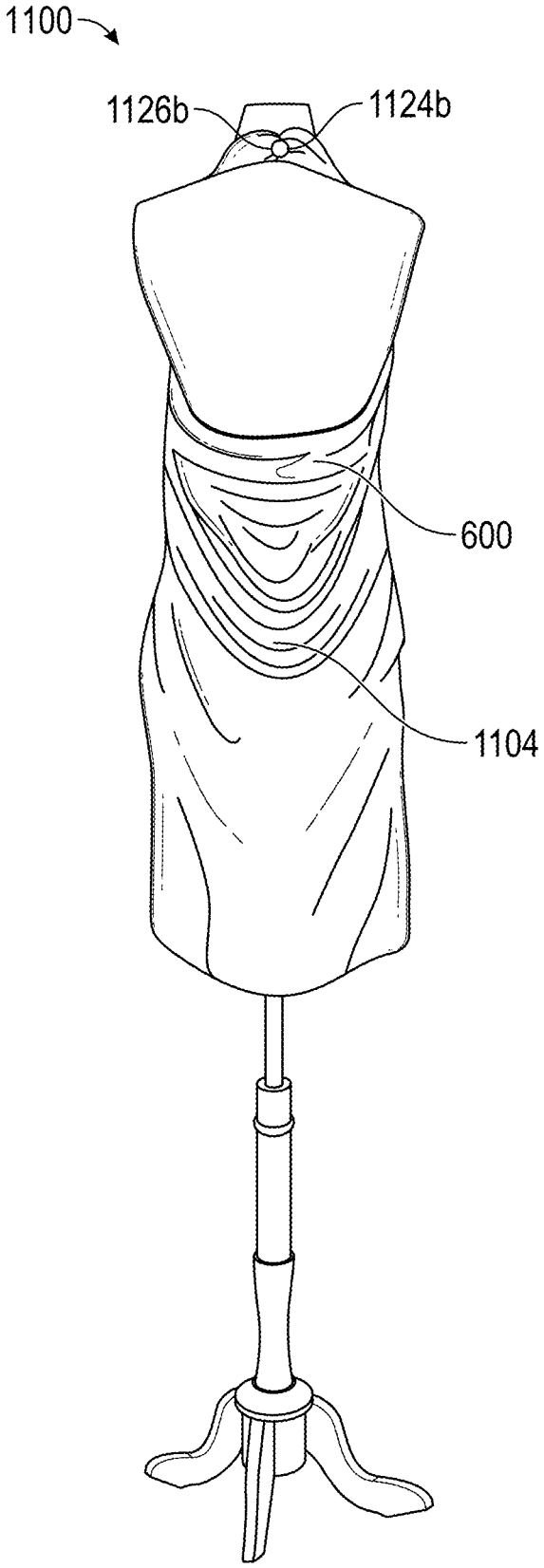
Figure 21G:
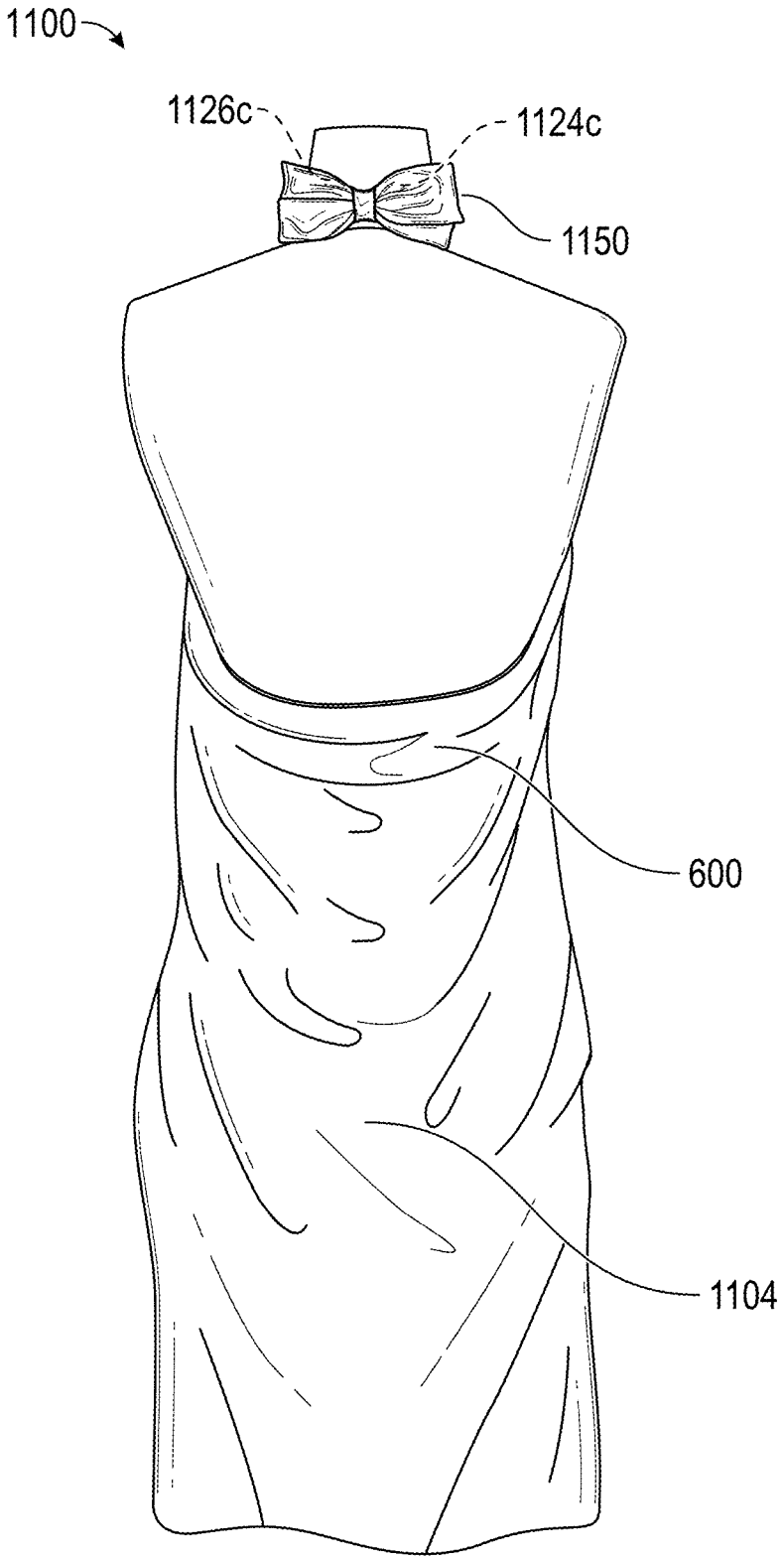
Figure 21H:
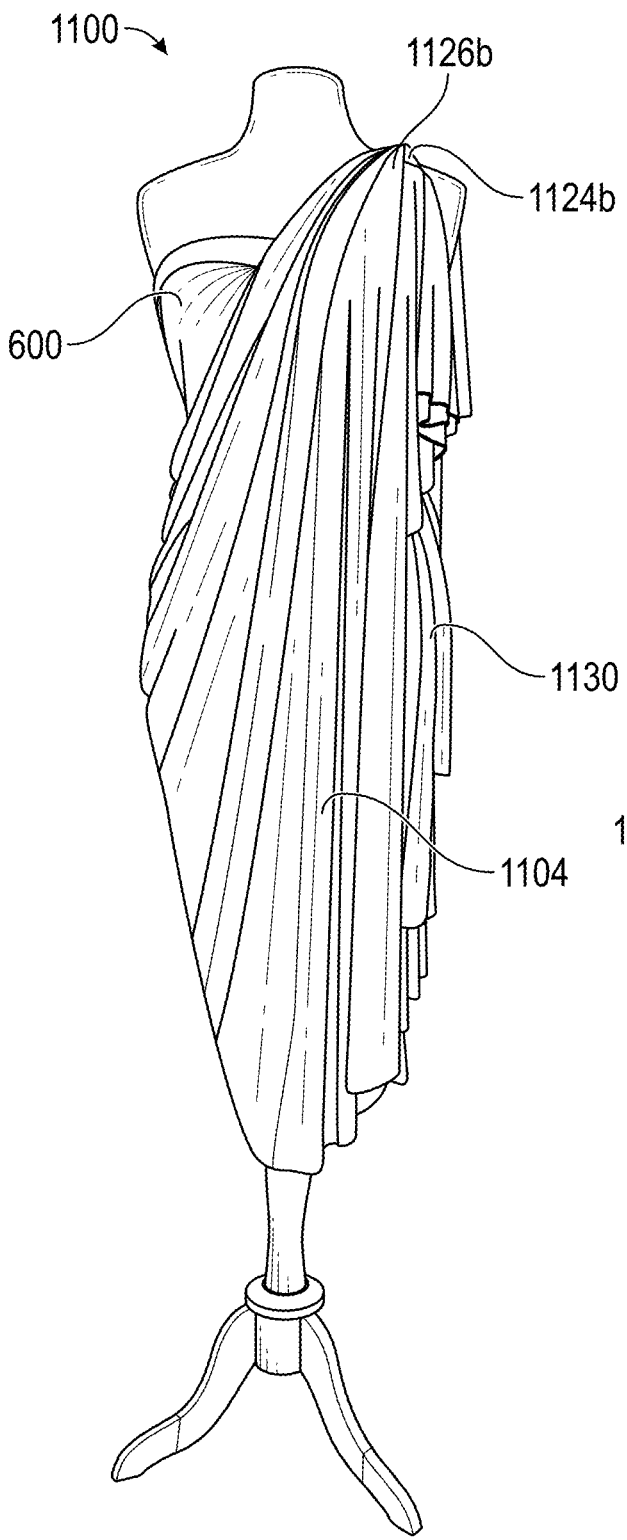
Figure 21I:
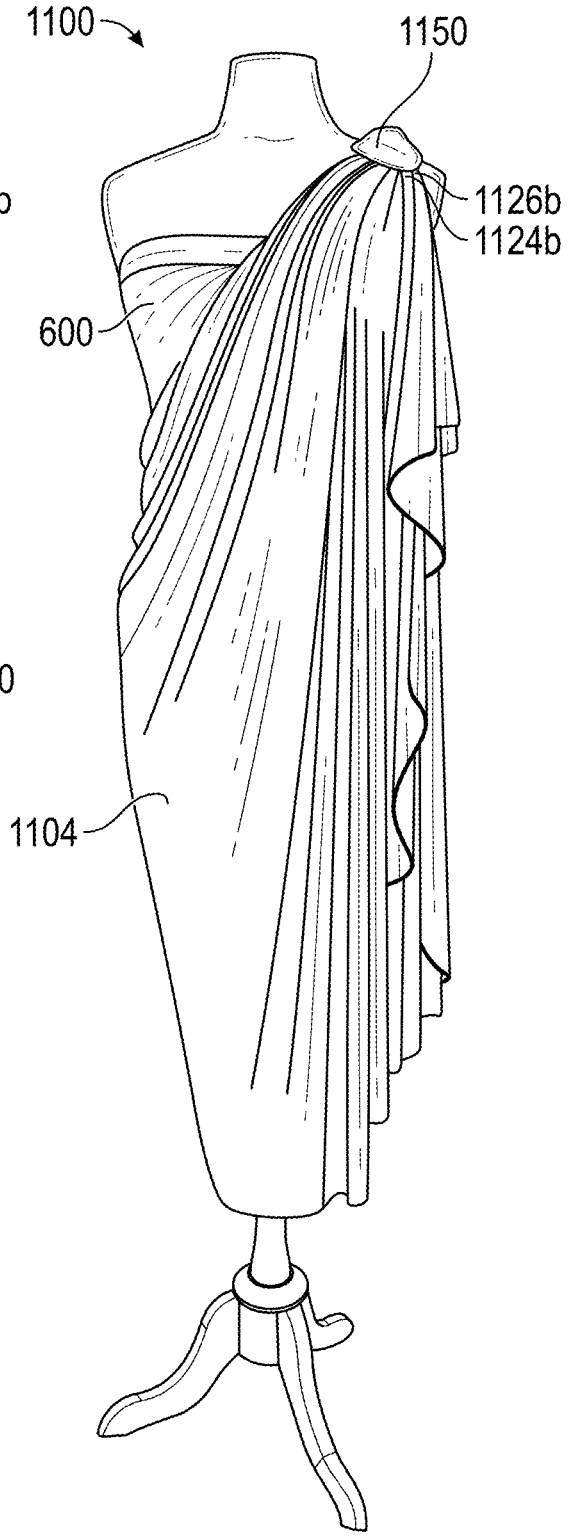
Figure 21J:
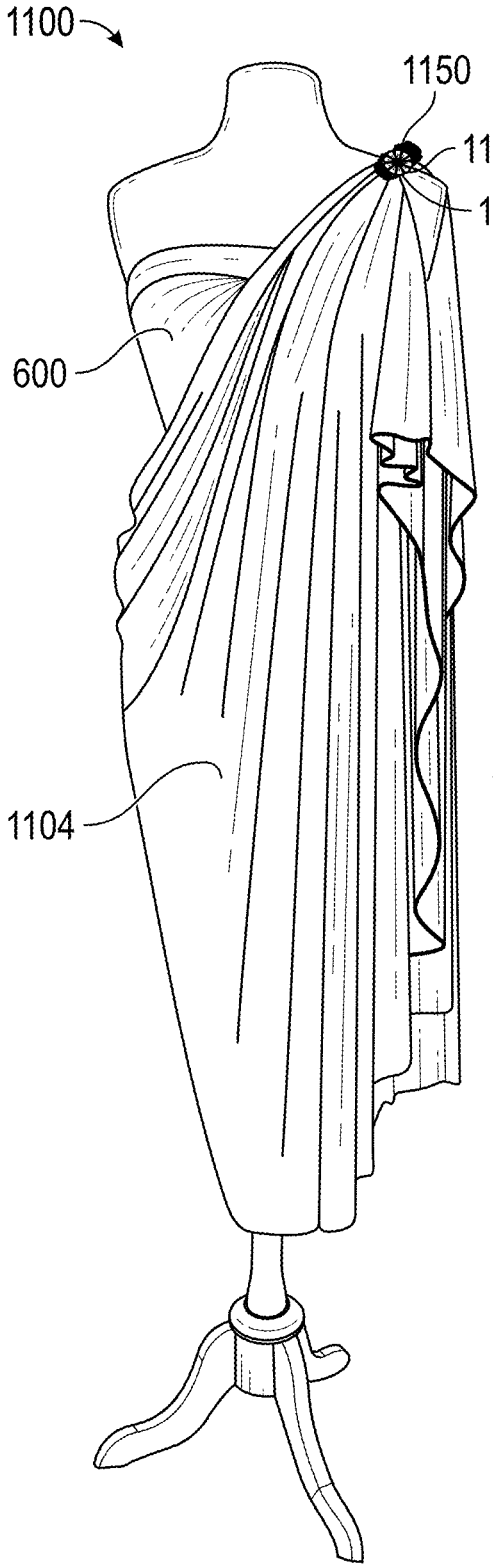
Figure 21K:
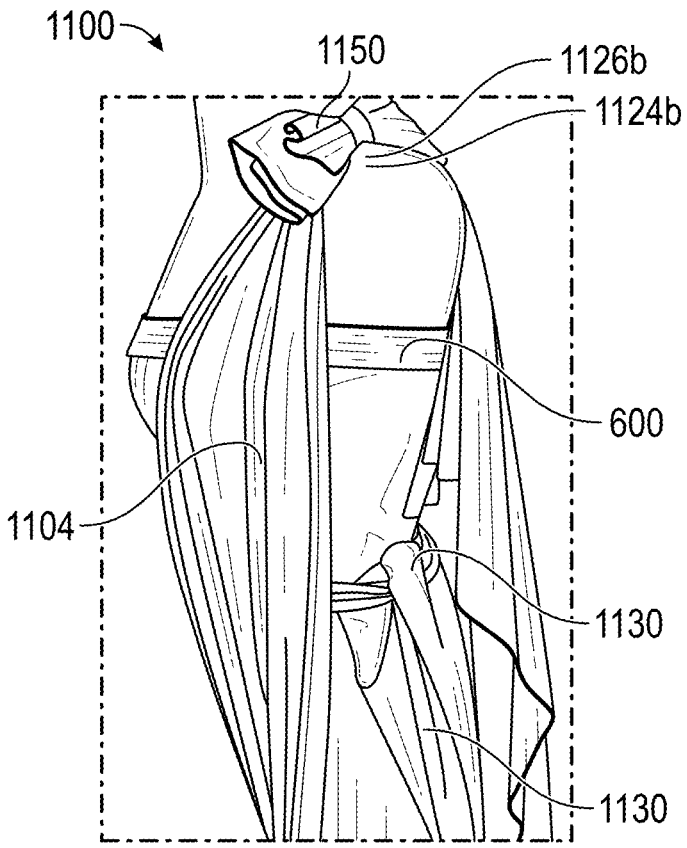

FIGS. 21E-21G illustrate the reconfigurable garment 1100 of FIG. 7 styled in a halter look. To achieve the look in FIGS. 21E-21F, the fabric panel 1104 is held against the back of the wearer. The fastening elements 1124*b*, 1126*b* are brought up from under the arms and connected behind the neck of the wearer. To close the front of the reconfigurable garment, the fastening elements 124*c*, 126*c* are connected in the chest area. The sleeves 1130 complete the look by being tied around the waist of the wearer.

Figure 21L:
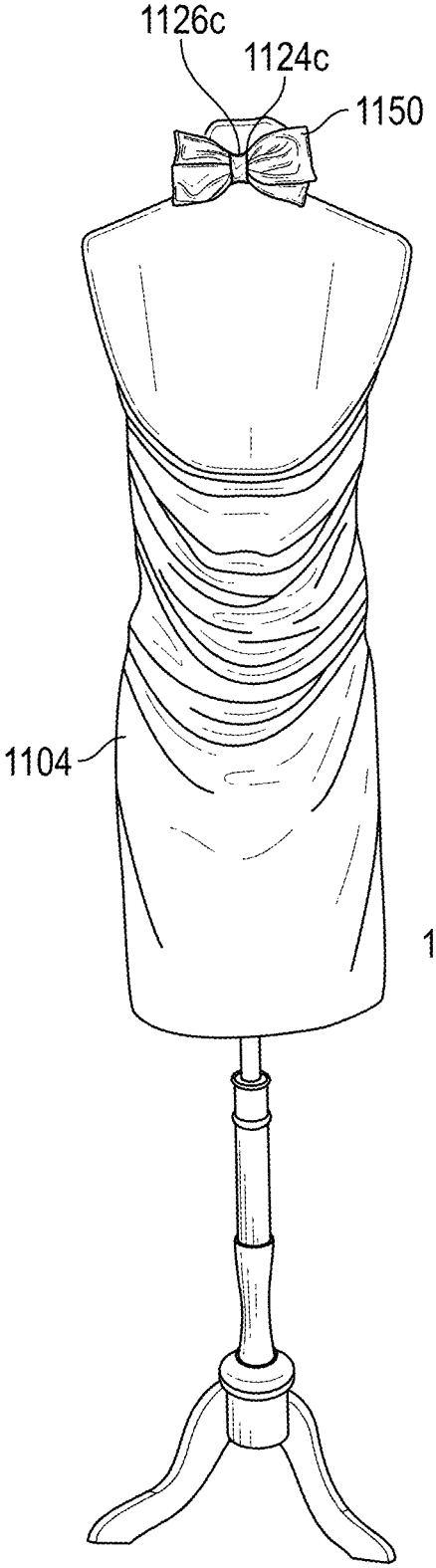
Figure 21M:
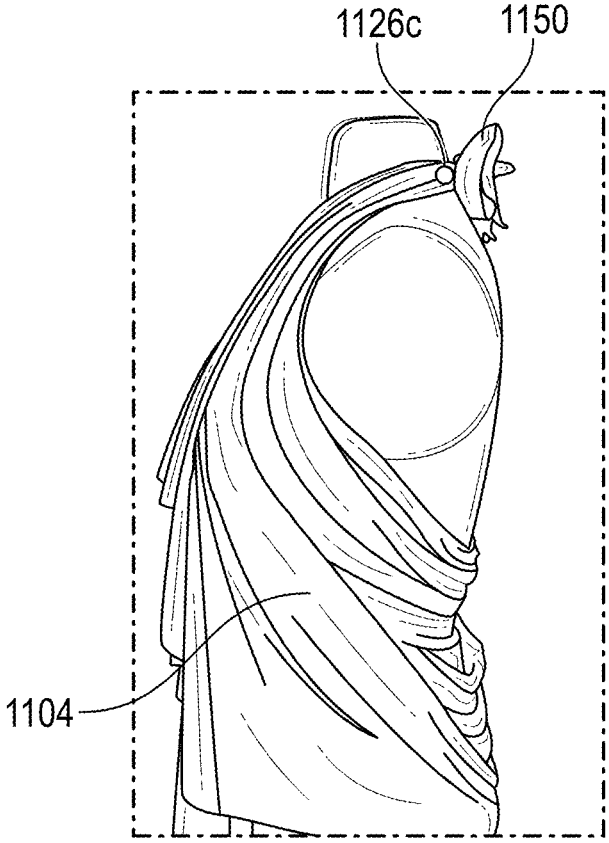
Figure 21N:
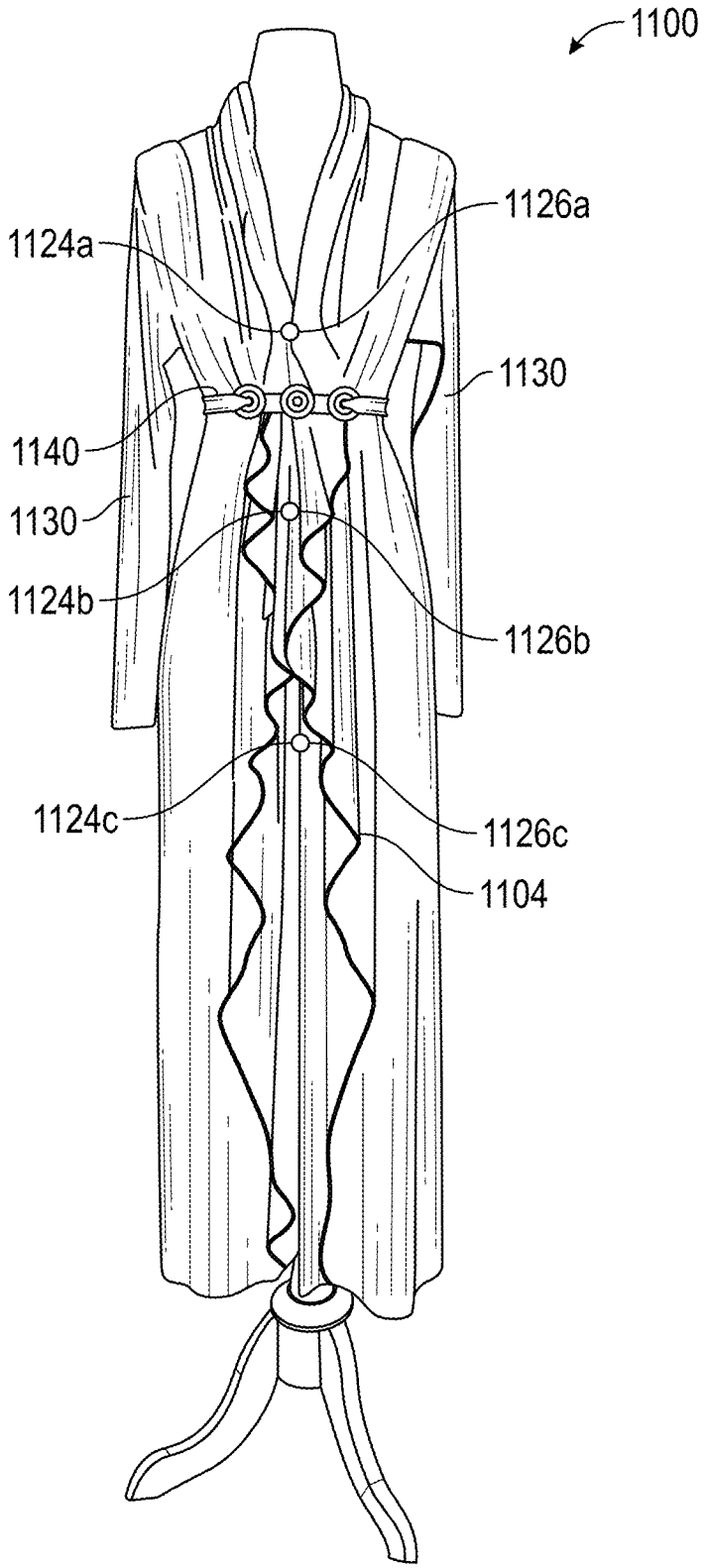

FIG. 21G and FIGS. 21L-21M illustrate an alternative look for the reconfigurable garment of FIGS. 21E-21G in which an adornment 1150 (e.g., a bow) can be secured to the fastening elements 1124*c*, 1126*c*. In the illustrated configuration, the adornment 1150 connects to the fastening elements 1124*c*, 1126*c* and spans the distance between these fastening elements 1124*c*, 1126*c*.

Notably, the illustrated configurations of FIGS. 21E-21G can include a tube dress 600 under the reconfigurable garment 1100. The tube dress 600 in the illustrated configuration is not connected to the reconfigurable garment 1100 but, in some configurations, the reconfigurable garment 1100 may be connected to the tube dress 600.

FIGS. 21H-21K illustrate the reconfigurable garment 1100 of FIG. 7 in an off-shoulder look. The reconfigurable garment 1100 in this configuration is reversed along the backside of the wearer and the fastening element 1124*b* is connected to the fastening element 1126*b* at the top shoulder. The sleeves 1130 can be tied so that the sleeves 1130 dangle at the sides of the waist. In the illustrated configuration, the tube dress 600 is positioned under the reconfigurable garment 1100; however, in some configurations, the reconfigurable garment 1100 is used without the tube dress 600. As with the prior embodiment, adornments 1150 can be used to interconnect the fastening elements 1124*b*, 1126*b*. The adornments 1150 can have any suitable shape and configuration as will be discussed below.

Figure 22A:
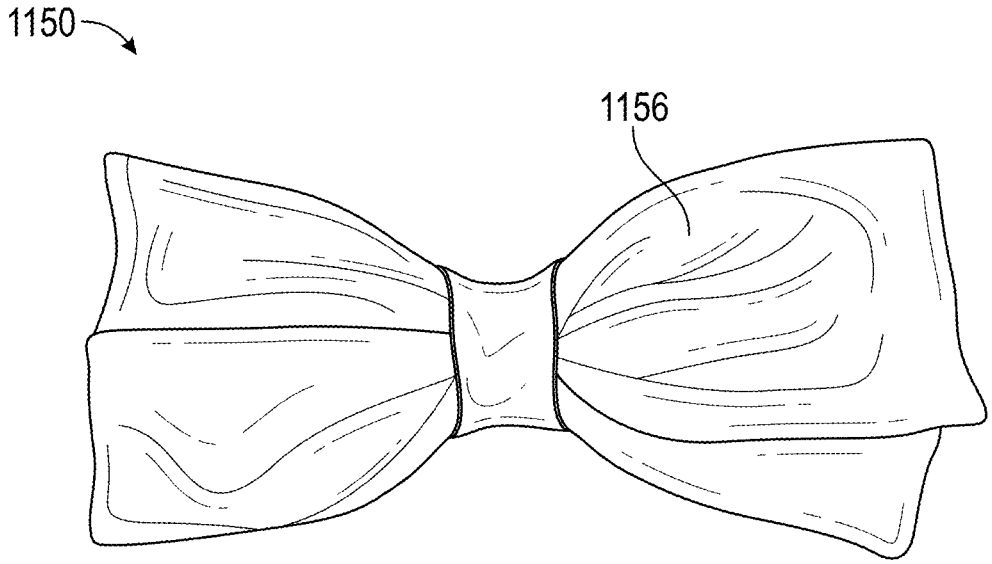
FIGS. 22A and 22B are front and rear views of an adornment in the form of a bow used in some of the looks of FIGS. 21A-21N.
Figure 22B:
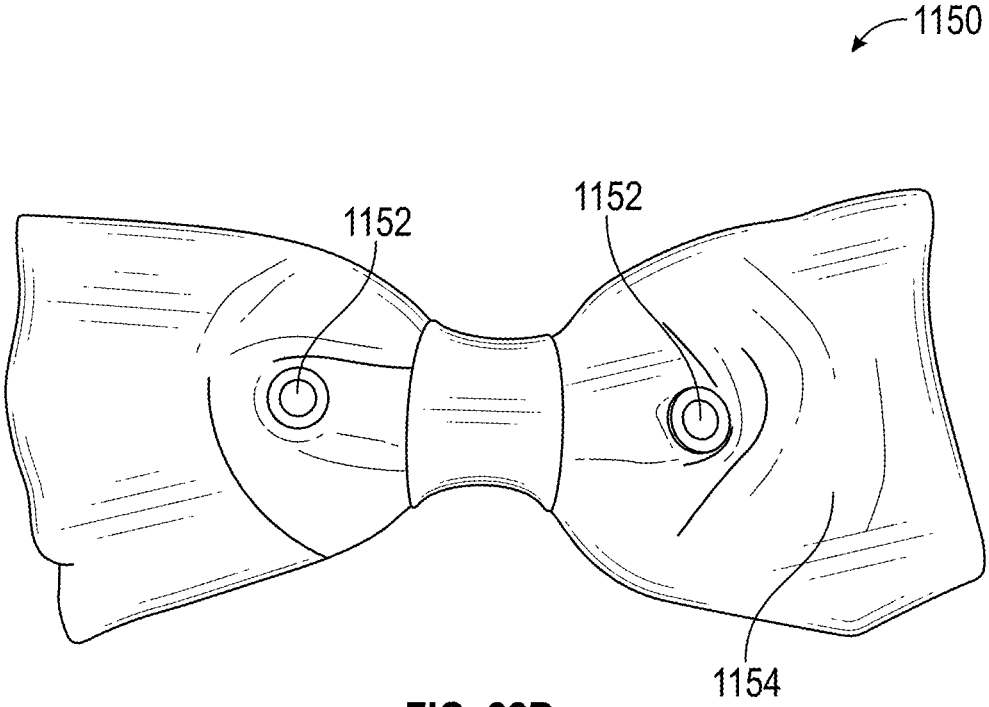

FIGS. 22A and 22B illustrate the adornment 1150 used in the configuration of the reconfigurable garment 1100 of FIG. 21G and FIGS. 21L-21M. Below there is a more detailed discussion of adornments and that discuss applies to the adornment 1150 of FIGS. 22A and 22B. The adornment of FIGS. 22A and 22B features two connecting elements 1152. The connecting elements 1152 are positioned on a rearward-facing surface 1154 of the illustrated adornment 1150. A forward surface 1156 obscures the presence of the connecting elements 1152.

Figure 23A:
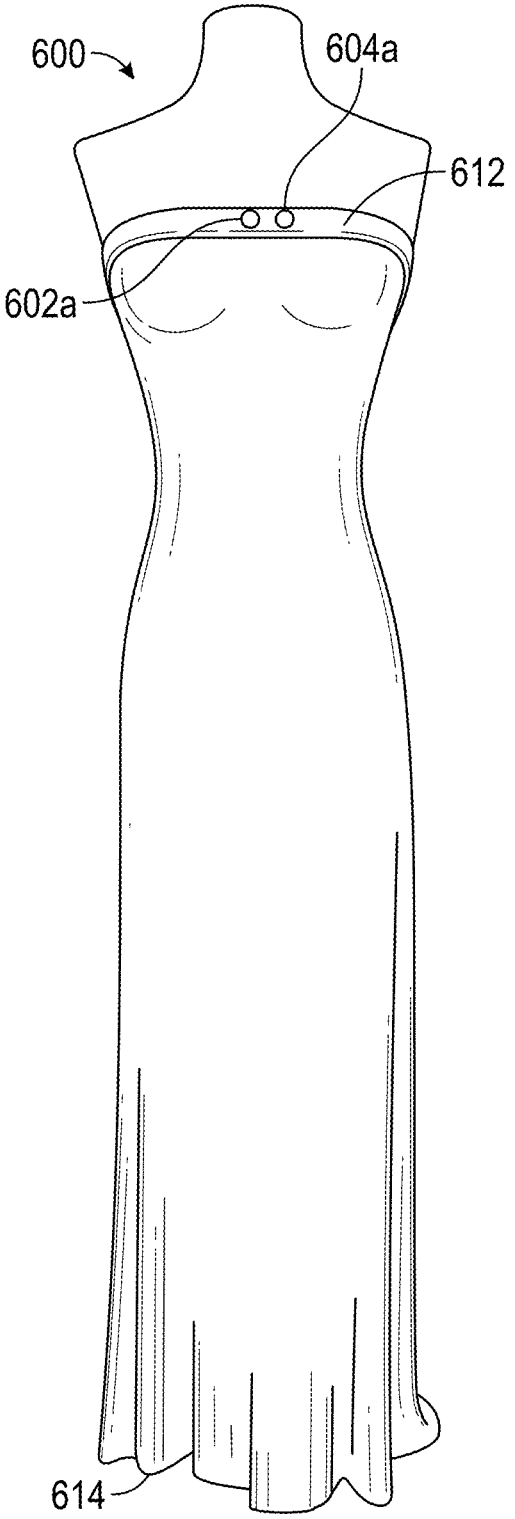
FIGS. 23A-23V are views of a further reconfigurable garments implementing a tube dress, such as those shown in FIGS. 10-14.
Figure 23B:
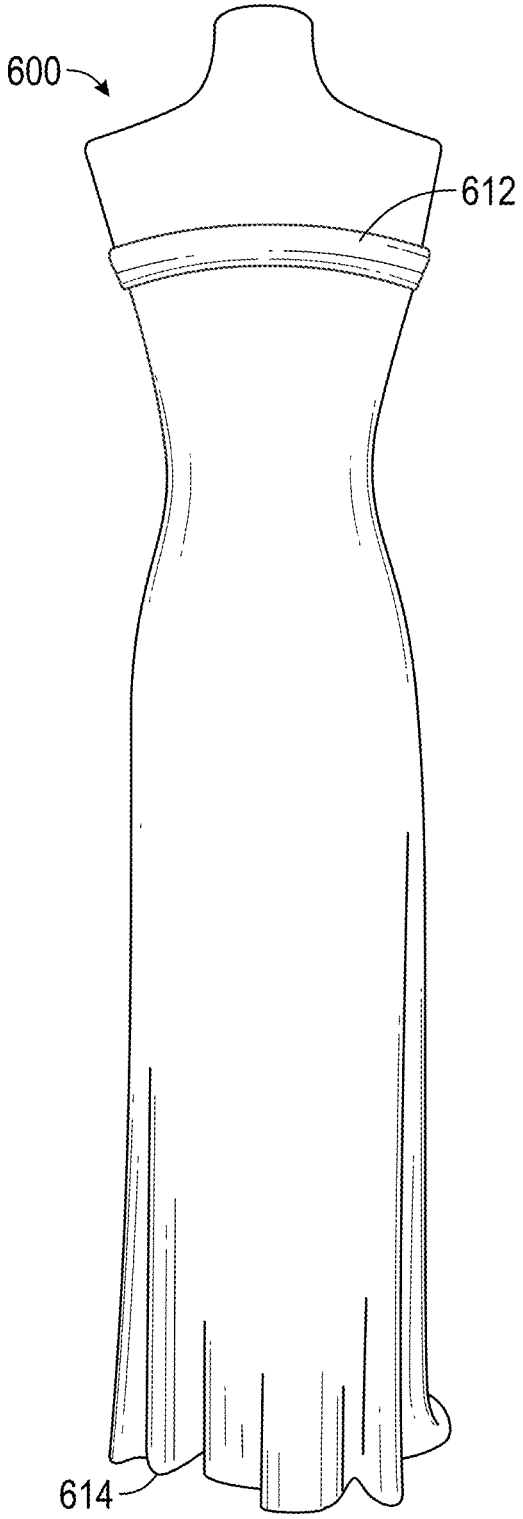
Figure 23C:
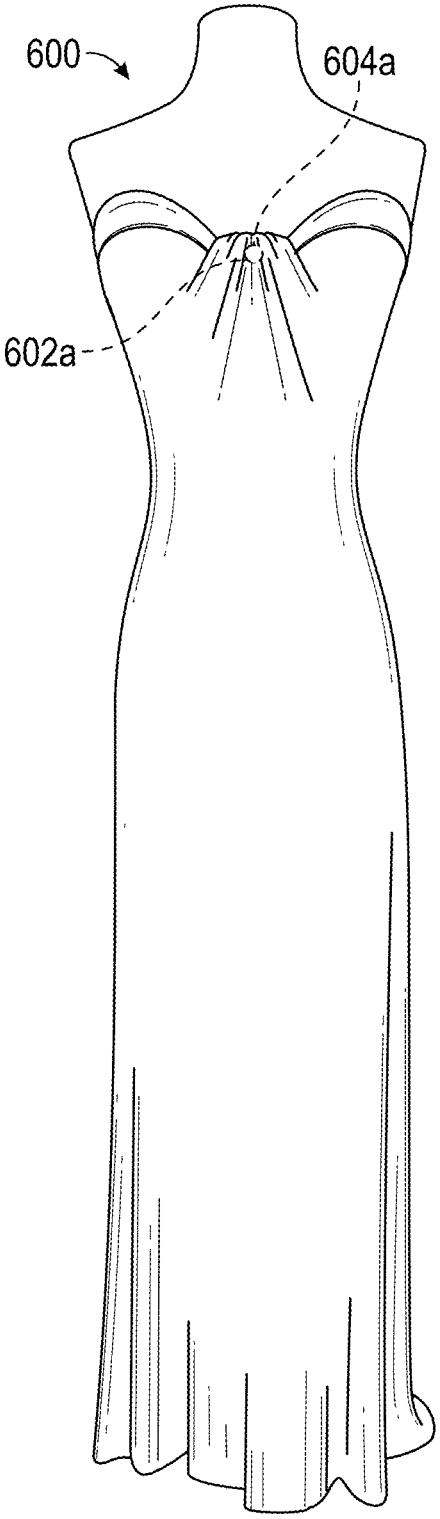
Figure 23D:
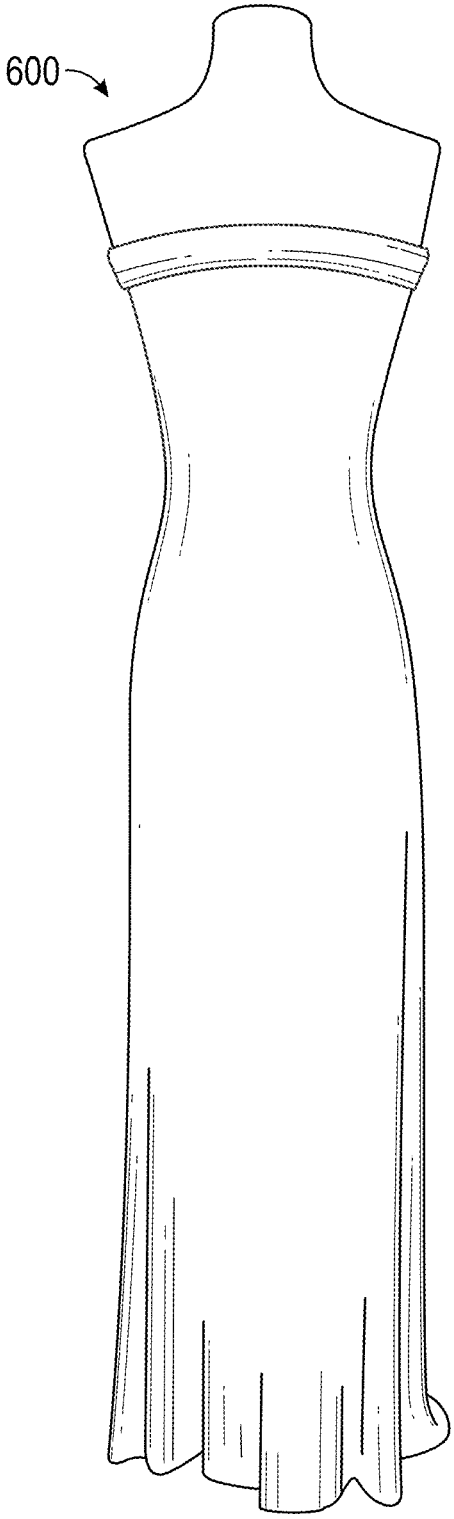

In the illustrated configuration, the two connecting elements 1152 comprise one male connecting element and one female connecting element. Of course, as will be discussed below, other configurations are possible. The connecting elements 1152 can connect with any mating connecting element of the reconfigurable garment 1100. In the illustrated configuration, the connecting elements 1152 of the adornment 1150 connect with the connecting elements 1124*b*, 1126*b* of the reconfigurable garment 1100. Accordingly, the connecting elements 1152 of the adornment 1150 also can connect with any of the related connecting elements 1124*a*, 1124*b*, 1124*c*, 1126*a*, 1126*b*, 1126*c*. Moreover, as will be discussed below. The adornment 1150 advantageously can be used with any of the garments disclosed herein as can any of the adornments discussed elsewhere in this disclosure. FIGS. 23A and 23B illustrate the tube dress 600 discussed above. As illustrated, the tube dress 600 can be a standalone dress. The tube dress 600 can include two or more fastening elements 602*a*, 604*a*, as discussed above. The two or more fastening elements 602*a*, 604*a* can alternate between male and female, can be universal, or can have any suitable configuration and orientation. In some configurations, the fastening elements 602*a*, 604*a* are disposed along a top bustline 612. In some configurations, there may be ten or more fastening elements 602*a*, 604*a*. In some configurations, the fastening elements 602*a*, 604*a* encircle the tube dress 600. In some such configurations, the fastening elements 602*a*, 604*a* encircle the top bustline 612 of the tube dress 600. Preferably, the fastening elements 602*a*, 604*a* are hidden along the top bustline 612. The fastening elements 602*a*, 604*a* can interlock with or interconnect with the fastening elements of another fabric panel or reconfigurable garment. In some configurations, as discussed above, the tube dress 600 can be sewn or otherwise secured to the fabric panel or reconfigurable garment. While the illustrated tube dress 600 is full length, other lengths can be provided (e.g., short). In some configurations, the tube dress 600 is body conforming and can be worn with the top bustline 612 as a bottom hemline 614. In some configurations, the tube dress 600 has fastening elements at the top bustline 612 as well as at the bottom hemline 614. In some configurations, the tube dress 600 has fastening elements encircling the bottom hemline 614. As illustrated in FIGS. 23C and 23D, the fastening elements 602*a*, 604*a* can be interconnected to create a look using only the tube dress 600, if desired. FIG. 23A illustrates the tube dress 600 from the front and FIG. 23B illustrates the tube dress 600 from the rear.

Figure 23E:
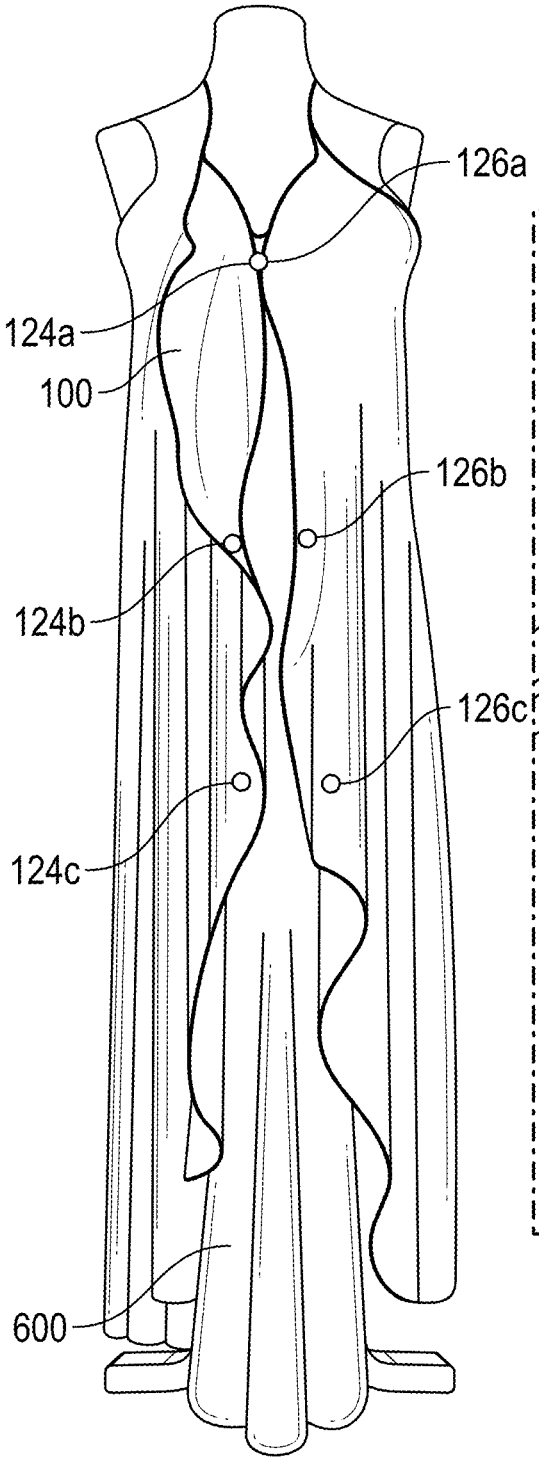
Figure 23F:
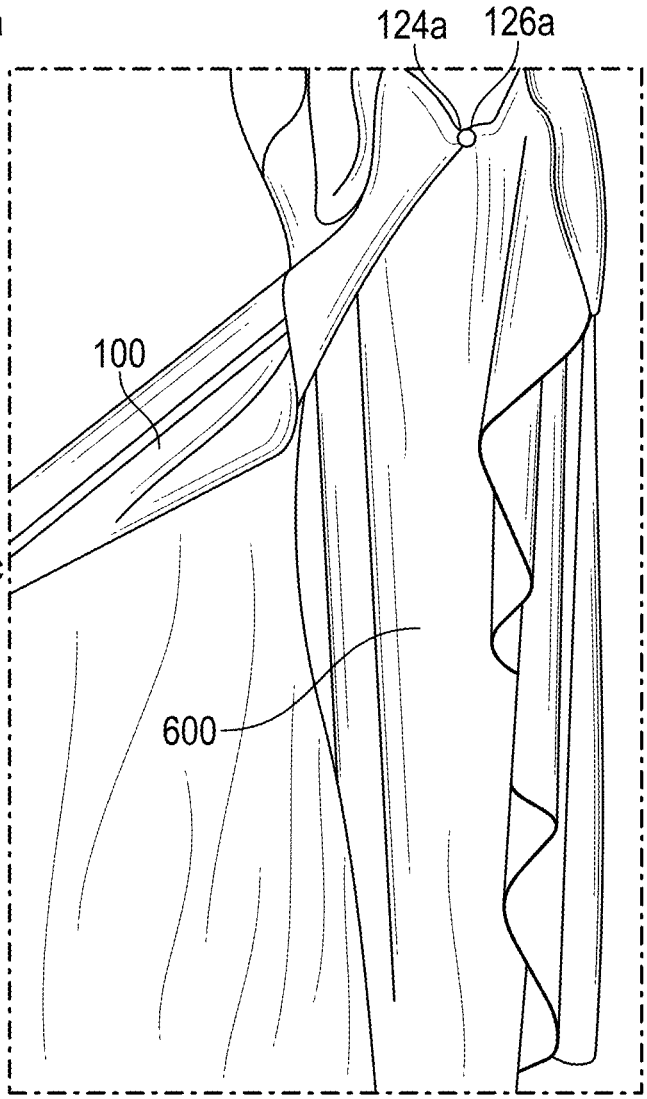
Figure 23G:
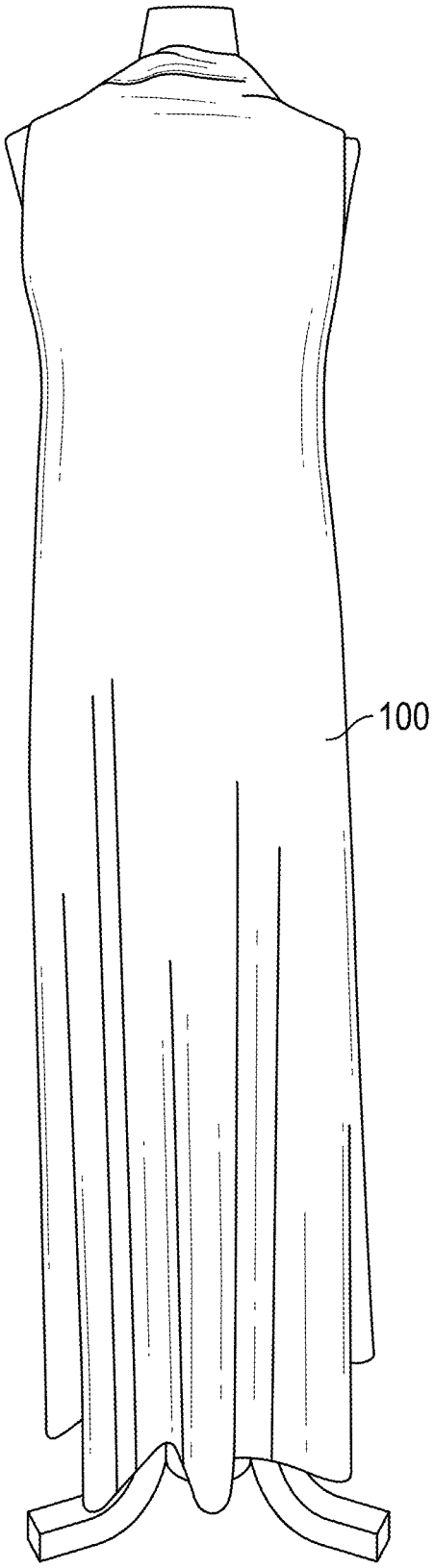
Figure 23H:
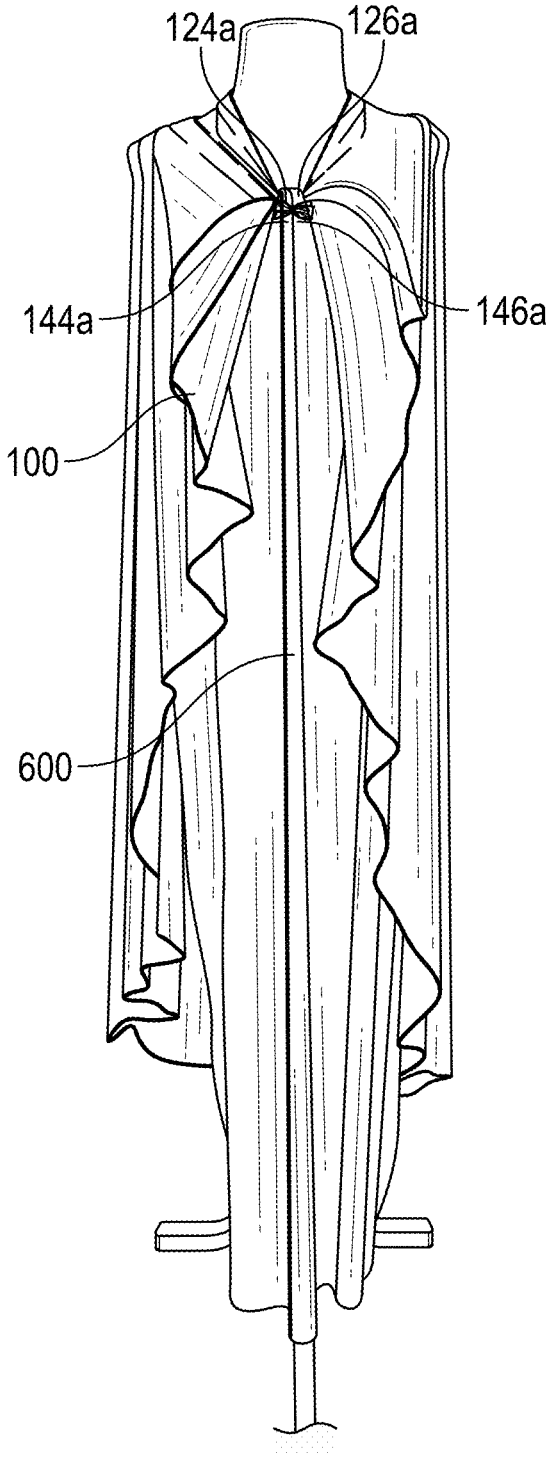
Figure 23I:
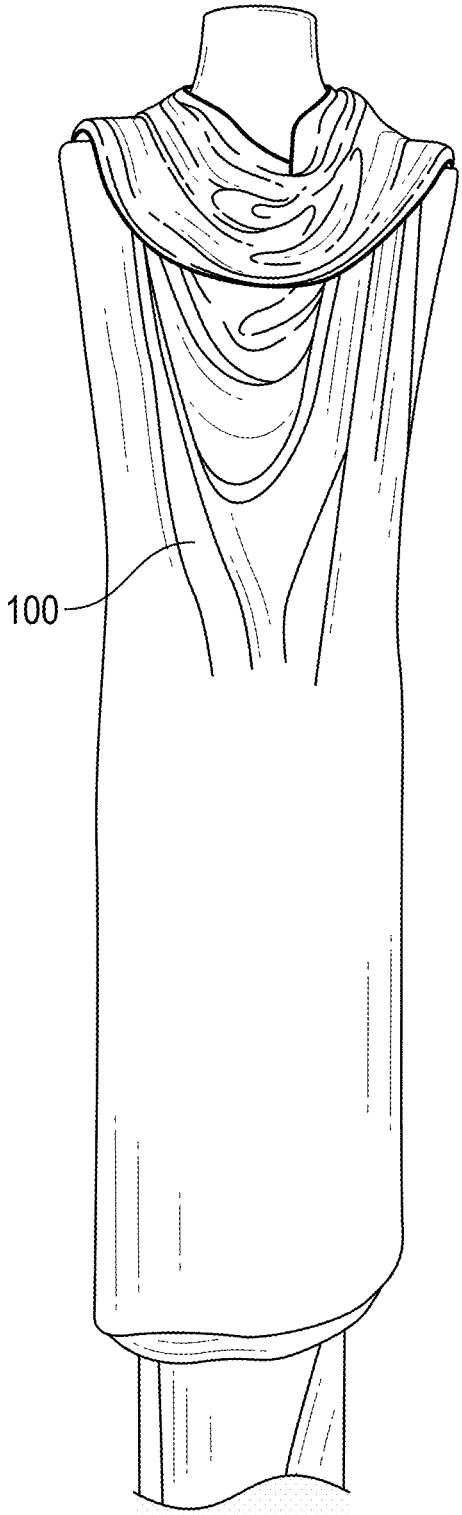
Figure 23J:
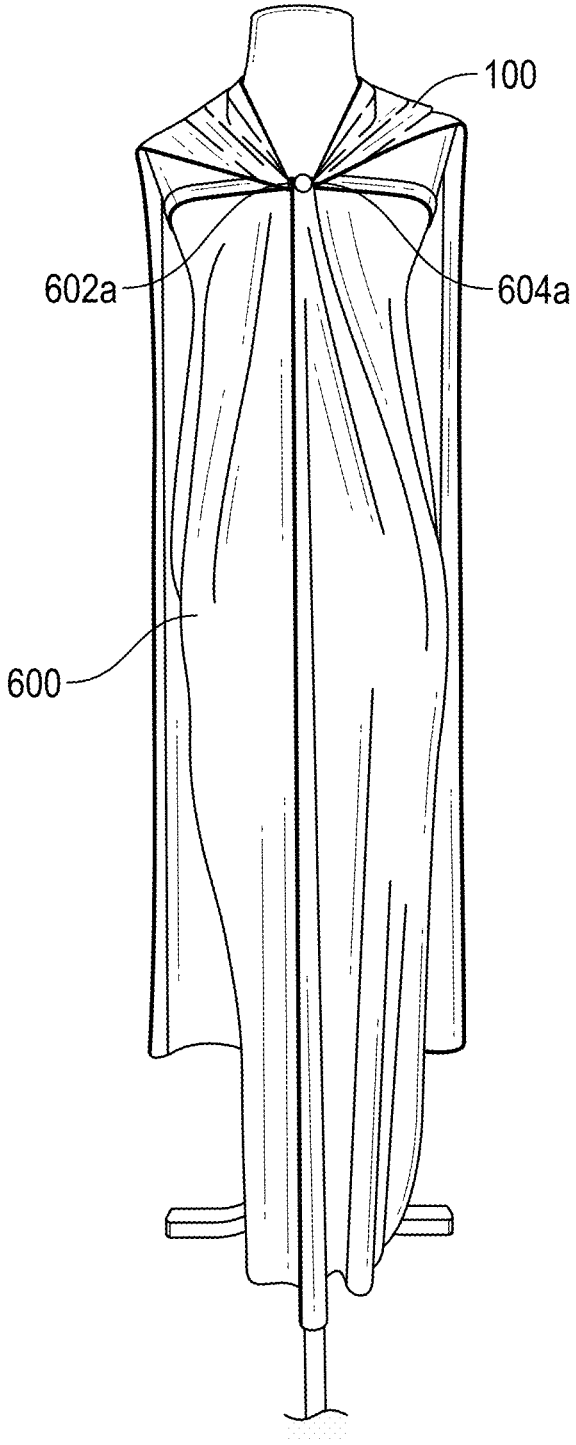
Figure 23K:
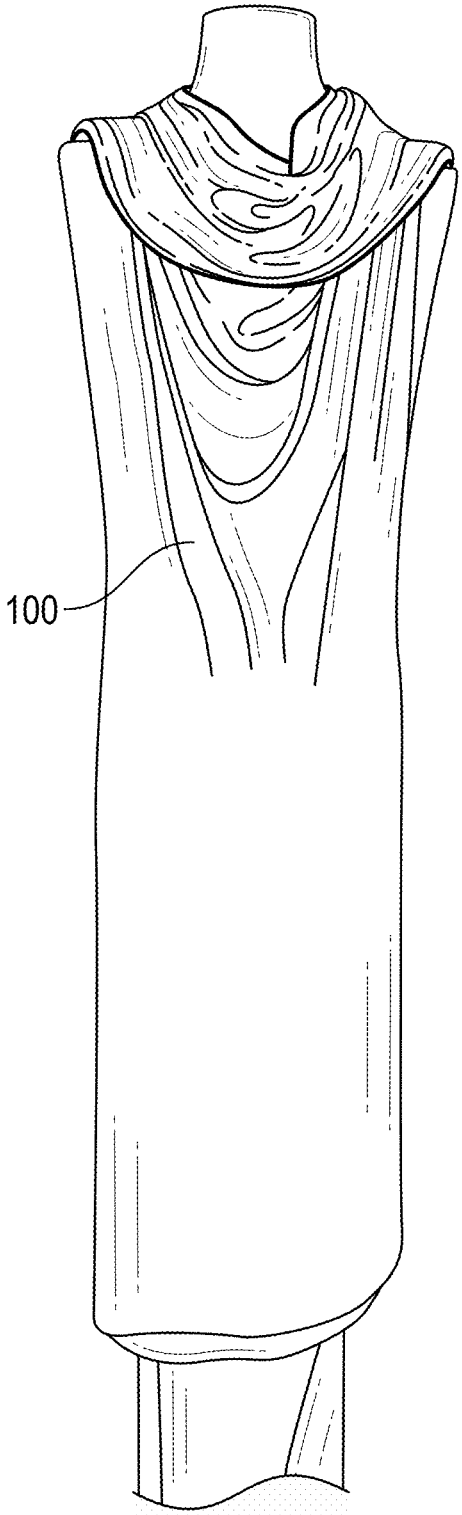
Figure 23L:
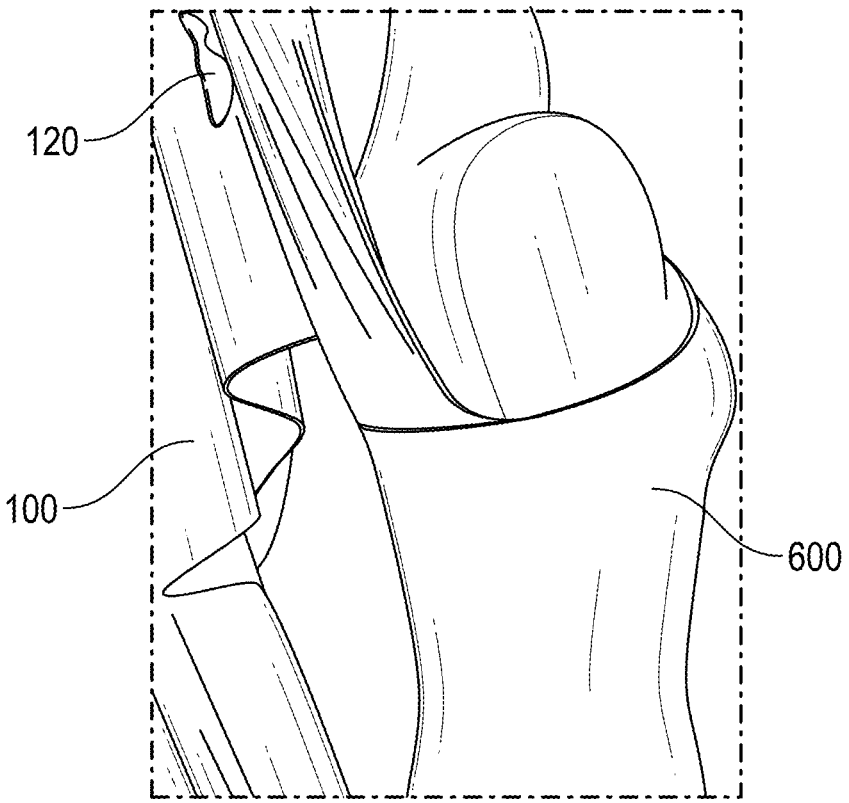
Figure 23M:
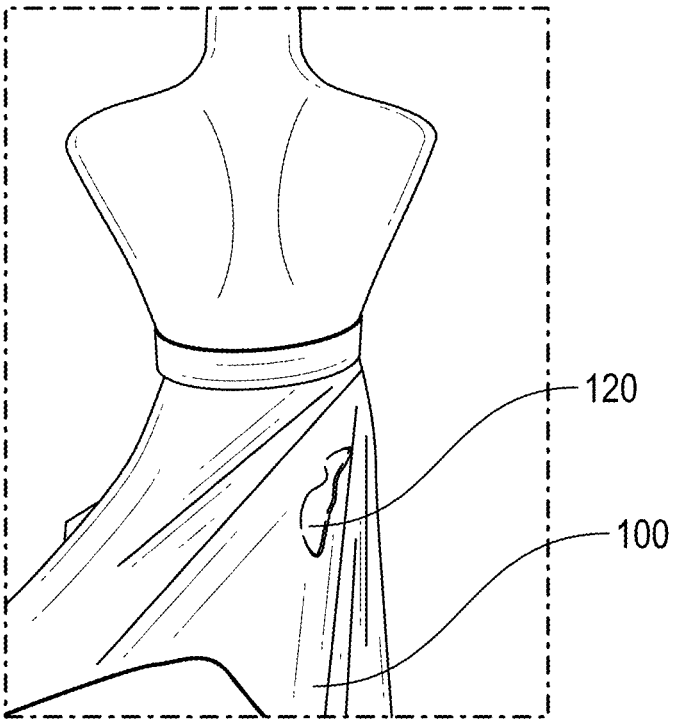
Figure 23N:
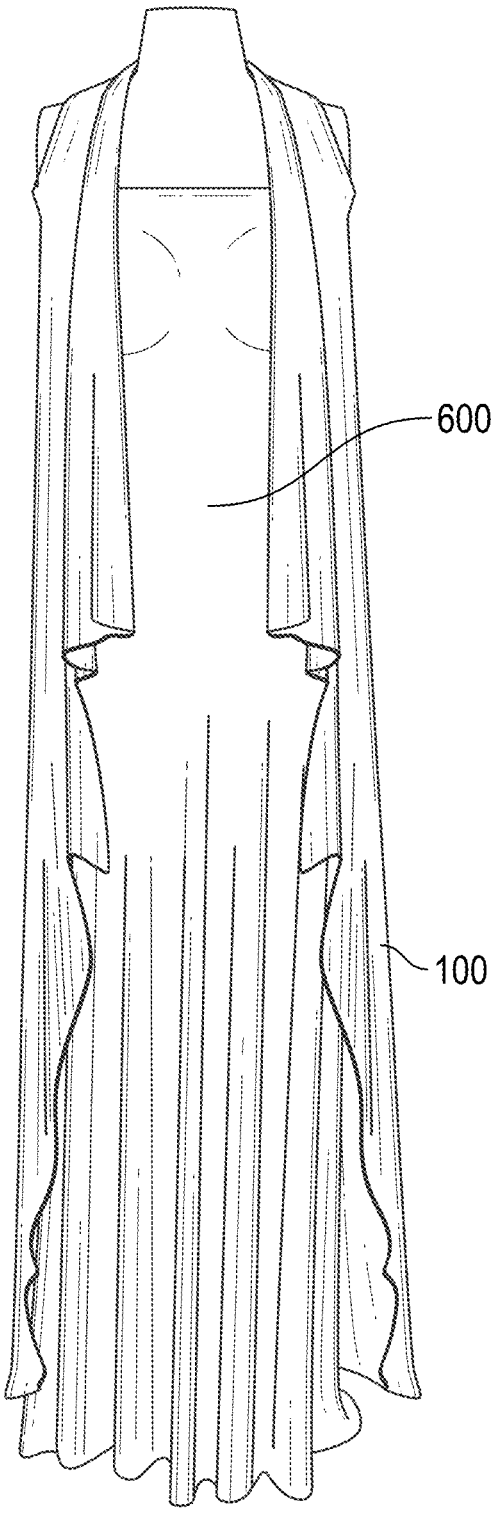
Figure 23O:
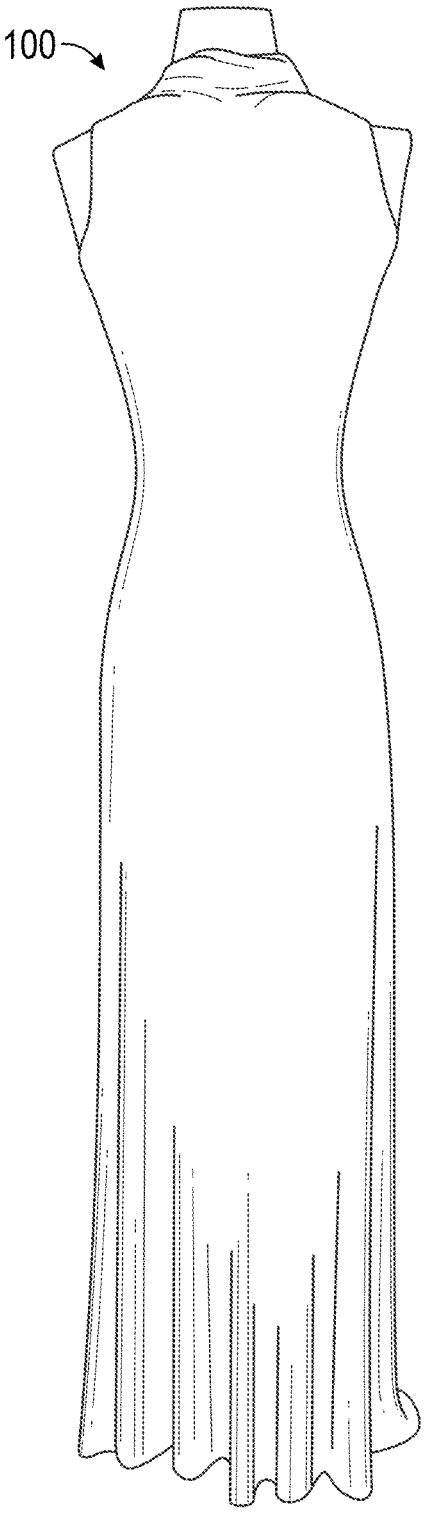
Figure 23P:
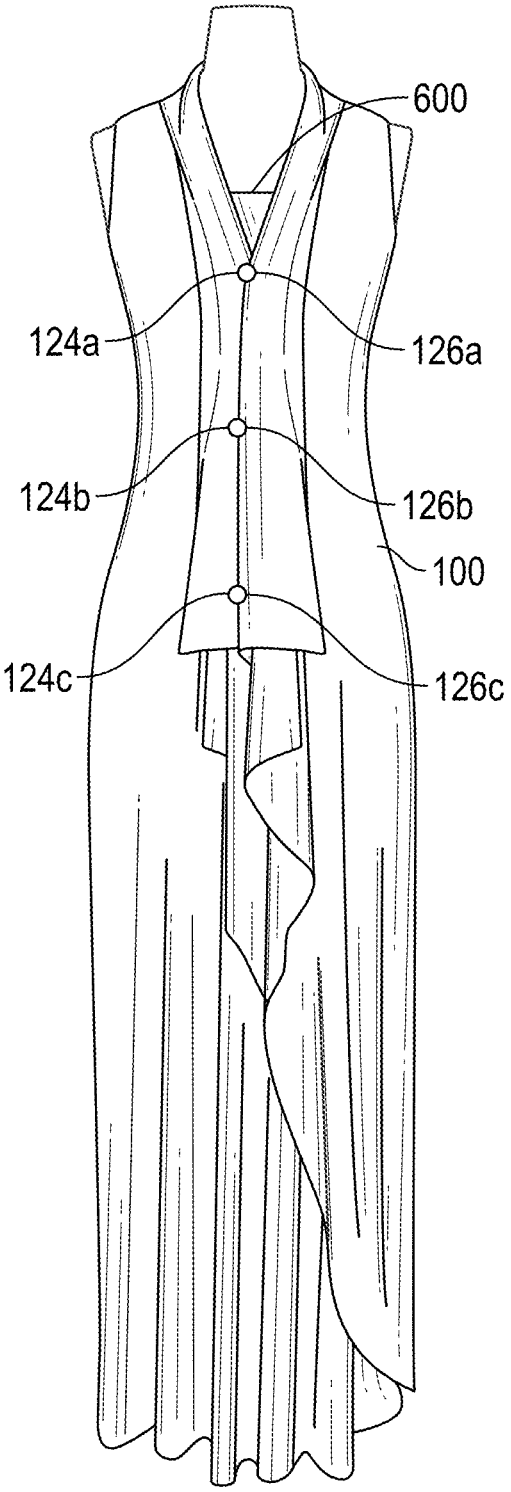
Figure 23Q:
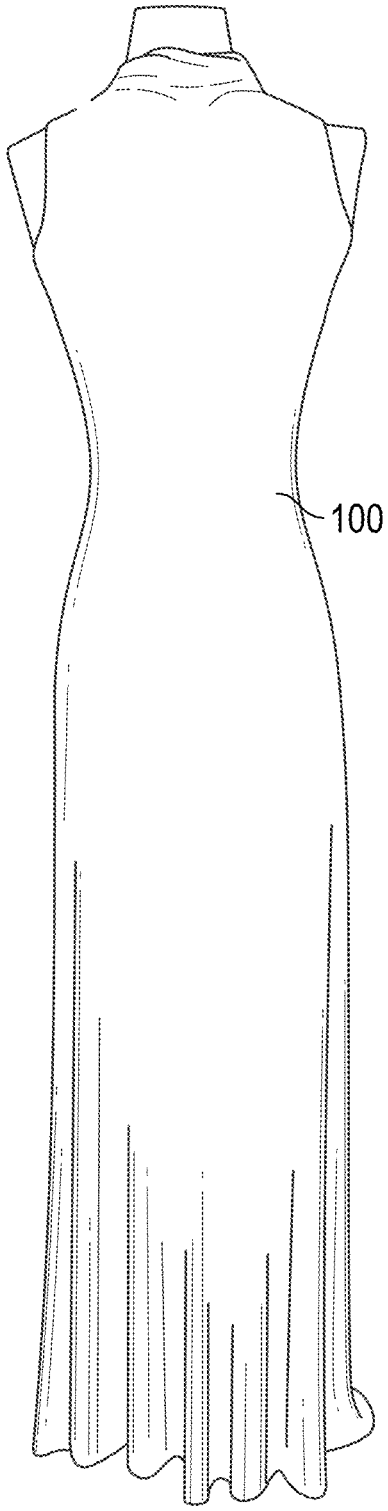
Figure 23R:
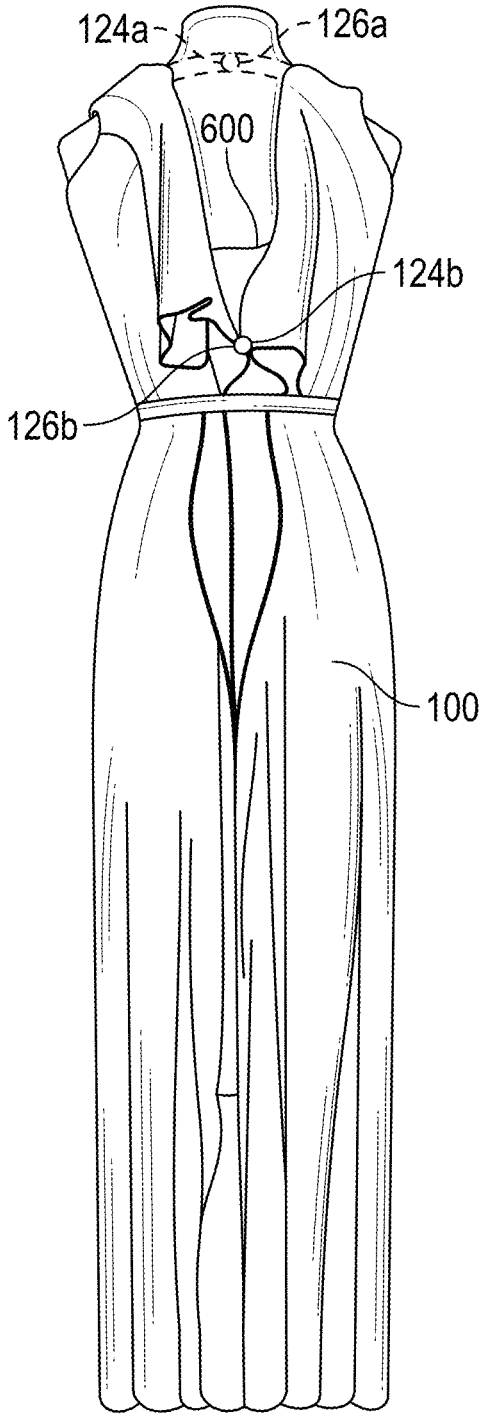
Figure 23S:
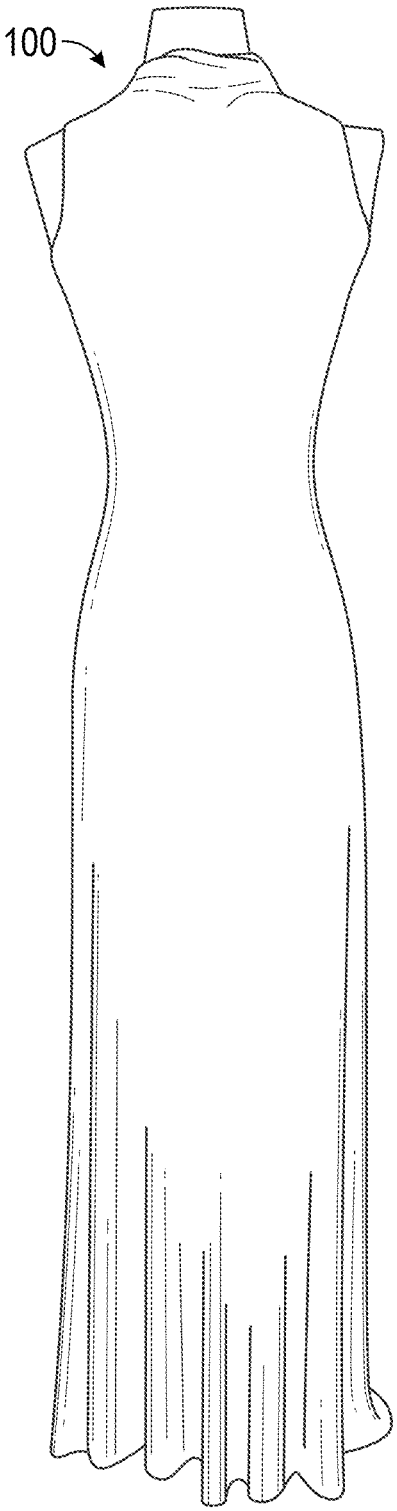
Figure 23T:
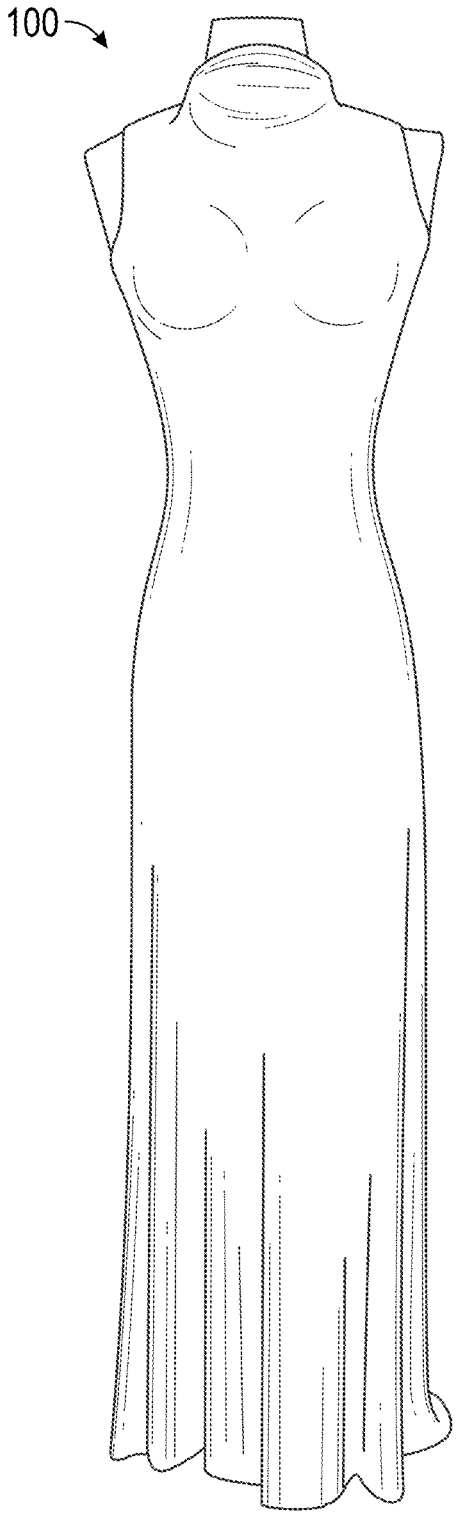
Figure 23U:
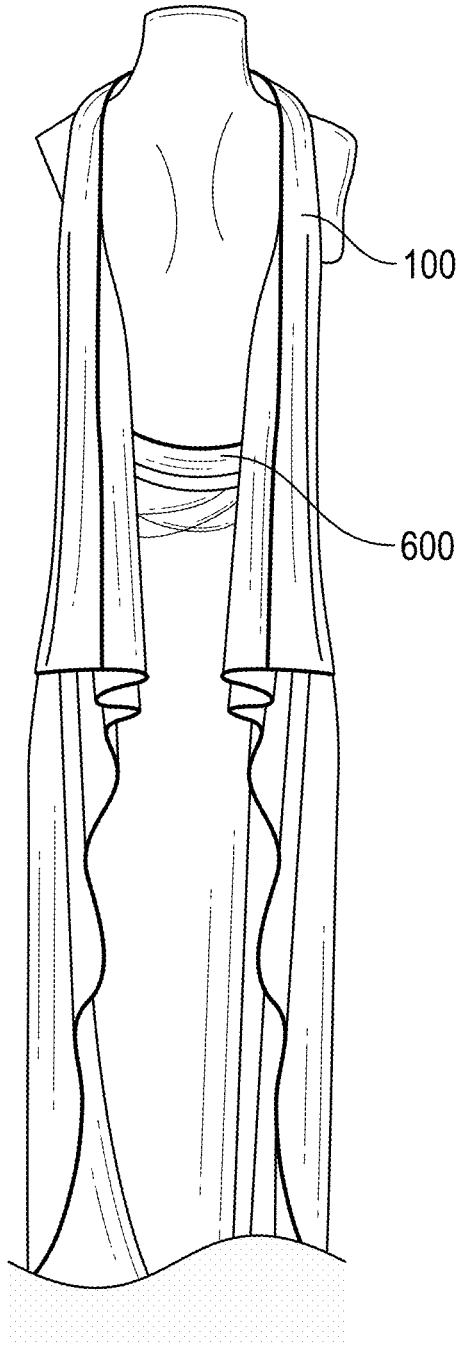
Figure 23V:
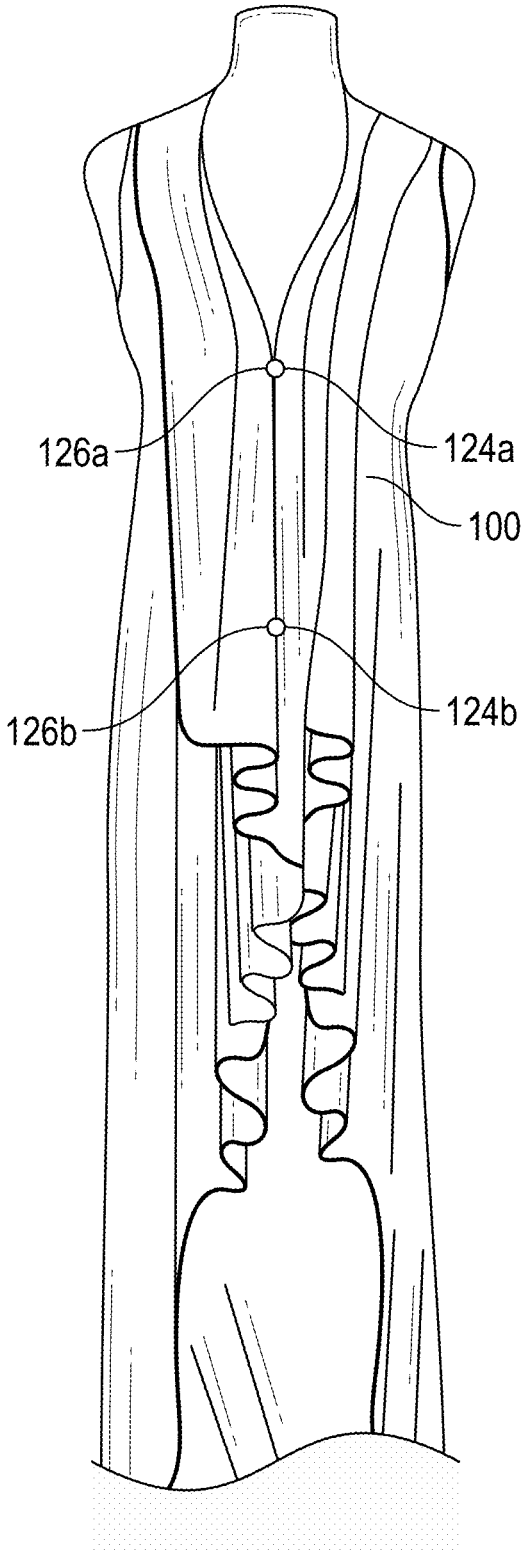

FIGS. 23E-23V illustrate reconfigurable garments that combine the tube dress 600 with one of the reconfigurable garments of FIGS. 1-9, some of which are illustrated in FIGS. 10-14. Adding the underlayer of the tube dress 600 provides further opportunities to reconfigure the reconfigurable garments of FIGS. 1-9. In the same way as the reconfigurable garments described above are able to be reconfigured using varied numbers and combinations of the fastening elements, the reconfigurable garments illustrated in FIGS. 23C-23V can be created by interconnecting various combinations of the fastening elements. In some configurations, the fastening elements 602*a*, 604*a* of the tube dress 600 can be interconnected with the fastening elements of the reconfigurable garments of FIGS. 1-9. In some configurations, the tube dress 600 is not attached to the reconfigurable garments of FIGS. 1-9 but the underlayer of the tube dress 600 provides additional freedom in configuring the outer reconfigurable garment.

As has been described above, some of the styles incorporate accessories. For example, belts and extenders can be used in conjunction with any of reconfigurable garments described above or to create additional styles not showcased in any of the figures. The belts and extenders provide additional design flexibility and facilitate an increase in the number of possible styles. The belts and the extenders are optional accessories that can be used to create additional looks.

Figure 24:
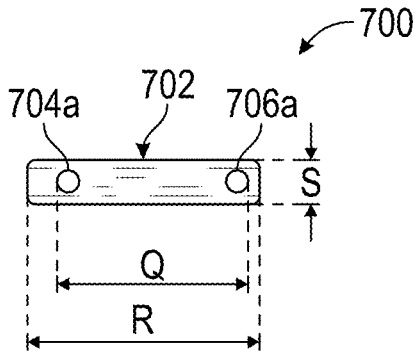
FIG. 24 is a schematic plan view of an extender.

FIG. 24 is a schematic representation of an extender 700. The extenders 700 can come in a variety of lengths and may or may not incorporate fastening elements 704*a*, 706*a*. In some configurations, as will be described, one or more fastening elements 704*a*, 706*a* can be used that are hidden when viewed from an outer surface, similar to the adornment 1150 described above and shown in FIGS. 22A and 22B.

The extender 700 comprises a body 702. The body 702 can be formed of any suitable material. In some configurations, the body 702 can be formed of the same material as the body of the reconfigurable garment with which it is paired. In other configurations, the body 702 can be formed of a more inelastic material compared to the body of the reconfigurable garment with which it is paired. In some such configurations, the body 702 is formed of a material that exhibits less stretch in at least one direction relative to the body of the garment with which it is paired. The body 702 can have an inner surface and an outer surface. The inner surface can be a surface that is configured to be closest to the body of the wearer while the outer surface can be an exposed surface that faces away from the wearer.

The illustrated body 702 has a length R and a width S. The length R can be any suitable length. In some configurations, the length R can be between 7 inches and 60 inches, preferably between 10 inches and 30 inches. The length R should be long enough to enhance some of the styles and enable the extender 700 to wrap over a shoulder or around a neck of the wearer, for example. On the other hand, the extender 700 should not be so long that the extender 700 is difficult to style and manage. Preferably, multiple shorter extenders 700 can be joined together to create a longer extender when a longer extender is desired. The width S can be any suitable dimension. In some configurations, the width S can be between 1 inch and 4 inches. The width S preferably is greater than the diameter of a snap or button when a snap or button forms the fastening element 704*a*, 706*a*.

In the extender 700 shown in FIG. 24, two or more fastening elements 704*a*, 706*a* are shown. The first fastening element 704*a* and the second fastening element 706*a* can be joined to the body 702 of the extender 700 in any suitable manner. In some configurations, the first fastening element 704*a* and the second fastening element 706*a* are complementary fastening elements that can be joined together. In other configurations, the first fastening element 704*a* and the second fastening element 706*a* are the same such that the two fastening elements 704*a*, 706*a* cannot be joined together but are used to join to other fastening elements. In some configurations, one or more of the first fastening element 704*a* and the second fastening element 706*a* can be universal such that it can mate with any other fastening element on the extender 700 or the associated reconfigurable garment.

The first fastening element 704*a* and the second fastening element 706*a* can be spaced apart by a distance Q. The distance Q can be any suitable length. In some configurations, the length R can be between 7 inches and 100 inches, preferably between 10 inches and 60 inches. In some configurations, as will be described, a series of fastening elements can be used and/or multiple aligned fastening elements can be used.

The fastening elements 704*a*, 706*a* can be exposed on one or two sides of the body 702. In some configurations, one of the fastening elements 704*a* can be exposed on one or both of the inner surface and the outer surface while one of the fastening elements 706*a* can be exposed on both or the other of the inner surface and the outer surface of the body 702. In some configurations, the fastening elements 704*a*, 706*a* can be hidden from view on the side of the body 702 to which the fastening elements are not exposed.

Figure 25:
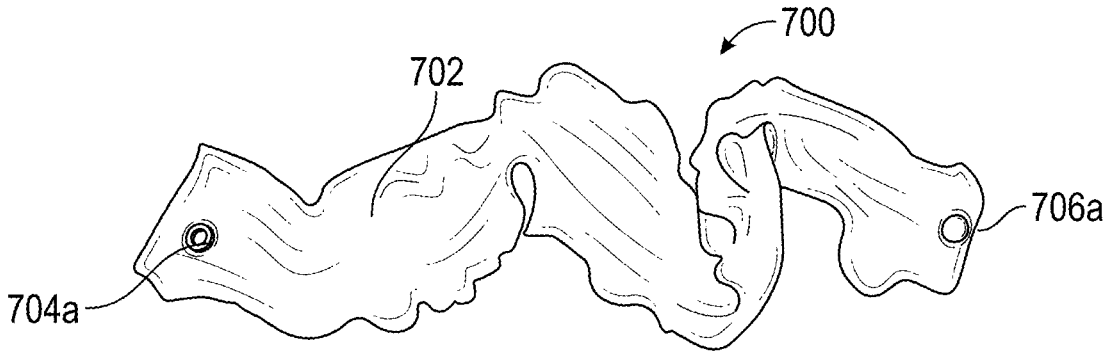
FIGS. 25-27 are views of extenders that are arranged and configured in accordance with certain features, aspects, and advantages of certain embodiments.
Figure 26:
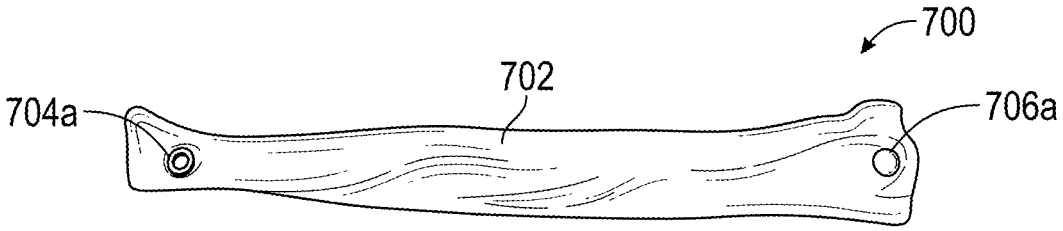
Figure 27:
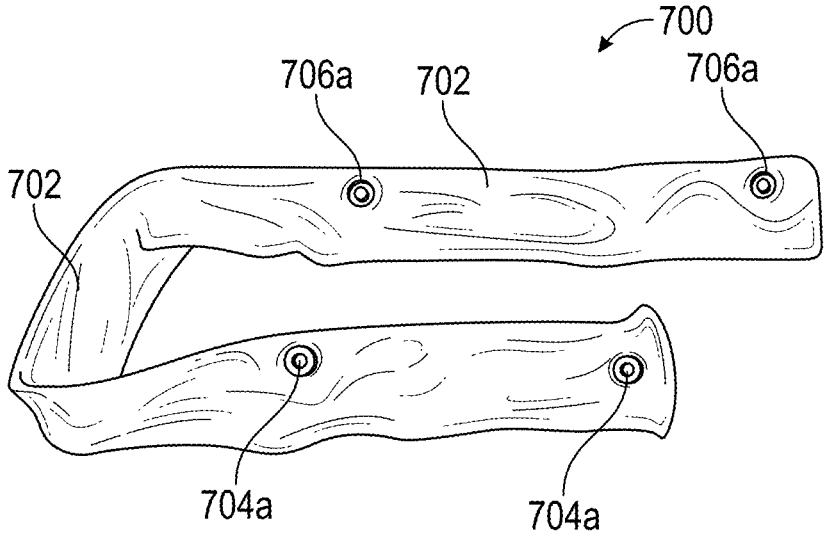

FIGS. 25-27 illustrate examples of extenders 700. FIG. 25 illustrates an unstretched but elastic extender 700 in which the body 702 has been formed of an elastic material. The illustrated extender 700 in FIG. 25 includes one first fastening element 704*a* and one second fastening element 706*a*. In this configuration, both of the first and second fastening elements 704*a*, 706*a* are exposed to the same side of the body 702 (i.e., only on the inner surface).

FIG. 26 illustrates another extender 700 in which the body 702 has been formed of an inelastic (or less elastic than FIG. 25) material. In the illustrated configuration, the body 702 has been formed with two layers. In some configurations, the body 702 can be formed of a tubular material. The body 702 includes one first fastening element 704*a* and one second fastening element 706*a*. The illustrated first and second fastening elements 704*a*, 706*a* face in opposite directions relative to the faces of the body 702 (i.e., one is exposed on the inner surface and one is exposed on the outer surface). In some configurations, however, the first and second fastening elements 704*a*, 706*a* can face in the same direction.

FIG. 27 illustrates another extender 700. The extender of FIG. 27 is similar to the extender of FIG. 26 except the extender 700 is longer in FIG. 27 than in FIG. 26. In addition, the extender 700 of FIG. 27 incorporates more than two fastening elements 704*a*, 706*a*. In some configurations, the body 702 includes two or more first fastening elements 704*a* and two or more second fastening elements 706*a*. In some configurations, however, the two or more first fastening elements 704*a* and two or more second fastening elements 706*a* can face in the same direction or any can face in a different direction from one another.

Figure 28:
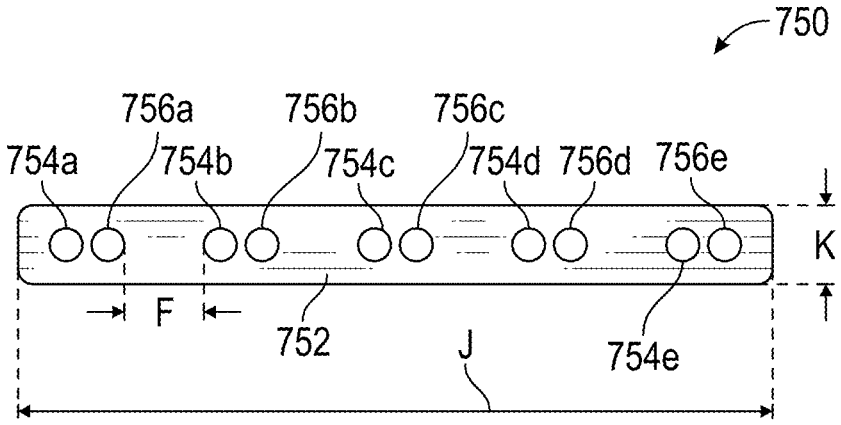
FIG. 28 is a schematic plan view of a further extender.

FIG. 28 schematically illustrates another form of an extender 750. As with the extenders 700 described above, the extenders 750 can come in a variety of lengths and may or may not incorporate fastening elements. In some configurations, as will be described, one or more fastening elements 754, 756 can be used that is hidden when viewed from the outer surface.

The extender 750 comprises a body 752. The body 752 can be formed of any suitable material. In some configurations, the body 752 can be formed of the same material as the body of the reconfigurable garment with which it is paired. In other configurations, the body 752 can be formed of a more inelastic material compared to the body of the reconfigurable garment with which it is paired. In some such configurations, the body 752 is formed of a material that exhibits less stretch in at least one direction relative to the body of the reconfigurable garment with which it is paired. The body 752 can have an inner surface and an outer surface. The inner surface can be a surface that is configured to be closest to the body of the wearer while the outer surface can be an exposed surface that faces away from the wearer.

The illustrated body 752 has a length J and a width K. The length J can be any suitable length. In some configurations, the length J can be between 7 inches and 100 inches, preferably between 10 inches and 60 inches. The length J should be long enough to enhance some of the styles and enable the extender 750 to wrap over a shoulder or around a neck of the wearer, for example. On the other hand, the extender 750 should not be so long that the extender 750 is difficult to style and manage. Preferably, multiple shorter extenders 750 can be joined together to create a longer extender when a longer extender is desired. The width K can be any suitable dimension. In some configurations, the width K can be 1 inch and 10 inches, preferably between 1 inch and 5 inches. The width K preferably is greater than the diameter of a snap or button when a snap or button forms the fastening element.

In the extender 750 shown in FIG. 28, two or more fastening elements are shown grouped together. The first fastening elements 754*a*-754*e* and the second fastening elements 756*a*-756*e* can be joined to the body 752 of the extender 750 in any suitable manner. In some configurations, the first fastening elements 754*a*-754*e* and the second fastening elements 756*a*-756*e* are complementary fastening elements that can be joined together. In other configurations, the first fastening elements 754*a*-754*e* and the second fastening elements 756*a*-756*e* are the same such that the first fastening elements 754*a*-754*e* and the second fastening elements 756*a*-756*e* cannot be joined together but are used to join to other fastening elements. In some configurations, the first fastening elements 754*a*-754*e* and/or the second fastening elements 756*a*-756*e* can be universal such that they can couple to male and female fastening elements.

The first fastening elements 754*a*-754*e* and the second fastening elements 756*a*-756*e* can be paired together and each of the pairs can be spaced apart by a distance F. The distance F can be any suitable length. In some configurations, the length F can be between 0.5 inches and 100 inches, preferably between 0.5 inches and 3 inches. In the illustrated configuration, the spacing between each of the pair of the first fastening elements 754*a*-754*e* and the second fastening elements 756*a*-756*e* is less than the spacing between each pair of the first fastening elements 754*a*-754*e* and the second fastening elements 756*a*-756*e*. In addition, the pairs of the first fastening elements 754*a*-754*e* and the second fastening elements 756*a*-756*e* are spaced apart uniformly.

The first fastening elements 754*a*-754*e* and the second fastening elements 756*a*-756*e* can be exposed on one or two sides of the body 752. In some configurations, one of the fastening elements 754*a* can be exposed on one or both of the inner surface and the outer surface while one of the fastening elements 756*a* can be exposed on both or the other of the inner surface and the outer surface of the body 752. In some configurations, the first fastening elements 754*a*-754*e* and the second fastening elements 756*a*-756*e* can be hidden from view on the side of the body 752 to which the fastening elements are not exposed.

Figure 29:
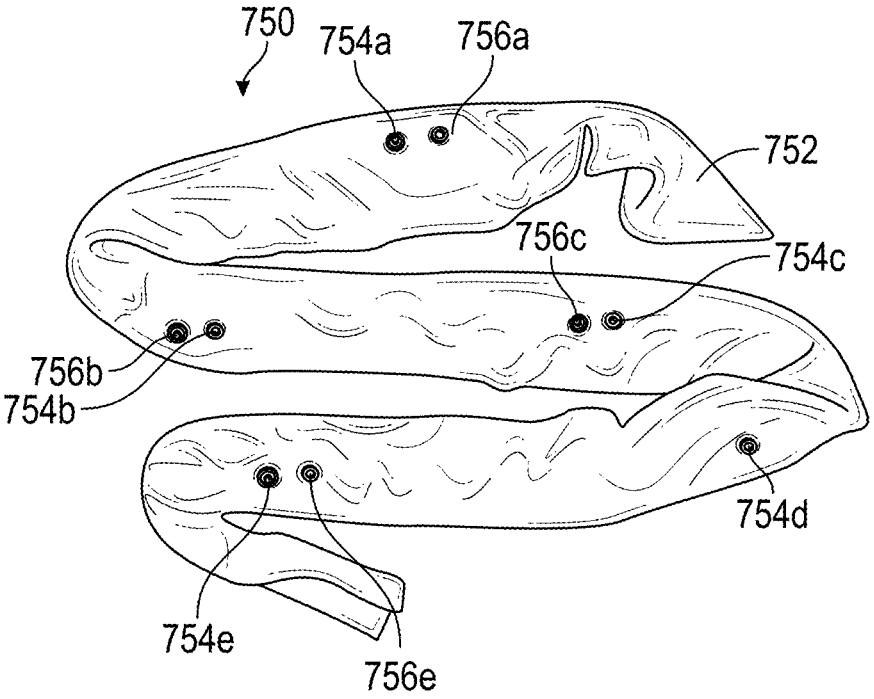
FIG. 29 is an embodiment of an extender that is arranged and configured in accordance with certain features, aspects, and advantages of a further extender.

FIG. 29 illustrates an extender 750 that is arranged and configured as described directly above with respect to FIG. 28. The extender 750 includes pairs of the first fastening elements 754*a*-754*e* and the second fastening elements 756*a*-756*e* and the pairs are spaced apart as described above. The body 752 has been formed of two layers of fabric such that the first fastening elements 754*a*-754*e* and the second fastening elements 756*a*-756*e* can be obscured from view as desired.

Figure 30:
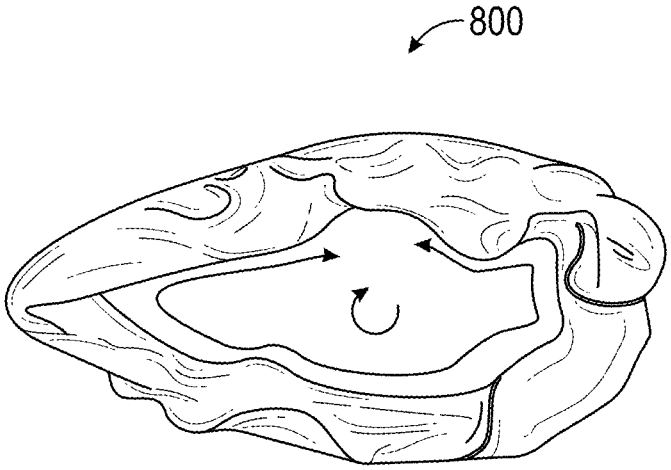
FIG. 30 and FIG. 31 are views of a loop-shaped extender.
Figure 31:
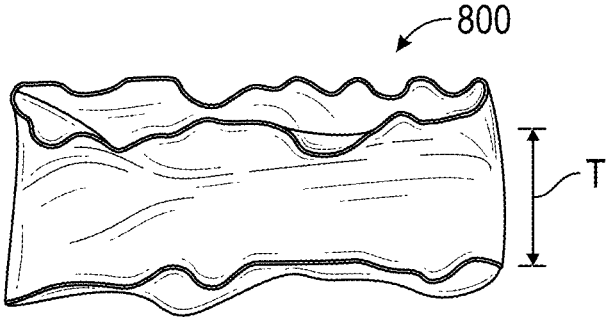

FIG. 30 and FIG. 31 illustrate versions of extenders 800 that are formed as a loop of material or fabric. As mentioned above, some extenders may not incorporate fastening elements and the illustrated extenders 800 do not incorporate fastening elements. Rather, the loop of the material or fabric enables the extenders 800 to be secured in position using the fastening elements of the garment with which the extenders 800 are paired. In some configurations, the fabric or material is the same as the fabric used for the garment with which the extender 800 is paired. The loop defined by the extenders 800 can have any suitable length C and width T. In some configurations, an extender, a ring-shaped accessory, or adornment can be used to loop around a pair of fasteners as a decorative option for the wearer.

Figure 32A:
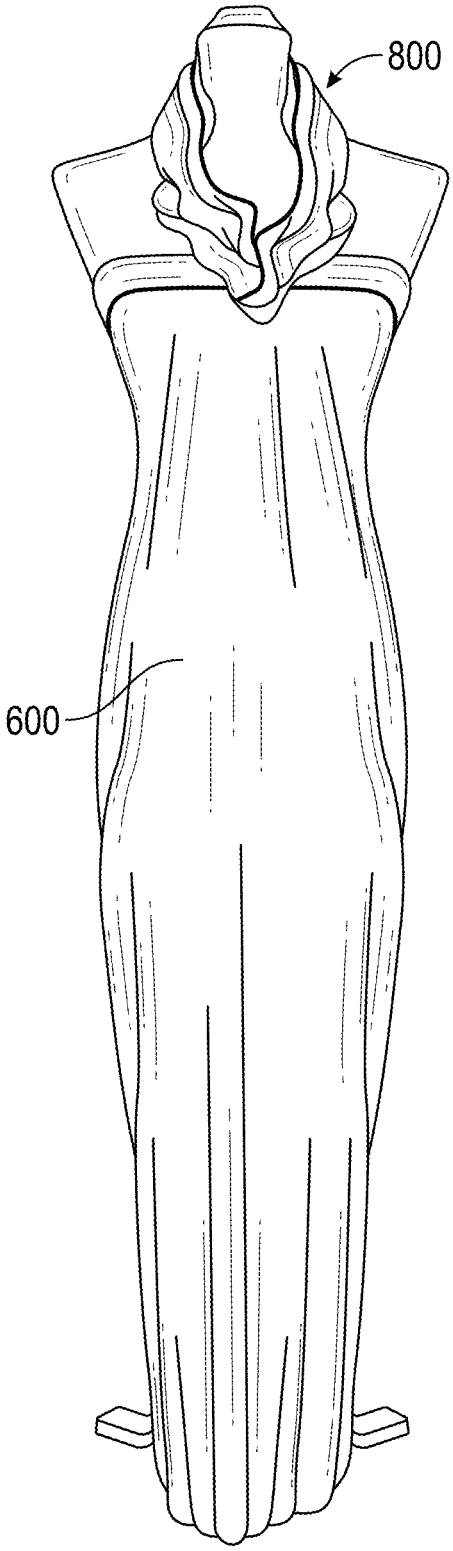
FIGS. 32A-32T are various looks that employ extenders that are arranged and configured in accordance with certain features, aspects, and advantages of certain embodiments.
Figure 32B:
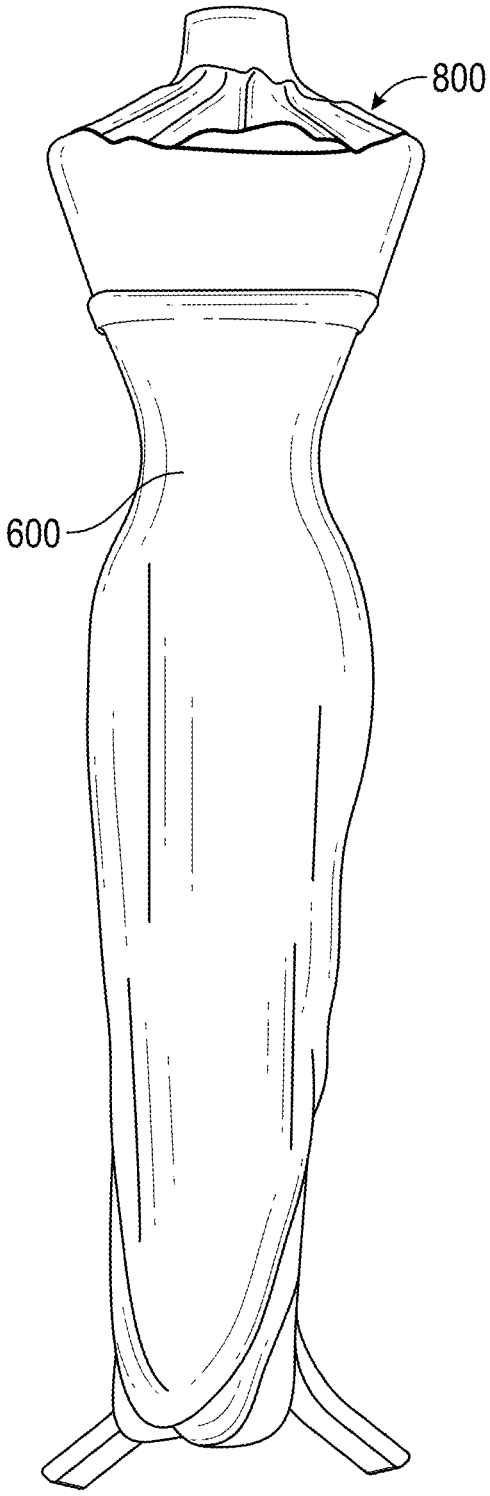
Figure 32C:
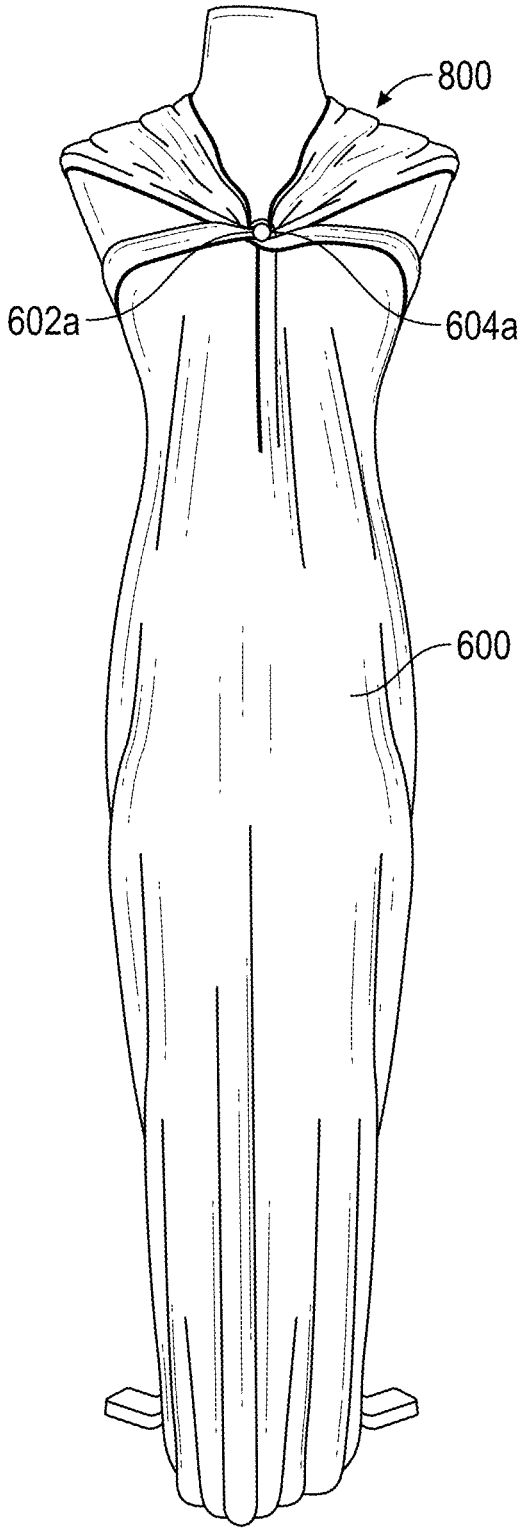
Figure 32D:
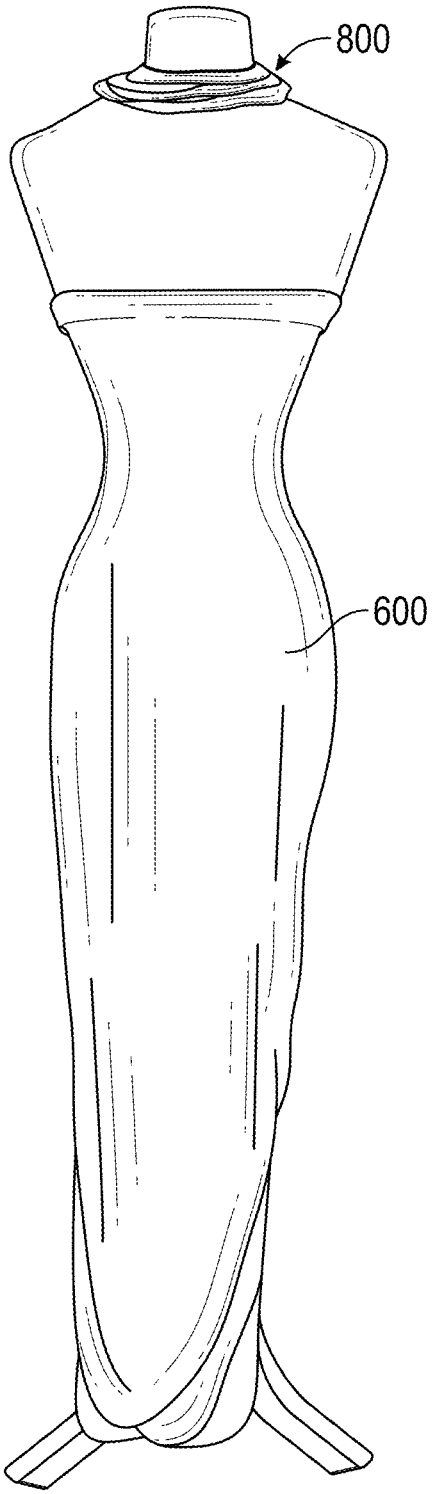
Figure 32E:
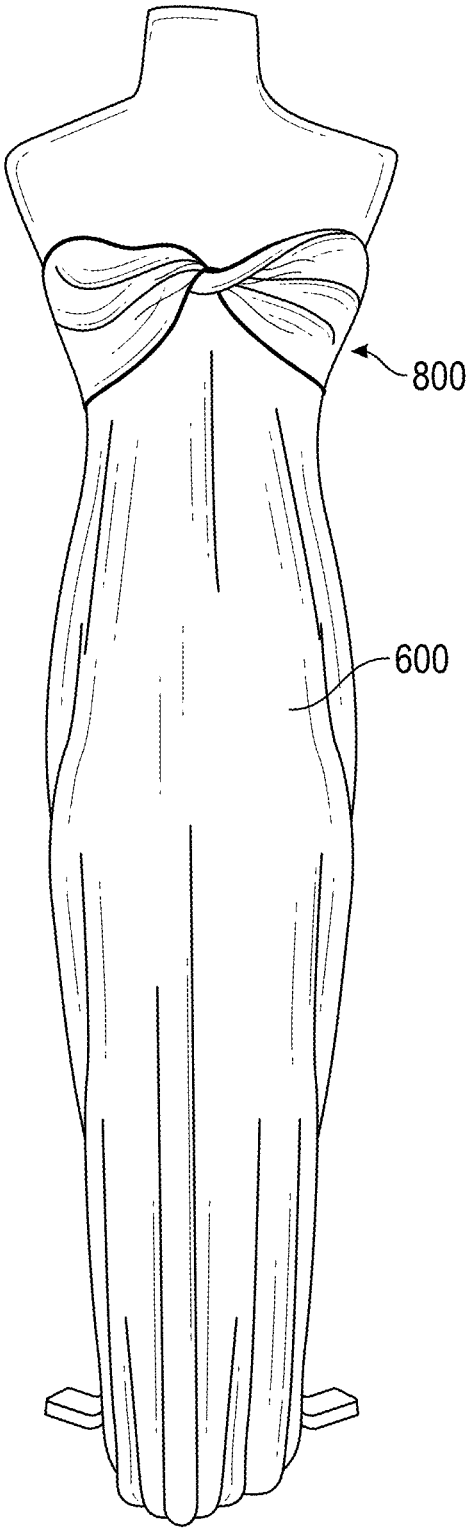
Figure 32F:
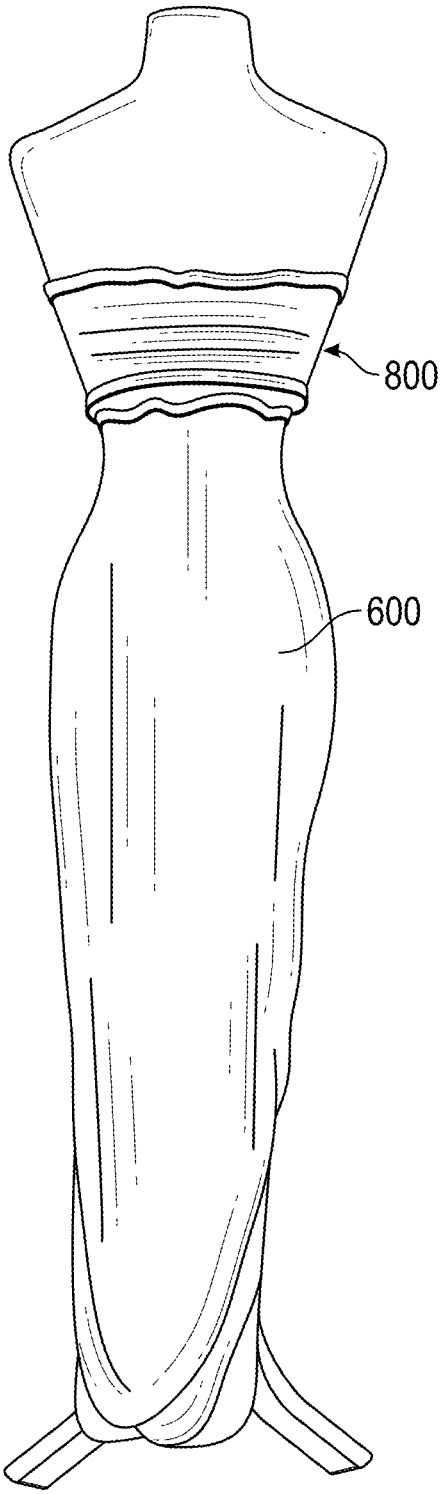
Figure 32G:
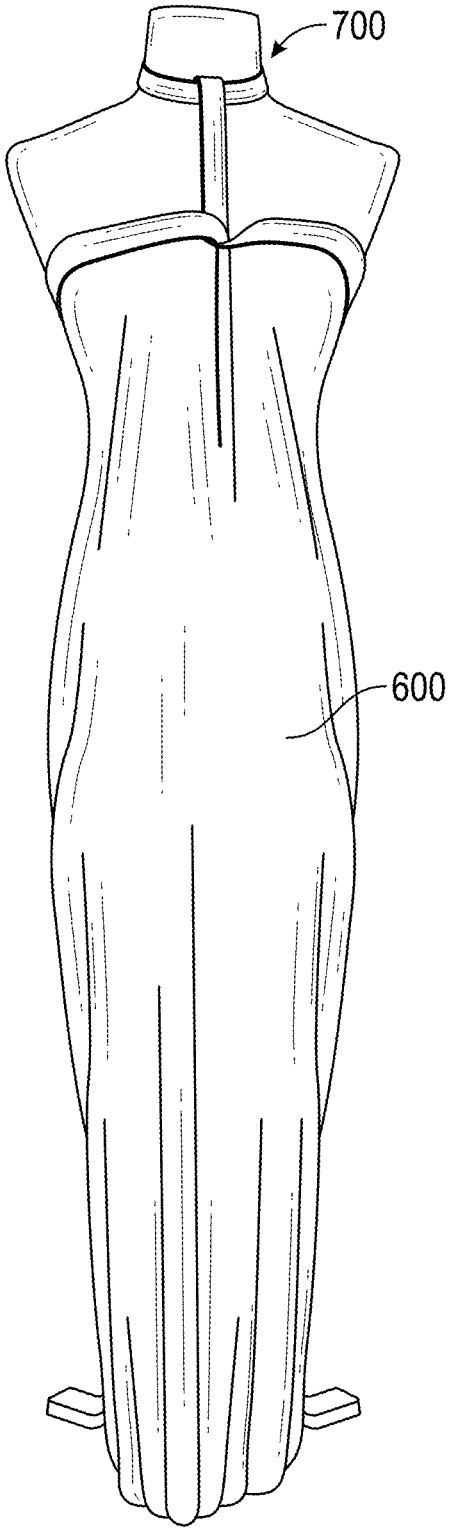
Figure 32H:
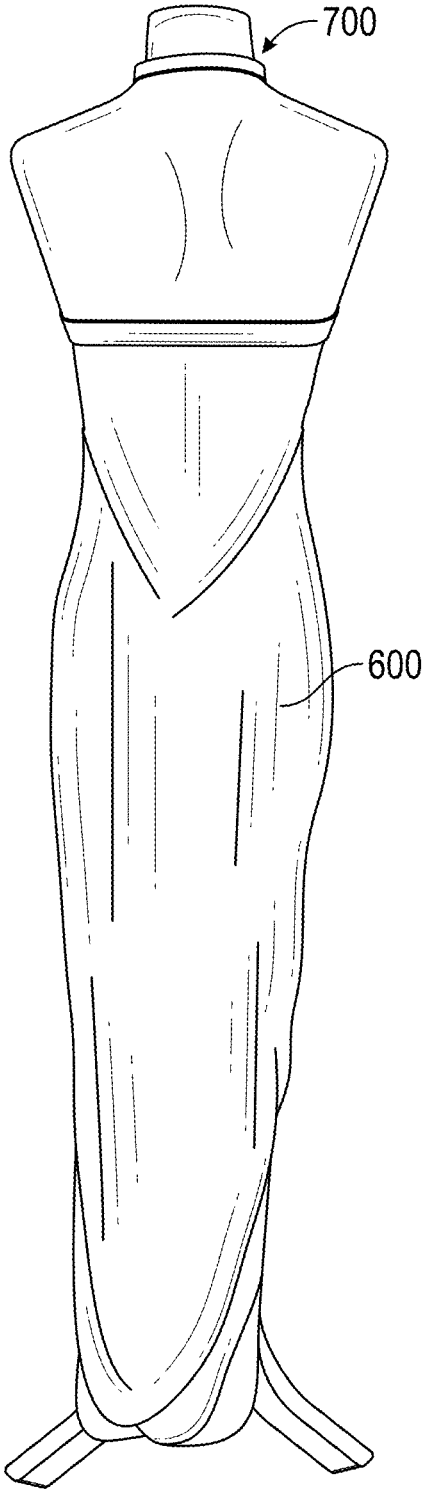
Figure 32I:
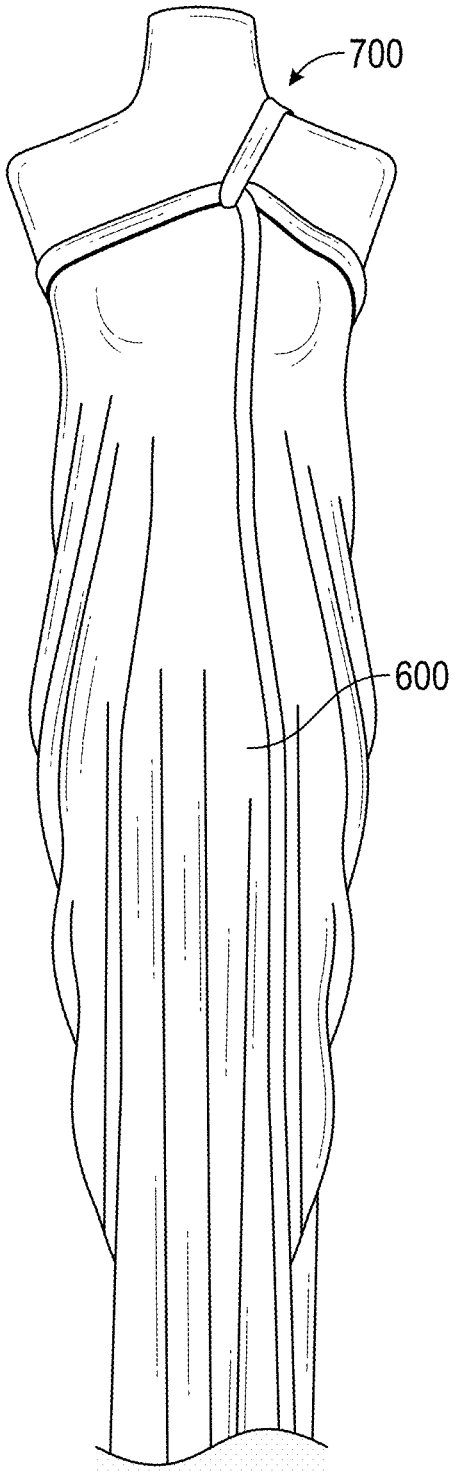
Figure 32J:
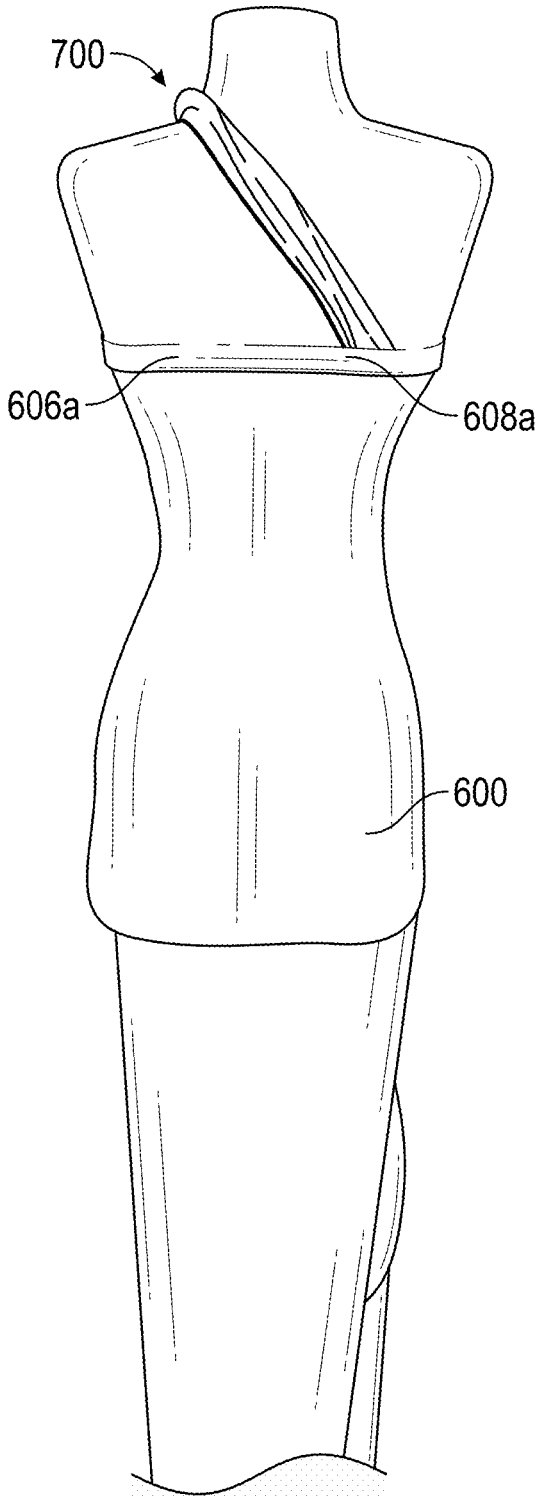
Figure 32K:
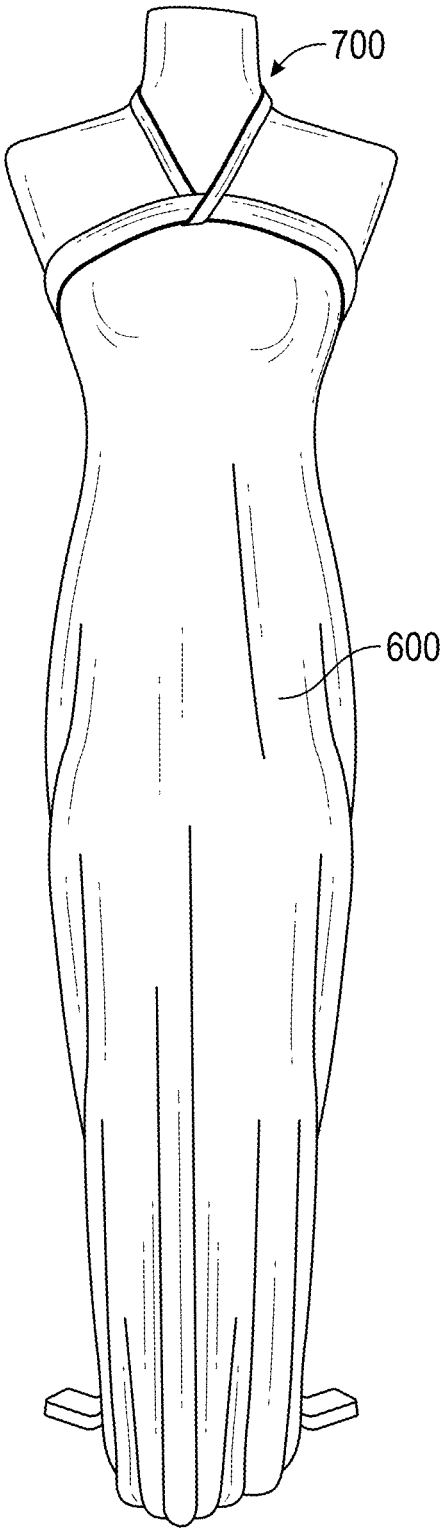
Figure 32L:
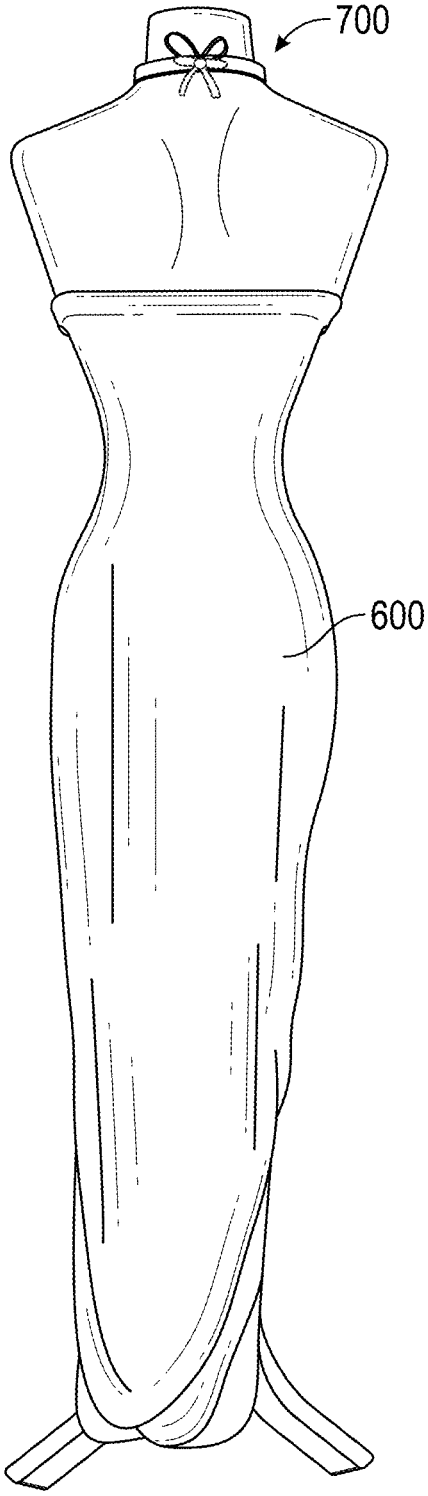
Figure 32M:
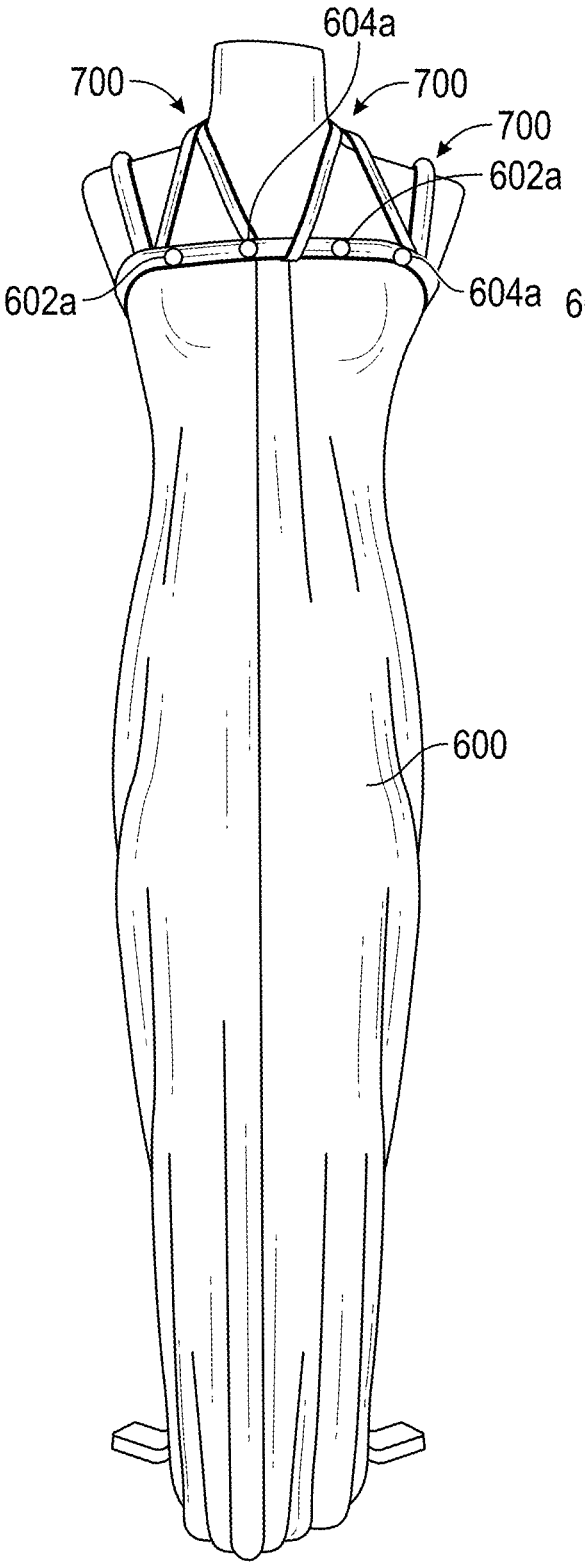
Figure 32N:
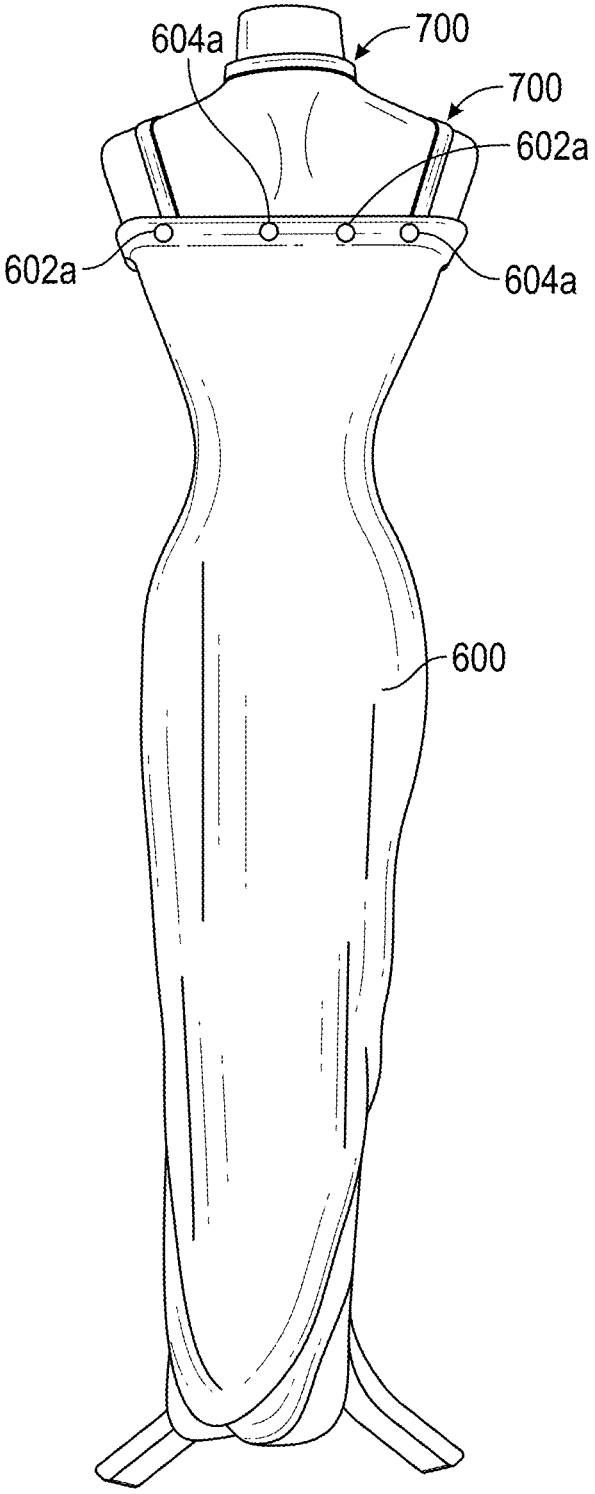
Figure 32O:
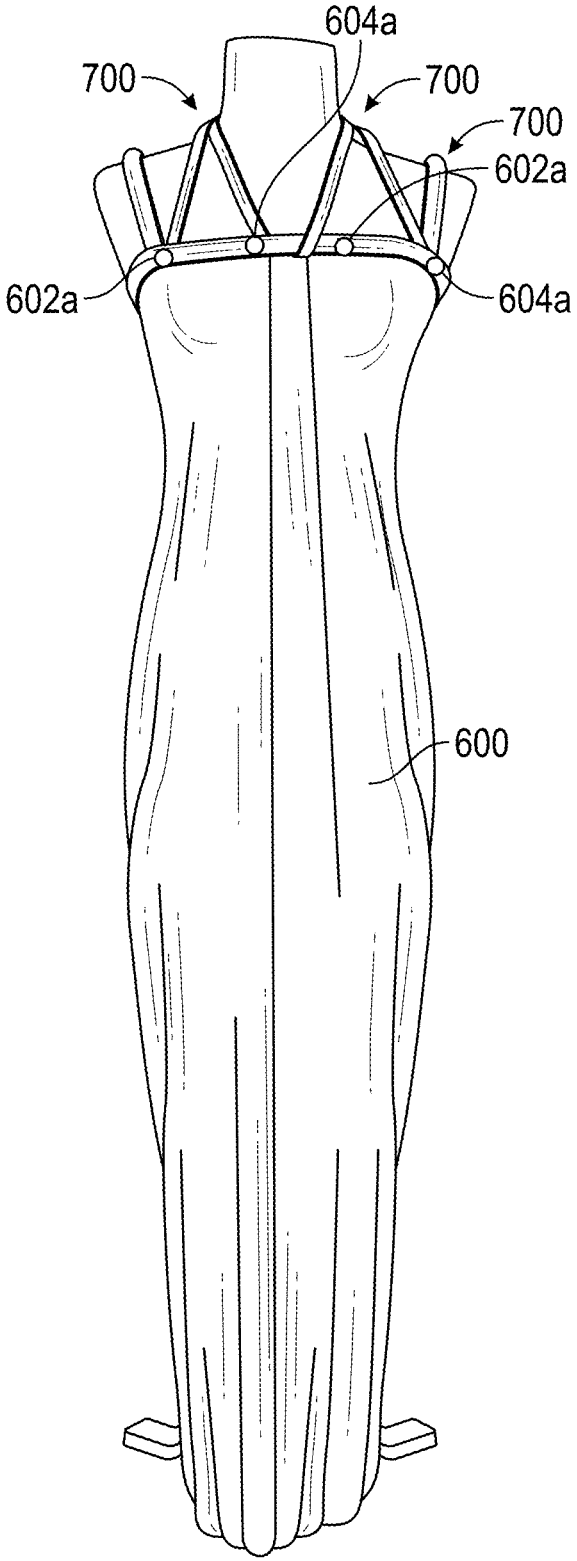
Figure 32P:
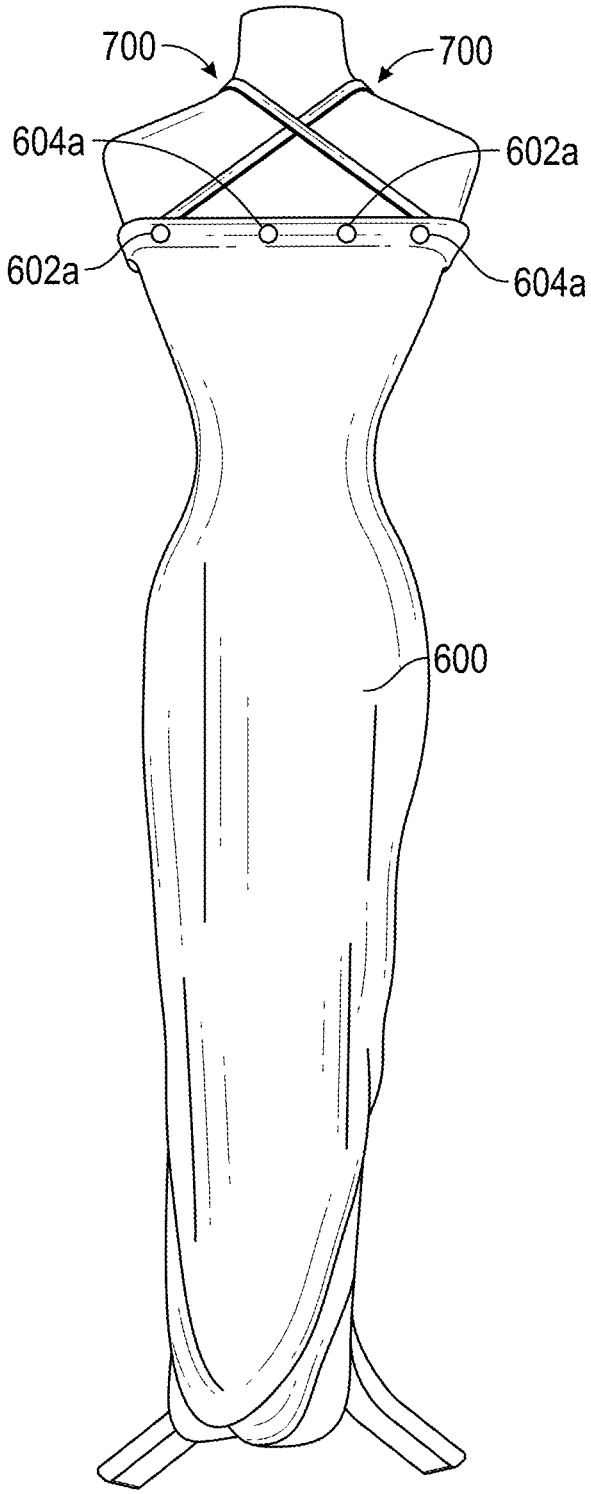
Figure 32Q:
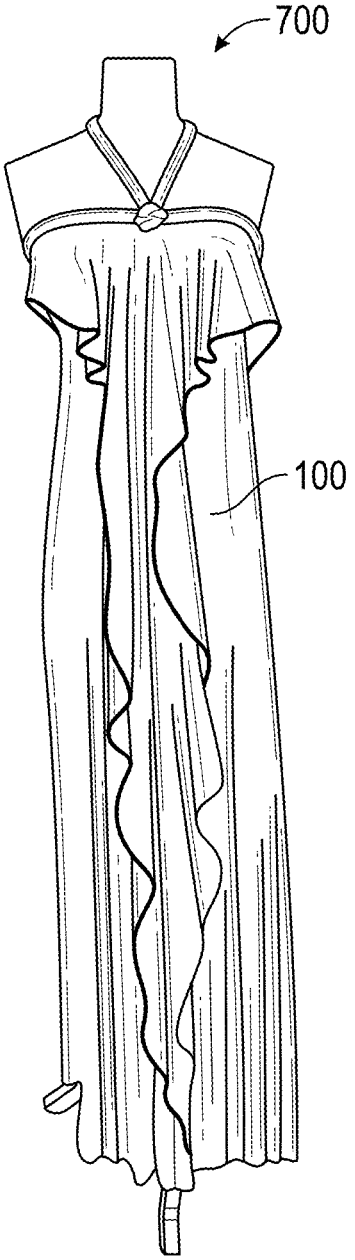
Figure 32R:
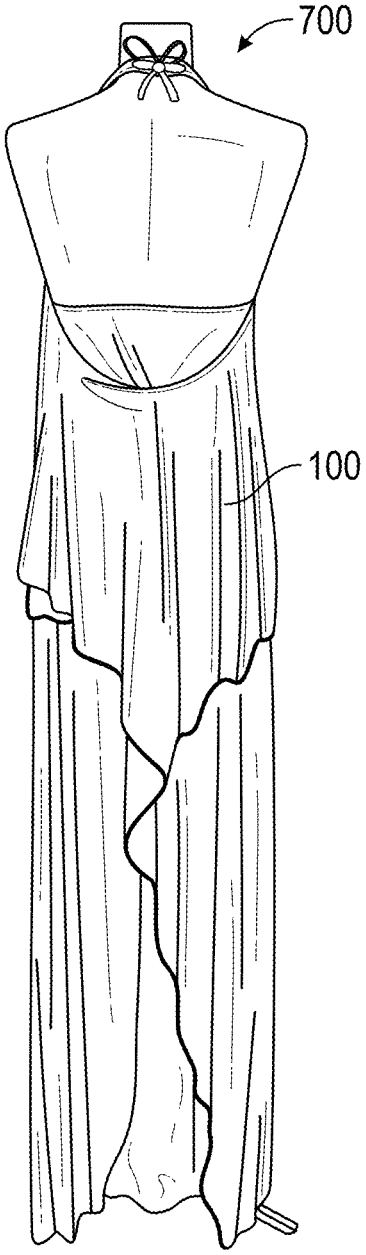
Figure 32S:
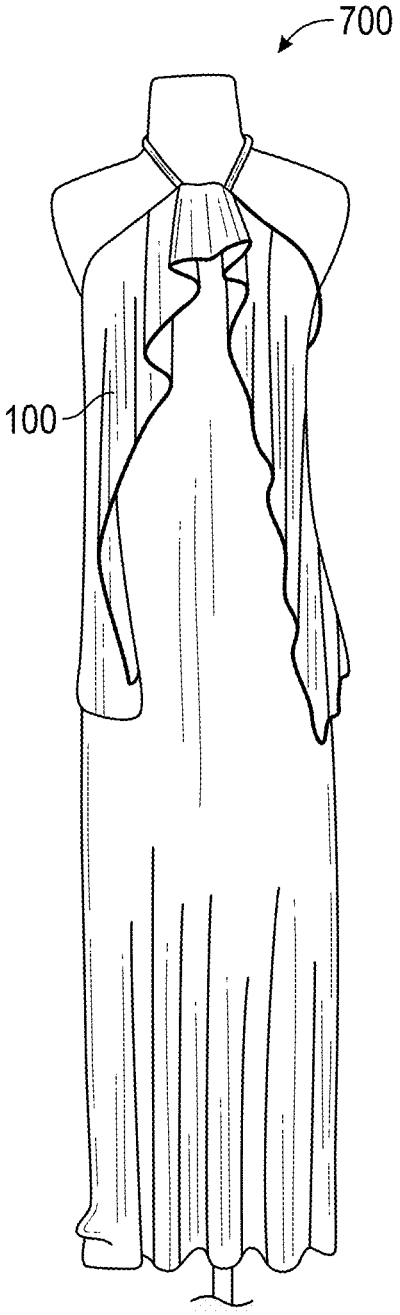
Figure 32T:
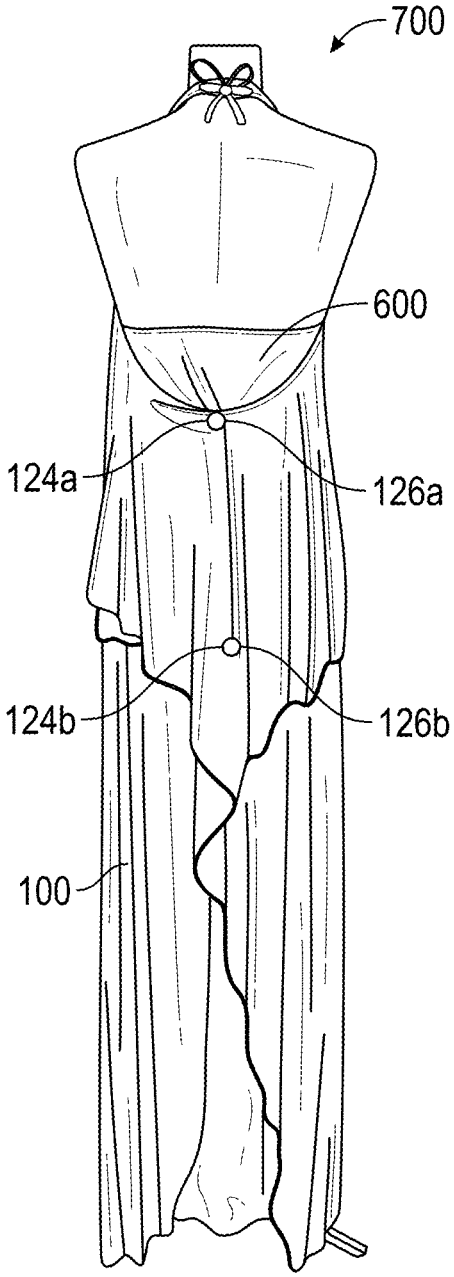
Figure 33:
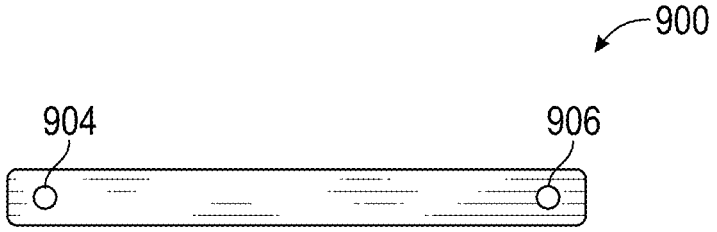
FIG. 33-FIG. 37 are further extenders configured for use as belts.

FIGS. 32A-32T are example of the garments described above in combination with one or more extender 700, 750, 800. For example, the styles illustrated in FIGS. 32A-32F simply expand upon the tube dress 600 shown and described above using the loop extender 800, while FIGS. 32G-32T illustrate the tube dress 600 in combination with one or more of the extenders 700, 750. The pairing of the extenders 700, 750, 800 with the tube dress 600 demonstrates the versatility of the extenders 700, 750, 800 and how the extenders 700, 750, 800 can greatly expand the style options. Similarly, the styles illustrated in FIGS. 32Q-32T illustrate a combination of the tube dress 600, the reconfigurable garment 100 of FIG. 1 and one or more extender 700, 750, 800.

With reference now to FIGS. 33-71, belts can be provided to complement and augment the looks provided by the reconfigurable garments described above. The belts can be similar to the extenders 700, 750, 800 described above. In some configurations, the extenders 700, 750, 800 can function as belts. As will be described, the ends of the belts can be joined with interchangeable buckles. In some configurations, the buckles can also serve as a broach or other adornment for the reconfigurable garments described above when connected to a fastening element of the reconfigurable garment or an extension.

FIG. 33-37 illustrate five different variations of belts 900, 910, 920, 930, 940. These are five example variations of belts; there are many more variations possible. Any of the belts 900, 910, 920, 930, 940 can be configured in accordance with any descriptions above relating to the extenders and, as such, the body of the belts will not be described in further detail.

Figure 34:
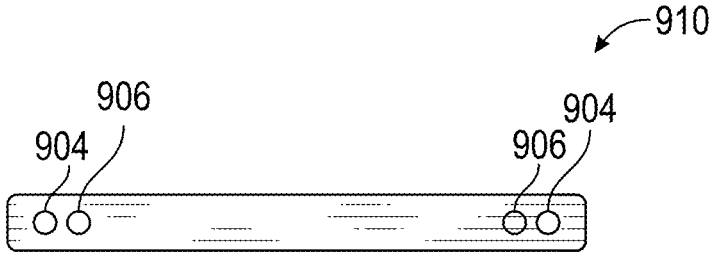
Figure 35:
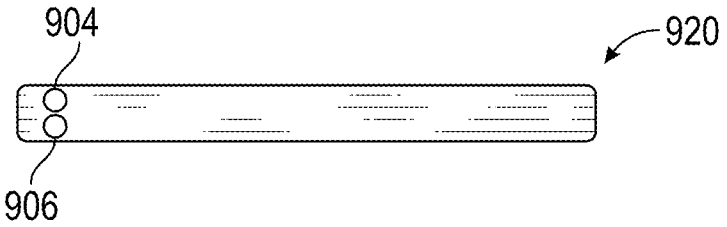
Figure 36:
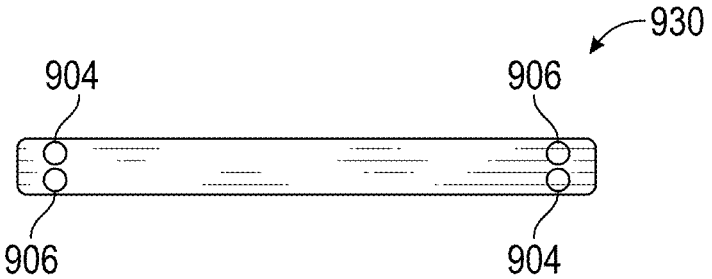
Figure 37:
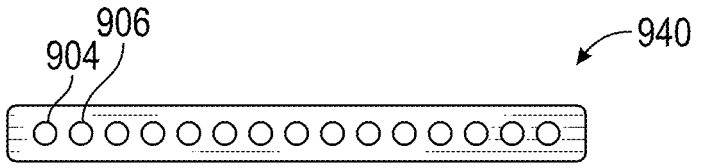

The belts 900, 910, 920, 930, 940 differ from each other in the arrangement of the fastening elements 904, 906. The fastening elements 904, 906 can complement each other or be universal. In some configurations, the fastening elements 904, 906 are arranged such that the belts can be closed in a loop without a fastener adornment, a buckle or other similar member (see, e.g., FIG. 55 and FIG. 66). In some configurations, such as those that will involve a fastener adornment, a buckle or other similar member, it is possible to connect to that fastener adornment using less than all of the fastening elements 904, 906 or using only one of the fastening elements 904 or the other of the fastening elements 906. As illustrated, the fastening elements can be arranged one high, two high or more. As illustrated, the fastening elements can be arranged the full length of the belt (FIG. 37), just a portion of the length of the belt (FIG. 35), or only at the ends of the belt (FIG. 34). In some configurations, the fastening elements are at both ends of the belt (FIG. 33) and in some configurations the fastening elements are on at least one end of the belt (FIG. 35). In some configurations, the fastening elements all face in the same direction and, in some configurations, the fastening elements face in opposing directions on the belt. In some configurations, the first fastening elements 904 face in a first direction and the second fastening elements face in an opposite direction to the first direction. In some configurations, the belt obscures the existence of the fastening elements from the opposite side of the functional portion of the fastening element.

Figure 38:
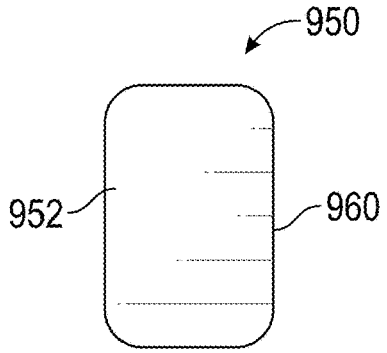
FIG. 38-FIG. 43 are adornments configured for use a buckles and accent pieces.
Figure 39:
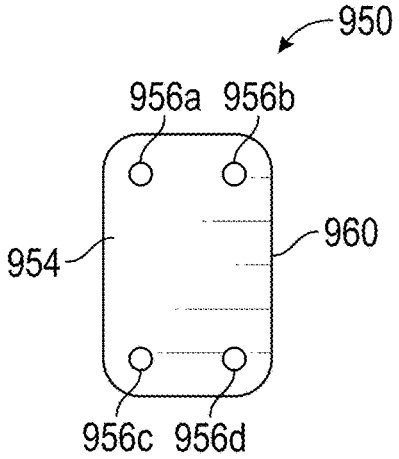

With reference now to FIG. 38-43, a few varieties of the fastener adornments will be described in greater detail. FIG. 38 and FIG. 39 illustrate a fastener adornment 950. The fastener adornment 950 has a first side 952 and a second side 954. In the illustrated configuration, the fastener adornment 950 includes four fastening elements 956*a*, 956*b*, 956*c*, 956*d*. In some configurations, the fastening elements 956 can be positioned such that all of the fastening elements 956 are on one of the first side 952 or the second side 954. In other configurations, the fastener adornment 950 can be configured such that a portion of the fastening elements 956 are positioned on the first side 952 and a portion of the fastening elements 956 are positioned on the second side 954.

Figure 40:
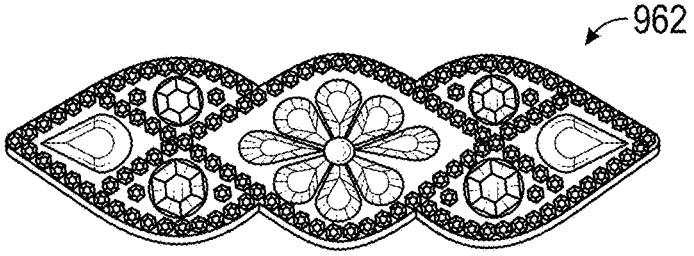
Figure 41:
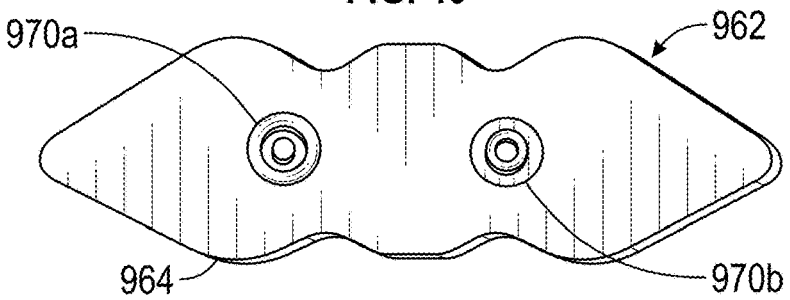
Figure 42:
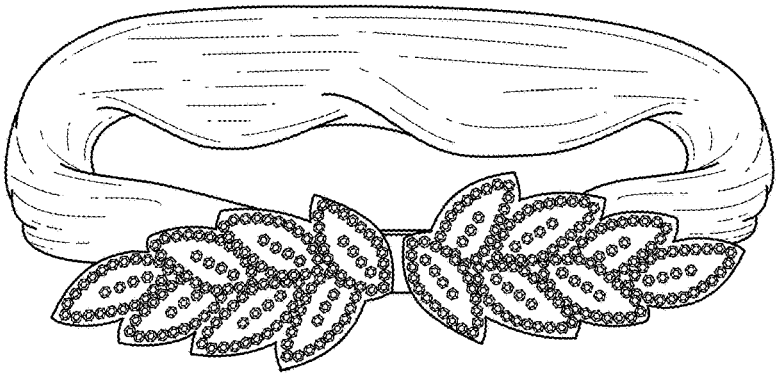
Figure 43:
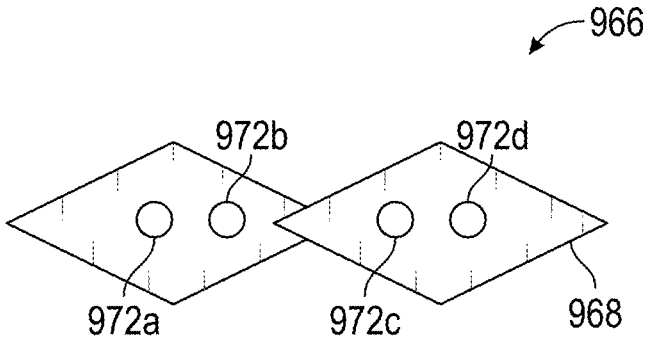

The fastener adornment 950 in the illustrated configuration of FIGS. 38 and 39 is generally rectangular in shape. Accordingly, the fastener adornment 950 can include a rectangular outer perimeter 960. The outer perimeter 960 can have any suitable shape. While the illustrated outer perimeter 960 is shown as a rectangle, the size and shape can vary according to the style tastes of the wearer. For example, FIG. 40 and FIG. 41 illustrate a further fastener adornment 962 with an elongate generally oval outer perimeter 964. Further, FIG. 42 and FIG. 43 illustrate a fastener adornment 966 with an outer perimeter 968 defined by interlocking leaves or diamond shapes. As discussed above, an almost limitless number of shapes can be used as the outer perimeter for a given fastener adornment.

While the fastener adornment 950 of FIG. 38 and FIG. 39 features four fastening elements 956, the fastener adornment 962 of FIG. 40 and FIG. 41 includes only two fastening elements 970*a*, 970*b*. In the arrangement shown in FIG. 41, the fastening element 970*a* has a first orientation while the second fastening element 970*b* has an opposite second orientation. In some configurations, both of the fastening elements 970*a*, 970*b* can have the same orientation.

Similarly, with reference to FIG. 43, the fastener adornment 966 includes four fastening elements 972*a*, 972*b*, 972*c*, 972*d*. While the illustrated arrangement includes all of the fastening elements 972 on the same side of the fastener adornment 966, it is possible to otherwise configure the fastening elements 972. For example, in some configurations, two of the fastening elements 972*a*, 972*b* may be positioned on a first side of the fastener adornment 966 and two of the fastening elements 972*a*, 972*b* may be positioned on a second side of the fastener adornment 966. In the illustrated configuration, the fastening elements 972*a*, 972*b* are paired together while the fastening elements 972*c*, 972*d* also are paired together. In some configurations, each of the fastening elements in the pairs of fastening elements are oriented opposite of each other. In some configurations, each of the fastening elements in the pairs of fastening elements are oriented the same as each other.

Figure 44:
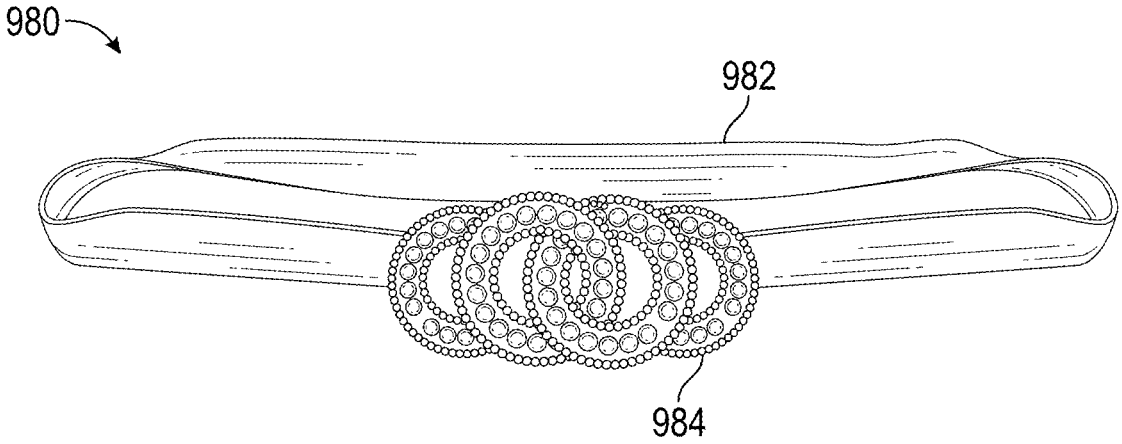
FIGS. 44-71 are belts configured from extenders and adornments.
Figure 45:
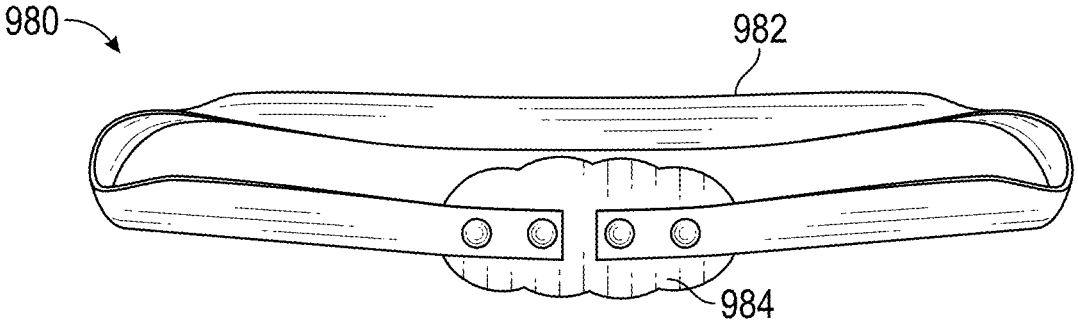
Figure 46:
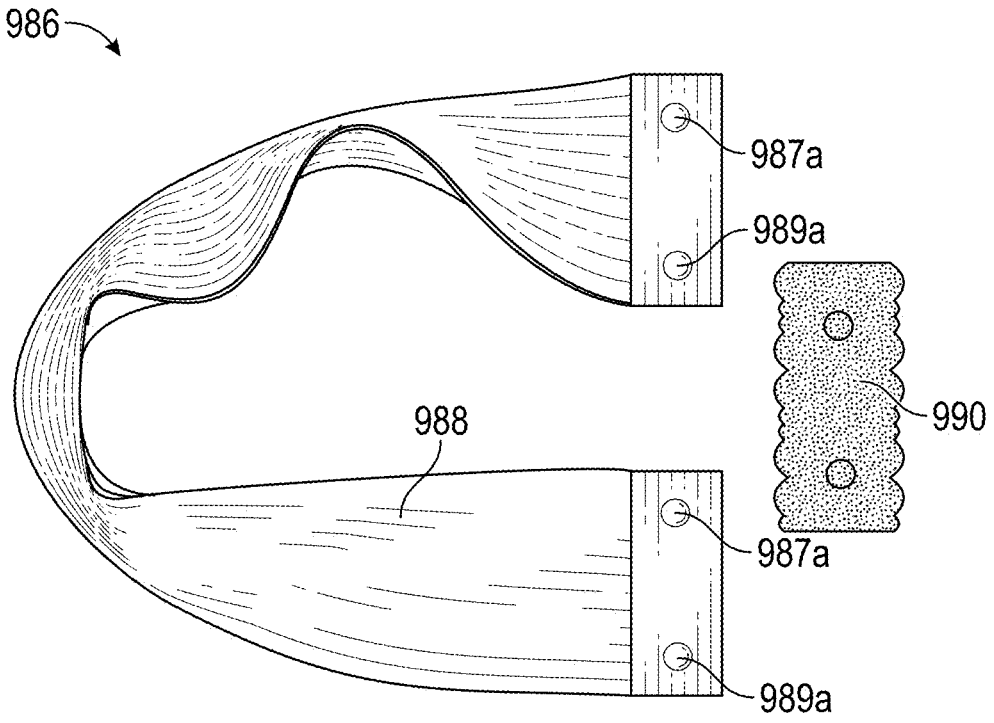
Figure 47:
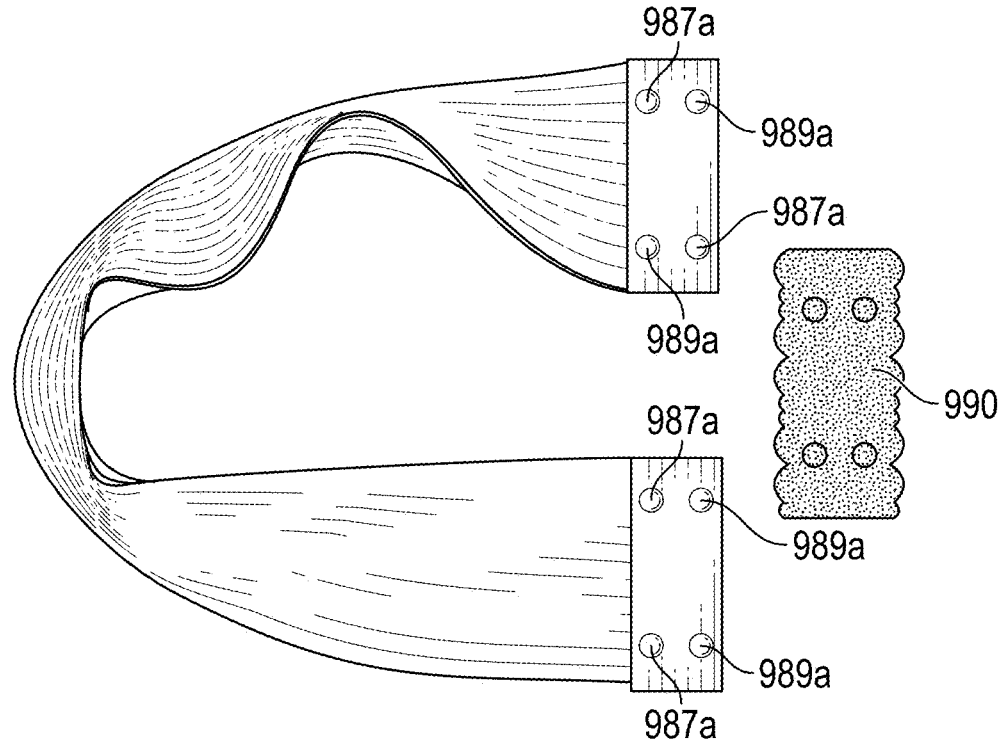
Figure 48:
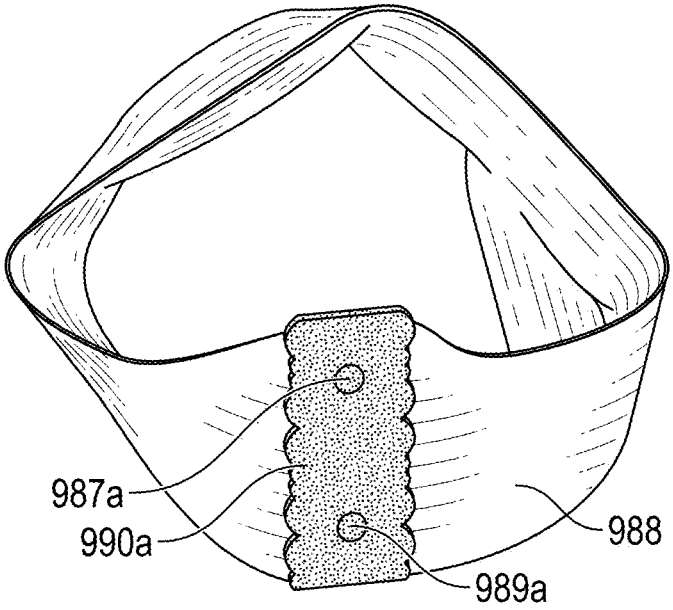
Figure 49:
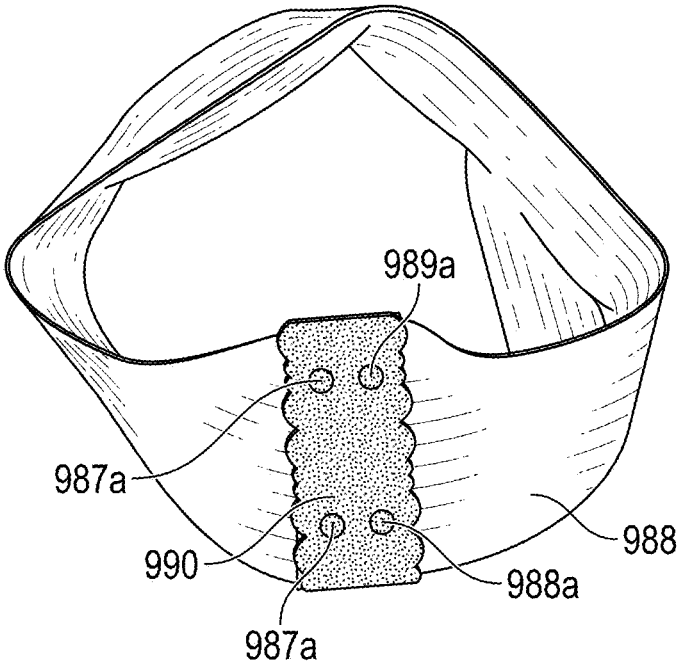

As shown in FIG. 44 and FIG. 45, a belt 980 can be configured from an extender 982 and a fastener adornment 984. The ends of the extender 982 can be connected together with the fastener adornment 984. In the illustrated configurations, at least one of the ends of the extender 982 can connect with, snap to, or interlock with a portion of the fastener adornment 984. In some configurations, the ends of the extender 982 connect with, snap to, or interlock with the rear side of the fastener adornment 984. In some configurations, the fastener adornment 984 can include a slot and each of the ends of the extender 982 can thread through the fastener adornment 984 before being secured to itself.

FIGS. 46-49 illustrate another belt 986. The belt 986 is configured with an extender 988 that has fastening elements 987*a*, 989*a* on both sides of a first end and fastening elements 987*a*, 989*a* on a single side of a second end. As such, one of the set of fastening elements 987*a*, 989*a* of the first end can join with the set of fastening elements 987*a*, 989*a* on the second end and the fastener adornment 990 can be secured to the other set of the fastening elements 987*a*, 989*a* on the first end such that the ends of the extender 988 can be obscured by the fastener adornment 990.

Figure 50:
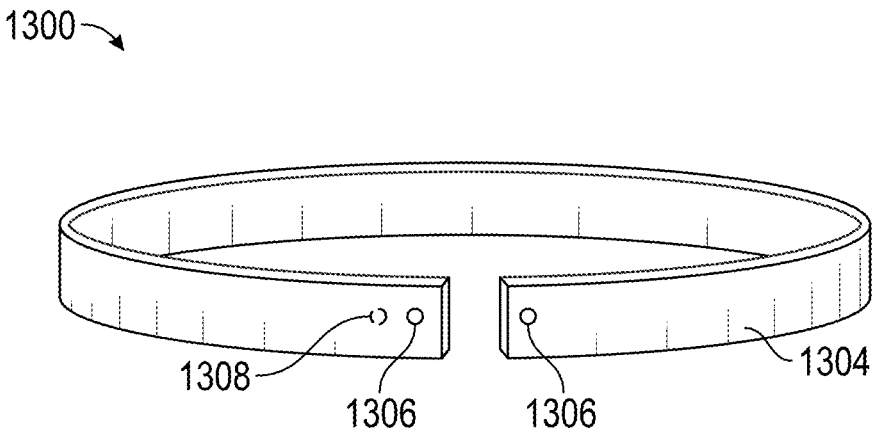
Figure 51:
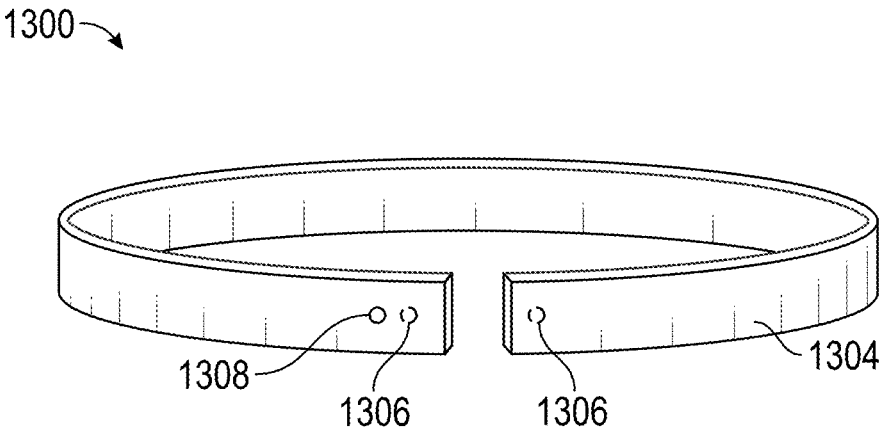
Figure 52:
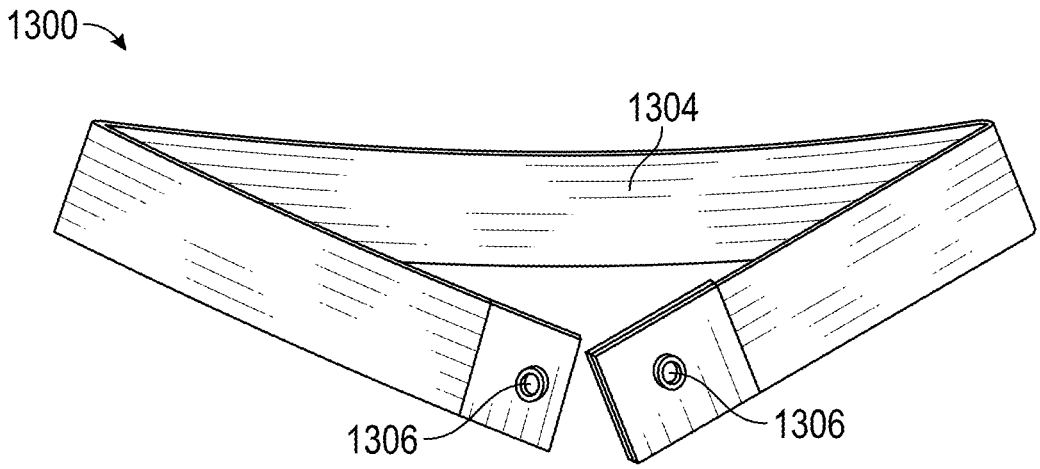
Figure 53:
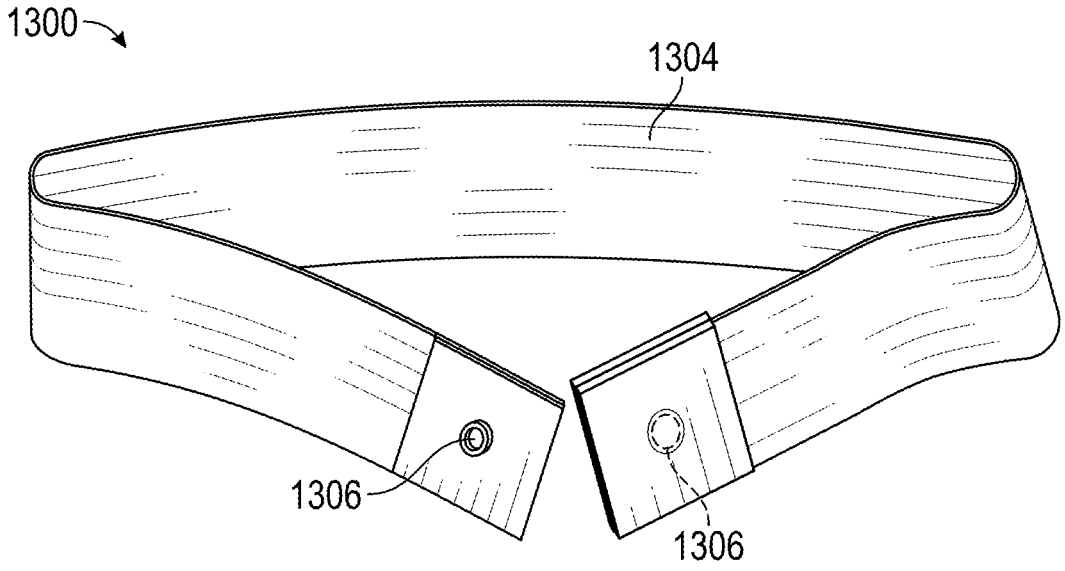
Figure 54:
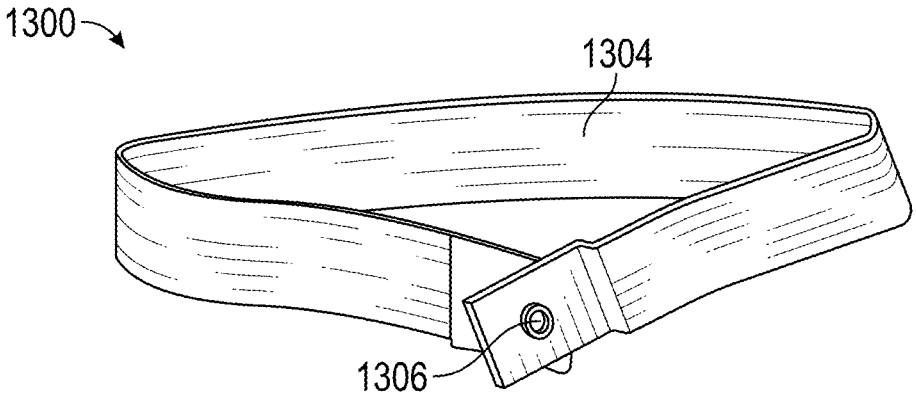
Figure 55:
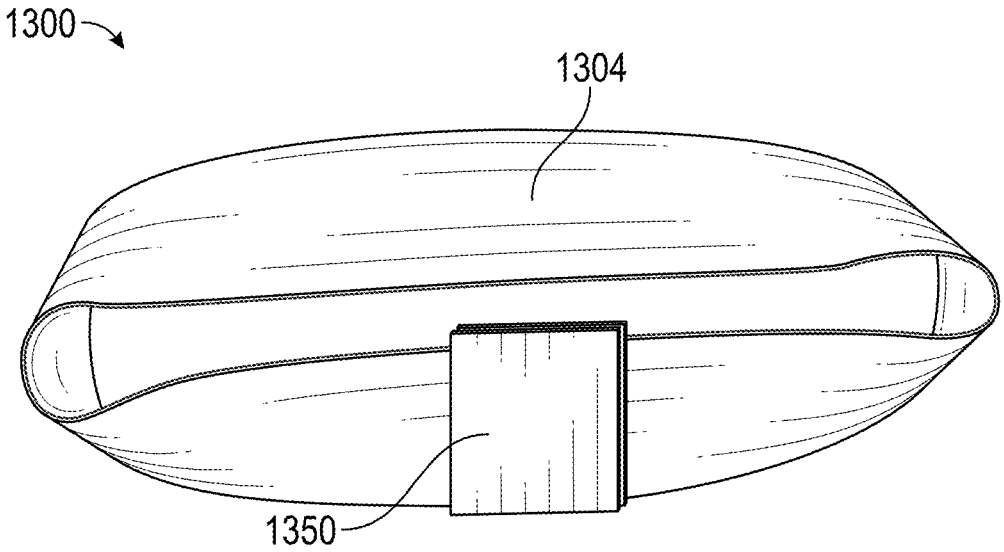
Figure 56:
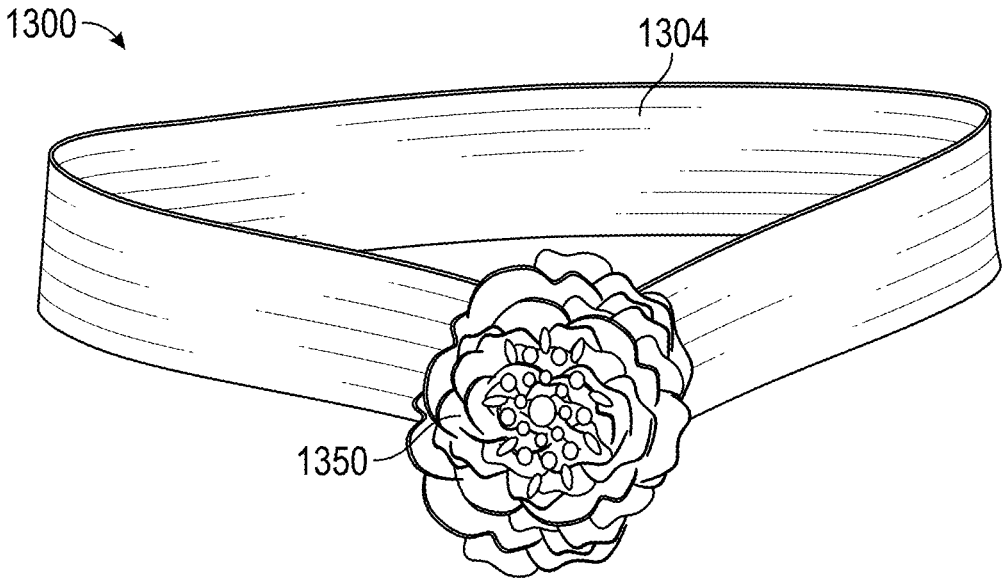
Figure 57:
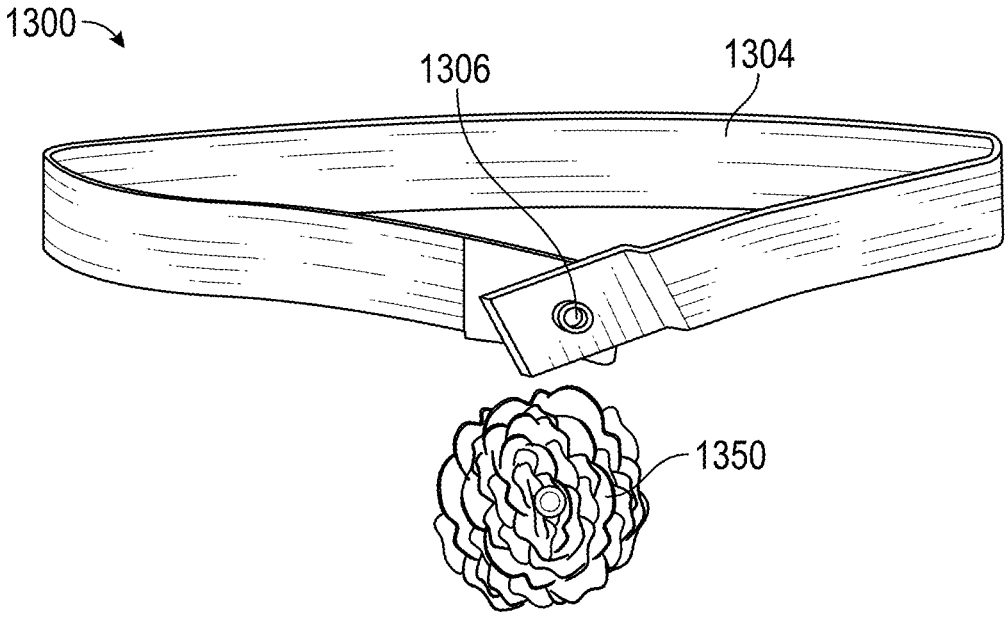
Figure 58:
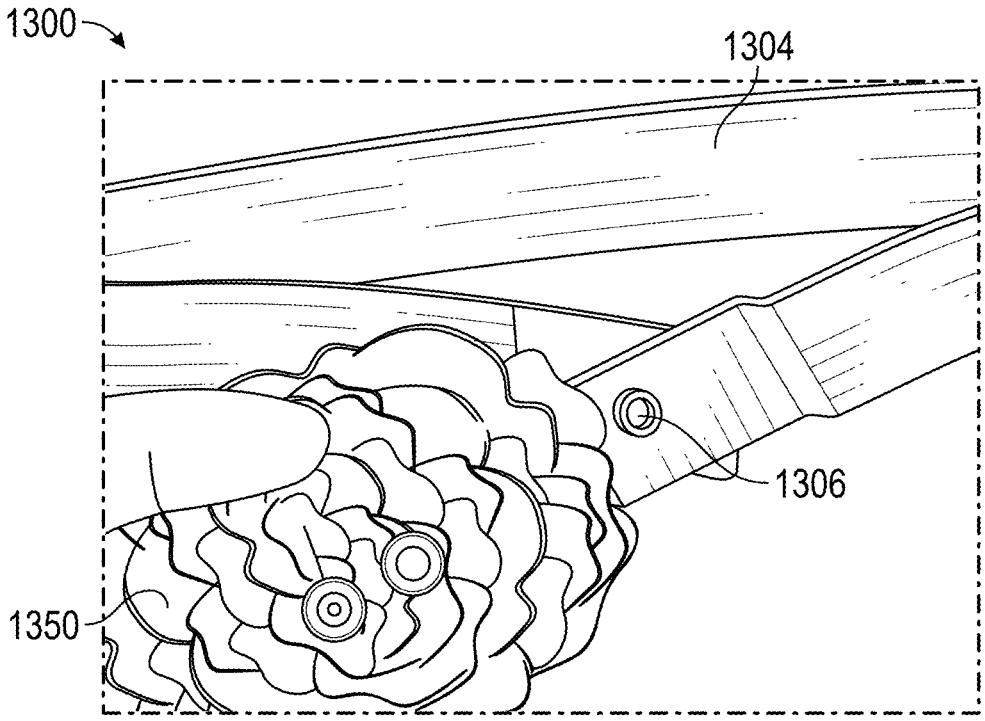
Figure 59:
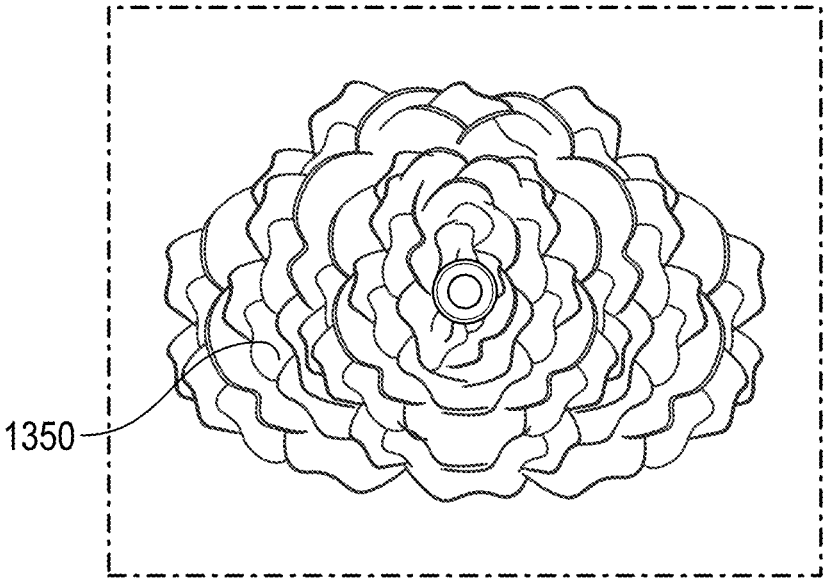
Figure 60:
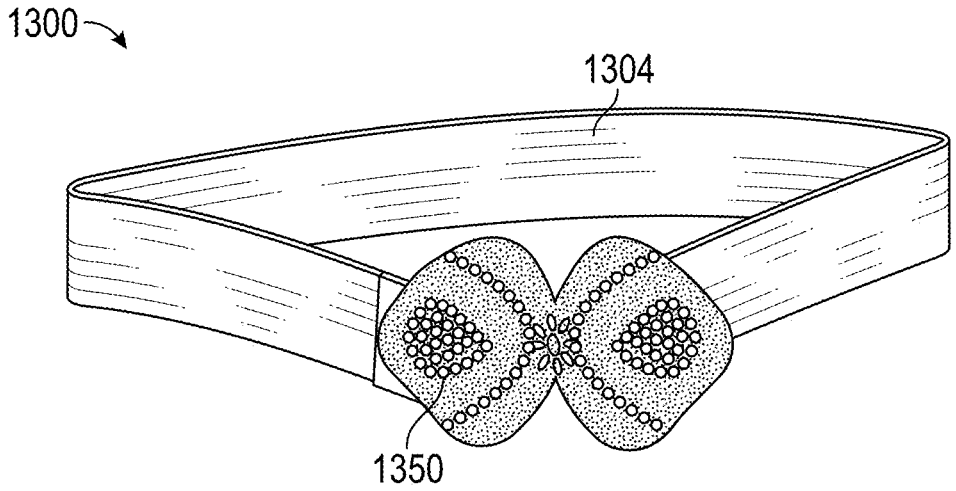
Figure 61:
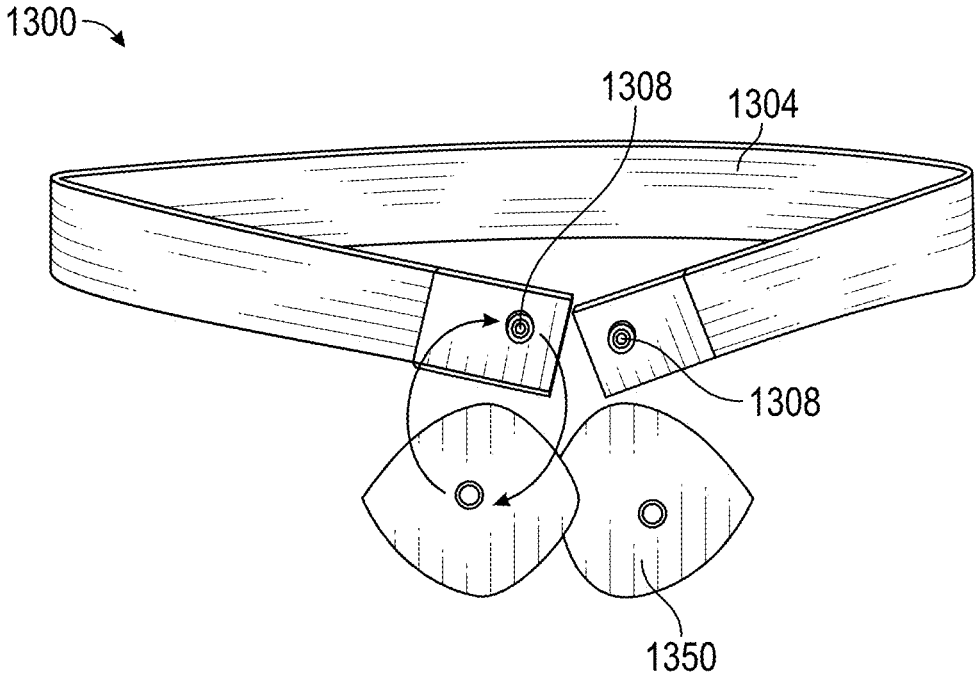

FIGS. 50-61 illustrate an additional belt 1300 with the extender 1304 having at least one outwardly fastening element 1306. One or more of the fastening elements 1308, however, may be obscured such that the fastening element 1308 is not outwardly facing. In FIG. 50, three fastening elements 1306, 1308 are shown with two of those fastening elements 1306 outwardly exposed. The third fastening element 1308 of the belt 1300 of FIG. 50 can be inwardly exposed such that the inwardly exposed fastening element 1308 can engage and join with one of the two outwardly exposed fastening elements 1306 while the other outwardly exposed fastening element 1306 can receive an adornment 1350, which is another form of the fastener adornment described above. FIG. 51 illustrates the belt 1300 of FIG. 50 inverted such that the outwardly exposed fastening elements 1306 are inwardly exposed, and the inwardly exposed fastening element 1308 is outwardly exposed. FIGS. 52-59 illustrate an embodiment of the configuration illustrated in FIG. 50 and FIG. 51 in the orientation of FIG. 50 while FIGS. 60-61 illustrate an embodiment of the configuration illustrated in FIG. 50 and FIG. 51 in the orientation of FIG. 51.

Figure 62:
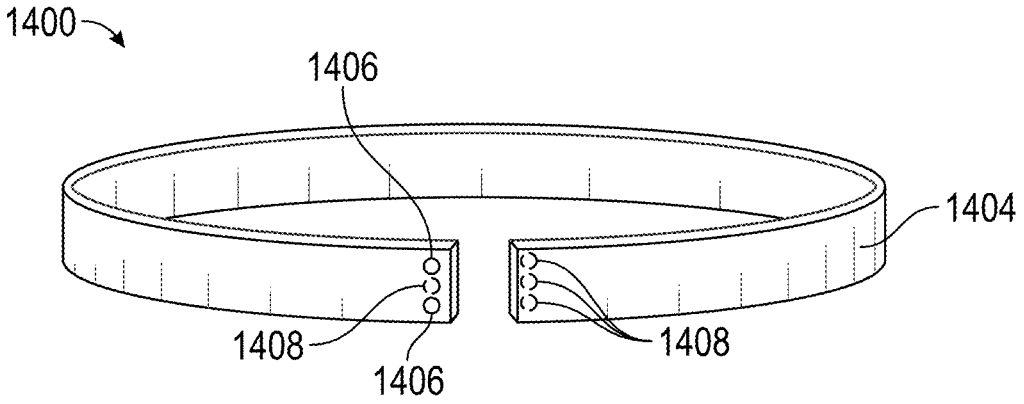
Figure 63:
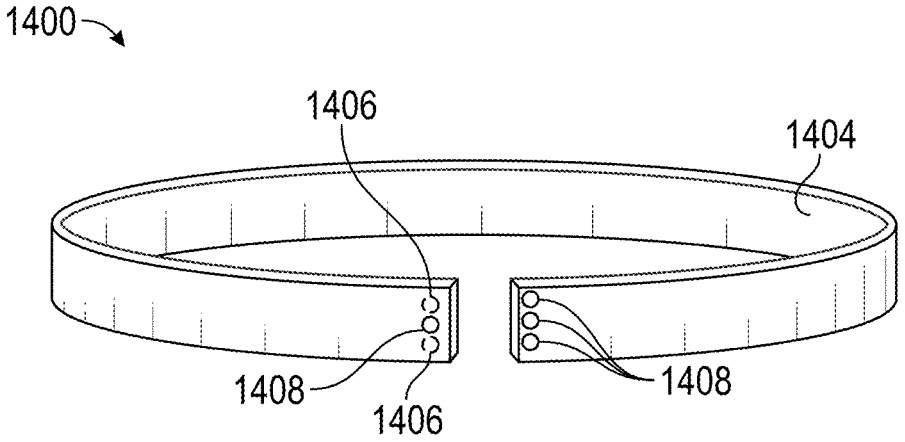
Figure 64:
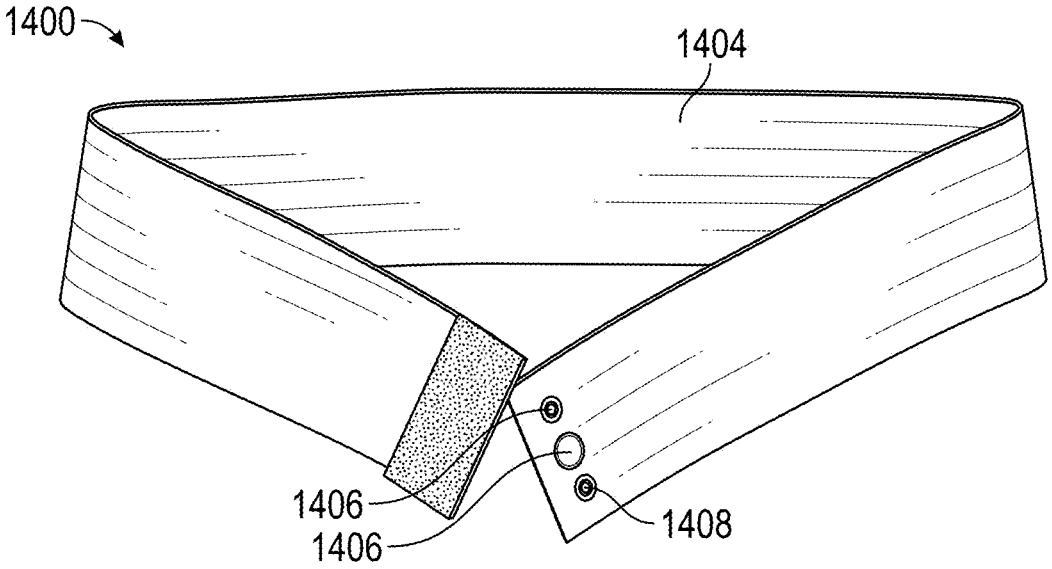
Figure 65:
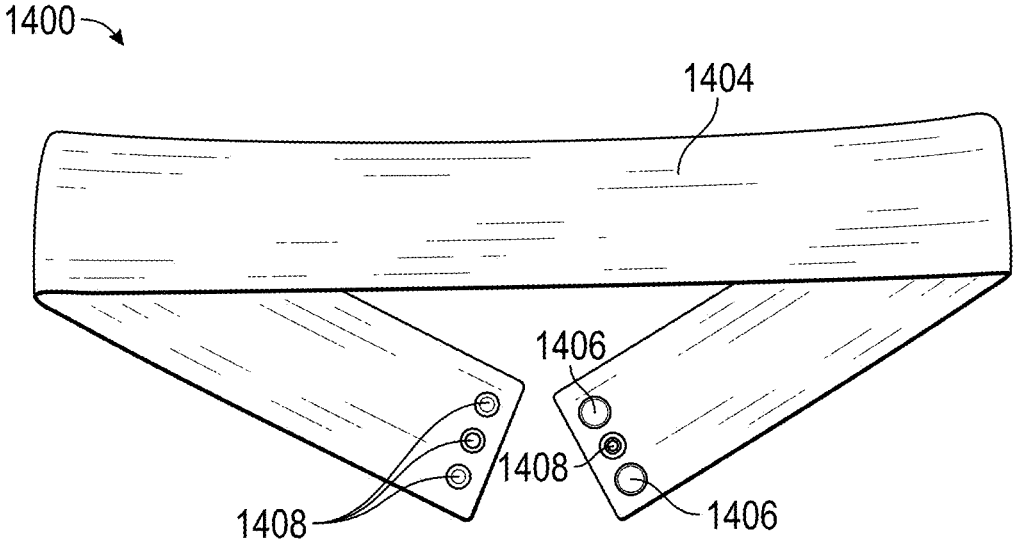
Figure 66:
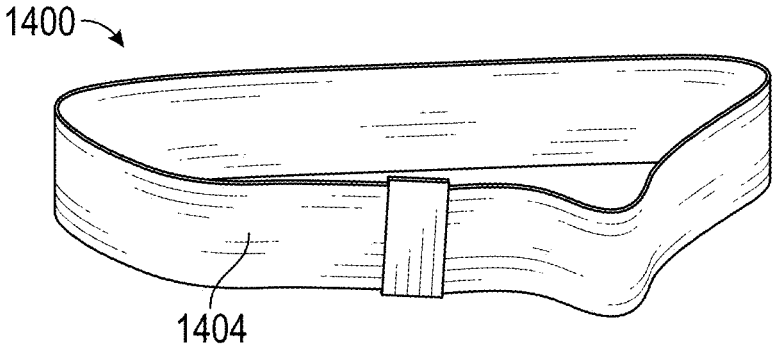

With reference to FIGS. 62-71, a further belt configuration 1400 is presented. As shown in FIG. 62, the extender 1404 can include three fastening elements 1406, 1408 at each end. In the illustrated configuration, a first end of the extender 1404 includes three fastening elements 1408 that are inwardly exposed. In some configurations, the three inwardly exposed fastening elements 1408 are not outwardly exposed. In the illustrated configuration, a second end of the extender 1404 includes two outwardly exposed fastening elements 1406 and one inwardly exposed fastening element 1408. In some configurations, the inwardly exposed fastening element 1408 is not outwardly exposed. In some configurations, the outwardly exposed fastening elements 1406 are not inwardly exposed. FIG. 63 illustrates the same extender 1404 of FIG. 62 flipped inside out. FIGS. 64-66 illustrate the extender 1404 connecting to itself in the configuration of FIG. 62 while FIGS. 67-71 illustrate the ends of the extender 1404 being joined by the fastener adornment 1450 while oriented as shown in FIG. 63.

Thus, the belt 1400 shown in FIGS. 62-71 facilitate at least four different configurations. In the first configuration, the user can choose to close the loop of the extender 1404 using the existing fastening elements on each side of the extender 1404. In the second configuration, the user can flip this same extender 1404 inside out and add a decorative adornment 1450 or similar member to the fastening elements 1406 on this side (see FIG. 71). In the third configuration, the user can interconnect the fastening elements 1408 located on the outside of the extender 1404 with the fastener adornment (see FIG. 68). In a fourth combination, the user can attach the extender 1404 or belt 1400 directly to the body of the reconfigurable garment and secure it to one of its many available fastening elements.

Figure 67:
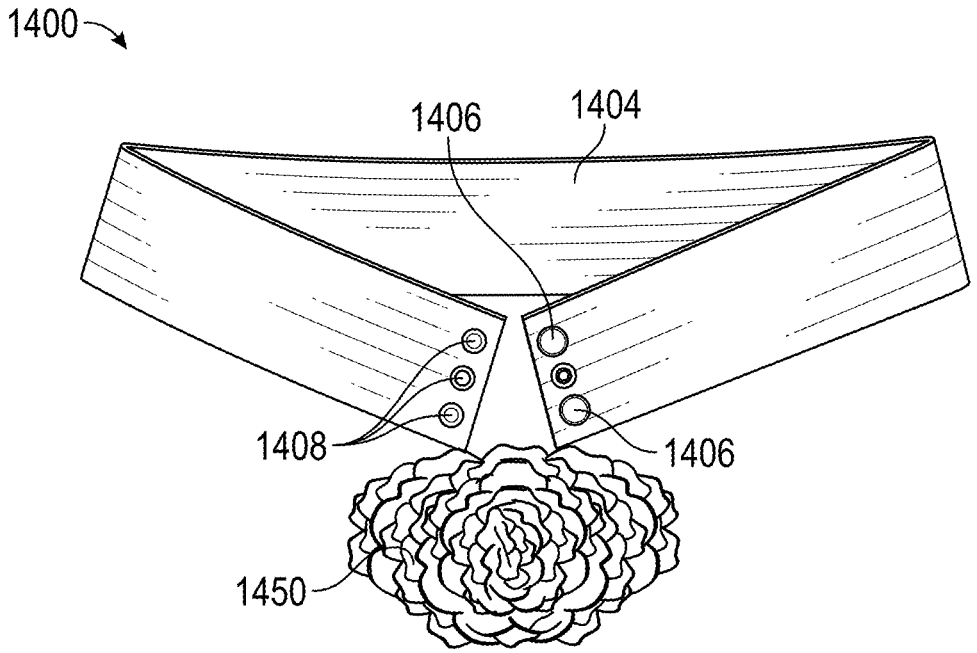
Figure 68:
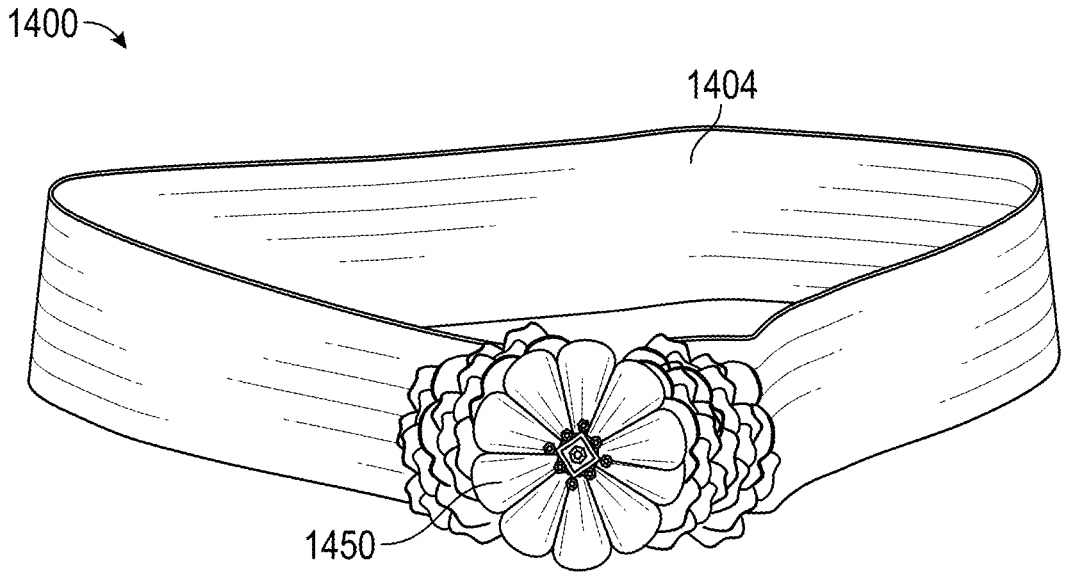
Figure 69:
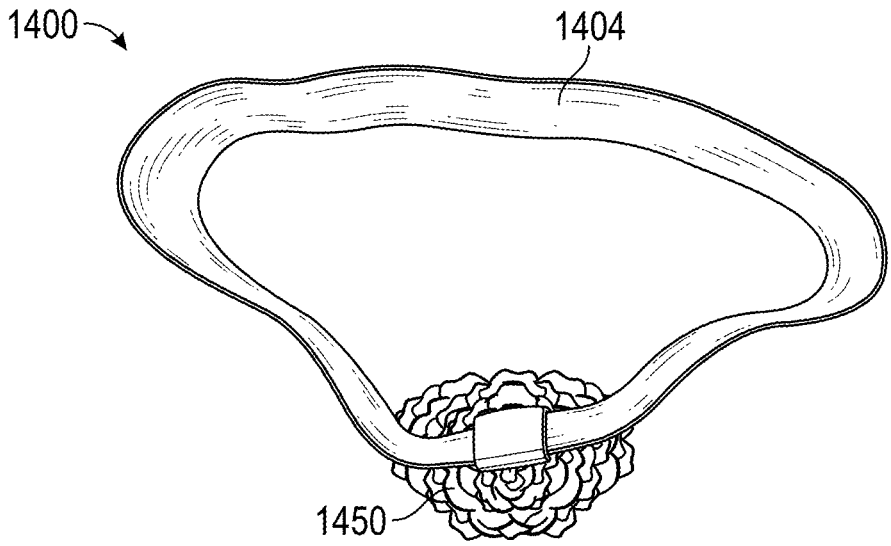
Figure 70:
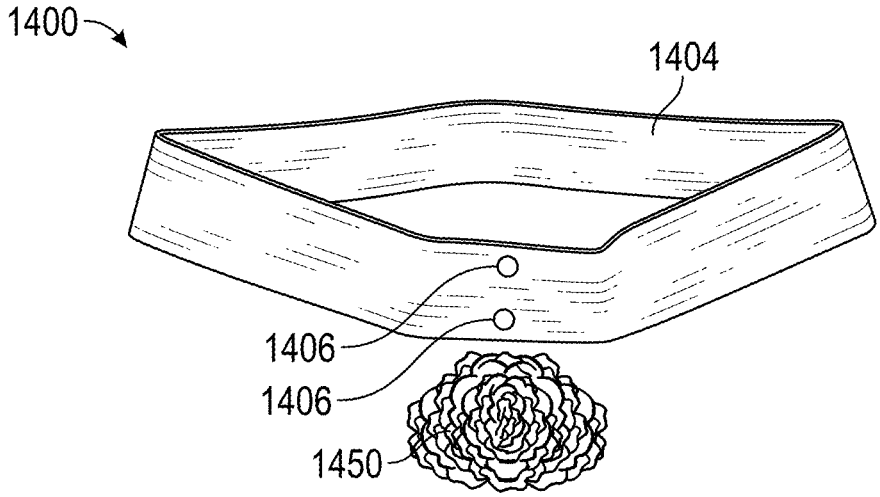
Figure 71:
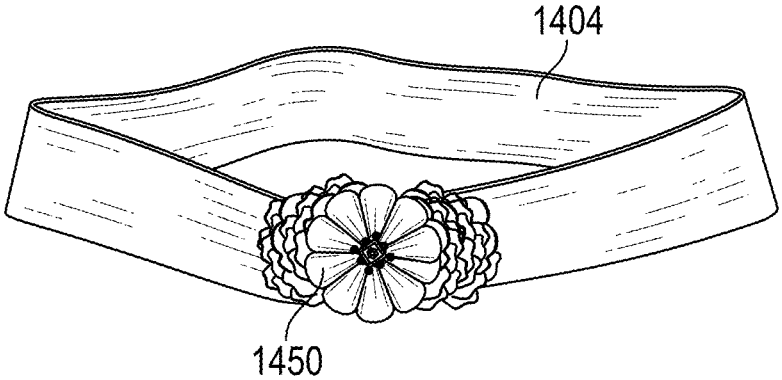
Figure 72:
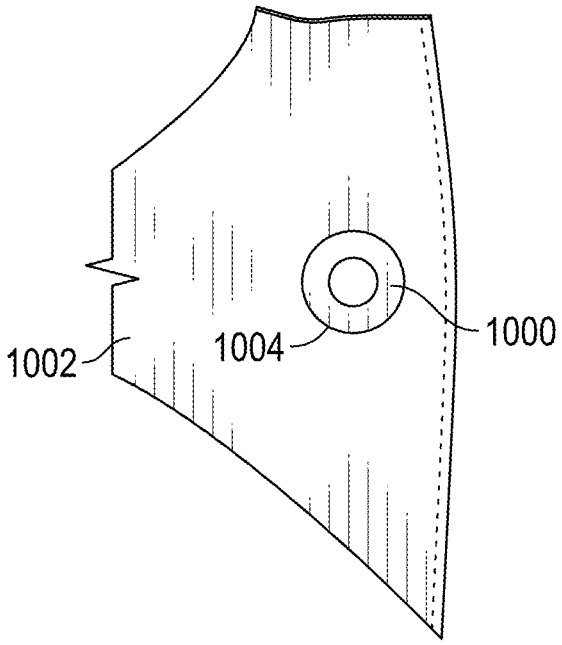
FIGS. 72-75 illustrate a method of connecting a fastening element in accordance with certain features, aspects, and advantages of an embodiment.
Figure 73:
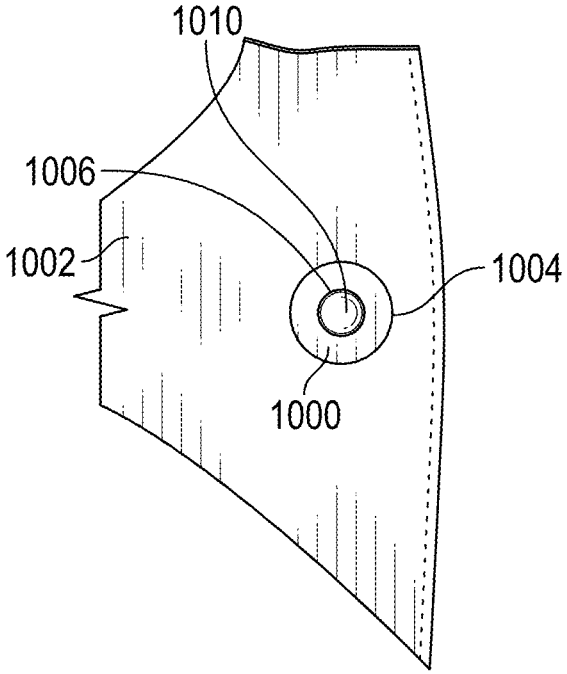
Figure 74:
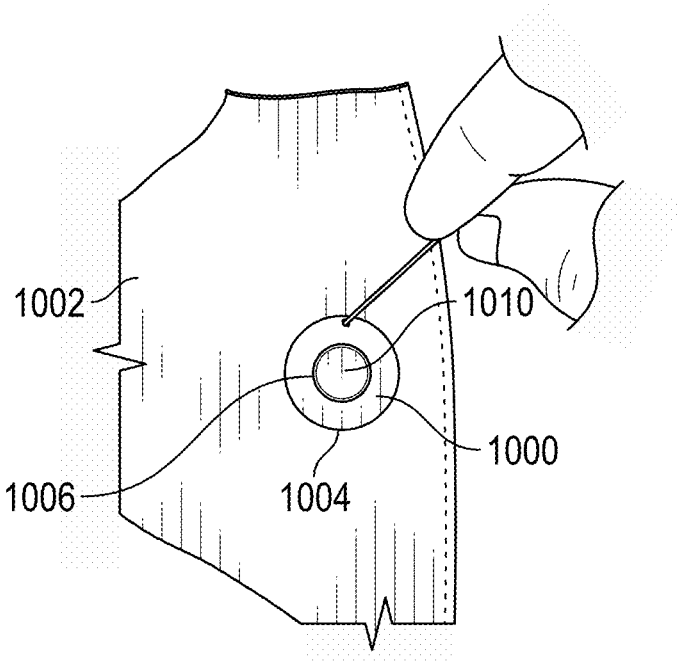

With regard to the decorative buckles or fastener adornment, while there are many ornamental possibilities for the frontside, the backside will contain at least one fastening element such as the one shown in FIG. 67 or FIG. 70. In some configurations, the interchangeable buckle can have two fastening elements on the backside as shown in FIG. 41. In other configurations, the interchangeable buckle can have up to 4 fastening elements on the back as shown in FIG. 43. The fastening elements can be arranged horizontally on (FIG. 41) or vertically (FIG. 47) on the back of the buckle depending on the particular design. Moreover, the ornamental buckles can have a box shape of stacked fastening elements as shown in FIG. 39.

As discussed above, any suitable fastening elements can be used. In some configurations, the fastening elements are snaps. However, in some configurations, the fabric selections render snaps generally undesirable. Snaps can be difficult to attach to slippery and/or stretchy materials, including, without limitation, spandex. With such materials, pulling at the snap can increase the likelihood that the snap will simply fall off or separate from the underlying fabric. Many of today's methods of attaching snaps to garments involve sewing in a stiff reinforcement strip of fabric or "ripstop" to hold the snap elements in place. This is often the choice of reinforcement for when designers need a simple snap system that fastens securely down the middle of a garment. However, "floating" snaps, such as those shown and described above, implement an innovative snap reinforcement system that does not have the stiff and rigid feel of traditional reinforcement methods, while remaining aesthetically pleasing.

The reinforcing method allows the reconfigurable garment to be flexible and enables snaps to be attached securely anywhere on the fabric panels of the garments, even discretely. Having a discrete reinforcement, as opposed to a rip-strip reinforcement, is desired when creating "reversable" looks, such as at least some of those described above. Reversibility provides enhanced styling options for the wearer.

The illustrated reinforcing method involves preparing reinforcement pieces 1000. The reinforcement pieces 1000 can be formed of the same fabric as the underlying fabric panel 1002 of the related garment or, in some configurations, the reinforcement pieces 1000 can be formed of a different fabric. In some preferred configuration, the fabric used for the reinforcement pieces 1000 can have at least the same weight and/or stretch as the fabric used for the garment.

The reinforcement pieces 1000 can have any suitable shape and size. In some configurations, the reinforcement pieces 1000 have an outer perimeter 1004 that is large enough to extend beyond an outer perimeter 1006 of the fastening element 1010 that the reinforcement piece 1000 is reinforcing. In some configurations, the reinforcement pieces can have at least a portion that extends beyond the fastening element 1010 that the reinforcement piece 1000 is reinforcing such that the portion is exposed. In some configurations, the reinforcement pieces 1000 can be circular. In some configurations, the reinforcement reinforcement pieces 1000 are sized to fit within a 4-inch diameter circle. While the reinforcement reinforcement pieces 1000 can be created in any suitable manner, in one particular configuration, the reinforcement reinforcement pieces 1000 can be die cut. The reinforcement reinforcement pieces 1000 define patches that can be applied to each side of a fabric panel 1002 at the location of the fastening element 1010. While it may be possible to reinforce on only one side of the fabric panel 1002, reinforcing on both sides provides improved performance and, in some configurations, can provide a unique aesthetic.

Figure 75:
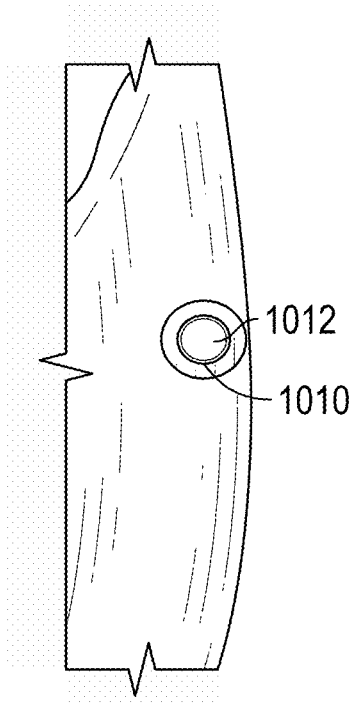
Figure 76:
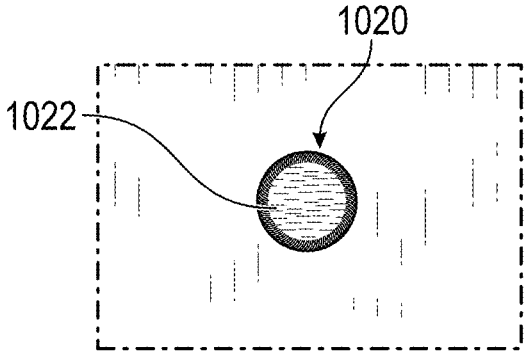
FIGS. 76-79 illustrate a method of connecting a fastening element in accordance with certain features, aspects, and advantage of an embodiment.
Figure 77:
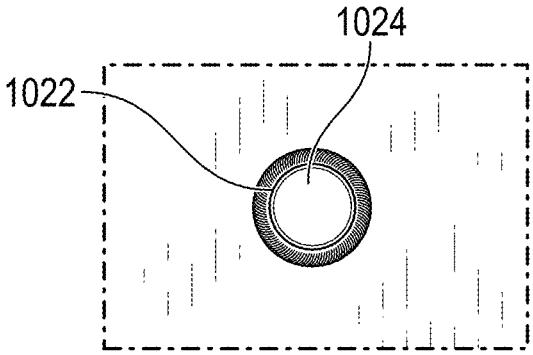
Figure 78:
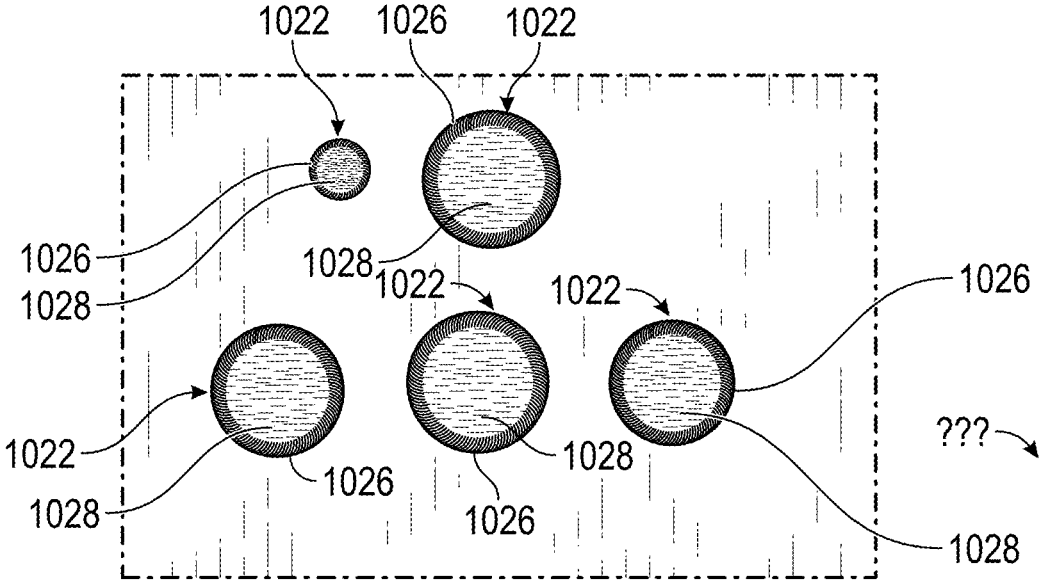
Figure 79:
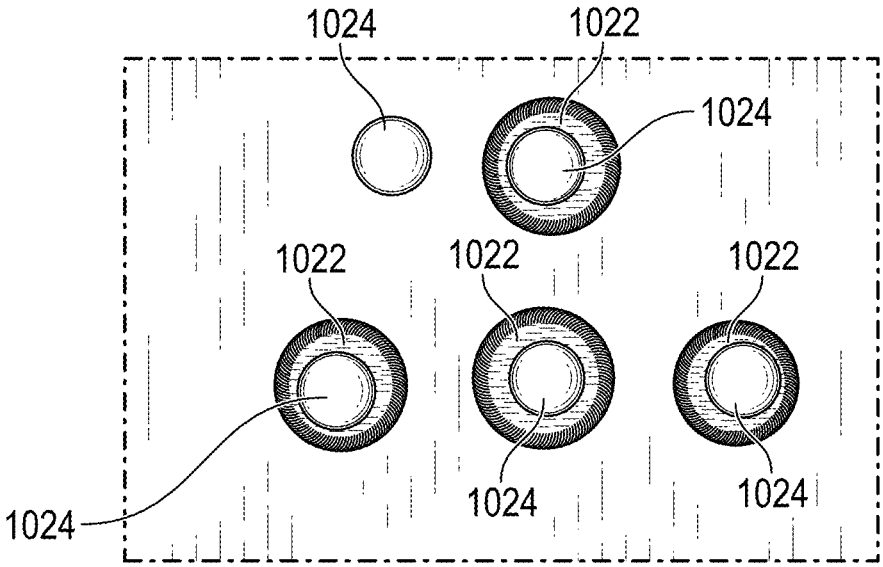

The reinforcement reinforcement pieces 1000 can be secured in position using adhesive, thermal welding, ultrasonic welding, stitching or any other suitable manner for connecting two or more layers of fabric. In some configurations, two or more methods (e.g., adhesive and sewing) can be used to provide a more secure attachment of the reinforcement reinforcement pieces 1000 and the fabric panel 1002. In some configurations, rather than providing reinforcement pieces, the properties of the fabric panel can be altered to provide a locally reinforced region. The fastening element 1010 then can be secured in place in the locally reinforced region, whether that local reinforcing is provided by reinforcement pieces or otherwise. In some configurations, the fastening element location can be obscured or camouflaged by positioning a further reinforcement piece 1012 overtop of a head of the fastening element, as shown in FIG. 75.

With reference now to FIGS. 72-79, reinforcement regions 1020 can be defined by needlework. In the illustrated configuration, the reinforcement regions 1020 can be formed by hand or machine needlework, such as by embroidery. Each of the reinforcement regions 1020 can provide a locally reinforced region 1022. The locally reinforced region 1022 can support a fastening element 1024. The fastening element 1024 in some configurations can be a snap or other suitable fastening element, as described above.

The locally reinforced region 1022 can be prepared by embroidering a design that will underlie the fastening element 1024. In some configurations, the embroidered design can be a circle, a square, a diamond, a flower, or the like. Any suitable design can be used. In some configurations, the locally reinforced region 1022 is small enough to be obscured beneath the fastening element 1024. In some configurations, the locally reinforced region can have at least a portion that is exposed (i.e., not obscured by the fastening element 1024). In some configurations, the exposed portion or portions of the locally reinforced region 1022 can provide a decorative element to the garment while also helping the reduce the likelihood of failure of the underlying fabric/fastening element connection. The illustrated locally reinforced region 1022 comprises an outline 1026 and a fill region 1028 that is disposed within the outline 1026. Any desired stitch techniques can be used for the outline 1026 and/or the fill region 1028. In some configurations, the stitches can be chain stitches, buttonhole or blanket stitches, running stitches, back stitches, satin stitches, whip-stitching or cross stitches. The stitching can be selected from the group consisting of chain stitch, buttonhole or blanket stitch, running stitch, back stitch, satin stitch, whip-stitch and cross stitch. In some configurations, any type of machine stitch used for embroidery can be used. In some such configurations, the embroidery can be free or surface embroidery. In some configurations, the embroidery can surround a hole and, as such, can take the form of drawn thread work and/or cutwork. Any suitable thread can be used. In some configurations, the thread can be rayon thread, polyester thread, or cotton thread.

By using embroidery to create the reinforced regions 1020, a garment can be more quickly and easily adjusted. In other words, when customizing a garment, the location of a fastener 1024 can be identified, the reinforced region 1020 created (e.g., embroidered), the fastener 1024 attached in the locally reinforced region 1022, and the connection between the garment and the fastener then will have added stability.

The garments discussed above provide an excellent opportunity for quickly customizing garments for a customer. For example, the customer can have the garment styled on their body or can have the location of the fastening elements adjusted or customized to the customer's specific body shape and sizes. Because of the versatility of the garment, further features, aspects, and advantages can be associated with a method of preparing and selling the reconfigurable garments discussed above.

In one embodiment, customers would be offered rapid "same day" tailoring of their reconfigurable garment. Since the general locations of the fastening elements will be the same for each dress style, the reconfigurable garments can be purchased ready "off the shelf" for all sizes. However, for an added experience, a personalized shopping and stylizing experience can be provided in-store or online. For example, the store can feature a section of pre-cut fabric shapes that are hanging and ready for application of the fastening elements in customized locations. The customer would select the fabric from the displayed pre-cut garment fabric panels. The body measurements of the customer then are used to positioned and apply the two sets of three or more fastening elements. Applying the fastening elements would be expected to be completed in 20-30 minutes. With the fastening elements applied to the fabric panel, the customer can either take the garment with them or can have a styling session in the store. The garment is suitable for rapid tailoring due to the innovative designs, fastening element locations, and fastening element application technique that helps create a stable, secure garment with the customer's choice of fabric. In some configurations, the customer could order the garment online by selecting the fabric, the cut, and supplying their measurements. In some configurations, the customer would be provided with an optional photoshoot and styling experience with each purchase. The photoshoot can provide a memorialization of at least two looks achievable with the reconfigurable garment.

FIGS. 80-85 are front, left, back, right, back-right, and front right views of a reconfigurable garment styled into a first look. FIGS. 86-91 are front, left, back, right, back-right, and front right views of the reconfigurable garment of FIGS. 80-85 styled into a second look.

FIGS. 92-97 are front, left, back, right, back-right, and front right views of another reconfigurable garment styled into a first look. FIGS. 98-103 are front, left, back, right, back-right, and front right views of the reconfigurable garment of FIGS. 98-103 styled into a second look. FIGS. 104-109 are front, left, back, right, back-right, and front right views of the reconfigurable garment of FIGS. 98-103 styled into a third look. FIGS. 110-115 are front, left, back, right, back-right, and front right views of the reconfigurable garment of FIGS. 98-103 styled into a fourth look. FIGS. 116-121 are front, left, back, right, back-right, and front right views of the reconfigurable garment of FIGS. 98-103 styled into a fifth look.

Conditional language used herein, such as, among others, "can," "could," "might," "may," "e.g.," and the like, unless specifically stated otherwise, or otherwise understood within the context as used, may be generally intended to convey that certain embodiments include, while other embodiments do not include, certain features, elements and/or states. Thus, such conditional language may be not generally intended to imply that features, elements and/or states may be in any way required for one or more embodiments or that one or more embodiments necessarily include these features, elements and/or states.

Conjunctive language such as the phrase "at least one of X, Y, and Z," unless specifically stated otherwise, may be otherwise understood with the context as used in general to convey that an item, term, etc. may be either X, Y, or Z. Thus, such conjunctive language may be not generally intended to imply that certain embodiments require the presence of at least one of X, at least one of Y, and at least one of Z.

While the above detailed description may have shown, described, and pointed out novel features as applied to various embodiments, it may be understood that various omissions, substitutions, and/or changes in the form and details of any particular embodiment may be made without departing from the spirit of the disclosure. As may be recognized, certain embodiments may be embodied within a form that does not provide all of the features and benefits set forth herein, as some features may be used or practiced separately from others.

Additionally, features described in connection with one embodiment can be incorporated into another of the disclosed embodiments, even if not expressly discussed herein, and embodiments may have the combination of features that still fall within the scope of the disclosure. For example, features described above in connection with one embodiment can be used with a different embodiment described herein and the combination can still fall within the scope of the disclosure. As an explicit example, the reconfigurable garment of FIG. 1 can be circular, or the circular garment of FIG. 3 can include armholes. As another explicit example, the reconfigurable garment of FIG. 3 can include just two first fastening elements and two second fastening elements. All other combinations of elements described above have been contemplated by the inventor.

Various features and aspects of the disclosed embodiments can be combined with, or substituted for, one another to form varying modes of the embodiments of the disclosure. Thus, it may be intended that the scope of the disclosure herein should not be limited by the particular embodiments described above. Accordingly, unless otherwise stated, or unless clearly incompatible, each embodiment of this disclosure may comprise, additional to its essential features described herein, one or more features as described herein from each other embodiment disclosed herein.

Features, materials, characteristics, or groups described in conjunction with a particular aspect, embodiment, or example may be to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps may be mutually exclusive. The protection may be not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that may be described in this disclosure in the context of separate implementations can also be implemented in combination in a single implementation. Conversely, various features that may be described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that may be not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added.

Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features may be described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that may be within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

The scope of the present disclosure may be not intended to be limited by the specific disclosures of preferred embodiments in this section or elsewhere in this specification, and may be defined by claims as presented in this section or elsewhere in this specification or as presented in the future. The language of the claims may be to be interpreted broadly based on the language employed in the claims and not limited to the examples described in the present specification or during the prosecution of the application, which examples may be to be construed as non-exclusive.

Unless the context clearly may require otherwise, throughout the description and the claims, the words "comprise", "comprising", and the like, may be to be construed in an inclusive sense as opposed to an exclusive or exhaustive sense, that may be to say, in the sense of "including, but not limited to".

Reference to any prior art in this description may be not, and should not be taken as, an acknowledgement or any form of suggestion that that prior art forms part of the common general knowledge in the field of endeavor in any country in the world.

The invention may also be said broadly to consist in the parts, elements and features referred to or indicated in the description of the application, individually or collectively, in any or all combinations of two or more of said parts, elements or features.

Where, in the foregoing description, reference may have been made to integers or components may have known equivalents thereof, those integers may be herein incorporated as if individually set forth. In addition, where the term "substantially" or any of it's variants have been used as a word of approximation adjacent to a numerical value or range, it may be intended to provide sufficient flexibility in the adjacent numerical value or range that encompasses standard manufacturing tolerances and/or rounding to the next significant figure, whichever may be greater.

Various changes and modifications to the presently preferred embodiments described herein may be apparent to those skilled in the art. Such changes and modifications may be made without departing from the spirit and scope of the invention and without diminishing its attendant advantages. For instance, various components may be repositioned as desired. It may be therefore intended that such changes and modifications be included within the scope of the invention. Moreover, not all of the features, aspects and advantages may be necessarily required to practice the present invention. Accordingly, the scope of the present invention may be intended to be defined only by the claims.

What is claimed is:

1. A method of reinforcing a snap fastening element for use in a reconfigurable garment, the method enabling the reconfigurable garment to be flexible and enabling the snap fastening element to be securely attached on one or more fabric panels of the reconfigurable garment, the method of reinforcing the snap fastening element comprising:

providing one or more fabric panels of the reconfigurable garment that define a body, the one or more fabric panels of the reconfigurable garment being formed of a material comprising spandex, mesh, or poly-mesh, the body comprising a vertically extending centerline, at least a region of the body on each side of the vertically extending centerline being a snap fastening element free region that does not have any snap fastening elements, a remainder of the body outside of the snap fastening element free region forming at least a portion of the reconfigurable garment that receives at least one snap fastening element in any part of the remainder of the body;

preparing at least one discrete reinforcement on a first fabric panel of the one or more fabric panels in the remainder of the body, each of the at least one discrete reinforcement on the first fabric panel being at a location of the snap fastening element, the at least one discrete reinforcement comprising an embroidered region, the embroidered region defining a locally reinforced region using added thread stitches, the added thread stitches defining an embroidered fill region; and joining one of the at least one snap fastening element to the first fabric panel at the location of the at least one discrete reinforcement.

2. The method of claim 1, wherein the locally reinforced region is obscured beneath the snap fastening element.

3. The method of claim 2, wherein each of the at least one snap fastening element is a single snap fastening element.

4. The method of claim 3, wherein the locally reinforced region comprises an outline that surrounds the embroidered fill region.

5. The method of claim 1, wherein the locally reinforced region has at least a portion that is exposed beyond the snap fastening element.

6. The method of claim 5, wherein each of the at least one snap fastening element is a single snap fastening element.

7. The method of claim 6, wherein the locally reinforced region comprises an outline that surrounds the embroidered fill region.

8. The method of claim 1, wherein the one or more fabric panels of the reconfigurable garment comprises one or more reversible fabric panels.

9. The method of claim 1, wherein the one or more fabric panels of the reconfigurable garment is formed of a stretch material.

10. The method of claim 9, wherein the stretch material comprises a two way stretch material.

11. The method of claim 9, wherein the stretch material comprises a four way stretch material.

12. The method of claim 1, wherein the at least one discrete reinforcement comprises at least three discrete reinforcements.

* * * * *